US007779982B2

(12) United States Patent
Fitzgerald et al.

(10) Patent No.: US 7,779,982 B2
(45) Date of Patent: Aug. 24, 2010

(54) CURRENCY PROCESSING AND STRAPPING SYSTEMS AND METHODS

(75) Inventors: Robert B. Fitzgerald, Lombard, IL (US); Robert J. Klein, Chicago, IL (US); Mark B. Renz, Arlington Heights, IL (US); Alan T. Lynch, Elk Grove Village, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 172 days.

(21) Appl. No.: 11/517,236

(22) Filed: Sep. 7, 2006

(65) Prior Publication Data

US 2008/0060906 A1 Mar. 13, 2008

(51) Int. Cl.
*G07F 7/04* (2006.01)

(52) U.S. Cl. ..... 194/206; 271/213; 271/218; 414/788.1; 414/788.9; 414/789.9

(58) Field of Classification Search ..... 271/298, 271/176, 3.14–3.17, 256–259, 65, 213, 218, 271/258.01, 258.02, 258.65; 414/789.9, 414/788.7, 788.4, 788.1, 789.6, 790.2, 790.4, 414/790.8; 209/534; 194/206, 207; 270/58.08
See application file for complete search history.

(56) References Cited

U.S. PATENT DOCUMENTS

| | | | | |
|---|---|---|---|---|
| 4,025,420 | A * | 5/1977 | Horino | 209/534 |
| 4,050,372 | A | 9/1977 | Kobiella | 100/2 |
| 4,153,499 | A | 5/1979 | Annis | 156/494 |
| 4,674,060 | A | 6/1987 | Larkin et al. | 364/567 |
| 4,787,518 | A | 11/1988 | Yuge et al. | 209/534 |
| 4,791,968 | A | 12/1988 | Pearson | 140/93.2 |
| 5,022,531 | A * | 6/1991 | Horino et al. | 209/552 |
| 5,078,057 | A | 1/1992 | Pearson | 100/25 |
| 5,126,002 | A | 6/1992 | Iwata et al. | 156/468 |
| 5,163,672 | A | 11/1992 | Mennie | 271/187 |
| 5,207,788 | A | 5/1993 | Geib | 271/122 |
| 5,218,813 | A | 6/1993 | Seidel | 53/399 |
| 5,287,802 | A | 2/1994 | Pearson | 100/4 |
| 5,295,196 | A | 3/1994 | Raterman et al. | 382/7 |

(Continued)

FOREIGN PATENT DOCUMENTS

EP 0 264 125 A1 4/1988

(Continued)

OTHER PUBLICATIONS

De La Rue Systems, 3000 User Guide, 108 pages. [e.g., G0015, G0048-49, G0060-67] (date: not dated).

(Continued)

*Primary Examiner*—Jeffrey A Shapiro
(74) *Attorney, Agent, or Firm*—Nixon Peabody LLP

(57) ABSTRACT

A method and device for evaluating currency bills using a strapping unit that allows a currency evaluating device to automatically strap stacks of currency bills. Currency bills are placed in an input receptacle and an evaluating unit processes each currency bill one at a time. The currency bills are then transported to a plurality of output receptacles within a strapping unit. A stack moving mechanism transports a stack of currency bills, which contains a predetermined number of currency bills, from each of the plurality of output receptacles to the strapping unit or a strapping position. Each stack of currency bills is strapped using strapping material.

46 Claims, 60 Drawing Sheets

U.S. PATENT DOCUMENTS

| | | | | |
|---|---|---|---|---|
| 5,333,438 | A | 8/1994 | Gurak et al. | 53/399 |
| 5,377,477 | A | 1/1995 | Haberstroh et al. | 53/399 |
| 5,459,977 | A | 10/1995 | Halberstroh | 53/399 |
| 5,467,405 | A | 11/1995 | Raterman et al. | 382/135 |
| 5,467,406 | A | 11/1995 | Graves et al. | 382/135 |
| D369,984 | S | 5/1996 | Larsen | D10/97 |
| 5,522,511 | A | 6/1996 | Sakoguchi et al. | 209/534 |
| 5,633,949 | A | 5/1997 | Graves et al. | 382/135 |
| 5,640,463 | A | 6/1997 | Csulits | 382/135 |
| 5,640,899 | A | 6/1997 | Bell et al. | 100/2 |
| 5,652,802 | A | 7/1997 | Graves et al. | 382/135 |
| 5,687,963 | A | 11/1997 | Mennie | 271/119 |
| 5,692,067 | A | 11/1997 | Raterman et al. | 382/135 |
| 5,704,491 | A | 1/1998 | Graves | 209/534 |
| 5,724,438 | A | 3/1998 | Graves | 382/135 |
| 5,746,882 | A | 5/1998 | Bell et al. | 156/580 |
| 5,751,840 | A | 5/1998 | Raterman et al. | 382/135 |
| 5,790,693 | A | 8/1998 | Graves et al. | 382/135 |
| 5,790,697 | A | 8/1998 | Jones et al. | 382/135 |
| 5,806,650 | A | 9/1998 | Mennie et al. | 194/206 |
| 5,815,592 | A | 9/1998 | Mennie et al. | 382/135 |
| 5,822,448 | A | 10/1998 | Graves et al. | 382/135 |
| 5,832,104 | A | 11/1998 | Graves et al. | 382/135 |
| 5,867,589 | A | 2/1999 | Graves et al. | 382/135 |
| 5,870,487 | A | 2/1999 | Graves et al. | 382/135 |
| 5,875,259 | A | 2/1999 | Mennie et al. | 382/135 |
| 5,878,999 | A * | 3/1999 | Neri et al. | 270/58.08 |
| 5,905,810 | A | 5/1999 | Jones et al. | 382/135 |
| 5,909,502 | A | 6/1999 | Mazur | 382/135 |
| 5,909,503 | A | 6/1999 | Graves et al. | 382/135 |
| 5,912,982 | A | 6/1999 | Munro et al. | 382/135 |
| 5,938,044 | A | 8/1999 | Weggesser | 209/534 |
| 5,940,623 | A | 8/1999 | Watts et al. | 395/712 |
| 5,943,655 | A | 8/1999 | Jacobsen | 705/30 |
| 5,960,103 | A | 9/1999 | Graves et al. | 382/135 |
| 5,966,456 | A | 10/1999 | Jones et al. | 382/135 |
| 5,982,918 | A | 11/1999 | Mennie et al. | 382/135 |
| 5,992,601 | A | 11/1999 | Mennie et al. | 194/207 |
| 5,996,314 | A | 12/1999 | Pennimi et al. | 53/399 |
| 6,012,565 | A | 1/2000 | Mazur | 194/207 |
| 6,021,883 | A | 2/2000 | Casanova et al. | 194/217 |
| 6,026,175 | A | 2/2000 | Munro et al. | 382/135 |
| 6,028,951 | A | 2/2000 | Raterman et al. | 382/135 |
| 6,039,286 | A | 3/2000 | Abrams et al. | 242/564.4 |
| 6,039,645 | A | 3/2000 | Mazur | 453/10 |
| 6,068,194 | A | 5/2000 | Mazur | 235/492 |
| 6,070,398 | A * | 6/2000 | Neri | 53/582 |
| 6,072,896 | A | 6/2000 | Graves et al. | 382/135 |
| 6,073,744 | A | 6/2000 | Raterman et al. | 194/207 |
| 6,074,334 | A | 6/2000 | Mennie et al. | 493/438 |
| 6,079,456 | A | 6/2000 | Drabarek et al. | 140/93.2 |
| 6,079,457 | A | 6/2000 | Crittenden | 140/93.2 |
| 6,128,402 | A | 10/2000 | Jones et al. | 382/135 |
| 6,220,419 | B1 | 4/2001 | Mennie | 194/207 |
| 6,237,739 | B1 | 5/2001 | Mazur et al. | 194/207 |
| 6,241,069 | B1 | 6/2001 | Mazur et al. | 194/207 |
| 6,256,407 | B1 | 7/2001 | Mennie et al. | 382/135 |
| 6,278,795 | B1 | 8/2001 | Anderson et al. | 382/135 |
| 6,311,819 | B1 | 11/2001 | Stromme et al. | 194/207 |
| 6,318,053 | B1 | 11/2001 | Frank et al. | 53/586 |
| 6,318,537 | B1 | 11/2001 | Jones et al. | 194/346 |
| 6,351,551 | B1 | 2/2002 | Munro et al. | 382/135 |
| 6,363,164 | B1 | 3/2002 | Jones et al. | 382/135 |
| 6,367,376 | B1 | 4/2002 | Bobren | 100/8 |
| 6,367,732 | B1 | 4/2002 | Bobren et al. | |
| 6,371,303 | B1 | 4/2002 | Klein et al. | 209/534 |
| 6,378,683 | B2 | 4/2002 | Mennie | 194/207 |
| 6,381,354 | B1 | 4/2002 | Mennie et al. | 382/135 |
| 6,398,000 | B1 | 6/2002 | Jenrick et al. | 194/200 |
| 6,418,838 | B1 | 7/2002 | Bobren et al. | 100/26 |
| 6,459,806 | B1 | 10/2002 | Raterman et al. | 382/135 |
| 6,460,705 | B1 | 10/2002 | Hallowell | 209/534 |
| 6,463,848 | B1 | 10/2002 | Haberstroh et al. | 100/32 |
| 6,478,065 | B1 | 11/2002 | Haberstroh et al. | 156/443 |
| 6,493,461 | B1 | 12/2002 | Mennie et al. | 382/135 |
| 6,505,766 | B2 | 1/2003 | Cheung et al. | 226/193 |
| 6,532,722 | B2 | 3/2003 | Gerbart et al. | 53/589 |
| 6,533,013 | B1 | 3/2003 | Nix | 156/361 |
| 6,536,195 | B2 | 3/2003 | Haberstroh et al. | 53/589 |
| 6,539,104 | B1 | 3/2003 | Raterman et al. | 382/135 |
| 6,543,341 | B2 | 4/2003 | Lopez | 100/4 |
| 6,550,375 | B2 | 4/2003 | Cheung | 100/29 |
| 6,560,355 | B2 | 5/2003 | Graves et al. | 382/135 |
| 6,560,947 | B2 | 5/2003 | Kasel | 53/399 |
| 6,588,569 | B1 | 7/2003 | Jenrick et al. | 194/206 |
| 6,598,726 | B1 | 7/2003 | Lundblad et al. | 194/206 |
| 6,601,687 | B1 | 8/2003 | Jenrick et al. | 194/206 |
| 6,603,872 | B2 | 8/2003 | Jones et al. | 382/135 |
| 6,621,919 | B2 | 9/2003 | Mennie et al. | 382/135 |
| 6,628,816 | B2 | 9/2003 | Mennie et al. | 382/135 |
| 6,636,624 | B2 | 10/2003 | Raterman et al. | 382/135 |
| 6,647,136 | B2 | 11/2003 | Jones et al. | 382/137 |
| 6,650,767 | B2 | 11/2003 | Jones et al. | 382/135 |
| 6,654,486 | B2 | 11/2003 | Jones et al. | 382/135 |
| 6,661,910 | B2 | 12/2003 | Jones et al. | 382/135 |
| 6,665,431 | B2 | 12/2003 | Jones et al. | 382/135 |
| 6,678,401 | B2 | 1/2004 | Jones et al. | 382/135 |
| 6,678,402 | B2 | 1/2004 | Jones et al. | 382/135 |
| 6,705,470 | B2 | 3/2004 | Klein et al. | 209/534 |
| 6,721,442 | B1 | 4/2004 | Mennie et al. | 382/135 |
| 6,724,926 | B2 | 4/2004 | Jones et al. | 382/135 |
| 6,724,927 | B2 | 4/2004 | Jones et al. | 382/135 |
| 6,731,785 | B1 | 5/2004 | Mennie et al. | 382/135 |
| 6,731,786 | B2 | 5/2004 | Jones et al. | 382/135 |
| 6,748,101 | B1 | 6/2004 | Jones et al. | 382/135 |
| 6,778,693 | B2 | 8/2004 | Jones et al. | 382/136 |
| 6,798,899 | B2 | 9/2004 | Mennie et al. | 271/10.09 |
| 6,810,137 | B2 | 10/2004 | Jones et al. | 382/137 |
| RE38,663 | E | 11/2004 | Kayani et al. | 194/206 |
| 6,843,418 | B2 | 1/2005 | Jones et al. | 235/462.01 |
| 6,860,375 | B2 | 3/2005 | Hallowell et al. | 194/328 |
| 6,866,134 | B2 | 3/2005 | Stromme et al. | 194/207 |
| 6,868,954 | B2 | 3/2005 | Stromme et al. | 194/207 |
| 6,880,692 | B1 | 4/2005 | Mazur et al. | 194/207 |
| 6,913,130 | B1 | 7/2005 | Mazur et al. | 194/207 |
| 6,913,260 | B2 | 7/2005 | Maier et al. | 271/265.04 |
| 6,915,893 | B2 | 7/2005 | Mennie | 271/265.04 |
| 6,929,109 | B1 | 8/2005 | Klein et al. | 194/206 |
| 6,955,253 | B1 | 10/2005 | Mazur et al. | 194/207 |
| 6,957,733 | B2 | 10/2005 | Mazur et al. | 194/215 |
| 6,959,800 | B1 | 11/2005 | Mazur et al. | 194/207 |
| 6,962,247 | B2 | 11/2005 | Maier et al. | 194/207 |
| 6,980,684 | B1 | 12/2005 | Munro et al. | 382/135 |
| 6,991,228 | B2 * | 1/2006 | Schaareman et al. | 271/220 |
| 6,994,200 | B2 | 2/2006 | Jenrick et al. | 194/206 |
| 6,996,263 | B2 | 2/2006 | Jones et al. | 382/135 |
| 7,000,828 | B2 | 2/2006 | Jones | 235/379 |
| 7,016,767 | B2 | 3/2006 | Jones et al. | 700/224 |
| 7,036,651 | B2 | 5/2006 | Tam et al. | 194/217 |
| 7,082,216 | B2 | 7/2006 | Jones et al. | 382/137 |
| 7,092,560 | B2 | 8/2006 | Jones et al. | 382/135 |
| 7,103,206 | B2 | 9/2006 | Graves et al. | 382/135 |
| 7,103,438 | B2 | 9/2006 | Hallowell et al. | 700/116 |
| 7,146,245 | B2 | 12/2006 | Jones et al. | 700/224 |
| 7,149,336 | B2 | 12/2006 | Jones et al. | 382/135 |
| 7,158,662 | B2 | 1/2007 | Chiles | 382/135 |
| 7,171,032 | B2 | 1/2007 | Jones et al. | 382/135 |
| 7,187,795 | B2 | 3/2007 | Jones et al. | 382/135 |
| 7,191,657 | B2 | 3/2007 | Maier et al. | 73/587 |
| 7,197,173 | B2 | 3/2007 | Jones et al. | 382/135 |
| 7,200,255 | B2 | 4/2007 | Jones et al. | 382/135 |
| 7,201,320 | B2 | 4/2007 | Csulits et al. | 235/462.01 |
| 7,232,024 | B2 | 6/2007 | Mazur et al. | 194/207 |
| 7,248,731 | B2 | 7/2007 | Raterman et al. | 382/135 |

| | | | | |
|---|---|---|---|---|
| 7,256,874 | B2 | 8/2007 | Csulits et al. | 356/71 |
| 7,269,279 | B2 | 9/2007 | Chiles | 382/135 |
| 2001/0006557 | A1 | 7/2001 | Mennie et al. | 382/135 |
| 2001/0015311 | A1 | 8/2001 | Mennie | 194/207 |
| 2001/0019624 | A1 | 9/2001 | Raterman et al. | 382/135 |
| 2001/0035603 | A1 | 11/2001 | Graves et al. | 271/265.01 |
| 2002/0001393 | A1 | 1/2002 | Jones et al. | 382/135 |
| 2002/0020603 | A1 | 2/2002 | Jones et al. | 194/346 |
| 2002/0056605 | A1 | 5/2002 | Mazur et al. | 194/207 |
| 2002/0085245 | A1 | 7/2002 | Mennie et al. | 382/135 |
| 2002/0085745 | A1 | 7/2002 | Jones et al. | 382/135 |
| 2002/0103757 | A1 | 8/2002 | Jones et al. | 382/135 |
| 2002/0104785 | A1 | 8/2002 | Klein et al. | 209/534 |
| 2002/0107801 | A1 | 8/2002 | Jones et al. | 382/137 |
| 2002/0118871 | A1 | 8/2002 | Jones et al. | 382/135 |
| 2002/0122580 | A1 | 9/2002 | Jones et al. | 382/135 |
| 2002/0126885 | A1 | 9/2002 | Mennie et al. | 382/135 |
| 2002/0126886 | A1 | 9/2002 | Jones et al. | 382/135 |
| 2002/0131630 | A1 | 9/2002 | Jones et al. | 382/135 |
| 2002/0136442 | A1 | 9/2002 | Jones et al. | 382/135 |
| 2002/0145035 | A1 | 10/2002 | Jones | 235/379 |
| 2002/0154804 | A1 | 10/2002 | Jones et al. | 382/135 |
| 2002/0154805 | A1 | 10/2002 | Jones et al. | 382/135 |
| 2002/0154806 | A1 | 10/2002 | Jones et al. | 382/135 |
| 2002/0154807 | A1 | 10/2002 | Jones et al. | 382/135 |
| 2002/0154808 | A1 | 10/2002 | Jones et al. | 382/135 |
| 2002/0186876 | A1 | 12/2002 | Jones et al. | 382/135 |
| 2003/0009420 | A1 | 1/2003 | Jones | 705/39 |
| 2003/0015395 | A1 | 1/2003 | Hallowell et al. | 194/206 |
| 2003/0015396 | A1 | 1/2003 | Mennie | 194/206 |
| 2003/0059098 | A1 | 3/2003 | Jones et al. | 382/135 |
| 2003/0062242 | A1 | 4/2003 | Hallowell et al. | 194/302 |
| 2003/0081824 | A1 | 5/2003 | Mennie et al. | 382/135 |
| 2003/0108233 | A1 | 6/2003 | Raterman et al. | 382/135 |
| 2003/0121752 | A1 | 7/2003 | Stromme et al. | 194/207 |
| 2003/0121753 | A1 | 7/2003 | Stromme et al. | 194/207 |
| 2003/0132281 | A1 | 7/2003 | Jones et al. | 235/379 |
| 2003/0139994 | A1 | 7/2003 | Jones | 705/36 |
| 2003/0168308 | A1 | 9/2003 | Maier et al. | 194/207 |
| 2003/0174874 | A1 | 9/2003 | Raterman et al. | 382/135 |
| 2003/0182217 | A1 | 9/2003 | Chiles | 705/35 |
| 2003/0198373 | A1 | 10/2003 | Raterman et al. | 382/135 |
| 2003/0202690 | A1 | 10/2003 | Jones et al. | 382/139 |
| 2004/0003980 | A1 * | 1/2004 | Hallowell et al. | 194/206 |
| 2004/0016621 | A1 * | 1/2004 | Jenrick et al. | 194/206 |
| 2004/0016797 | A1 | 1/2004 | Jones et al. | 235/462.01 |
| 2004/0028266 | A1 | 2/2004 | Jones et al. | 382/135 |
| 2004/0083149 | A1 | 4/2004 | Jones | 705/35 |
| 2004/0145726 | A1 | 7/2004 | Csulits et al. | 356/71 |
| 2004/0149538 | A1 | 8/2004 | Sakowski | 194/207 |
| 2004/0153408 | A1 | 8/2004 | Jones et al. | 705/43 |
| 2004/0154964 | A1 | 8/2004 | Jones | 209/534 |
| 2004/0173432 | A1 | 9/2004 | Jones | 194/216 |
| 2004/0251110 | A1 | 12/2004 | Jenrick et al. | |
| 2005/0029168 | A1 | 2/2005 | Jones et al. | 209/534 |
| 2005/0035034 | A1 | 2/2005 | Long | |
| 2005/0040225 | A1 | 2/2005 | Csulits et al. | 235/379 |
| 2005/0047642 | A1 | 3/2005 | Jones et al. | |
| 2005/0060055 | A1 | 3/2005 | Hallowell | 700/213 |
| 2005/0060059 | A1 | 3/2005 | Klein et al. | 700/213 |
| 2005/0060061 | A1 | 3/2005 | Jones | 700/226 |
| 2005/0077142 | A1 | 4/2005 | Tam et al. | 194/217 |
| 2005/0086271 | A1 | 4/2005 | Jones et al. | 707/200 |
| 2005/0087422 | A1 | 4/2005 | Maier et al. | 194/207 |
| 2005/0108165 | A1 | 5/2005 | Jones et al. | 705/43 |
| 2005/0117791 | A2 | 6/2005 | Raterman et al. | 382/135 |
| 2005/0117792 | A2 | 6/2005 | Graves et al. | 382/135 |
| 2005/0150738 | A1 | 7/2005 | Hallowell et al. | 382/135 |
| 2005/0163361 | A1 | 7/2005 | Jones et al. | 382/135 |
| 2005/0163362 | A1 | 7/2005 | Jones et al. | 382/137 |
| 2005/0169511 | A1 | 8/2005 | Jones | 382/135 |
| 2005/0173221 | A1 | 8/2005 | Maier et al. | 194/207 |
| 2005/0183928 | A1 | 8/2005 | Jones et al. | 194/207 |
| 2005/0207634 | A1 | 9/2005 | Jones et al. | 382/135 |
| 2005/0213803 | A1 | 9/2005 | Mennie et al. | 382/135 |
| 2005/0241909 | A1 | 11/2005 | Mazur et al. | 194/207 |
| 2005/0249394 | A1 | 11/2005 | Jones et al. | 382/135 |
| 2005/0265591 | A1 | 12/2005 | Jones et al. | 382/135 |
| 2005/0276458 | A1 | 12/2005 | Jones et al. | 382/135 |
| 2005/0278239 | A1 | 12/2005 | Jones et al. | 705/35 |
| 2006/0010071 | A1 | 1/2006 | Jones et al. | 705/42 |
| 2006/0054455 | A1 | 3/2006 | Kuykendall et al. | 194/217 |
| 2006/0078186 | A1 | 4/2006 | Freeman et al. | 382/135 |
| 2006/0182330 | A1 | 8/2006 | Chiles | 382/135 |
| 2006/0195567 | A1 | 8/2006 | Mody et al. | 709/214 |
| 2006/0210137 | A1 | 9/2006 | Raterman et al. | 382/135 |
| 2006/0274929 | A1 | 12/2006 | Jones et al. | 382/135 |
| 2007/0076939 | A1 | 4/2007 | Jones et al. | 382/135 |
| 2007/0078560 | A1 | 4/2007 | Jones et al. | 700/224 |
| 2007/0095630 | A1 | 5/2007 | Mennie et al. | 194/206 |
| 2007/0112674 | A1 | 5/2007 | Jones et al. | 705/45 |
| 2007/0122023 | A1 | 5/2007 | Jenrick et al. | 382/135 |
| 2007/0172107 | A1 | 7/2007 | Jones et al. | 382/137 |

FOREIGN PATENT DOCUMENTS

| | | | |
|---|---|---|---|
| EP | 0 264 125 | B1 | 4/1988 |
| EP | 1 007 411 | B1 | 8/2002 |
| GB | 2054513 | | 7/2007 |
| JP | 63-271687 | | 11/1988 |
| JP | 2597752 | | 6/1994 |
| JP | 6-219419 | | 8/1994 |
| WO | WO 91/11778 | | 8/1991 |
| WO | WO 92/17394 | | 10/1992 |
| WO | WO 93/23824 | | 11/1993 |
| WO | WO 95/24691 | | 9/1995 |
| WO | WO 96/10800 | | 4/1996 |
| WO | WO 96/36933 | | 11/1996 |
| WO | WO 97/30422 | | 8/1997 |
| WO | WO 97/43734 | | 11/1997 |
| WO | WO 97/45810 | | 12/1997 |
| WO | WO 98/12662 | | 3/1998 |
| WO | WO 98/13785 | | 4/1998 |
| WO | WO 98/24052 | | 6/1998 |
| WO | WO 98/24067 | | 6/1998 |
| WO | WO 98/35323 | | 8/1998 |
| WO | WO 98/40839 | | 9/1998 |
| WO | WO 98/47100 | | 10/1998 |
| WO | WO 98/50272 | A2 | 11/1998 |
| WO | WO 98/50892 | | 11/1998 |
| WO | WO 98/59323 | | 12/1998 |
| WO | WO 99/09511 | | 2/1999 |
| WO | WO 99/14668 | | 3/1999 |
| WO | WO 99/23601 | | 5/1999 |
| WO | WO 99/41695 | | 8/1999 |
| WO | WO 99/48040 | | 9/1999 |
| WO | WO 99/48042 | | 9/1999 |
| WO | WO 00/24572 | | 5/2000 |
| WO | WO 01/08108 | | 2/2001 |
| WO | WO 01/59685 | | 8/2001 |
| WO | WO 01/59723 | | 8/2001 |
| WO | WO 01/62650 | A1 | 8/2001 |
| WO | WO 02/29735 | | 4/2002 |
| WO | WO 02/054360 | | 7/2002 |
| WO | WO 03/005312 | | 1/2003 |
| WO | WO 03/028361 | | 4/2003 |
| WO | WO 03/029913 | | 4/2003 |
| WO | WO 03/030113 | | 4/2003 |
| WO | WO 03/067532 | | 8/2003 |
| WO | WO 03/107282 | | 12/2003 |
| WO | WO 2004/010367 | | 1/2004 |
| WO | WO 2004/027717 | | 4/2004 |
| WO | WO 2004/036508 | | 4/2004 |
| WO | WO 2004/038631 | | 5/2004 |
| WO | WO 2004/068422 | | 8/2004 |
| WO | WO 2004/029904 | | 9/2004 |

| | | | |
|---|---|---|---|
| WO | WO 2005/013209 | A2 | 2/2005 |
| WO | WO 2005/017842 | A1 | 2/2005 |
| WO | WO 2005/028348 | A2 | 3/2005 |
| WO | WO 2005/029240 | A2 | 3/2005 |
| WO | WO 2005/036445 | A1 | 4/2005 |
| WO | WO 2005/041134 | A2 | 5/2005 |
| WO | WO 2005/076229 | A1 | 8/2005 |
| WO | WO 2005/035907 | | 9/2005 |
| WO | WO 2006/039439 | A2 | 4/2006 |
| WO | WO 2006/076289 | A2 | 7/2006 |
| WO | WO 2006/076634 | A2 | 7/2006 |

OTHER PUBLICATIONS

De La Rue Systems, 3000 Series, Used Banknote Sorting Machines, 12 pages. [e.g., Q0007] (date: not dated).
Declaration of Stephen G. Emery regarding, inter alia, De La Rue 3000 Series, 20 pages (Sep. 6, 2007).
Search Report for PCT/US07/18852 which claims priority to U.S. Appl. No. 11/517,236 (Jan. 4, 2008).
Written Opinion for PCT/US07/18852 which claims priority to U.S. Appl. No. 11/517,236 (Jan. 4, 2008).
European Search Report for EP 03760337, mailed Jul. 12, 2007.
De La Rue Systems, 3100 Series, Provisional Operator Instructions, 35 pages. [e.g., X0017 (Count Mode)] (Jun. 1985).
De La Rue Systems, 3400/3500 Series, High Speed Currency Sorting Systems (4 pages) © 1989.
De La Rue Systems, 3000 Series, Used Backnote Sorting Machines (14 pages) date unknown.
PCT Search Report for application No. PCT/US03/18706 (dated Dec. 13, 2004 ).
Federal Reserve Bank of San Francisco, Cash Services: Deposit Preparation from www.frbsf.org, 2 pages, (downloaded Jan. 29, 2003, Announcement dated Feb. 1, 2001).
Federal Reserve Bank, Operating Circular 2, 13 pages (Jan. 2, 1998).
Glory Autostrap 100 from www.gloryusainc.com, 2 pages (Jun. 24, 2002).
Glory Autostrap 100 from www.westernmoney.com, 3 pages (Jun. 24, 2002).
Glory Autostrap 100 from www.elec-mech.com 9 pages (Jun. 24, 2002).
Mosler/Toshiba TouchSort™ Currency Processing System from www.mosler.com, 3 pages (Jun. 28, 2002).
Toshiba CS-601 and CS-700 sorters from www3.toshiba.co.jp, 6 pages (Jun. 28, 2002).

* cited by examiner

| | $1 | $2 | $5 | $10 | $20 | $50 | $100 |
|---|---|---|---|---|---|---|---|
| STACK LIMIT | 100 | 10 | 100 | NONE | 200 | 100 | 100 |

FIG. 11

| | POCKET #1 | POCKET #2 | POCKET #3 | POCKET #4 | POCKET #5 | POCKET #6 |
|---|---|---|---|---|---|---|
| ASSGMT. STATUS | FIXED | DYNAMIC | DYNAMIC | DYNAMIC | DYNAMIC | NO BILLS |
| CURRENT DENOM. ASSGMT. | $20 | NONE | $1 | $5 | $1 | — |
| CURRENT STACK LIMIT | 200 | — | 100 | 100 | 100 | — |
| OPEN STATUS | NO | YES | NO | NO | NO | NO |
| FULL STATUS | NO | NO | YES | NO | NO | YES |

FIG. 12

CURRENCY PROCESSING AND STRAPPING SYSTEMS AND METHODS

FIELD OF THE INVENTION

The present invention relates generally to the field of currency handling systems and, more particularly, to methods and apparatuses for processing and strapping currency bills.

BACKGROUND OF THE INVENTION

A variety of techniques and apparatuses have been used to satisfy the requirements of automated currency handling machines. As businesses and banks grow, these businesses are experiencing a greater volume of paper currency. These businesses are continually requiring not only that their currency be processed more quickly but, also, processed with more options in a less expensive manner. At the upper end of sophistication in this area of technology are machines that are capable of rapidly discriminating and counting multiple currency denominations and then sorting the currency bills into a multitude of output compartments.

However, many of these high-end machines are extremely large and expensive such that they are commonly found only in large institutions. These machines are not readily available to businesses which have monetary and space budgets, but still have the need to process large volumes of currency. Other high-end currency handling machines require their own climate controlled environment which may place even greater strains on businesses having monetary and space budgets. For example, one of these machines can cost over $500,000, it can weigh over 1,400 pounds, measuring over 5 feet in length, over 2 feet in depth, and over 5 feet in height. Additionally, the stringent environment specifications may require a narrow humidity range, such as between 50-55%, and a narrow temperature range, such as between 70-74° F.

Typically, in the handling of bulk currency, after the currency bills have been analyzed, denominated, authenticated, counted, and/or otherwise processed, the currency bills are sorted by denomination into separate output receptacles or cassettes. The resulting individual stacks of bills having a single denomination must then be further processed so that the bills therein may be strapped. Bill strapping is a process whereby a stack of a specific number of bills of a single denomination are bounded together such as being secured with a paper strap. For example, one dollar bills may be segregated into stacks of one hundred $1 bills and then bound with a paper strap. Strapping facilitates the handling of currency by allowing the strapped stacks of bills to be counted rather than the individual currency bills. Traditionally, U.S. currency bills are strapped in stacks containing one hundred bills.

The task of bill strapping can increase the amount of time required to process a given batch of currency. Some currency handing machines are able to segregate currency bills into individual denominations, then the operator must manually count the bills into smaller batches for strapping purposes. In other situations, a currency handling device may suspend operation after a predetermined number of bills of a given denomination have been delivered to an output receptacle at which time the operator can remove those bills from the output receptacle and bind the bills with a paper strap. However, this manner of strapping can increase the time required to process a batch of currency bills.

SUMMARY OF THE INVENTION

It is an object of some embodiments of the present invention to provide a device for strapping a stack of currency bills. According to one embodiment such a device comprises an input receptacle for receiving bills to be strapped; an evaluating unit for processing the bills received in the input receptacle; a plurality of output receptacles for receiving the bills processed by the evaluating unit; and a transport mechanism defining a transport path and adapted to transport bills from the input receptacle, past the evaluating unit, and to the plurality of output receptacles. The transport mechanism is adapted to transport each bill individually along the transport path. The device further comprises one or more strapping units for strapping stacks of bills, each strapping unit being adapted to receive stacks of bills from more than one of the plurality of output receptacles. A bill moving mechanism is adapted to move bills selected for strapping from a plurality of the output receptacles to the one or more strapping units.

Many additional embodiments are described below and in the accompanying figures in which like reference numbers refer to like features. Accordingly, the above summary of the present invention is not intended to represent each embodiment, or every aspect, of the present invention. Additional features and benefits of the present invention will become apparent from the detail description, figures, and claims set forth below.

BRIEF DESCRIPTION OF THE DRAWINGS

Other objects and advantages of the invention will become apparent upon reading the following detailed description in conjunction with the drawings in which:

FIG. 11 illustrates an example of the stack limits stored in memory according to one embodiment;

FIG. 12 illustrates the status of various assignments according to one embodiment;

DETAILED DESCRIPTION OF THE ILLUSTRATED EMBODIMENTS

Figure 1A:
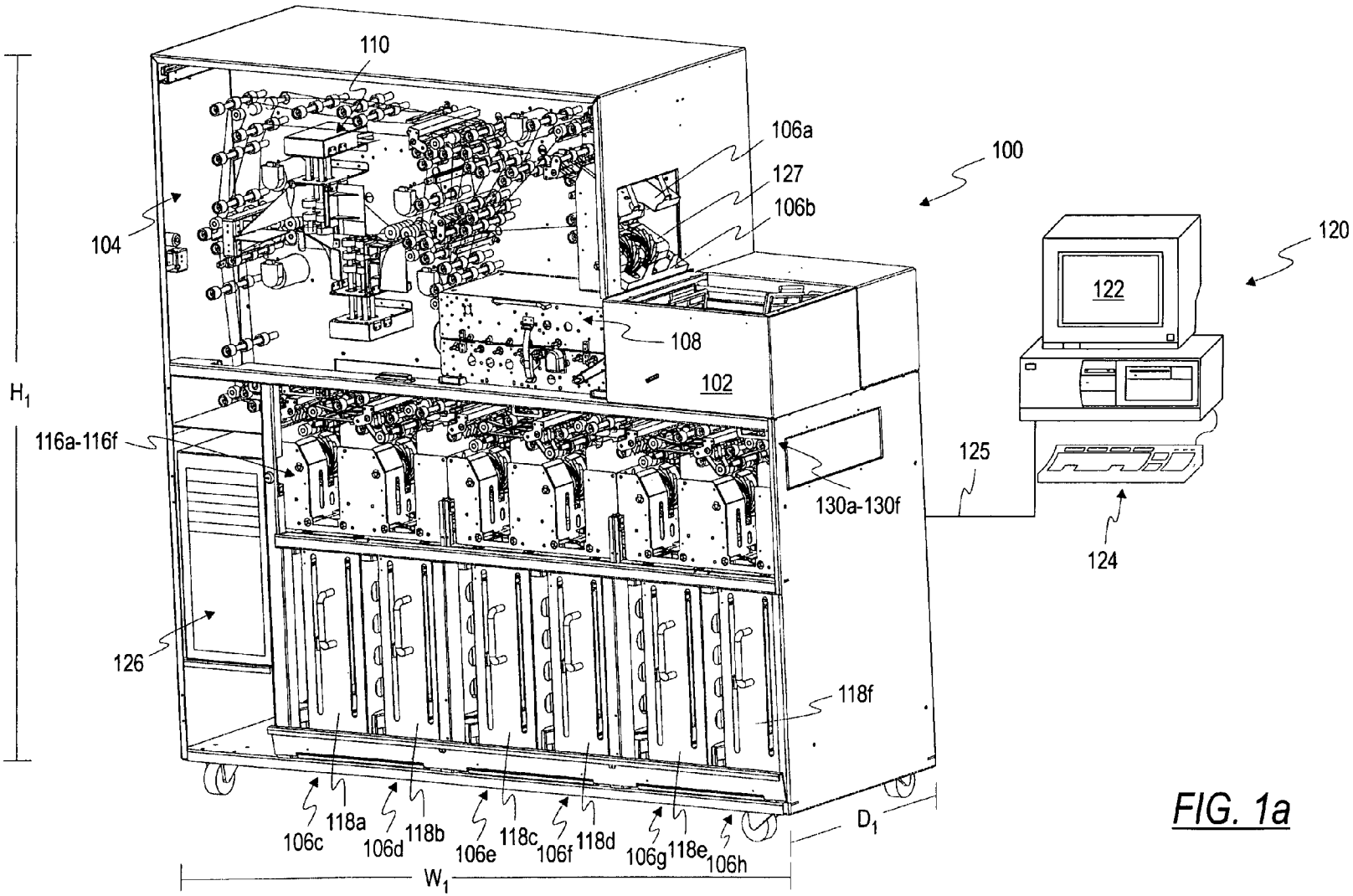
FIG. 1*a* is a perspective view of a document handling device according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

When describing various embodiments of the present invention, the term "currency bills" refers to official currency bills including both U.S. currency bills, such as a $1, $2, $5, $10, $20, $50, or $100 note, and foreign currency bills. Foreign currency bills are bank notes issued by a non-U.S. governmental agency as legal tender, such as a Euro, Japanese Yen, or British Pound note.

The term "currency documents" includes both currency bills and "substitute currency media." Examples of substitute currency media include without limitation: casino cashout tickets (also variously called cashout vouchers or coupons) such as "EZ Pay" tickets issued by International Gaming Technology or "Quicket" tickets issued by Casino Data Systems; casino script; promotional media such as Disney Dollars or Toys 'R Us "Geoffrey Dollars"; or retailer coupons, gift certificates, gift cards, or food stamps. Substitute currency media may include a barcode, and these types of substitute currency media are referred to herein as "barcoded tickets." Examples of barcoded tickets include casino cashout tickets such as "EZ Pay" tickets and "Quicket" cashout tickets, barcoded retailer coupons, barcoded gift certificates, or any other promotional media that includes a barcode. Although many embodiments refer to the "denomination" of currency bills as the criterion used in evaluating the currency bills, other predetermined criteria can be used to evaluate the currency bills, such as, for example, color, size, and orientation. The term "non-currency documents" includes any type of document, except currency documents, that can be evaluated according to a predetermined criterion, such as color, size, shape, orientation, and so on.

"Substitute currency notes" are sheet-like documents similar to currency bills but are issued by non-governmental agencies such as casinos and amusement parks and include, for example, casino script and Disney Dollars. Substitute currency notes each have a denomination and an issuing entity associated therewith such as a $5 Disney Dollar, a $10 Disney Dollar, a $20 ABC Casino note and a $100 ABC Casino note. "Currency notes" consist of currency bills and substitute currency notes.

First, a number of currency handling devices will be described together with descriptions of various features and operating modes that may be used in conjunction therewith. These descriptions are generally related to FIGS. 1-7. Additional details of various embodiments of dynamic sorting methods are then described in conjunction with FIGS. 8-16. The dynamic sorting methods may be used in conjunction with the various devices described in connection with FIGS. 1-7. Finally, details concerning various embodiments employing one or more strapping units are then described in conjunction with FIGS. 17-39. The strapping systems described herein may be used in conjunction with the devices and methods described in conjunction with FIGS. 1-16.

Figure 1B:
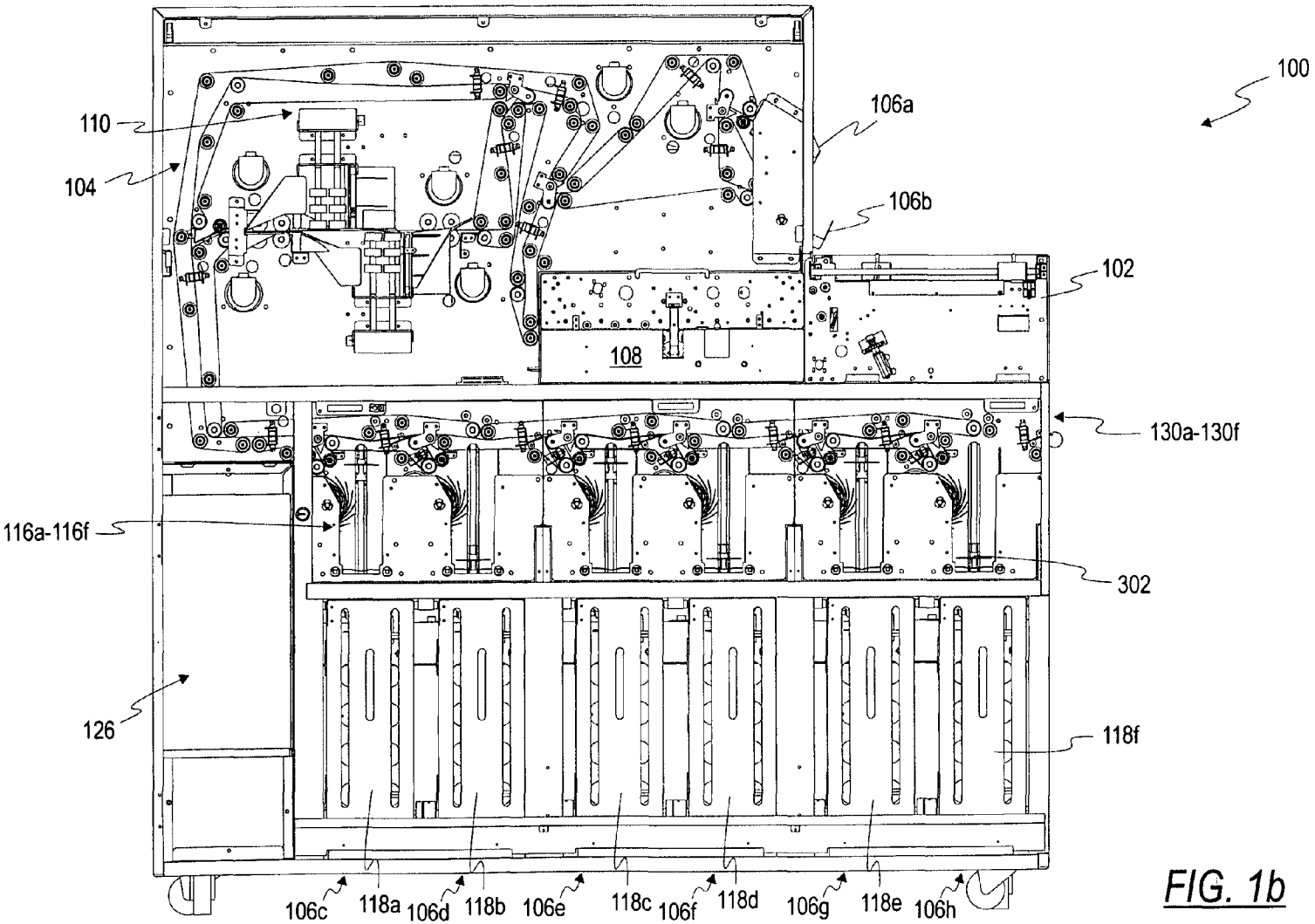
FIG. 1*b* is a front view of a document handling device according to one embodiment.

Referring to FIGS. 1*a* and 1*b*, a multi-pocket document processing device 100 such as a currency handling device according to one embodiment of the present invention is illustrated. Currency bills are fed, one by one, from a stack of currency bills placed in an input receptacle 102 into a transport mechanism 104. The transport mechanism 104 guides currency bills to one of a plurality of output receptacles 106*a*-106*h*, which may include upper output receptacles 106*a*, 106*b*, as well as lower output receptacles 106*c*-106*h*. Before reaching an output receptacle 106 the transport mechanism 104 guides the bill through an evaluation region 108 where a bill can be, for example, analyzed, authenticated, denominated, counted, and/or otherwise processed. In alternative embodiments of the currency handling device 100 of the present invention, the evaluation region 108 can determine bill orientation, bill size, or whether bills are stacked upon one another. The results of the above process or processes may be used to determine to which output receptacle 106 a bill is directed. The illustrated embodiment of the currency handling device has an overall width, $W_1$, of approximately 4.52 feet (1.38 meters), a height, $H_1$, of approximately 4.75 feet (1.45 meters), and a depth, $D_1$, of approximately 1.67 feet (0.50 meters).

In one embodiment, documents such as currency bills are transported, scanned, denominated, authenticated and/or otherwise processed at a rate equal to or greater than 600 bills per minute. In another embodiment, documents such as currency bills are transported, scanned, denominated, authenticated, and/or otherwise processed at a rate equal to or greater than 800 bills per minute. In another embodiment, documents such as currency bills are transported, scanned, denominated, authenticated and/or otherwise processed at a rate equal to or greater than 1000 bills per minute. In still another embodiment, documents such as currency bills are transported, scanned, denominated, authenticated, and/or otherwise processed at a rate equal to or greater than 1200 bills per minute. In still another embodiment, documents such as currency bills are transported, scanned, denominated, authenticated, and/or otherwise processed at a rate equal to or greater than 1500 bills per minute.

In the illustrated embodiment, interposed in the bill transport mechanism 104, intermediate the bill evaluation region 108 and the lower output receptacles 106*c*-106*h* is a bill facing mechanism designated generally by reference numeral 110. The bill facing mechanism is capable of rotating a bill 180° so that the face orientation of the bill is reversed. The leading edge of the bill (the wide dimension of the bill according to one embodiment) remains constant while the bill is rotated 180° about an axis parallel to the smaller dimension of the bill) so that the face orientation of the bill is reversed. That is, if a U.S. bill, for example, is initially presented with the surface bearing a portrait of a president facing down, it may be directed to the facing mechanism 110, whereupon it will be rotated 180° so that the surface with the portrait faces up. The decision may be taken to send a bill to the facing mechanism 110 when the selected mode of operation or other operator instructions call for maintaining a given face orientation of bills as they are processed by the currency handling device 100. Using U.S. currency as an example, it may be desirable in certain circumstances for all of the bills ultimately delivered to the lower output receptacles 106*c*-106*h* to have the bill surface bearing the portrait of the president facing up. In such embodiments of the currency handling device 100, the bill evaluation region 108 is capable of determining the face orientation of a bill, such that a bill not having the desired face orientation can first be directed to the facing mechanism 110 before being delivered to the appropriate output receptacle 106. Further details of examples of facing mechanisms which may be utilized for this purpose are disclosed in commonly-owned, U.S. Pat. No. 6,074,334, incorporated herein by reference in its entirety, and U.S. patent application Ser. No. 09/503,039, filed on Feb. 11, 2000 entitled "Two Belt Facing Mechanism, and now issued as U.S. Pat. No. 6,371,303, each of which is incorporated herein by reference in its entirety. Facing mechanisms such as those referred above may be employed in conjunction with the present invention such as the device illustrated in FIGS. 1*a* and 1*b*. Other alternative embodiments of the currency handling device 100 do not include the facing mechanism 110.

The currency handling device 100 in FIG. 1*a* may be controlled from a separate controller or control unit 120 which has a display/user-interface 122, which may incorporate a touch panel display in one embodiment of the present invention, which displays information, including "functional" keys when appropriate. The display/user-interface 122 may be a full graphics display. Alternatively, additional physical keys or buttons, such as a keyboard 124, may be employed. The control unit 120 may be a self-contained desktop or laptop computer which communicates with the currency handling device 100 via a cable 125. The currency handling device 100 may have a suitable communications port (not shown) for this purpose. In embodiments in which the control unit 120 is a desktop computer wherein the display/user-interface 122 and the desktop computer are physically separable, the desktop computer may be stored within a compartment 126 of the currency handling device 100. In other alternative embodiments, the control unit 120 is integrated into the currency handling device 100 so the control unit 120 is contained within the device 100.

The operator can control the operation of the currency handling device 100 through the control unit 120. Through the control unit 120 the operator can direct the bills into specific output receptacles 106*a*-106*h* by selecting various user defined modes. In alternative embodiments, the user can select pre-programmed user defined modes or create new user defined modes based on the particular requirements of the application. For example, the operator may select a user defined mode which instructs the currency handling device 100 to sort bills by denomination; accordingly, the evaluation region 108 would denominate the bills and direct one dollar bills into the first lower output receptacle 106*c*, five dollar bills into the second lower output receptacle 106*d*, ten dollar bills into the third lower output receptacle 106*e*, twenty dollar bills into the forth lower output receptacle 106*f*, fifty dollar bills into the fifth lower output receptacle 106*g*, and one-hundred dollar bills into the sixth lower output receptacle 106*h*. The operator may also instruct the currency handling device 100 to deliver those bills whose denomination was not determined, no call bills, to the first upper output receptacle 106*a*. In such an embodiment, upper output receptacle 106*a* would function as a reject pocket. In an alternative embodiment, the operator may instruct the currency handling device 100 to also evaluate the authenticity of each bill. In such an embodiment, authentic bills would be directed to the appropriate lower output receptacle 106*c*-106*h*. Those bills that were determined not to be authentic, suspect bills, would be delivered to the second upper output receptacle 106*b*. A multitude of user defined modes are disclosed in commonly assigned U.S. Pat. No. 6,278,795, incorporated herein by reference in its entirety, which may be employed in conjunction with the present invention such as the device illustrated in FIGS. 1*a* and 1*b*.

According to one embodiment, the currency handling device 100 is designed so that when the evaluation region 108 is unable to identify certain criteria regarding a bill, the unidentified bill is flagged and "presented" in one of the output receptacles 106*a*-106*h*, that is, the transport mechanism 104 is stopped so that the unidentified bill is located at a predetermined position within one of the output receptacles 106*a*-106*h*, such as being the last bill transported to one of the output receptacles. Such criteria can include denominating information, authenticating information, information indicative of the bill's series, or other information the evaluation region 108 is attempting to obtain pursuant to a mode of operation.

Which output receptacles 106*a*-106*h* the flagged bill is presented in may be determined by the user according to a selected mode of operation. For example, where the unidentified bill is the last bill transported to an output receptacle 106*a*-106*h*, it may be positioned within a stacker wheel or positioned at the top of the bills already within the output receptacle 106*a*-106*h*. While unidentified bills may be transported to any output receptacles 106*a*-106*h*, it may be more convenient for the operator to have unidentified bills transported to one of the upper output receptacles 106*a*, 106*b* where the operator is able to easily see and/or inspect the bill which has not been identified by the evaluation region 108. The operator may then either visually inspect the flagged bill while it is resting on the top of the stack, or alternatively, the operator may decide to remove the bill from the output receptacle 106 in order to examine the flagged bill more closely. In an alternative embodiment of the currency handling device 100, the device 100 may communicate to the user via the display/user-interface 122 in which one of the output receptacles 106*a*-106*h* a flagged bill is presented.

The currency handling device 100 may be designed to continue operation automatically when a flagged bill is removed from the upper output receptacle 106*a*, 106*b* or, according to one embodiment of the present invention, the device 100 may be designed to suspend operation and require input from the user via the control unit 120. Upon examination of a flagged bill by the operator, it may be found that the flagged bill is genuine even though it was not identified as so by the evaluation region 108 or the evaluation region 108 may have been unable to denominate the flagged bill. However, because the bill was not identified, the total value and/or denomination counters will not reflect its value. According to one embodiment, such an unidentified bill is removed from the output receptacles 106 and reprocessed or set aside. According to another embodiment, the flagged bills may accumulate in the upper output receptacles 106*a*, 106*b* until the batch of currency bills currently being processed is completed or the output receptacle 106*a*, 106*b* is full and then reprocessed or set aside.

According to another embodiment, when a bill is flagged, the transport mechanism may be stopped before the flagged bill is transported to one of the output receptacles. Such an embodiment is particularly suited for situations in which the operator need not examine the bill being flagged; for example, the currency handling device 100 is instructed to first process United States currency and then British currency pursuant to a selected mode of operation where the currency handling device 100 processes United States $1, $5, $10, $20, $50, and $100 currency bills into the lower output receptacles 106*c*-106*h*, respectively. Upon detection of the first British pound note, the currency handling device 100 may halt operation allowing the operator to empty the lower output receptacles 106*c*-106*h* and to make any spatial adjustments necessary to accommodate the British currency. A multitude of modes of operation are described in conjunction with bill flagging, presenting, and/or transport halting in commonly owned, commonly assigned U.S. patent application Ser. No. 08/916,100 entitled "Method and Apparatus for Document Processing" which was filed on May 28, 1997, and is now issued as U.S. Pat. No. 6,278,795, incorporated herein by reference in its entirety above, which may be employed in conjunction with the present invention such as the device illustrated in FIGS. 1*a* and 1*b*.

In the illustrated embodiment, with regard to the upper output receptacles 106*a*, 106*b*, the second upper output receptacle 106*b* is provided with a stacker wheel 127 for accumulating a number of bills, while the first upper output receptacle 106*a* is not provided with such a stacker wheel. Thus, when pursuant to a preprogrammed mode of operation or an operator selected mode or other operator instructions, a bill is to be fed to the first upper output receptacle 106*a*, there may be a further instruction to momentarily suspend operation of the currency handling device 100 for the operator to inspect and remove the bill. On the other hand, it may be possible to allow a small number of bills to accumulate in the first upper output receptacle 106*a* prior to suspending operation. Similarly, the second upper output receptacle 106*b* may be utilized initially as an additional one of the lower output receptacles 106*c*-106*h*. However, there is no storage cassette associated with the second upper output receptacle 106*b*. Therefore, when the second upper output receptacle 106*b* is full, operation may be suspended to remove the bills at such time as yet further bills are directed to the second upper output receptacle 106*b* in accordance with the selected mode of operation or other operator instructions. In an alternative embodiment of the currency handling device 100 both the first and the second upper output receptacles 106*a*, 106*b* are equipped with a stacker wheel. In such, an embodiment both the upper output receptacles 106*a*, 106*b* may also function as the lower output receptacle 106*c*-106*h* allowing a number of bills to be stacked therein.

In FIGS. 1*a* and 1*b* each of the lower output receptacles 106*c*-106*h* includes a first portion designated as an escrow compartment 116*a*-116*f* and a second portion designated as a storage cassette 118*a*-118*f* (described in more detail below).

Figure 1C:
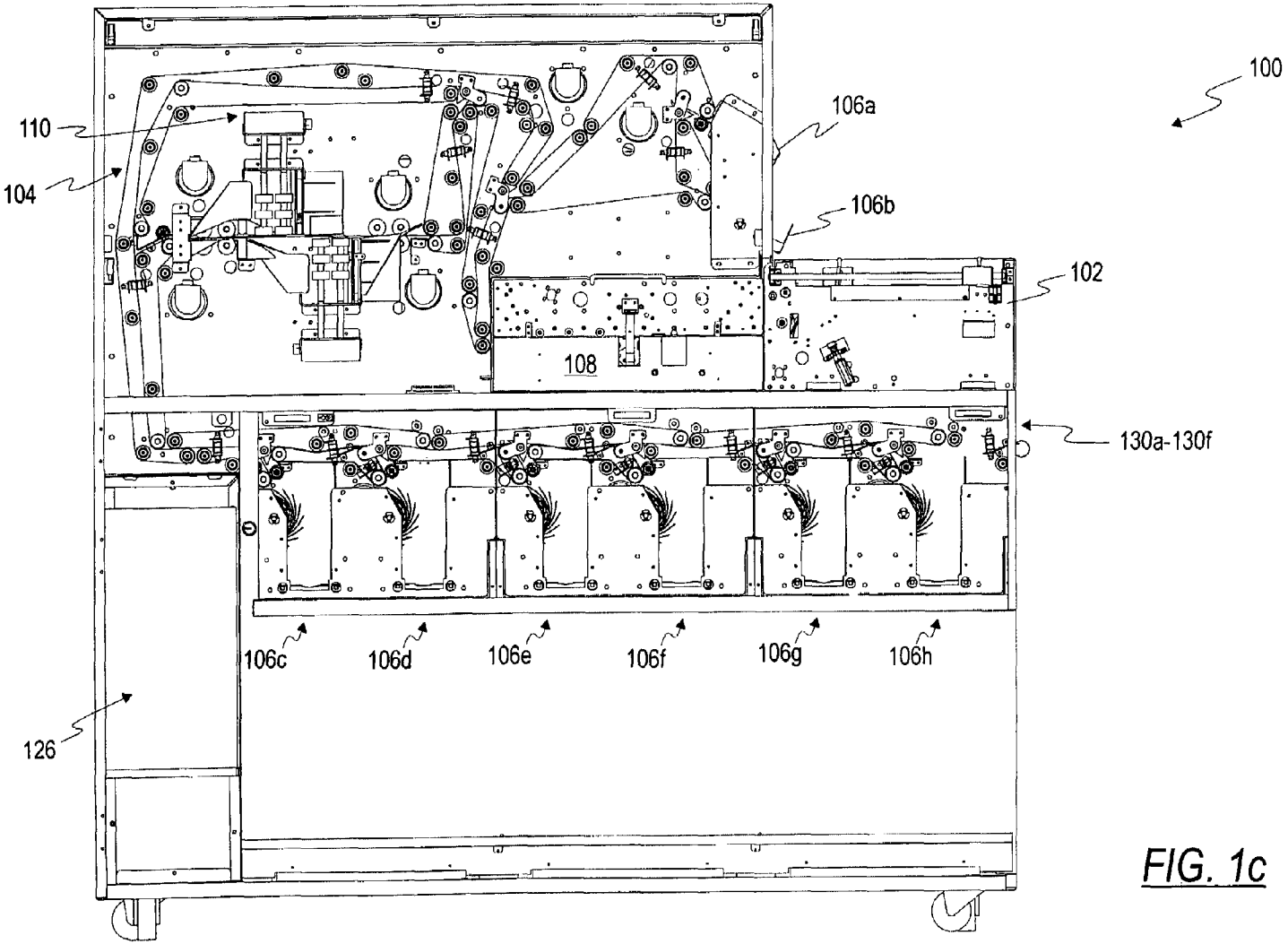
FIG. 1*c* is a front view of a document handling device according to one embodiment.

In FIG. 1*c* a multi-pocket document processing device 100 such as a currency handling device according to one embodiment of the present invention is illustrated. The device of FIG. 1*c* is similar to that shown in FIG. 1*b* except that the lower output receptacles 106*c*-106*h* are not divided into two portions. That is, there are no storage cassettes in the embodiment shown in FIG. 1*c*.

Figure 1D:
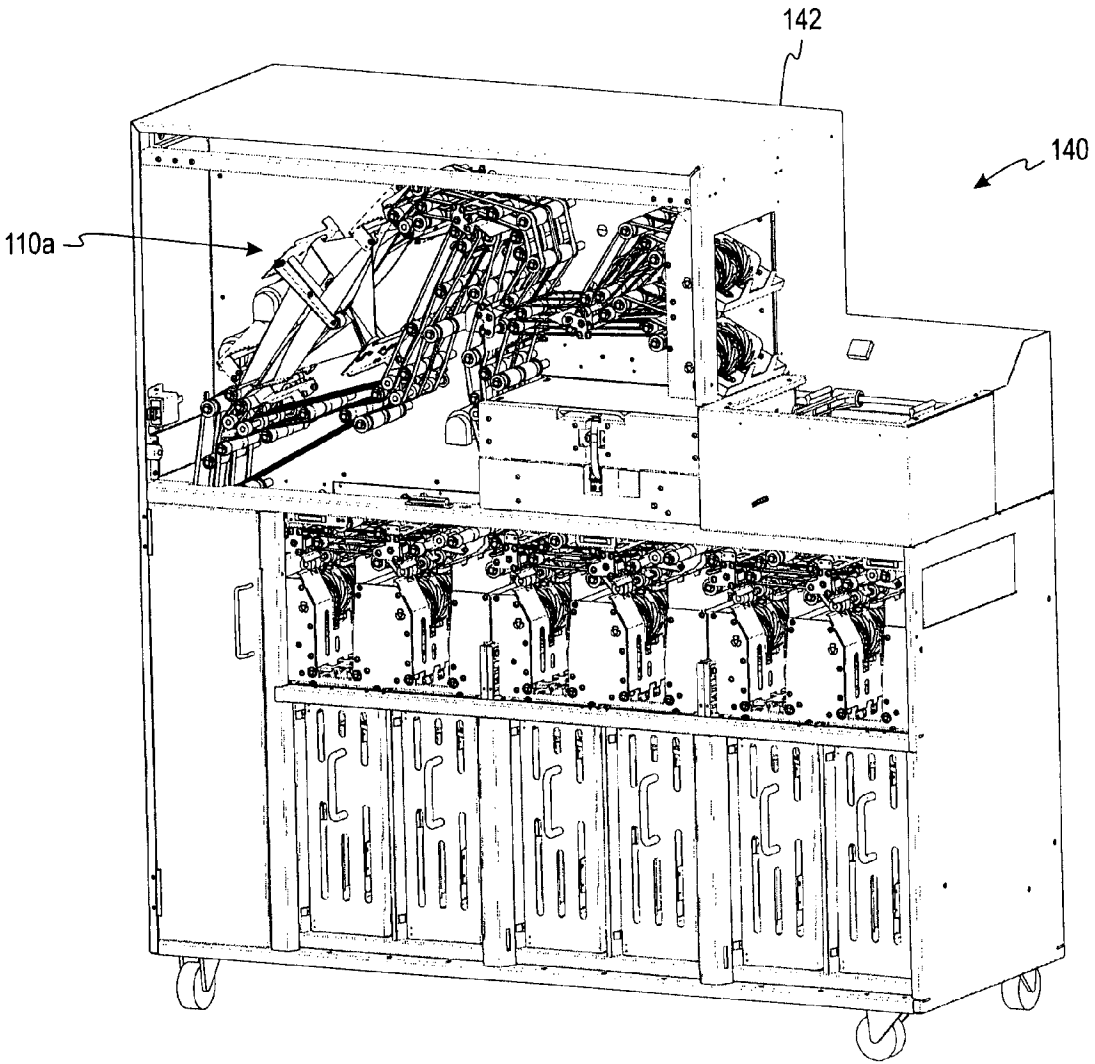
FIG. 1*d* is a perspective view of a document handling device according to one embodiment.
Figure 1E:
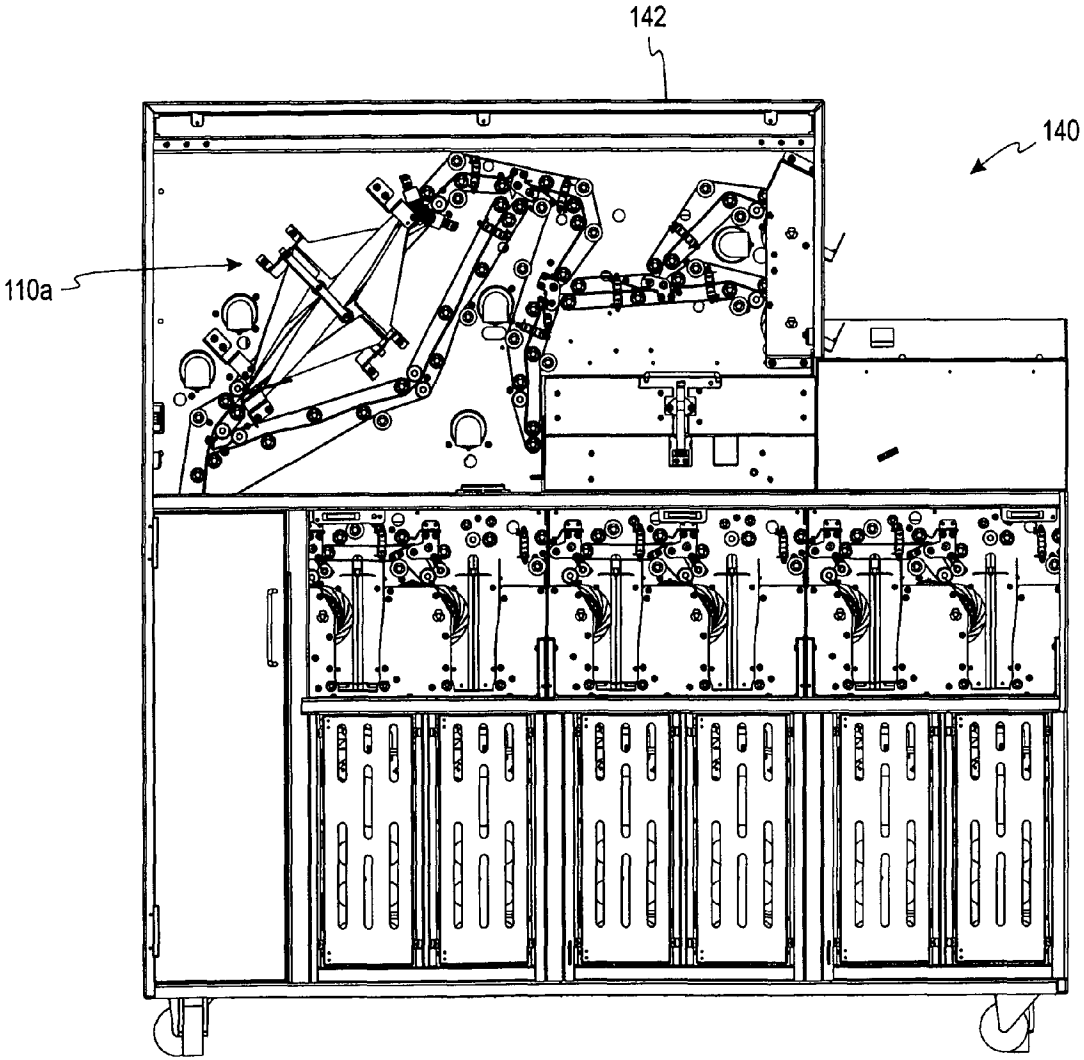
FIG. 1*e* is a front view of a document handling device according to one embodiment.

FIG. 1*d* is a perspective view and FIG. 1*e* is a front view of a multi-pocket document processing device 140 which is identical to the device 100 of FIGS. 1*a* and 1*b* except that the device 140 comprises a different embodiment of a facing mechanism 110*a*. The currency processing device comprises a main housing 142.

Additional details concerning multi-pocket document and currency evaluation devices such as that described in conjunction with FIGS. 1*a*-1*e* are provided in the following commonly-owned U.S. patent applications: Ser. No. 09/502,666 filed Feb. 11, 2000 entitled "Currency Handling System Having Multiple Output Receptacles," now issued as U.S. Pat. No. 6,398,000, Ser. No. 09/688,526 filed Oct. 16, 2000 entitled "Currency Handling System Having Multiple Output Receptacles," Ser. No. 09/688,538 filed Oct. 16, 2000 entitled "Currency Handling System Having Multiple Output Receptacles", Ser. No. 09/635,181 filed Aug. 9, 2000 entitled "Method of Creating Identifiable Smaller Stacks of Currency Bills with a Larger Stack of Currency Bills," now issued as U.S. Pat. No. 6,460,705, and Ser. No. 10/068,977 filed Feb. 8, 2002 entitled "Multiple Pocket Currency Processing Device and Method," and commonly-owned PCT Application WO 01/59723, each of which application and patent is incorporated herein by reference in its entirety.

The various multiple output receptacle devices described herein may be employed in conjunction with one or more of the document or currency strapping embodiments described below. Additional details described in the above applications include, for example, additional details concerning the evaluation region 108, the transport mechanism, the input receptacle, the various output receptacles including escrow and cassettes, and various facing mechanisms. Likewise various modes of operation are described in the above referenced applications (e.g., various strapping and stacking-for-strapping modes) and it is contemplated that such modes of operations can be used in conjunction with the various strapping devices and methods described below.

Figure 1F:
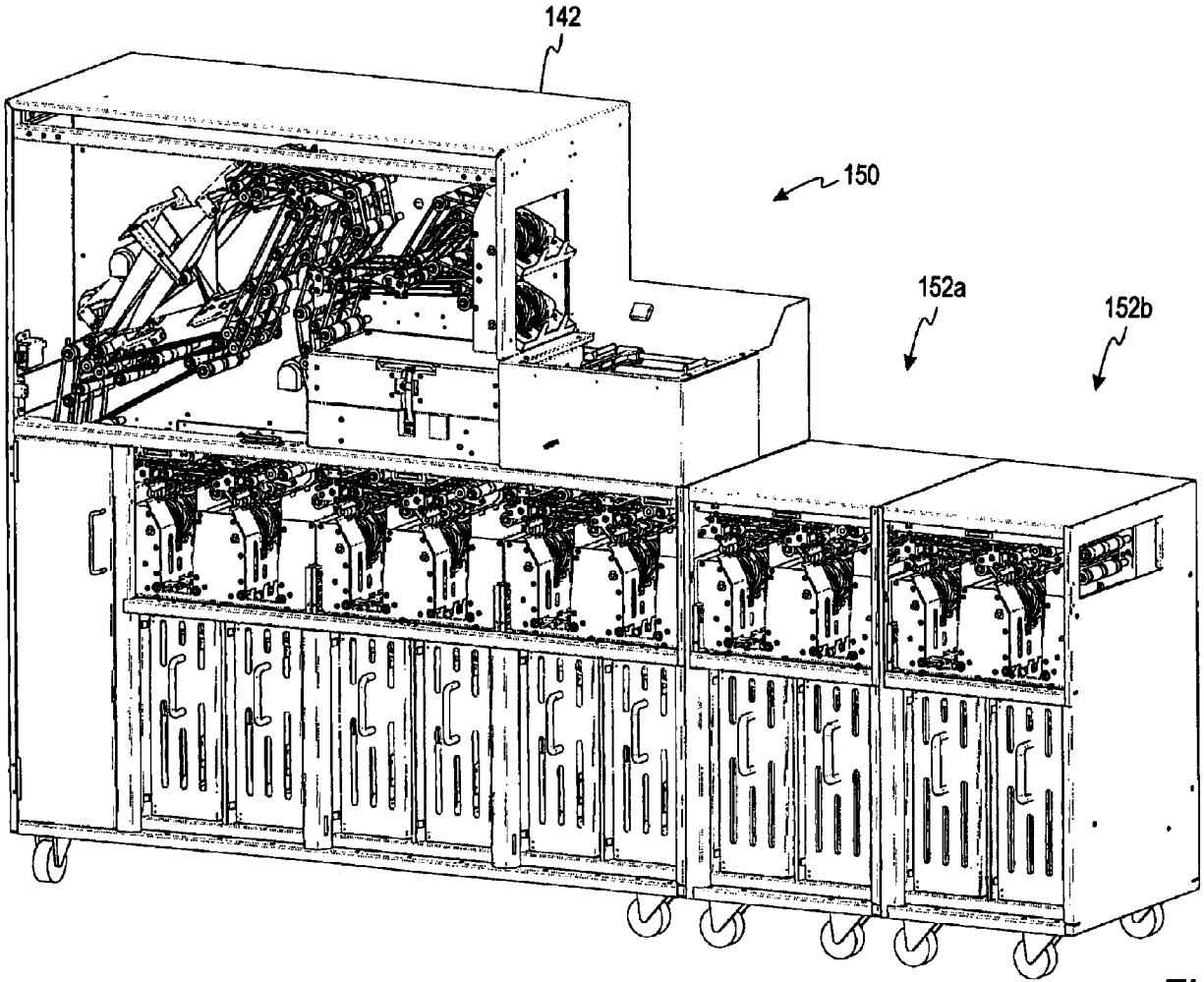
FIG. 1*f* is a perspective view of a document handling device having modular output receptacles according to one embodiment.
Figure 1G:
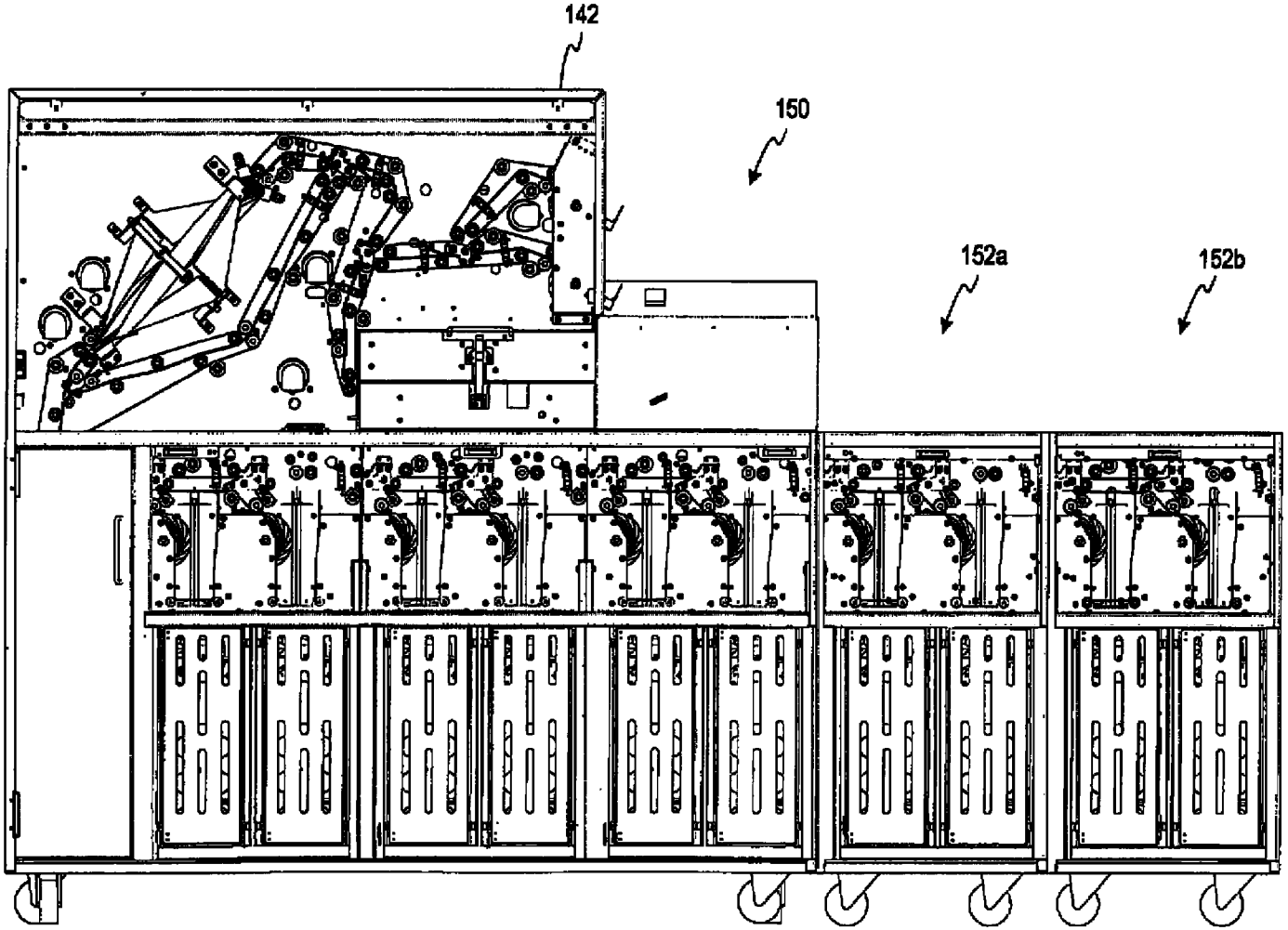
FIG. 1*g* is a front view of a document handling device having modular output receptacles according to one embodiment.

For example, the characteristics of the evaluation region 108 may vary according to the particular application and needs of the user. The evaluation region 108 can accommodate a number and variety of different types of sensors depending on a number of variables. These variables are related to whether the machine is authenticating, counting, or discriminating denominations and what distinguishing characteristics are being examined, e.g. size, thickness, color, magnetism, reflectivity, absorbability, transmissivity, electrical conductivity, etc. The evaluation region 108 may employ a variety of detection means including, but not limited to, a size detection and density sensor, a lower and an upper optical scan head, a single or multitude of magnetic sensors, thread sensor(s), infrared sensor(s), ultraviolet/fluorescent light scan head(s), and/or other radiation sensor(s). These detection means and a host of others are disclosed in commonly owned U.S. Pat. No. 6,278,795 incorporated by reference above. manipulator Referring back to FIG. 1*a*, the illustrated embodiment of the currency handling device 100 includes a total of six lower output receptacles 106*c*-106*h*. More specifically, each of the lower output receptacles 106*c*-106*h* includes a first portion designated as an escrow compartment 116*a*-116*f* and a second portion designated as a storage cassette 118*a*-118*f*. Typically, bills are initially directed to the escrow compartments 116, and thereafter at specified times or upon the occurrence of specified events, which may be selected or programmed by an operator, bills are then fed to the storage cassettes 118. The storage cassettes are removable and replaceable, such that stacks of bills totaling a predetermined number of bills or a predetermined monetary value may be accumulated in a given storage cassette 118, whereupon the cassette may be removed and replaced with an empty storage cassette. In the illustrated embodiment, the number of lower output receptacles 106*c*-106*h* including escrow compartments 116 and storage cassettes 118 are six in number. In alternative embodiments, the currency handling device 100 may contain more or less than six lower output receptacles including escrow compartments and storage cassettes 118. In other alternative embodiments, modular lower output receptacles 106 can be implemented to add many more lower output receptacles to the currency handling system 100. Each modular unit may comprise one, two or more lower output receptacles. In other alternative embodiments, several modular units may be added at one time to the currency handling device 100. FIG. 1*f* is a perspective view and FIG. 1*g* is a front view of an embodiment of a currency handling device 150 comprising two modular units 152*a,b* coupled in series to the main housing 142 of the currency handling device. In the embodiment illustrated, each modular unit comprises two output receptacles.

A series of diverters 130*a*-130*f*, which are a part of the transportation mechanism 104, direct the bills to one of the lower output receptacles 106*c*-106*h*. When the diverters 130 are in an upper position, the bills are directed to the adjacent lower output receptacle 106. When the diverters 130 are in a lower position, the bills proceed in the direction of the next diverter 130.

Figure 2A:
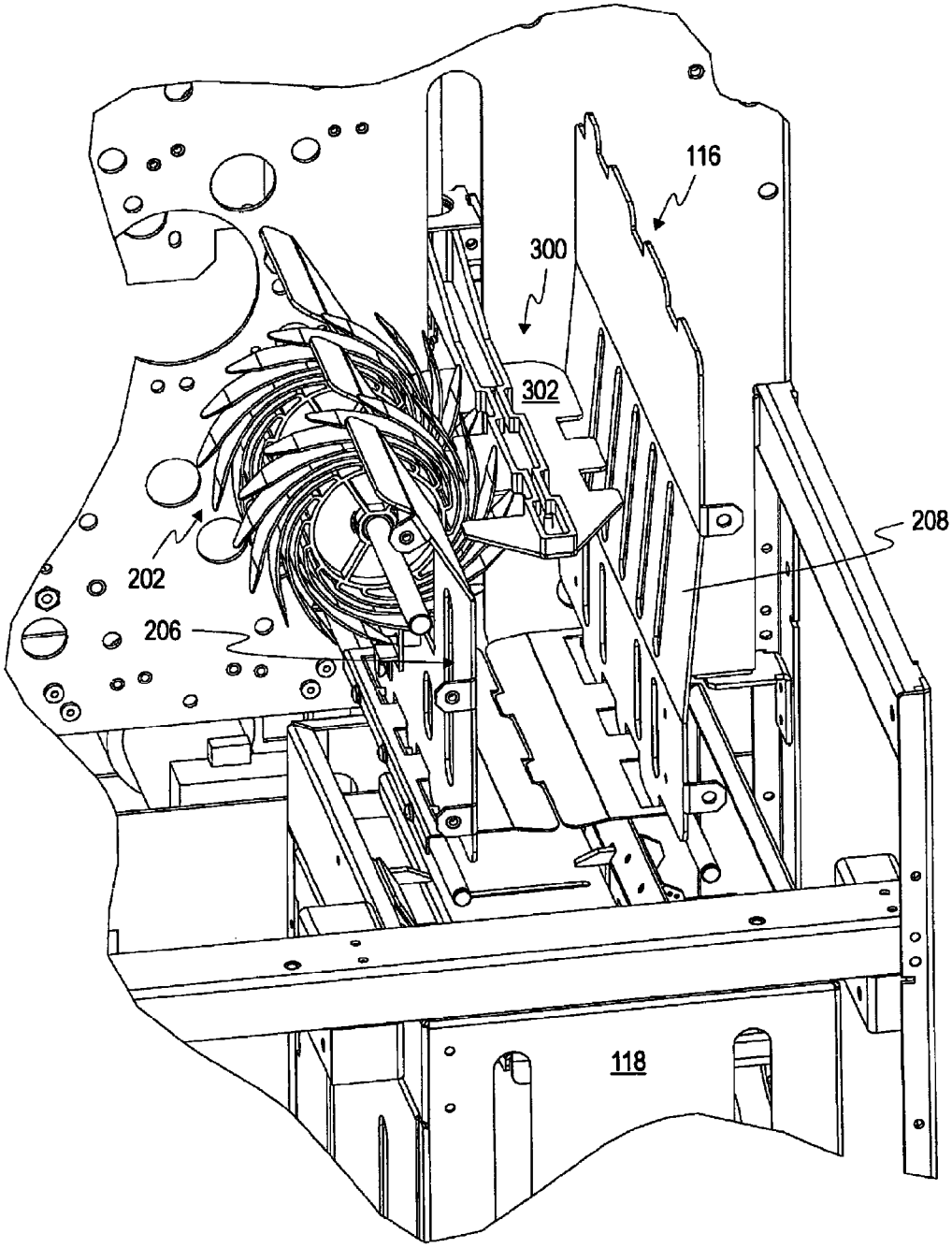
FIG. 2*a* is a front perspective view of an escrow compartment, a plunger assembly, and a storage cassette according to one embodiment of a document handling device.

The vertical arrangement of some embodiments of the lower output receptacles 106*c*-106*h* is illustrated in FIG. 2*a*. The escrow compartment 116 is positioned above the storage cassette 118. In addition to the escrow compartment 116 and the storage cassette 118, each of the lower output receptacles 106*c*-106*h* contains a plunger assembly 300. The plunger assembly 300 is shown during its decent towards the storage cassette 118.

Figure 2B:
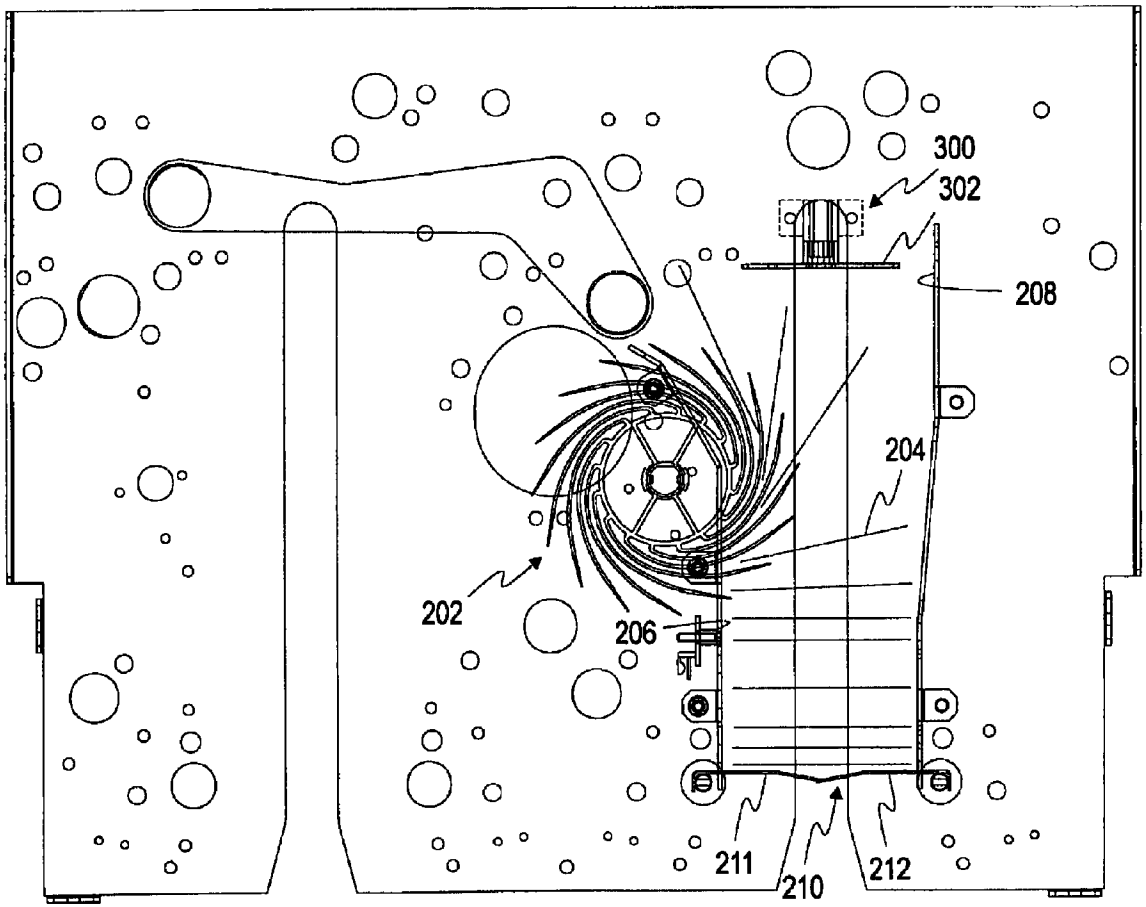
FIG. 2*b* is a front view of an escrow compartment and plunger assembly according to one embodiment of a document handling device.

Referring now to FIG. 2*b*, an embodiment of one of the escrow compartments 116 of the lower output receptacles 106*c*-106*h* is shown. The escrow compartment 116 contains a stacker wheel 202 to receive the bills 204 from the diverter 130. The stacker wheel 202 stacks the bills 204 within the escrow compartment walls 206, 208 on top of a gate 210 disposed between the escrow compartment 116 and the storage cassette 118. In an alternative embodiment, the escrow compartment 116 contains a pair of guides to aid in aligning the bills substantially directly on top of one another. The gate 210 is made up of two shutters: a first shutter 211 and a second shutter 212. The shutters 211, 212 are hingedly connected enabling the shutters 211, 212 to rotate downward approximately ninety degrees to move the gate from a first position (closed position) wherein the shutters 211, 212 are substantially co-planer to a second position (open position) wherein the shutters 211, 212 are substantially parallel. According to some embodiments, below the gate 210 is the storage cassette 118 (not shown in FIG. 2*b*).

Figure 2C:
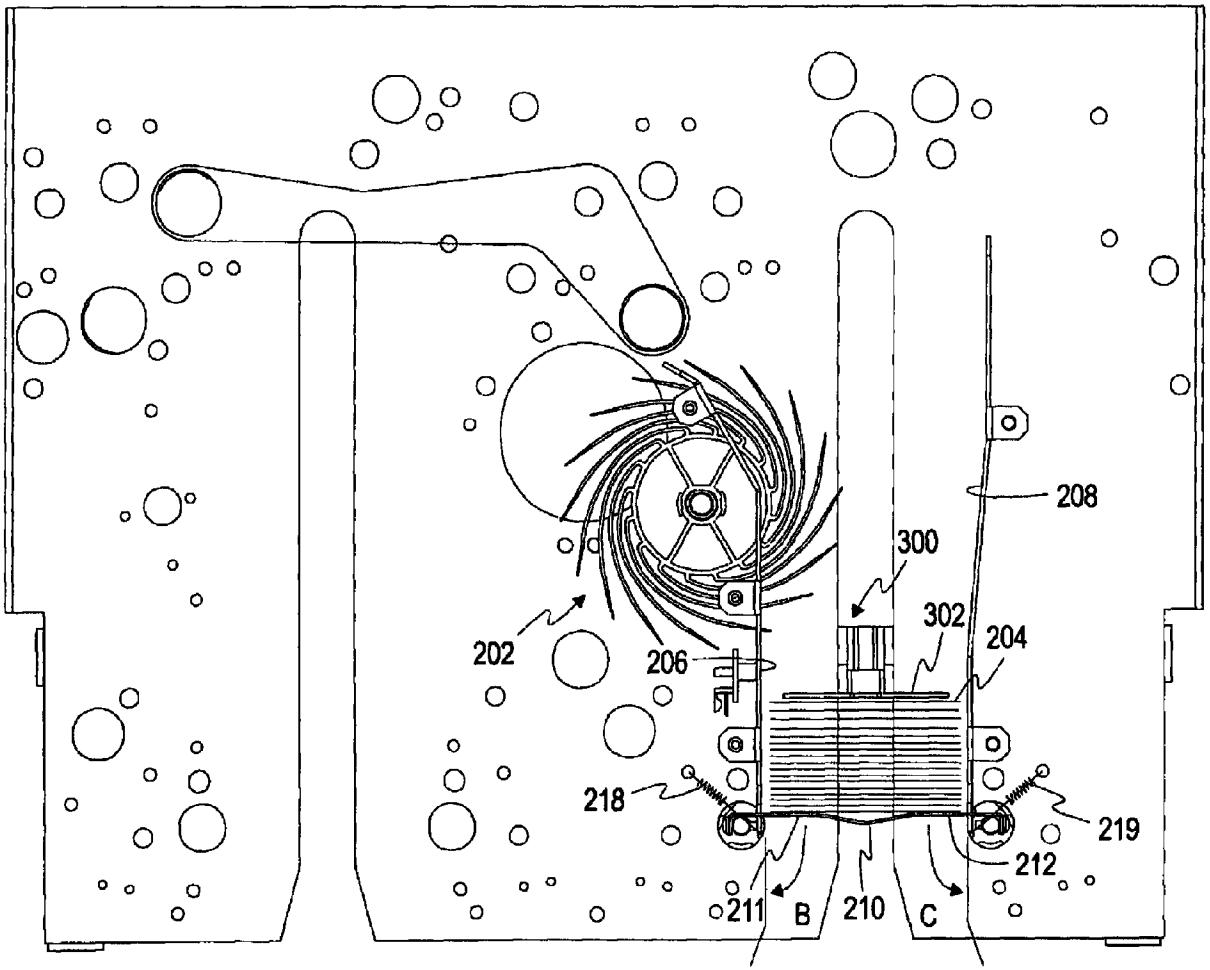
FIG. 2*c* is another front view of an escrow compartment and plunger assembly according to one embodiment of a document handling device.

FIG. 2*c* illustrates the positioning of the paddle 302 when transferring a stack of bills from the escrow compartment 116 to a storage cassette 118. When the paddle descends upon the stack of bills 204 it causes shutters 211, 212 to quickly rotate in the directions referred to by arrows B and C, respectively; thus, "snapping" open the gate 210. The quick rotation of the shutters 211, 212 insures that the bills fall into the storage cassette 118 in a substantially stacked position. According to one embodiment, the paddle is programmed to descend after a predetermined number of bills 204 are stacked upon the gate 210. According to other embodiments, the operator can instruct the paddle 302 via the control unit 120 to descend upon the bills 204 stacked upon the gate 210.

Beginning with FIG. 2*b*, the operation of one of the lower output receptacles 106*c*-106*h* according to some embodiments will be described. Pursuant to a mode of operation, the bills 204 are directed by one of the diverters 130 into the escrow compartment 116 of the lower output receptacle. The stacker wheel 202 within escrow compartment 116 receives the bills 204 from the diverter 130. The stacker wheel 202 stacks the bills 204 on top of the gate 210. According to some embodiments, pursuant to a preprogrammed mode of operation, once a predetermined number of bills 204 are stacked in the escrow compartment 116, the control unit 120 instructs the currency handling device 100 to suspend processing currency bills and the paddle 302 then descends from its home position above the escrow compartment 116 to transfer the bills 204 into the storage cassette 118. Once the bills 204 have been deposited in the storage cassette 118 the currency handling device resumes operation until an escrow compartment is full or all the bills within the input receptacle 102 have been processed.

Referring now to FIG. 2*c* the plunger assembly 300 downwardly travels placing the paddle 302 onto of the stack of bills 204. Upon making contact with the bills 204 the paddle 302 continues to travel downward. As the paddle 302 continues its descent, the paddle 302 forces the gate 210 to snap open. The paddle 302 imparts a force to the bills 204 that is transferred to the to the shutters 211, 212 causing the shutters 211, 212 to rotate from the closed position to the open position. The rotation of the shutters 211, 212 is indicated by the arrows B and C, respectively. Once the paddle 302 imparts the amount of force necessary to rotate levers 216, 217, the extension springs 218, 219 quickly rotate the shutters 211, 212 downward, thus "snapping" the gate 210 open. The downward rotation of the shutters 211, 212 causes each of the corresponding parallel bars 214, 215 to pivot which in turn rotates the levers 216, 217. The extension springs 218, 219 maintain the shutters 211, 212 in the open position allowing the paddle 302 to descend into the storage cassette 118. The hingedly connected side arms 306, 308 retract as the rollers 316, 318 to roll around the levers 216, 217 while the plunger assembly 300 is traveling downward into the cassette 118.

According to some embodiments, once the gate 210 is opened, the bills 204 are transferred into a storage cassette 118. The paddle 302 may continue its downward motion towards the storage cassette 118 to ensure that the bills 204 are transferred to the cassette 118.

FIGS. 3*a*-3*e* illustrate the components of the storage cassettes 118 according to one embodiment. The bills 204 are stored within the cassette housing 348 which has a base 349. Each storage cassette 118 contains two pairs of retaining tabs 350 positioned adjacent to the interior walls 351, 352 of the storage cassette. The lower surface 354 of each tab 350 is substantially planar. The tabs 350 are hingedly connected to the storage cassette 118 enabling the tabs 350 to downwardly rotate from a horizontal position, substantially perpendicular with the side interior walls 351, 352 of the cassette 118, to a vertical position, substantially parallel to the interior walls 351, 352 of the cassette 118. The tabs 350 are coupled to springs (not shown) to maintain the tabs in the horizontal position.

The storage cassette 118 contains a slidable platform 356 which is biased upward. During operation of the currency handling system 100, the platform 356 receives stacks of bills from the escrow compartment 116. The floor 356 is attached to a base 358 which is slidably mounted to a vertical support member 360. The base 358 is spring-loaded so that it is biased upward and in turn biases the platform 356 upward. According to some embodiments, the storage cassettes 118 are designed to be interchangeable so that once full, a storage cassette can be easily removed from the currency handling device 100 and replaced with an empty storage cassette 118. In the illustrated embodiment, the storage cassette 118 is equipped with a handle 357 in order to expedite removal and/or replacement of the storage cassettes 118. Also in the illustrated embodiment, the storage cassette 118 has a door 359 which enables an operator to remove bills from the storage cassette 118

Figure 3A:
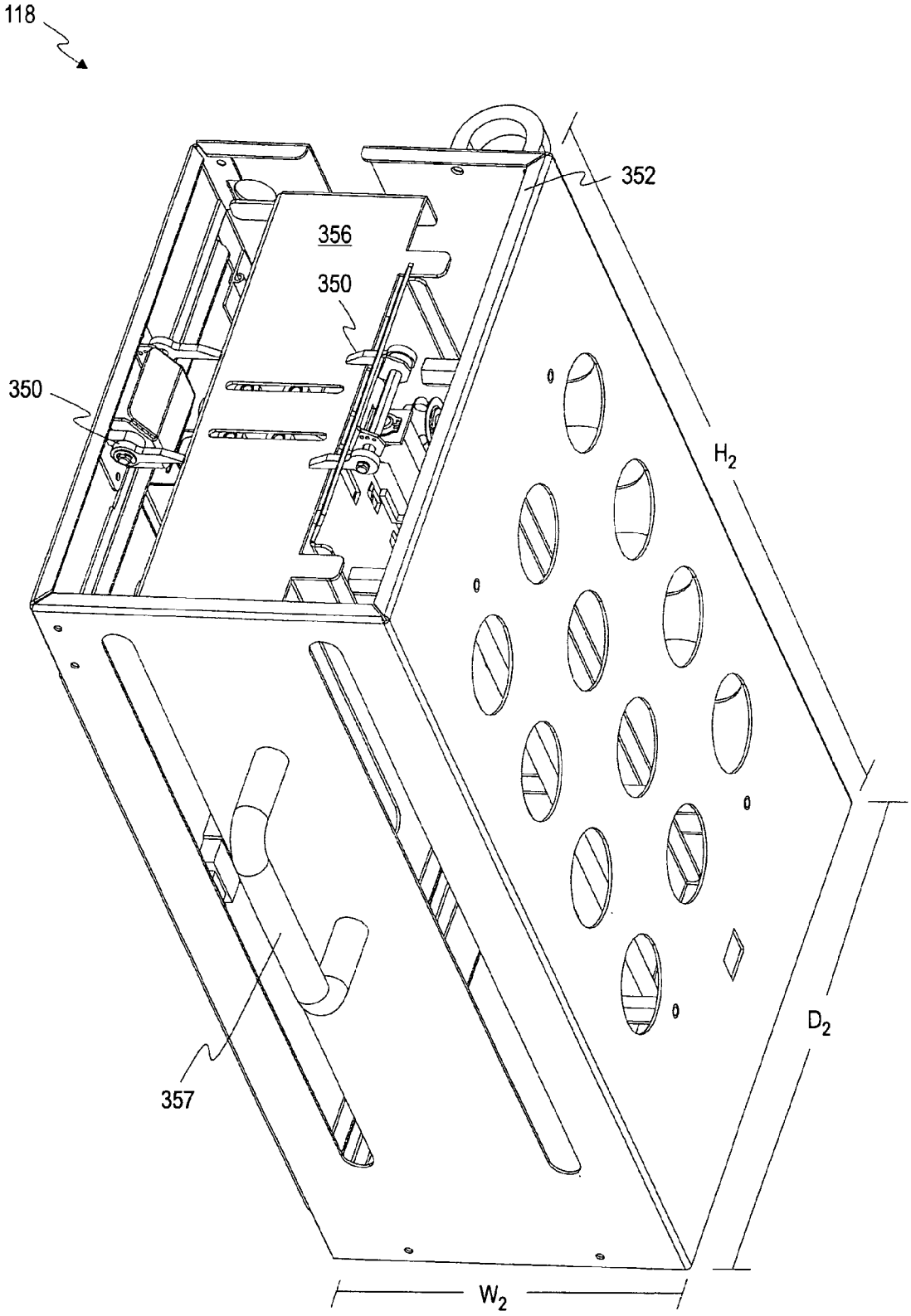
FIG. 3*a* is a perspective view of a storage cassette according to one embodiment of a document handling device.
Figure 3B:
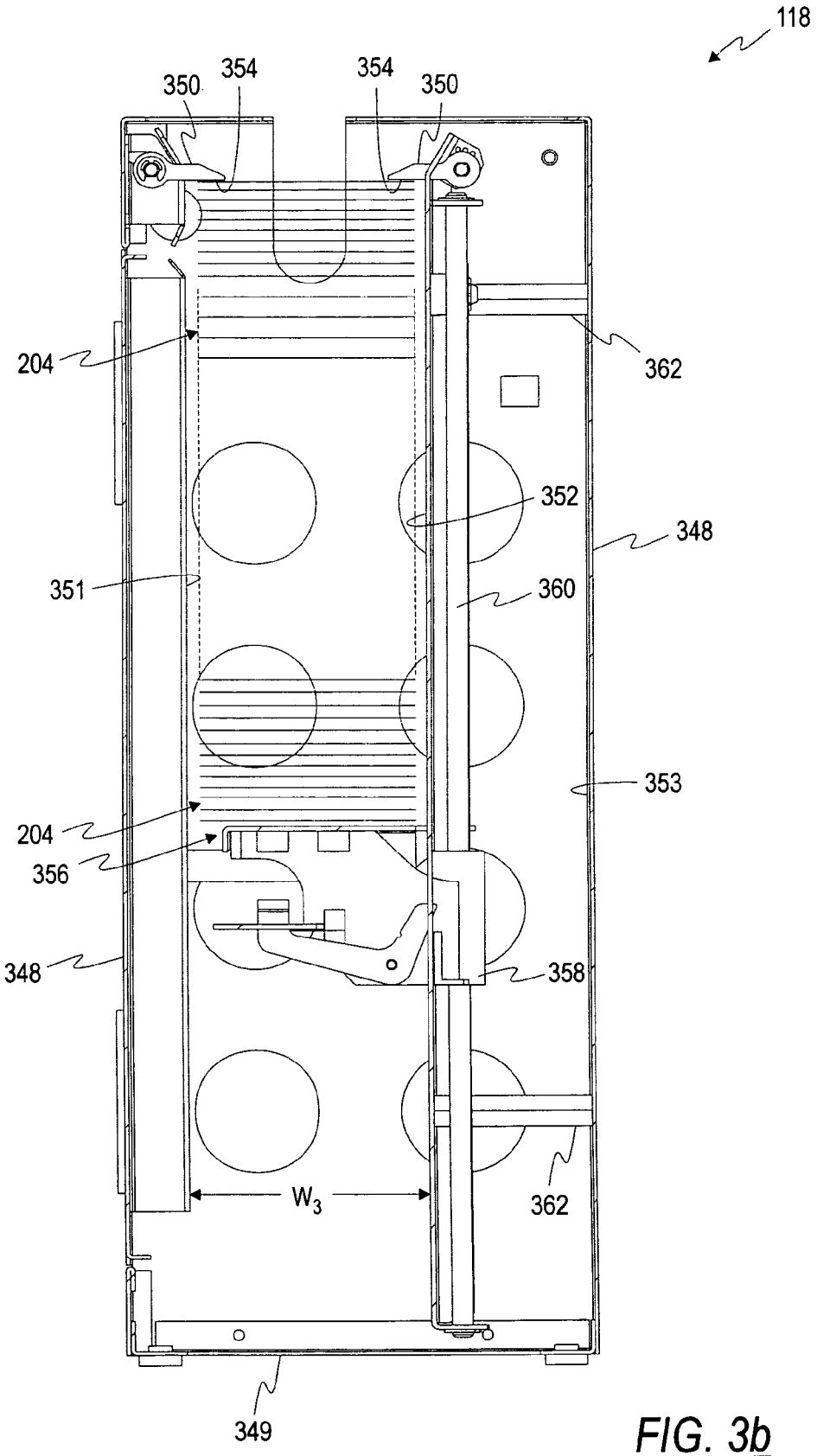
FIG. 3*b* is a rear sectional view of a storage cassette according to one embodiment of a document handling device.
Figure 3C:
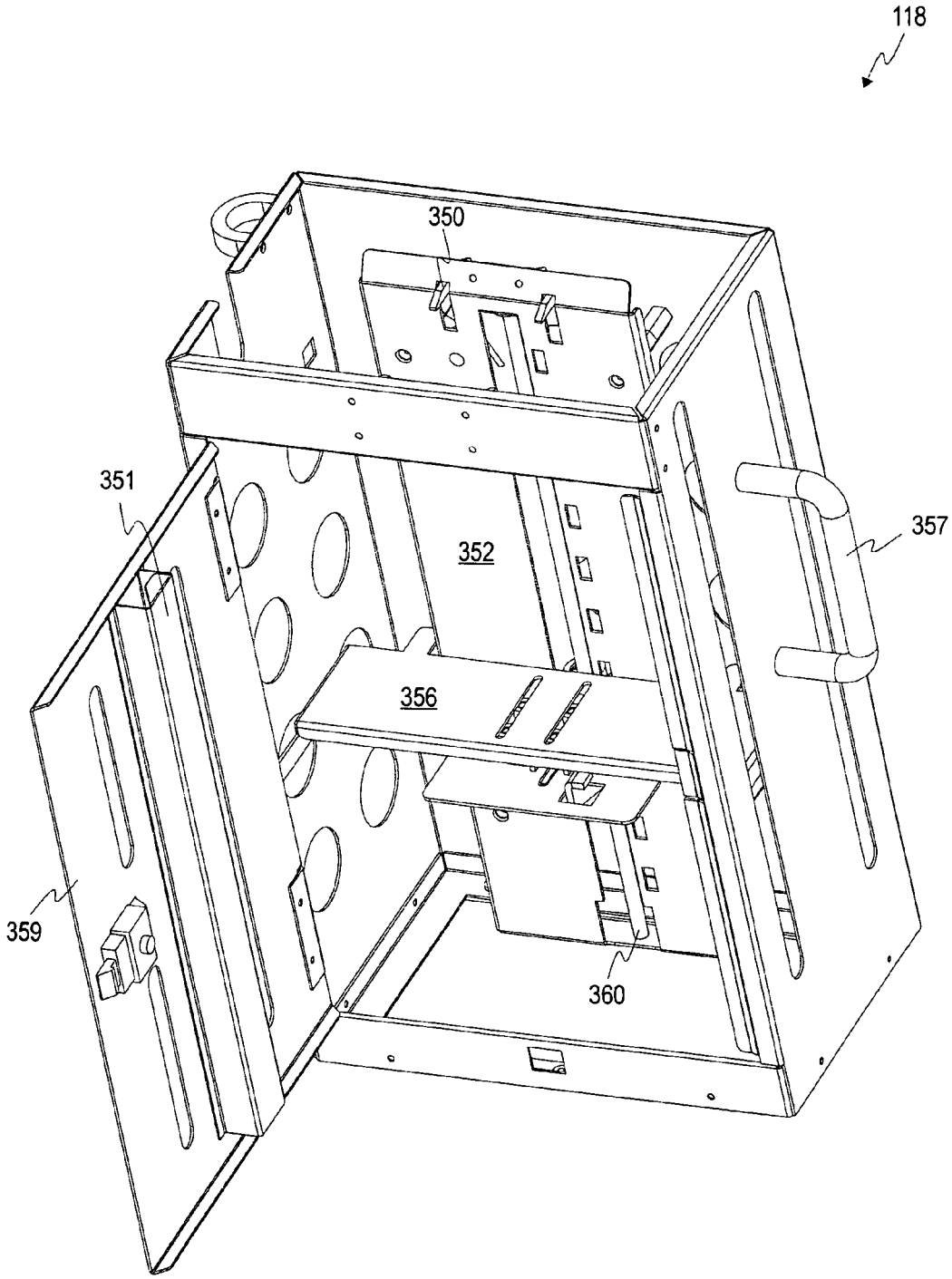
FIG. 3*c* is a perspective view of a storage cassette showing a door in the open position according to one embodiment of a document handling device.
Figure 3D:
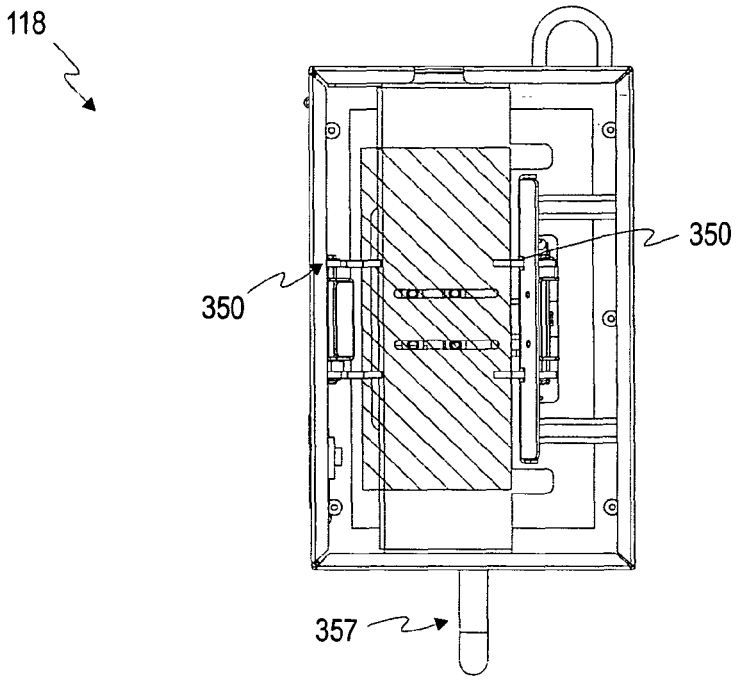
FIG. 3*d* is a top view of a storage cassette sized to accommodate United States currency documents according to one embodiment of a document handling device.
Figure 3E:
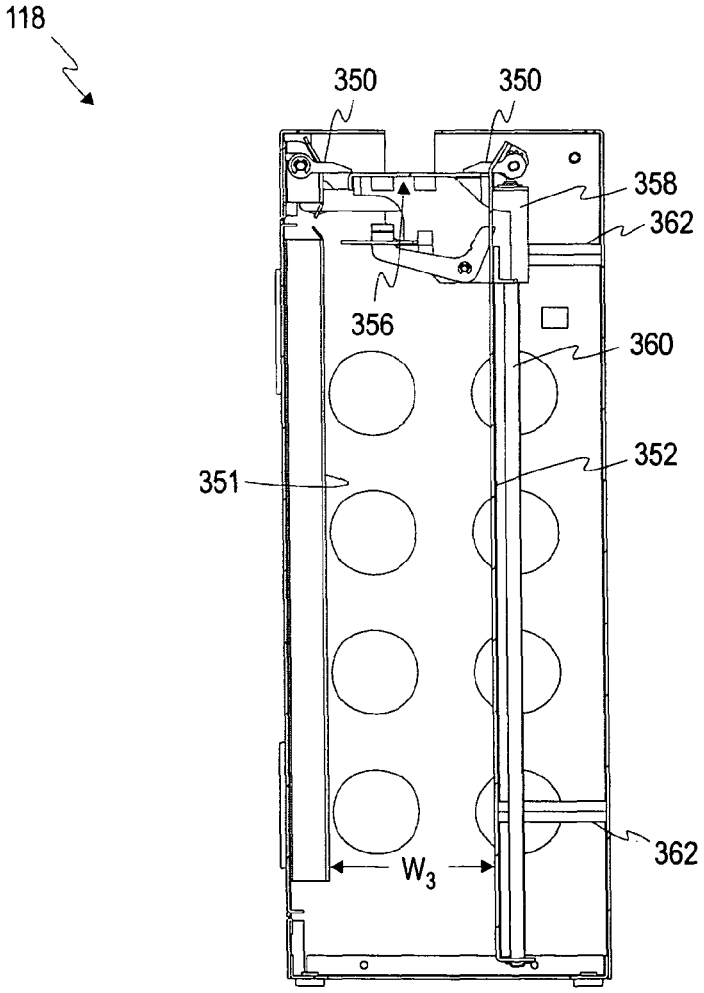
FIG. 3*e* is a rear view of a storage cassette sized to accommodate United States currency documents according to one embodiment of a document handling device.

Referring now to FIG. 3*b*, once the gate 210 is opened, the bills 204 fall a short distance onto the platform 356 of the storage cassette 118 or onto a stack of bills 204 already deposited on the platform 356. The paddle 302 continues its downward motion towards the storage cassette 118 to ensure that the bills 204 are transferred to the cassette 118. Initially, some bills 204 may be spaced apart from the platform 356 or the other bills 204 within the storage cassette by retaining tabs 350. As the plunger assembly 300 continues to descend downward into the cassette, the paddle 302 continues to urge the stack of bills 204 downward causing the retaining tabs 350 to rotate downward. The bills 204 are pushed past retaining tabs 350 and onto the platform 356.

Once the plunger assembly 300 has descended into the cassette 118 a distance sufficient for the paddle 302 to clear the retaining tabs 350 allowing the retaining tabs 350 to rotate upward, the plunger assembly initiates its ascent out of the storage cassette 118. The platform 356 urges the bills 204 upward against the underside of the paddle 302. The paddle 302 is equipped with two pairs of slots 324, 326 to enable the paddle to clear the pairs of retaining tabs 350. When the paddle 302 ascends past the pairs of retaining tabs 350 the bills 204 are pressed against the lower surfaces 354 of the pairs of retaining tabs 350 by the platform 356.

In alternative embodiments of the currency handling device 100, the input receptacle 102, the transport mechanism, the output receptacles 106, and the cassettes 118 can be sized to accommodate documents of varying sizes such as various international currencies, stock certificates, postage stamps, store coupons, etc. For example, to accommodate documents of different widths, the width of the escrow compartment 116, the gate 210, and the storage cassette 118 may need to be increased or decreased as appropriate. The document evaluation device 100 is sized to accommodate storage cassettes 118 and gates 210 of different widths. According to some embodiments, the entire transport mechanism 104 of the currency handling device 100 may be dimensioned to accommodate the largest currency bills internationally or the largest type of documents to be processed. Accordingly, the document handling device 100 can be used to process the currency or documents of varying sizes.

In various alternative embodiments, the currency handling device 100 is dimensioned to process a stack of different sized currencies at the same time. For example, one application may require the processing of United States dollars (2.5 inches×6 inches, 6.5 cm×15.5 cm) and French currency (as large as 7.17 inches×3.82 inches, 18.2 cm×9.7 cm). The application may simply require the segregation of the United States currency from the French currency wherein the currency handling device 100 delivers United States currency to the first lower output receptacle 106*c* and the French currency to the second output receptacle 106*d*. In another alternative embodiment, the currency handling device 100 processes a mixed stack of U.S. ten and twenty dollar bills and French one hundred and two hundred Franc notes wherein the currency documents are denominated, counted, and authenticated. In that alternative embodiment, the U.S. ten and twenty dollar bills are delivered to the first 106*c* and second 106*d* lower output receptacles, respectively, and the French one hundred and two hundred Franc notes are delivered to the third 106*e* and fourth 106*f* lower output receptacle, respectively. In other alternative embodiments, the currency handling device 100 denominates, counts, and authenticates six different types of currency wherein, for example, Canadian currency is delivered to the first lower output receptacle 106*c*, United States currency is delivered to the second output receptacle 106*d*, Japanese currency is delivered to the third lower output receptacle 106*e*, British currency is delivered to the fourth lower output receptacle 106*f*, Mexican currency is delivered to the fifth lower output receptacle 106*g*, and Euro currency is delivered to the sixth lower output receptacle 106*h*. In another embodiment, no call bills or other denominations of currency, such as Mexican currency for example, may be directed to the second upper output receptacle 106*b*. In another embodiment, suspect bills are delivered to the first upper output receptacle 106*a*.

In other alternative embodiments of the currency handling device 100, the user can vary the type of documents delivered to the output receptacles 106. For example, in one alternative embodiment an operator can direct, via the control unit 120, that a stack of one, five, ten, twenty, fifty, and one-hundred United States dollar bills be denominated, counted, authenticated, and directed into lower output receptacles 106*c*-106*h*, respectively. In still another alternative embodiment, the currency handling device 100 is also instructed to deliver other bills, such as a United States two dollar bill or currency documents from other countries that have been mixed into the stack of bills, to the second upper output receptacle 106*b*. In still another alternative embodiment, the currency handling device 100 is also instructed to count the number and aggregate value of all the currency bills processed and the number and aggregate value of each individual denomination of currency bills processed. These values can be communicated to the user via the display/user-interface 122 of the currency handling device 100. In still another alternative embodiment, no call bills and bills that are stacked upon one another are directed to the second upper output receptacle 106*b*. In still another alternative embodiment, the operator can direct that all documents failing an authentication test be delivered to the first upper output receptacle 106*a*. In another alternative embodiment, the operator instructs the currency handling device 100 to deliver no call bills, suspect bills, stacked bills, etc. to one of the lower output receptacles 106*c*-106*h*. The currency handling device 100 which has eight output receptacles 106*a*-106*h* provides a great deal of flexibility to the user. And in other alternative embodiments of the currency handling device 100, numerous different combinations for processing documents are available.

In other alternative embodiments, the currency handling device 100 is capable of denominating, authenticating, stacking, and facing for strapping purposes batches of bills containing several different international currencies. For example, in one embodiment of the present invention, a user may desire to segregate, denominate, authenticate, and stack for strapping purposes U.S. $20, $50, $100 bills and Canadian $20, $50, $100 bills. The U.S. $20, $50, $100 dollar bills may be directed to the first three lower output receptacles 106*c*-*e* and the Canadian $20, $50, $100 bills may be directed to the second three lower output receptacles 106*f*-*h*. Accordingly, the currency handling device must denominate each of the currency bills before directing the bills to a lower output receptacle 106*c*-*h*. Non-U.S. $20, $50, $100 bills and non-Canadian $20, $50, $100 are directed to one of the upper output receptacles 106*a*, 106*b* such as the second upper output receptacle 106*b*. The bills may also be authenticated. Authentic U.S. $20, $50, $100 bills and Canadian $20, $50, $100 are directed to the appropriate lower output receptacles 106*c-h*. Those bills which are not authenticated, suspect bills, can be routed to the first upper output receptacle 106*a*. Further, non-U.S. $20, $50, $100 suspect bills and non-Canadian $20, $50, $100 suspect bills can also be directed to the first upper output receptacle 106*a*. Additionally, in other alternative embodiments of the present invention, modular output receptacles can be added so that, for example, U.S. $5 and $10 bills are processed in the same manner along side the U.S. $20, $50, $100 bills and Canadian $20, $50, $100 bills.

In addition to the various multi-pocket document evaluation devices described above in connection with FIGS. 1-3, additional multi-pocket document evaluation devices and methods of operating the same will now be described in connection with FIGS. 4-7. The operating modes to be described in connection with FIGS. 4-7 may also be applied to the embodiments described in connection with FIGS. 1-3.

Figure 4A:
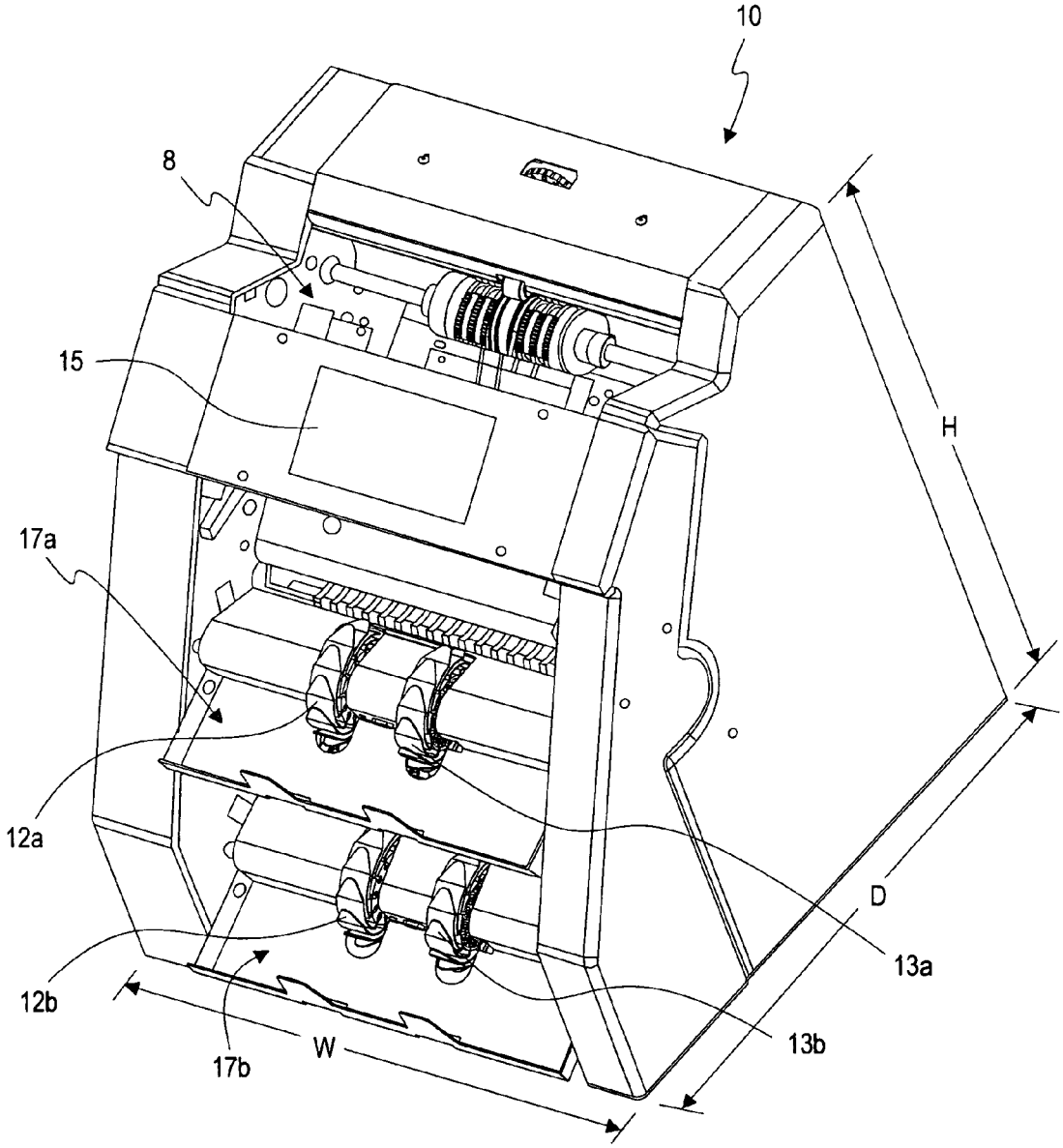
FIG. 4*a* is a perspective view of a multi-pocket document evaluation device according to one embodiment.
Figure 4B:
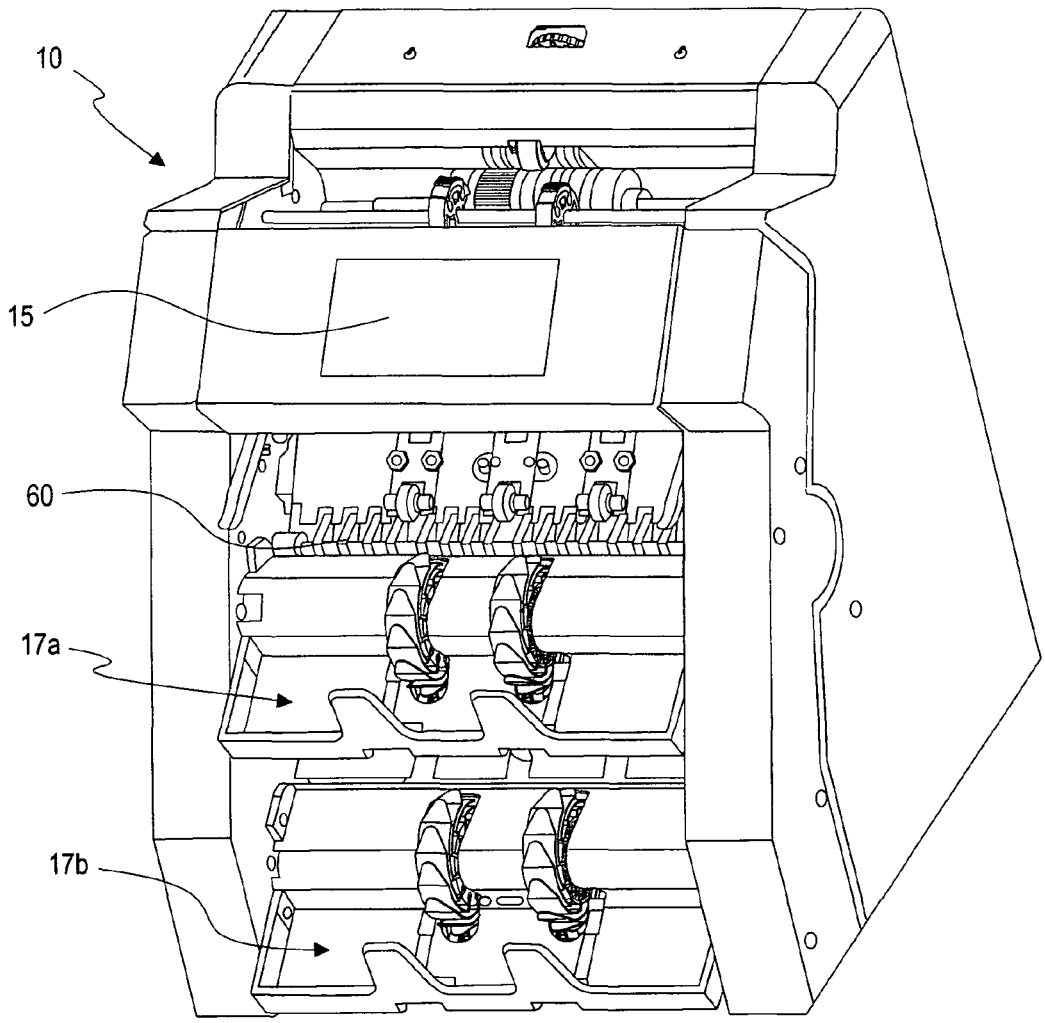
FIG. 4*b* is another perspective view of a multi-pocket document evaluation device according to one embodiment.
Figure 4C:
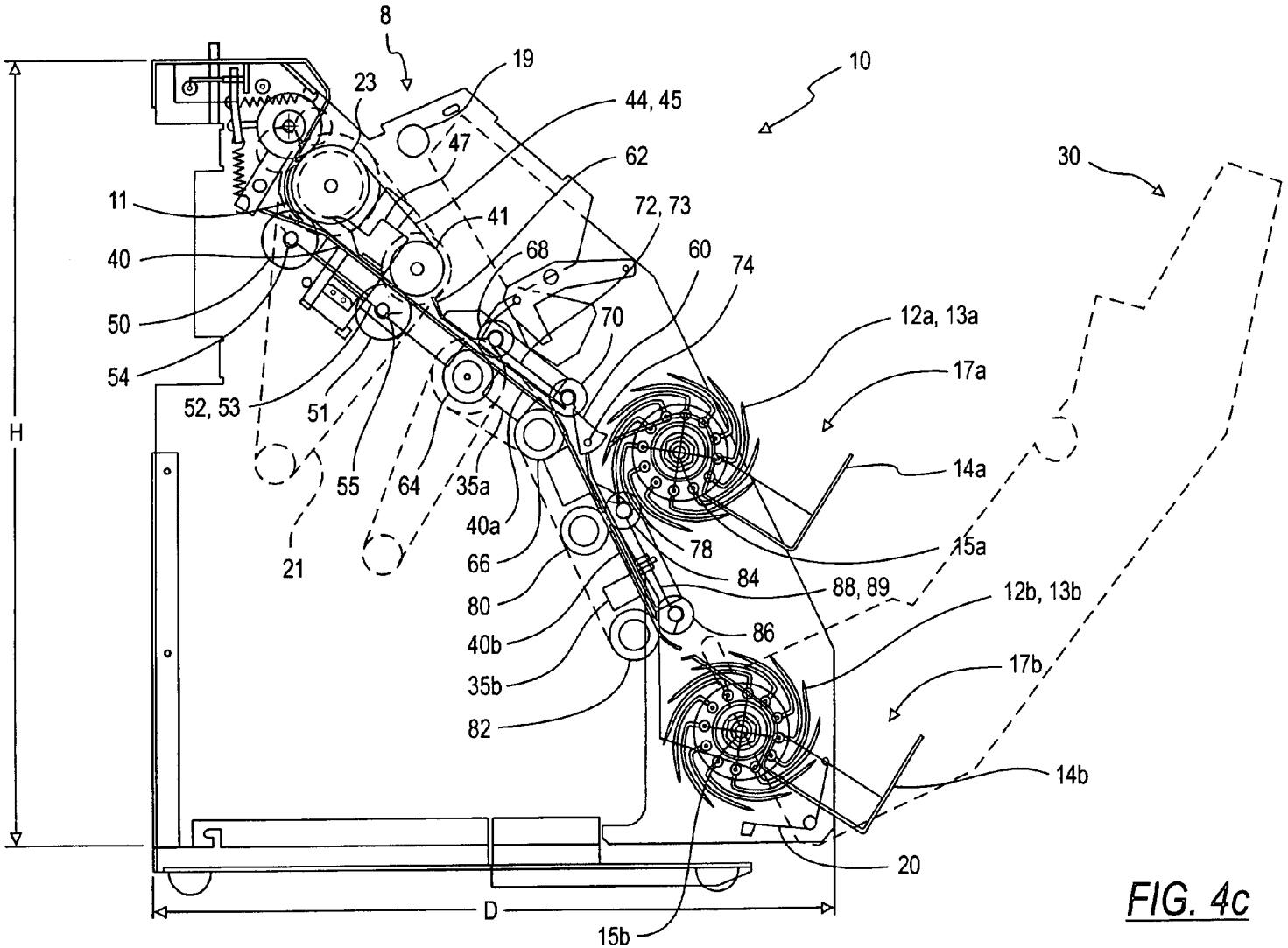
FIG. 4*c* is a side sectional view of an evaluation device depicting various transport rolls in side elevation according to one embodiment.

FIGS. 4*a* and 4*b* depict an exterior perspective view and FIG. 4*c* is a side view of a multi-pocket document evaluation device 10 such as a currency discriminator according to one embodiment of the present invention. According to one embodiment the currency discriminator 10 is compact having a height (H) of about 17½ inches (44.5 cm), width (W) of about 13½ inches (34.3 cm), and a depth (D) of about 15 inches (38.1 cm) and weighs approximately 35 lbs. (16 kg). The evaluation device 10 may be rested upon a tabletop.

In FIGS. 4*a*, 4*b*, and 4*c*, currency bills are fed, one by one, from a stack of currency bills placed in an input receptacle 8 into a transport mechanism. The transport mechanism includes a transport plate or guide plate 40 for guiding currency bills to one of a plurality of output receptacles 17*a* and 17*b*. Before reaching the output receptacles 17*a*, 17*b* a bill can be, for example, evaluated, analyzed, authenticated, discriminated, counted and/or otherwise processed. The results of the above process or processes may be used to determine to which output receptacle 17*a*, 17*b* a bill is directed. In one embodiment, documents such as currency bills are transported, identified, and otherwise processed at a rate equal to or greater than 600 bills per minute. In another embodiment, documents such as currency bills are transported, identified, and otherwise processed at a rate equal to or greater than 800 bills per minute. In another embodiment, documents such as currency bills are transported, identified, and otherwise processed at a rate equal to or greater than 1000 bills per minute. In another embodiment, documents such as currency bills are transported, identified, and otherwise processed at a rate equal to or greater than 1200 bills per minute. In another embodiment, documents such as currency bills are transported, identified, and otherwise processed at a rate equal to or greater than 1500 bills per minute. For currency bills, the identification may include the determination of the denomination of each bill.

FIGS. 4*a*-4*c* are described in more detail in U.S. Pat. No. 6,311,819 B1 incorporated herein by reference in its entirety. The currency discriminator 10 in FIGS. 4*a* and 4*b* has a touch panel display 15 in one embodiment of the present invention which displays appropriate "functional" keys when appropriate. The touch panel display 15 simplifies the operation of the multi-pocket currency discriminator 10. The touch panel display 15 may be a full graphics display. Alternatively or additionally physical keys or buttons may be employed.

From the input receptacle 8, the currency bills are moved in seriatim from the bottom of a stack of bills along a curved guideway 11 (shown in FIG. 4*c*) which receives bills moving downwardly and rearwardly and changes the direction of travel to a forward direction. The curvature of the guideway 11 corresponds substantially to the curved periphery of a drive roll 23 so as to form a narrow passageway for the bills along the rear side of the drive roll 23. An exit end of the curved guideway 11 directs the bills onto the transport plate 40 which carries the bills through an evaluation section and to one of the output receptacles 17*a*, 17*b*.

Stacking of the bills in one embodiment is accomplished by a pair of driven stacking wheels 12*a* and 13*a* for the first or upper output receptacle 17*a* and by a pair of stacking wheels 12*b* and 13*b* for the second or bottom output receptacle 17*b*. The stacker wheels 12*a,b* and 13*a,b* are supported for rotational movement about respective shafts 15*a,b* journalled on a rigid frame and driven by a motor (not shown). Flexible blades of the stacker wheels 12*a* and 13*a* deliver the bills onto a forward end of a stacker plate 14*a*. Similarly, the flexible blades of the stacker wheels 12*b* and 13*b* deliver the bills onto a forward end of a stacker plate 14*b*.

A diverter 60 directs the bills to either the first or second output receptacle 17*a*, 17*b*. When the diverter is in a lower position, bills are directed to the first output receptacle 17*a*. When the diverter 60 is in an upper position, bills proceed in the direction of the second output receptacle 17*b*.

Figure 5A:
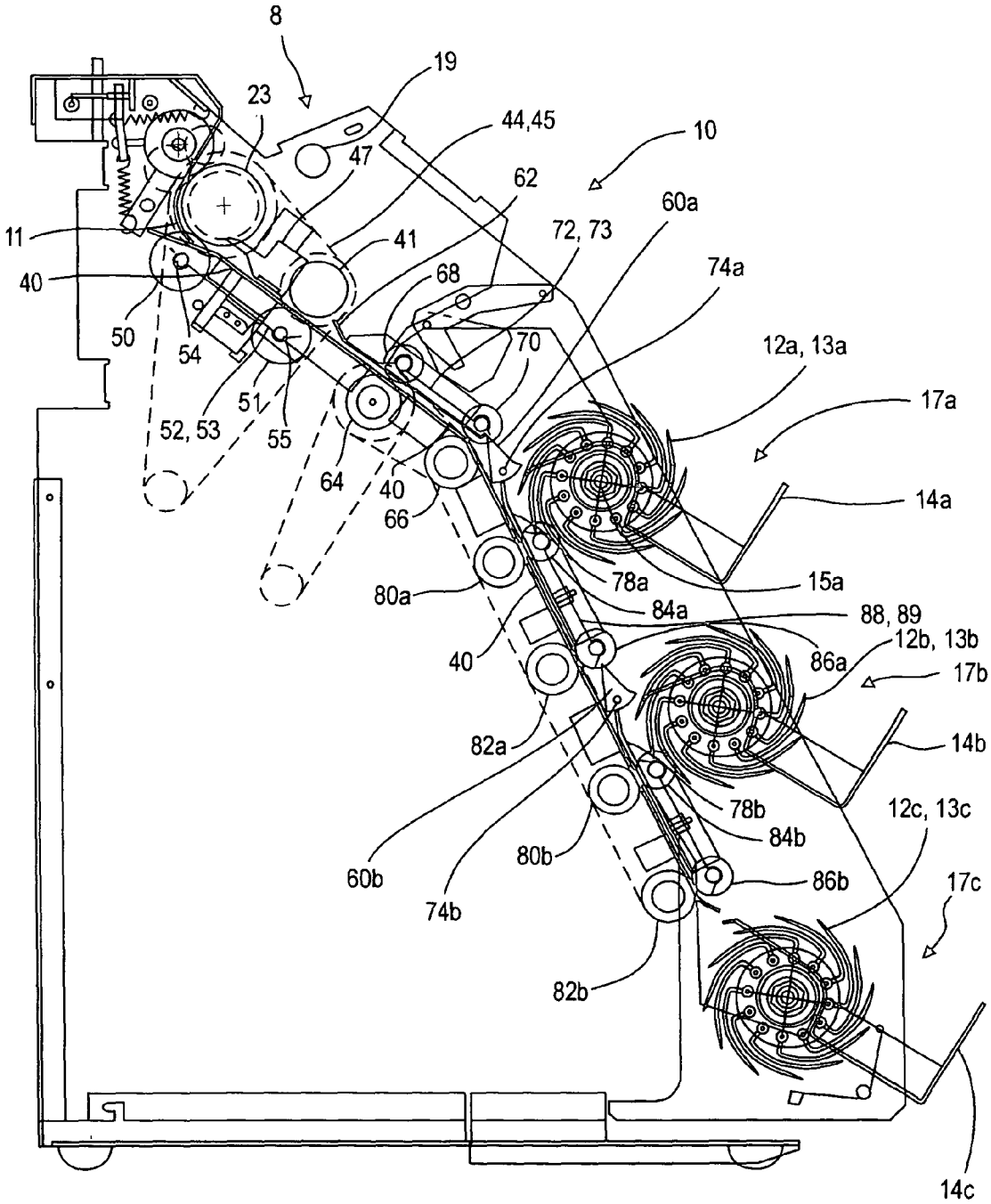
FIG. 5*a* is a side sectional view of an evaluation device having three output receptacles depicting various transport rolls in side elevation according to one embodiment.
Figure 5B:
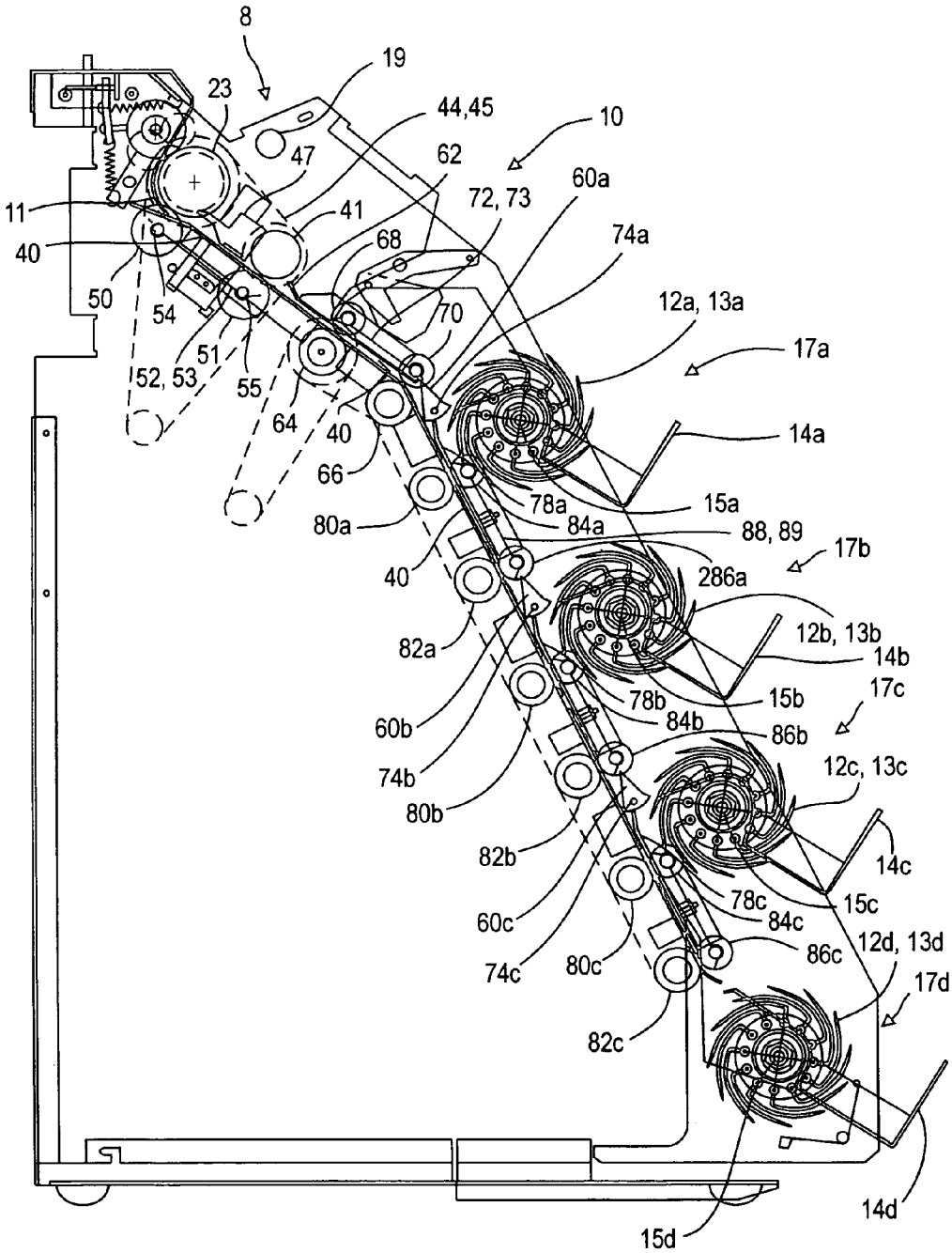
FIG. 5*b* is a side sectional view of an evaluation device having four output receptacles depicting various transport rolls in side elevation according to one embodiment.
Figure 5C:
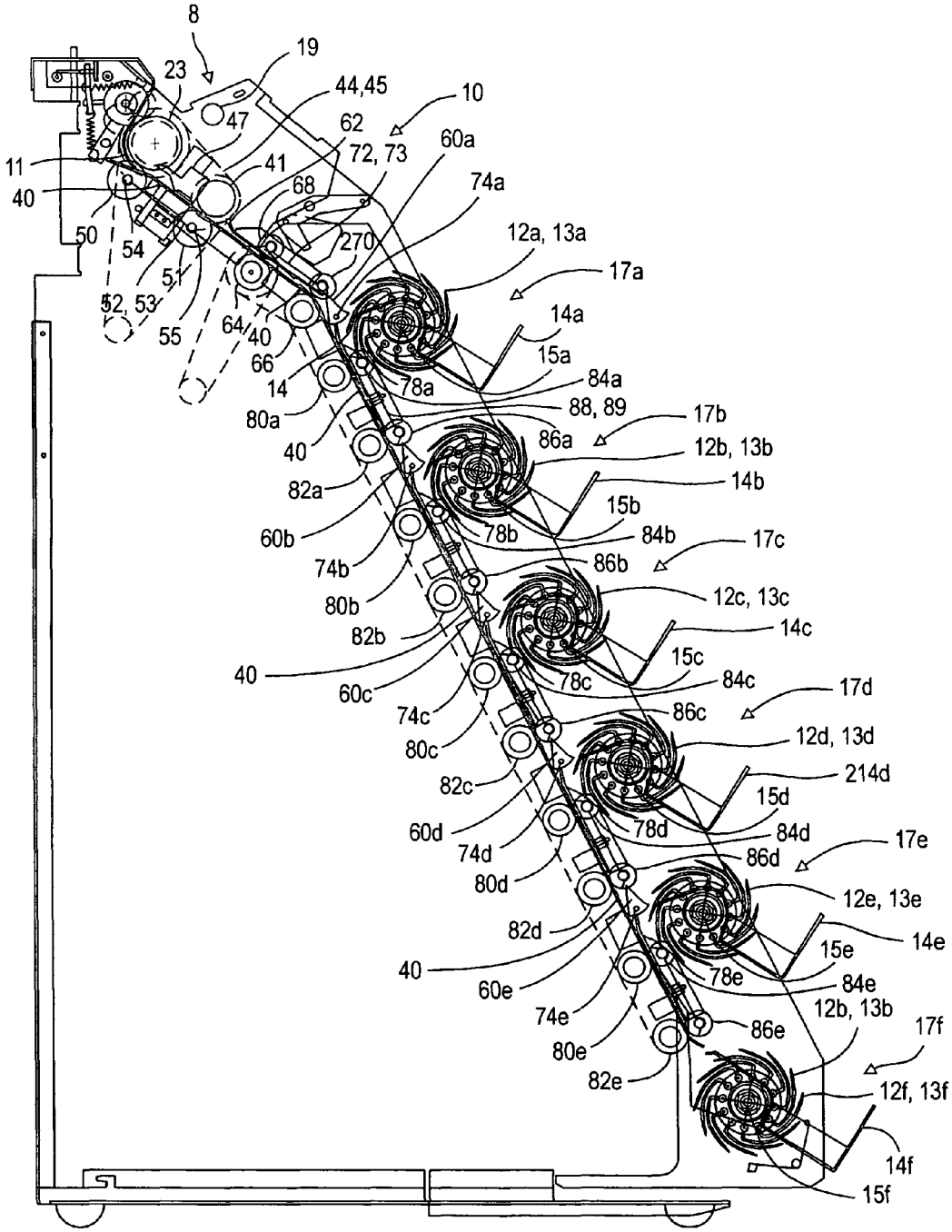
FIG. 5*c* is a side sectional view of an evaluation device having six output receptacles depicting various transport rolls in side elevation according to one embodiment.

FIGS. 5*a-c* depict multi-pocket document evaluation devices 10, such as a currency discriminators, according to other embodiments of the present invention. FIG. 5*a* depicts a three-pocket document evaluation device 10, such as a currency discriminator. FIG. 5*b* depicts a four-pocket document evaluation device 10, such as a currency discriminator. FIG. 5*c* depicts a six-pocket document evaluation device 10, such as a currency discriminator.

The multi-pocket document evaluation devices 10 in FIGS. 5*a-c* have a transport mechanism which includes a transport plate or guide plate 40 for guiding currency bills to one of a plurality of output receptacles 17. The transport plate 40 according to one embodiment is substantially flat and linear without any protruding features. Before reaching the output receptacles 17, a bill can be, for example, evaluated, analyzed, authenticated, discriminated, counted and/or otherwise processed.

The multi-pocket document evaluation devices 10 move the currency bills in seriatim from the bottom of a stack of bills along the curved guideway 11 which receives bills moving downwardly and rearwardly and changes the direction of travel to a forward direction. An exit end of the curved guideway 11 directs the bills onto the transport plate 40 which carries the bills through an evaluation section and to one of the output receptacles 17. A plurality of diverters 60 direct the bills to the output receptacles 17. When a diverter 60 is in its lower position, bills are directed to the corresponding output receptacle 17. When a diverter 60 is in its upper position, bills proceed in the direction of the remaining output receptacles.

Evaluation Region

The characteristics of the evaluation region 47 may vary according to the particular application and needs of the user. The evaluation region can accommodate a number and variety of different types of sensors depending on a number of variables. These variables are related to whether the machine is authenticating, counting or discriminating and what distinguishing characteristics are being examined, e.g., size, color, magnetism, reflectivity, absorbability, transmissivity, electrical conductivity, etc. The evaluation region 47 may be incorporated in any of the above described devices including the devices illustrated in FIGS. 1*a*-1*g*, 4*a*-4*c*, and 5*a*-5*c*.

The evaluation region 47 may employ a variety of detection means such as magnetic or optical sensors. For example, as described above in connection with the evaluation region 108 (FIGS. 2*a* and 2*b*) and in U.S. Pat. No. 6,311,819 B1 (incorporated herein by reference in its entirety) a variety of currency characteristics can be measured using magnetic, optical, electrical conductivity, capacitive, and mechanical sensing. Exemplary scanheads are illustrated in FIGS. 13-16 of U.S. Pat. No. 6,311,819 B1.

Figure 6:
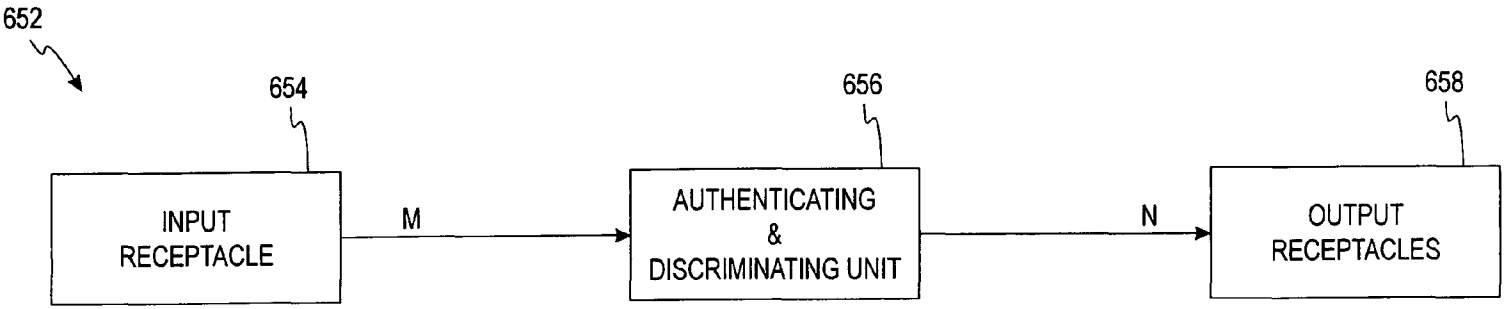
FIG. 6 is a functional block diagram illustrating a document authenticator and discriminator according to one embodiment.

Turning now to FIG. 6, there is shown a functional block diagram illustrating an embodiment of a document authenticator and discriminator according to the present invention. The discriminator system 652 comprises an input receptacle 654 for receiving a stack of currency bills. A transport mechanism defining a transport path (as represented by arrow M) transports the bills in the input receptacle, one at a time, past one or more sensors of an authenticating and discriminating unit 656. Bills are then transported to one of a plurality of output receptacles 658 (arrow N). The system 652 may correspond, for example, to the discriminators described above having multiple output pockets such as those shown in FIGS. 1*a*-1*g*, 4*a*-4*c*, and 5*a*-5*c*. According to some embodiments, the authenticating and discriminating unit scans and determines the denomination of each passing bill. Any variety of discriminating techniques may be used. For example, the discriminating method disclosed in U.S. Pat. No. 5,295,196 (incorporated by reference herein in its entirety) may be employed to optically scan each bill. In addition to determining the denomination of each scanned bill, the authenticating and discriminating unit 656 may additionally or alternatively include various authenticating tests. Additional details of FIG. 6 are described in U.S. Pat. No. 6,311,819 B1 (incorporated by reference above).

Signals from the authenticating and discriminating unit 656 are sent to a signal processor such as a central processor unit ("CPU"). The CPU records the results of the authenticating and discriminating tests in a memory. When the authenticating and discriminating unit 656 is able to confirm the genuineness and denomination of a bill, the value of the bill is added to a total value counter in memory that keeps track of the total value of the stack of bills that were inserted in the input receptacle 654 and scanned by the authenticating and discriminating unit 656. Additionally, depending on the mode of operation of the discriminator system 652, counters associated with one or more denominations may be maintained in the memory. For example, a $1 counter may be maintained to record how many $1 bills were scanned by the authenticating and discriminating unit 656. Likewise, a $5 counter may be maintained to record how many $5 bills were scanned, and so on. In an operating mode where individual denomination counters are maintained, the total value of the scanned bills may be determined without maintaining a separate total value counter. The total value of the scanned bills and/or the number of each individual denomination may be displayed on a display such as a monitor or LCD display.

Figure 7:
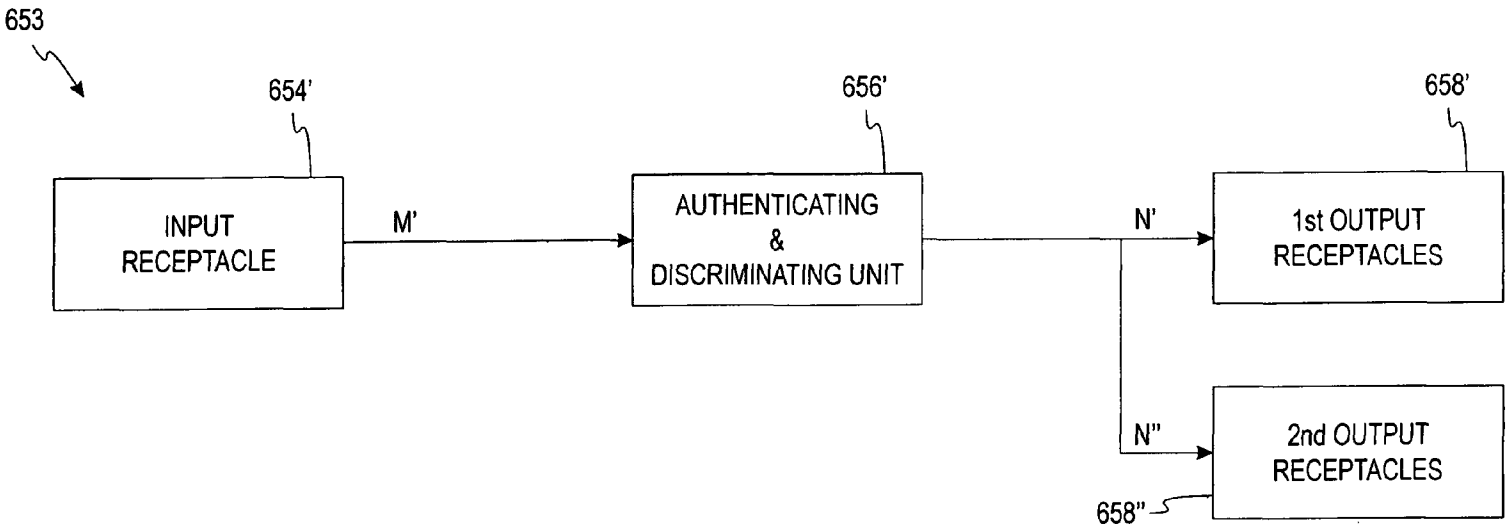
FIG. 7 is a functional block diagram illustrating a two-pocket document authenticator and discriminator according to one embodiment.

Turning now to FIG. 7, there is shown a functional block diagram illustrating a two-pocket document authenticator and discriminator according to one embodiment of the present invention. The discriminator system 653 comprises an input receptacle 654' for receiving a stack of currency bills. A transport mechanism defining a transport path (as represented by arrow M') transports the bills in the input receptacle, one at a time, past one or more sensors of an authenticating and discriminating unit 656'. Bills are then transported to one of two output receptacles 658', 658" (as represented by arrows N', N"). The system 653 may correspond, for example, to the discriminators described above having two output pockets such as those shown in FIGS. 4*a*-4*c*.

Additional details various modes of operating of multiple output receptacle evaluating devices such as shown in FIGS. 4-7 are described in U.S. Pat. No. 6,311,819 B1 (incorporated by reference above).

In general, some embodiments of the present invention comprise strapping systems comprising one or more strapping units in combination with a document or currency evaluating device comprising an input receptacle, a document or currency evaluating unit or region, and an output receptacle or a plurality of output receptacles. In some embodiment, a currency evaluating unit may be adapted to discriminate the denomination of processed bills and/or to authenticate processed bills. The evaluating device is adapted to count the number of documents or bills transported into each pocket. Accordingly to some embodiments, the device is adapted to stop transporting additional documents or bills into a particular output receptacle once the number of documents or bills has reached a strap limit. At that point, the stack of bills in an output receptacle which has reached a strap limit may be strapped by a strapping unit. According to various embodiments, such strapping systems transport, denominate and/or authenticate, and divert bills to one of the output pockets at speeds equal to or greater than 600 documents per minute. According to another embodiment, such systems transport, denominate and/or authenticate, and divert bills to one of the output pockets at speeds equal to or greater than 800 documents per minute. According to another embodiment, such systems transport, denominate and/or authenticate, and divert bills to one of the output pockets at speeds equal to or greater than 1000 documents per minute. The devices described in connection with FIGS. 1-7 may be employed in conjunction with the various strapping systems described including those adapted to transport, denominate and/or authenticate, and divert bills to the output pockets at speeds equal to or greater than 600, 800, 1000, 1200, and/or 1500 documents or bills per minute.

While many of the above embodiments have been described in conjunction with U.S. currency, systems according to the present invention may alternatively or additionally process currency of other countries such as the Euro, United Kingdom, France, Germany, Japan, Spain, Canada, Italy, Brazil, Mexico, Taiwan, and Saudi Arabia. Likewise, the above systems may support the processing of multiple types of documents including, for example, checks, deposit slips, header documents, etc.

Additionally, the systems described above may contain fitness sensors such as density sensors, reflectance sensors, magnetic sensors, correlation, UV and soil sensors, tear detectors, etc. Also the systems may utilize flash memory as mentioned above and $E^2$ proms for reliable storage of data and set ups.

Additionally, the systems described above may contain unique customization features such as user-defined keys, user-defined print outs, user-defined modes of operation, user-defined document distribution parameters, user-defined set-ups. The customization features may be controlled or changed through simple input though an interface device such as a keyboard or touch screen which are described in more detail in U.S. Pat. No. 6,311,819 B1 (incorporated by reference above).

Now various embodiments of dynamic sorting or assignment methods are described in more detail in conjunction with FIGS. 8-16. The dynamic sorting methods may be used in conjunction with the various devices described above such as those illustrated in and described in conjunction with FIGS. 1*a*-1*g*, 4*a*-4*c*, 5*a*-5*c*, 6, and 7.

Generally a Dynamic Assignment is a quick evaluating method that allows a multi-pocket currency evaluating device, such as the Cummins Multi-Pocket Sorter or variations of the Cummins Multi-Pocket Sorter, to automatically assign a denomination to an "open pocket," which is a pocket that has not had a denomination assigned thereto and which has no currency in it. Exemplary evaluating devices compatible with the invention are described in commonly-owned, U.S. Pat. No. 6,460,705, incorporated herein by reference in its entirety, which may be employed in conjunction with the present invention. Likewise, examples of multi-pocket sorters ("MPS") are illustrated in FIGS. 1*a*-1*g*, 4*a*-4*c*, 5*a*-5*c*, 6, and 7.

Embodiments of the Dynamic Assignment method provide fast and efficient results when processing mixed denomination currency. Some embodiments of Dynamic Assignment methods allow the highest volume denominations to be dynamically assigned to the open pockets, and therefore the evaluating device can keep evaluating currency as long as open pockets are available even though one or more pockets has reached its currency bill limit. After all the pockets have been taken (i.e., no open pockets are available) the evaluating device can operate as long as the currency bills being evaluated have the same denominations as the currency bills that have already been evaluated and that are residing in output pockets in which the stack limit has not been reached. Also, after a dynamic pocket is emptied and is open again, a new denomination can be assigned to that pocket. In general, without a dynamic assignment the evaluating device would stop when a pocket or pockets with a fixed assigned denomination reaches a limit.

According to some embodiments a multi-pocket currency discriminator may be provided in which all pockets are fixed pockets but which permit an operator the option to assign more than one pocket for a particular denomination. Such embodiments present at least two problems. One problem is that the assignment of other pockets to one denomination is done at the expense of pockets for other denominations. Another problem is that the operator must anticipate approximately how many currency bills of a particular denomination exist in the batch of currency bills requiring evaluating. Dynamic Assignment operation greatly reduces these and other problems. Furthermore, dynamic parameters, those parameters on which dynamic assignment is made, are not limited to denomination. Other predetermined parameters may be used as dynamic parameters to determine to which pockets currency bills will be delivered, e.g., country, orientation, size, authenticity characteristic, and others, and any combination of parameters may be applied to the currency bills.

Figure 8:
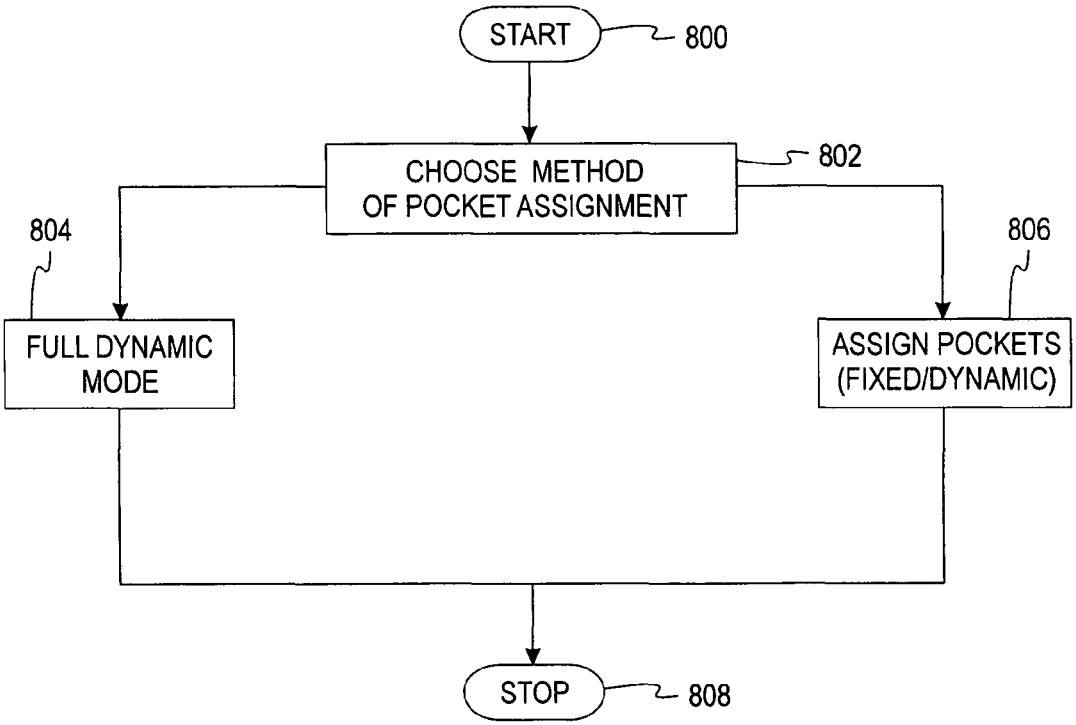
FIG. 8 illustrates a flowchart for making parameter assignments to pockets such as denomination parameter assignments according to one embodiment.

Referring to FIG. 8, FIG. 8 illustrates a flowchart for making parameter assignments to pockets such as denomination parameter assignments. Such parameters assignments may be made in a setup mode. The process begins at step 800 and the currency evaluation device prompts the operator to choose a method of assignment (802). The currency evaluation device may contain a user interface to provide information to and receive information from an operator of the device. The operator can choose full dynamic assignment (804) or make individual assignment decisions (806) about individual pockets or output receptacles. Once the pocket assignment procedure has been completed, the process ends (808).

By selecting full dynamic assignment (804) all pockets (or all available pockets) are designated to be dynamic pockets. Embodiments of dynamic pockets will be described in more detail below but generally a dynamic pocket is a pocket which can be assigned to a particular denomination or sorting parameter during normal operation of a currency evaluation device, that is, a denomination or other parameter assignment can be made on-the-fly. For example, a dynamic pocket may be a pocket that does not have a specific denomination preassigned to it in which case the evaluating device automatically assigns a denomination to a particular dynamic pocket on-the-fly. After a dynamic pocket has been assigned a denomination the dynamic pocket becomes "temporarily" a fixed pocket, accepting only currency bills of the same denomination as the automatically assigned denomination until the pocket has been cleared so that it becomes once again an open pocket. When the dynamic pocket becomes an open pocket the evaluating device will automatically assign another denomination to the dynamic pocket, as needed, which could be the same or different than the previous denomination that was assigned to the dynamic pocket.

Figure 9:
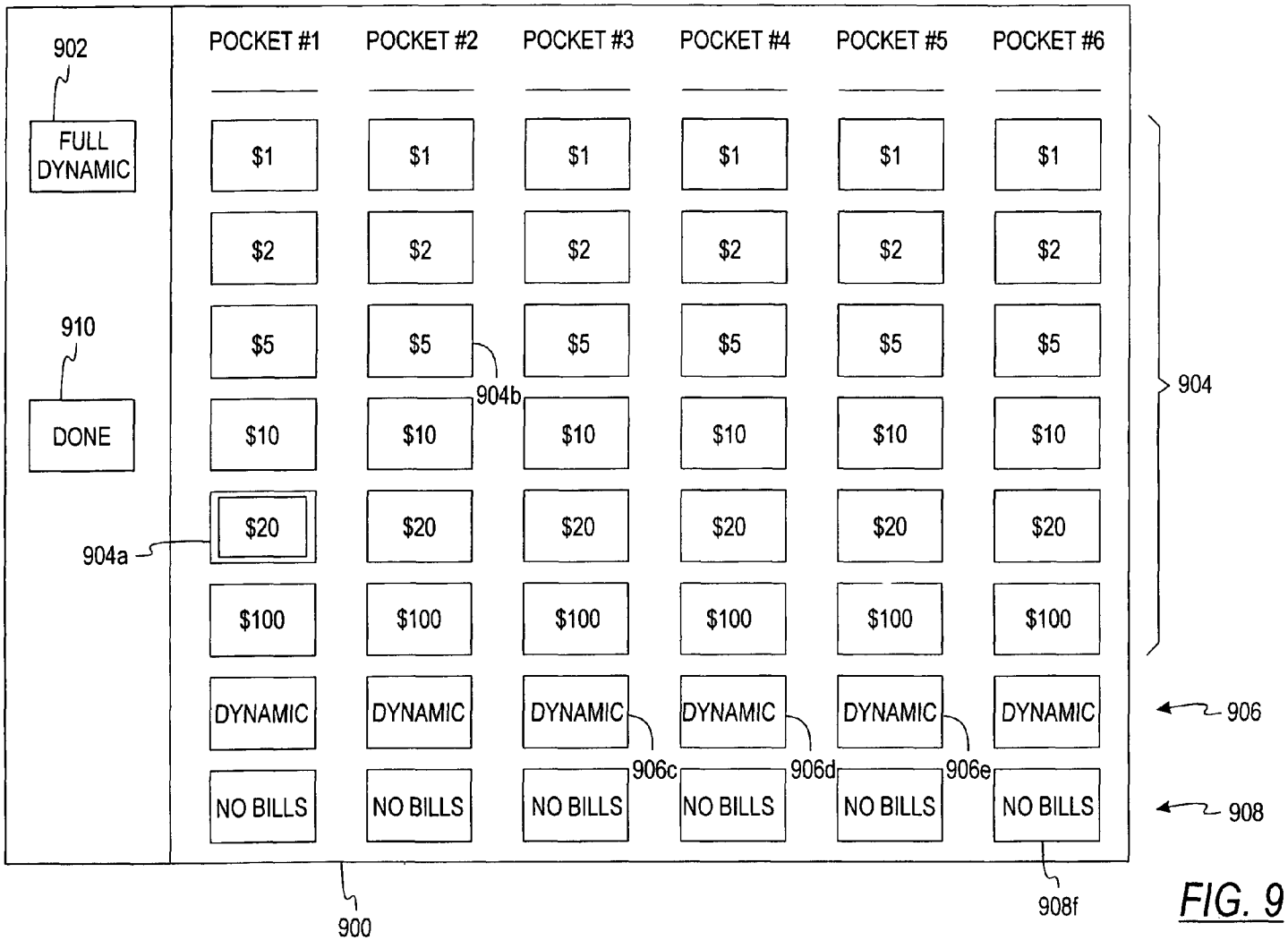
FIG. 9 illustrates one embodiment of a user interface.

The process of making pocket assignment is discussed in more detail in conjunction with FIG. 9 which illustrates one embodiment of a user interface 900. Any of a variety of user interfaces may be utilized. For example, the user interface 900 may be a touch screen, a combination of a display and physical selection elements such as physical keys, buttons, or switches, or may comprise a touch screen and a non-touch display and/or physical keys, buttons or switches. In some embodiments, a touch screen, a non-touch screen display, and/or physical selection elements are mounted directly on the currency evaluation device. In other embodiments, a touch screen, a non-touch screen display, and/or physical selection elements may be physically separate from the currency evaluation device. For example, the display (touch screen or non-touch screen) may be mounted directly on the currency evaluation device and a separate keyboard may be electrically coupled to the currency evaluation device. Likewise the interface may comprise lights and/or buzzers to communicate information to an operator.

The user interface 900 illustrated in FIG. 9 comprises a number of selection elements such as a full dynamic selection element 902, a plurality of denomination assignment selection elements 904, a plurality of dynamic assignment selection elements 906, a plurality of "no bills" assignment selection elements 908 and a "done" selection element (910). As discussed above, the selection elements may be either physical selection elements or displayed selection elements on a touch screen. For example, user interface 900 may be a touch screen and the selection elements may be displayed keys which can be touched to make various selections.

The user interface 900 is provided with means for an operator to make different parameter assignments for a plurality of output receptacles. In the example shown in FIG. 9, the operator is permitted to designate assignments for six output receptacles, which may correspond, for example, to pockets 116*a*-116*f* of the currency evaluation device 100 illustrated in FIG. 1*a* or the output pockets illustrated in FIG. 1*c* or 1*d*.

A method of indicating pockets assignments will now be discussed in conjunction with FIG. 9. If the operator wishes to make all pockets dynamic pockets, the operator may simply select the full dynamic selection element 902. Alternatively, the operator may achieve the same result by selecting all the dynamic selection elements 906. Of course, full dynamic selection element 902 may be omitted in some embodiments in which case a full dynamic assignment may be made by selection all the dynamic selection elements 906.

The operator may make a pocket a fixed pocket by selecting an appropriate one of the denomination selection elements 904. For example, the interface permits the operator to make Pocket #1 a $20 bill fixed pocket by selecting selection element 904*a*. When selection element 904*a* has been selected, the operation of the currency evaluation device is controlled, for example, by a processor so that only $20 bills may be transported into Pocket #1. If the operator wishes to assign the $5 denomination to Pocket #2, selection element 904*b* may be selected. Likewise, if the operator desires to designate Pockets #3-#5 dynamic pockets, then selection elements 906*c*-906*e* may be selected. Finally, if the operator desires to turn off Pocket #6 so that no bills are transported into Pocket #6 during normal operation, the operator may select selection element 908*f*. Of course, the option to turn off a pocket may be omitted in some embodiments in which case selection elements 908 may be omitted. In some embodiments, the currency evaluation device may be adapted to automatically turn off one or more of its pockets. This may be done, for example, by disabling the selection elements associated with a particular pocket such as the column of selection elements associated with a non-functional pocket. For example, if a stacking unit in one of the pockets breaks, the device, e.g., via the control of a processor, may turn off that pocket. Such embodiments have the advantage of permitting the currency evaluation device to continue operating using the other, functional output receptacles even when one or more of the pockets become non-functional. This has the advantage of minimizing any interruption of the normal work of a business using the currency evaluation device during the time it takes to get a non-functional pocket repaired.

It is apparent that the user interface 900 of FIG. 9 permits the operator of a currency evaluation device complete flexibility in making pocket assignments. For example, the operator may choose to make all pockets (or all functional pockets) dynamic pockets (e.g., via selection element 902 or selection elements 906)—such an assignment choice is called a full dynamic assignment. Alternatively, the operator may choose to assign fixed denominations to all pockets (or all available pockets) (e.g., via choosing from selection elements 904 and not any of the individual dynamic selection elements 906)—such an assignment is called a full fixed assignment. Alternatively, the operator may make some pockets fixed while making others dynamic (e.g., via choosing some denomination selection elements 904 and some individual dynamic selection elements 906)—such an assignment is called a dynamic-fixed combination assignment or dynamic-fixed assignment. An example of a fixed-dynamic combination assignment is illustrated in FIG. 12, described in more detail below.

In a "Fixed Assignment" each output pocket, such as output receptacles 106*c*-106*h* shown in FIGS. 1*a*-1*b*, is designated as a fixed pocket which means that the pocket is "fixed" to accept only an operator assigned denomination. Of course, the operator may choose at a later time to change the denomination that is assigned to that particular pocket. The operator may also choose at a later time to change a fixed pocket to a dynamic pocket. However, if the operator chooses to change the denomination that is assigned to a particular pocket without changing any of the fixed pockets to dynamic pockets, the pocket will still be a "fixed" pocket, the only difference being that the denomination that the pocket is "fixed" to accept has changed. For example, each pocket can be assigned one bill denomination: pocket 1 is assigned a $1 denomination, pocket 2 is assigned a $5 denomination, pocket 3 is assigned a $10 denomination, pocket 4 is assigned a $20 denomination, pocket 5 is assigned a $50 denomination, and pocket 6 is assigned a $100 denomination. Accordingly each respective pocket will only accept the particular denomination that it has been assigned. Therefore, if any one pocket becomes full then the evaluating device will stop when another bill having the denomination assigned to the full pocket is encountered, even if there is one or more empty pockets.

Alternatively, the operator may fix the pockets according to any combination that the operator desires. For example, assuming that the operator may know that $1 currency bills comprise 50 percent or more of the currency stack requiring evaluation, then the operator may fix half of the evaluating device's pockets, which would be three pockets according to the previous example, to receive $1 bills. The three pockets assigned to receive $1 bills can be any of the pockets of the evaluating device.

A "Dynamic-Fixed Assignment" is a hybrid assignment that combines the "Full Dynamic Assignment" and the "Fixed Assignment" into one. Some of the evaluating device's pockets will be selected to be dynamic pockets while others will be fixed pockets. The dynamic pockets will operate according to the "Dynamic Assignment" described above and the fixed pockets will operate according to the "Fixed Assignment" described above. In the "Dynamic-Fixed Assignment" the operator can be given a choice to select preprogrammed alternatives as far as which pockets will be fixed pockets, which will be dynamic pockets, which denomination or denominations will be dynamically assigned, which denomination or denominations will be fixed, and which denomination or denominations will be fixed to which pocket. Alternatively, the operator may be able to fully customize the pocket assignment.

Additionally, in some embodiments of a Dynamic-Fixed Assignment open dynamic pockets may not be accessible to bills having denominations fixed to one or more pockets. For example, if Pocket #1 is fixed to $1 bills and Pockets 2-6 are dynamic pockets and the first 101 bills are $1 bills, the device will stop operating upon the detection of the $101^{st}$ $1 bill (assuming a stack limit of 100). The device stops even though pockets 2-6 are open dynamic pockets. Likewise, if Pockets 1 and 2 are both fixed to $1 bills, in the above example, the device may continue operating until the detection of the $201^{st}$ $1 (assuming Pocket 1 was not cleared after becoming full).

Alternatively, in some embodiments of a Dynamic-Fixed Assignment open dynamic pockets may be indicated (e.g., via a user interface) to be accessible to bills having denominations fixed to one or more pockets. According to such an embodiment and using the example for above, if Pocket #1 is fixed to $1 bills and Pockets 2-6 are dynamic pockets and the first 101 bills are $1 bills, the device will not stop operating upon the detection of the $101^{st}$ $1 bill (assuming a stack limit of 100). Rather the $101^{st}$ $1 bill may be dynamically assigned to Pocket #2.

As discussed above, according to some embodiments, the currency evaluation device may be programmed to permit the operator to choose one of three different ways of assignment: a "Full Dynamic Assignment", a "Dynamic-Fixed Assignment", or a "Fixed Assignment". Means for selecting each way of assignment are provided in the evaluating device, such as a user interface such as a touch screen or other type of control panel. For example, a selection button may allow an operator to choose between "Full Dynamic," "Dynamic-Fixed," and "Fixed" Assignment. If the operator chooses either the "Dynamic-Fixed Assignment" or the "Fixed Assignment"), then the operator has to assign at least one denomination to at least one pocket. Means for assigning a denomination to a fixed pocket are provided in the evaluating device such as, for example, one or more assignment buttons which permit the assignment of a particular denomination to a particular pocket. Alternatively and/or additionally, other sorting criteria may be assigned to particular pockets, e.g., face orientation, country, etc.

Figure 10:
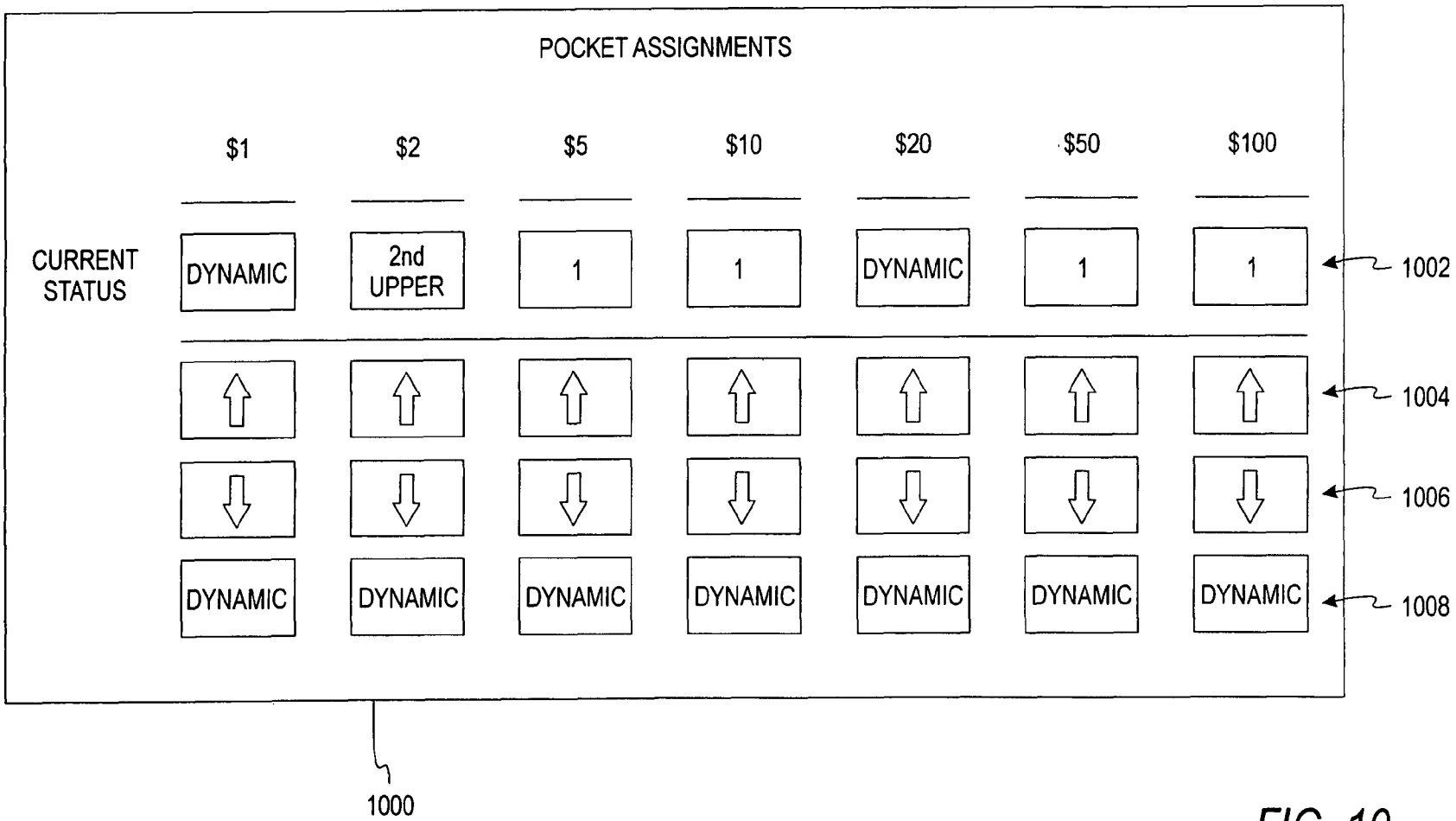
FIG. 10 illustrates an example of a user interface in which dynamic vs. fixed assignments are made on a per denomination basis according to one embodiment.

Additionally, according to some embodiments, a dynamic/fixed assignment can be made on a per denomination basis. FIG. 10 illustrates an example of a user interface 1000 in which dynamic vs. fixed assignments are made on a per denomination basis. The interface 1000 may be any type of interface as explained above, e.g., touch screen, non-touch screen display and physical selection elements, or a combination thereof. In the example illustrated in FIG. 10, a column is associated with each U.S. denomination. The current pocket assignment is displayed in row 1002. The current pocket assignment can be changed using scroll selection elements 1004 and 1006 or the dynamic selection elements 1008. Selection of a dynamic selection element 1008, designates a corresponding denomination as one that will be dynamically assigned to an available dynamic pocket. The scroll keys 1004 and 1006 may be used to scroll through pockets of the currency evaluation device. For example, in the case of the currency evaluation device shown in FIG. 1*a*, 1*c* or 1*d*, the scroll keys 1004 and 1006 may scroll through a list containing a "1$^{st}$ Upper Pocket" (e.g., 106*a*), a "2$^{nd}$ Upper Pocket" (e.g., 106*b*), a "1$^{st}$ Lower Pocket" or "1" (e.g., 106*c*), a "2$^{nd}$ Lower Pocket" or "2" (e.g., 106*d*), a "3$^{rd}$ Lower Pocket" or "3" (e.g., 106*e*), a "4$^{th}$ Lower Pocket" or "4" (e.g., 106*f*), a "5$^{th}$ Lower Pocket" or "5" (e.g., 106*g*), and a "6$^{th}$ Lower Pocket" or "6" (e.g., 106*h*). Of course, the exact appearance of the user interface 1000 may be modified in any number of ways. For example, "dynamic" could be added to the scroll list and the dynamic selection elements 1008 could then be omitted. Also, the scroll selection elements 1004 or 1006 could be replaced with a "Next" or "Change" selection element. Also, the interface may be adapted to permit a user to assign more than one fixed pocket to a denomination, e.g., the $5 denomination could be fixed to both lower Pockets #1 and #2.

In the example illustrated in FIG. 10, the $1 and $20 denominations are designated to be dynamic denominations, meaning that they can be dynamically assigned to any open dynamic pocket. The $2, $5, $10, $50, and $100 denominations are fixed denominations, meaning they are pre-assigned (via a setup mode) to one or more fixed pockets. In the illustrated case the $2 denomination is assigned to a 2$^{nd}$ Upper pocket (e.g., 106*b* in FIG. 1*a* or 1*c*) and the $5, $10, $50, and $100 denominations are assigned to the first lower pocket (e.g., 106*c* in FIG. 1*a* or 1*c*).

According to some embodiments, more than one denomination can be assigned to a given pocket. For example, as shown in FIG. 10, the first lower pocket is assigned to be a fixed pocket to which $5, $10, $50, and $100 bills are directed. Such an assignment scheme may be advantageous when few $5, $10, $50, and $100 bills are expected in a stack of bills to be processed and when many $1 and $20 bills are expected. By assigning low expected volume bill denominations to the same pocket, more pockets become available for dynamic sorting of high volume notes. In the example illustrated in FIG. 10 five lower pockets would be available for dynamic sorting (assuming the currency evaluation devices shown in FIG. 1*a*, 1*c* or 1*d* are being utilized). Assuming a stack of bills to be processed does contain mostly $1 and $20 bills, the operator would then be given more time to clear pockets which have become full (e.g., reached a strap limit) as there are more dynamic pockets available to accept subsequent $1 and $20 notes. As a result, the time during which the device must halt operation due to the lack of available pockets to receive bills can be reduced.

The currency evaluation device can be adapted to report a total for the value of bills contained in a pocket, the number of bills in a pocket, the number of bills per denomination in a pocket, and/or the value of bills per denomination in a pocket. Such reporting may be particularly useful when having a fixed pocket which is accepting more than one denomination.

According to some embodiments, some output receptacles may be excluded from the fixed, dynamic assignment scheme, for example, when a particular output pocket is designated to be an offsort pocket. For example, referring to FIGS. 1*a* and 1*b*, output receptacles 106*a* and 106*b* may be designated as offsort pockets, while output receptacles 106*c*-106*h* may be designated as dynamic pockets or fixed pockets. In another embodiment employing the currency evaluation device illustrated in FIG. 1*a*, 1*c* or 1*d*, one of the upper output receptacles 106*a* or 106*b*, is designated an offsort pocket (e.g., receives no calls, suspects), the other upper output receptacle 106*a* or 106*b* is a fixed pocket assigned to $2 denomination (i.e., receives bills determined to be $2 bills), while the lower output receptacles 106*c*-106*h* may be assigned to be fixed or dynamic pockets as described above in connection with FIG. 9.

In some embodiments, the operator is permitted to set stack limits for one or more of the output receptacles of a currency evaluation device. For example, the currency evaluation device according to some embodiments is provided with a user interface which permits the operator to assign stack limits to individual pockets, e.g., 100 bills for Pockets #1-#3 and 200 bills for Pockets #4-#6. Alternatively, the currency evaluation device according to some embodiments is provided with a user interface which permits the operator to assign stack limits to individual sorting parameters such as bill denomination. For example, a user interface may be provided which permits the operator to assign a stack limit of 100 bills to $1 and $5 denominations and a stack limit of 200 bills for $20 bills. An example of the stack limits stored in memory according to such an embodiment is illustrated in FIG. 11. In this way, regardless to which pocket(s) an individual denomination is assigned, an appropriate stack limit can be assigned. According to such embodiments it does not matter if $1 bills are initially set to Pocket #1 and then later assigned to Pocket #4. When the $1 denomination is assigned to a pocket that pocket will have to $1 stack limit associated therewith, e.g., 100 notes. Likewise, in the above example, if during operation Pocket #1 becomes reassigned from $1 bills to $20 bills, the stack limit for Pocket #1 will be changed from the $1 stack limit (e.g., 100 notes) to the $20 stack limit (e.g., 200 notes). A processor, for example, may keep track of individual denomination stack limits (e.g., by storing such limits in a memory) and pocket denomination assignments (e.g., that the $1 denomination has been assigned to Pocket #4). Alternatively, in some embodiments, the stack limits may not be user-definable but rather are predetermined by the manufacturer.

When a stack limit has not be designated, a particular pocket's pocket limit will apply. A pocket limit is the maximum number of bills a given pocket is adapted to accept. For example, a pocket may have a capacity or pocket limit of 250 notes. If $1 bills are assigned to that pocket and a strap limit of 100 notes has been assigned to $1 bills, then the pocket will be designated as full when the pocket contains 100 notes. However, if no strap limit has been set for $1 notes (and no strap limit has otherwise been set for the pocket), then the pocket will be designated as full when the pocket limit is reached, e.g., when pocket contains 250 notes.

FIG. 12 provides an example of the status of various assignments. Such information may be maintained in a memory under the control of a processor. Likewise such information may be communicated to the operator of the device such as via a display or printout. In the example illustrated in FIG. 12, Pocket #1 has been designated a fixed pocket which accepts $20 bills. The current stack limit associated with Pocket #1 is 200 notes. Pocket #1 is not an open pocket because it has been assigned to the $20 denomination. Pocket #1 is currently not full, meaning that fewer than 200 notes are contained in the pocket. It may or may not be empty.

Pockets #2-#5 have been designated to be dynamic pockets. Currently, no denomination has been assigned to Pocket #2 and thus its status is open (there are no bills in Pocket #2) and not full. There is currently no stack limit assigned to Pocket #2. Note that if a denomination later becomes to be assigned to Pocket #2 and the assigned denomination has an associated stack limit, that denomination stack limit would be assigned to Pocket #2. Pocket #3 has been dynamically assigned to $1 bills. There are currently 100 $1 bills in Pocket #3 as indicated by the full status and the stack limit of 100 notes. Because there are bills in dynamic Pocket #3, the pocket is not open. If Pocket #3 is cleared (that is the bills are removed), the pocket will again become open and non-full. Additionally, the stack limit may be cleared as would be the case if the stack limit currently assigned to Pocket #3 came to become assigned to Pocket #3 because $1 bills were dynamically assigned to Pocket #3 and $1 bills had a stack limit of 100 associated therewith.

Pocket #4 has been dynamically assigned to $5 bills and the current stack limit is 100. The stack limit of 100 for Pocket #4 may be associated with the assigned denomination as described above (e.g., $5 bills have been assigned a stack limit of 100 as shown in FIG. 11, and thus 100 note stack limit becomes associated with Pocket #4 when the $5 denomination is assigned to Pocket #4). Alternatively, in some embodiments stack limits may be assigned directly to individual pockets and remain the same regardless of which denominations become assigned thereto. Currently there are some $5 bills in Pocket #4 (open status=not open) but fewer than 100 notes (full status=non-full).

Pocket #5 has been dynamically assigned to the $1 denomination. As will be explained below, this would have occurred upon the processing of the $101^{st}$ $1 bill because after the $100^{th}$ $1 bill, Pocket #3 became full and thus unable to accept additional $1 bills. Pocket #5 is not an open dynamic pocket (open status=no) and the pocket is not full (full status=no).

Pocket #6 has been disabled (assignment status=no bills). Because the pocket has been disabled it is not an open pocket. In some embodiments it may be treated as a full pocket. In other embodiments, the full status of a disabled pocket is disregarded as the pocket is simply treated as being disabled. As described above, in some embodiments, the operator (via, e.g., a user interface) may be provided the option of turning a pocket off (disabled). Likewise in some embodiments a currency evaluation device may be programmed to automatically disable a pocket, for example, when a problem with the pocket is detected (e.g., through a self-diagnosis the currency evaluation device determines that the stacking wheel in Pocket #6 is not working properly and thus automatically disables Pocket #6 and provides any indication to the operator of the nature of the problem and/or the need to call for service).

Figure 13A:
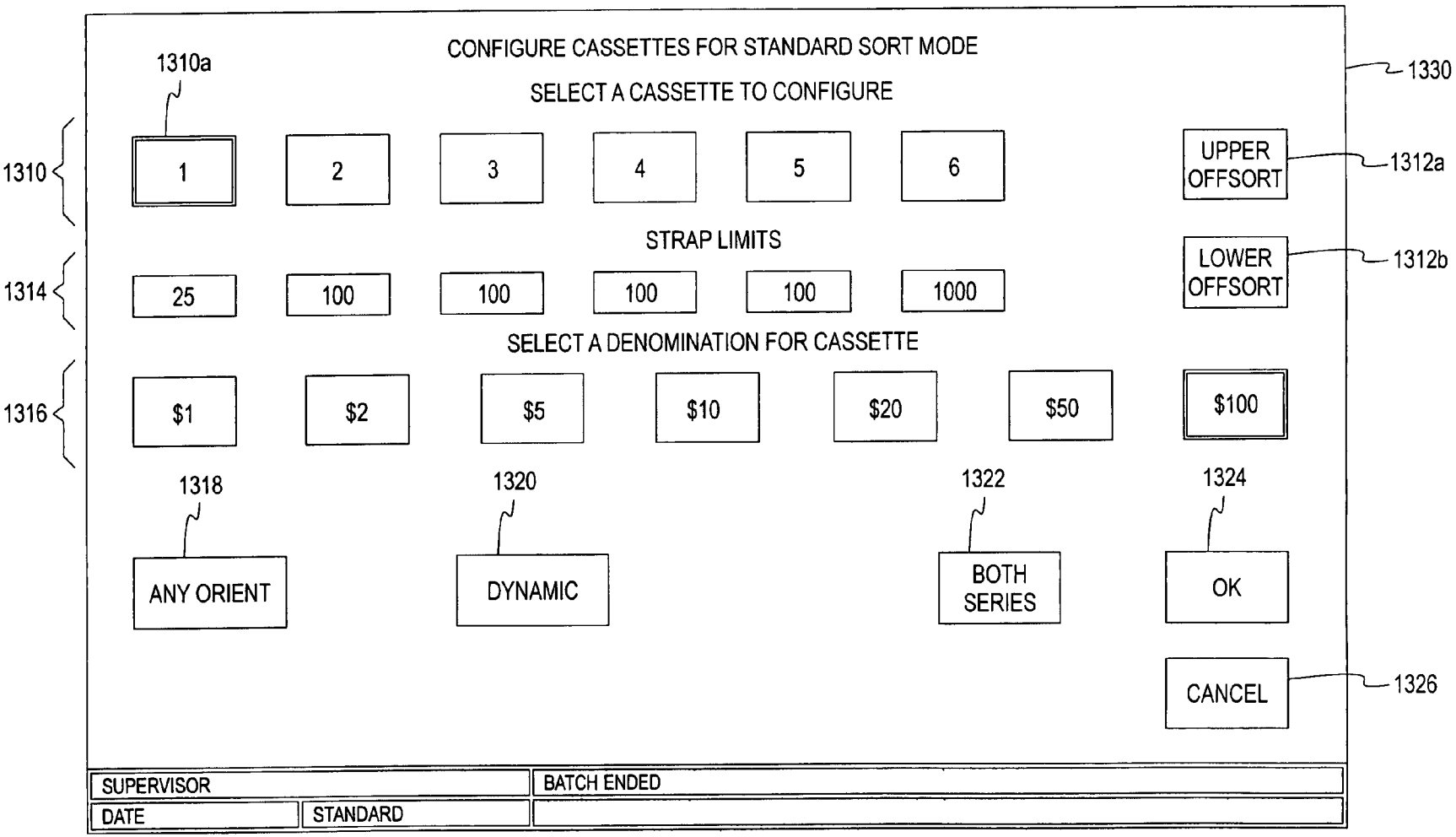
FIGS. 13*a* and 13*b* illustrate additional embodiments of user interfaces.
Figure 13B:
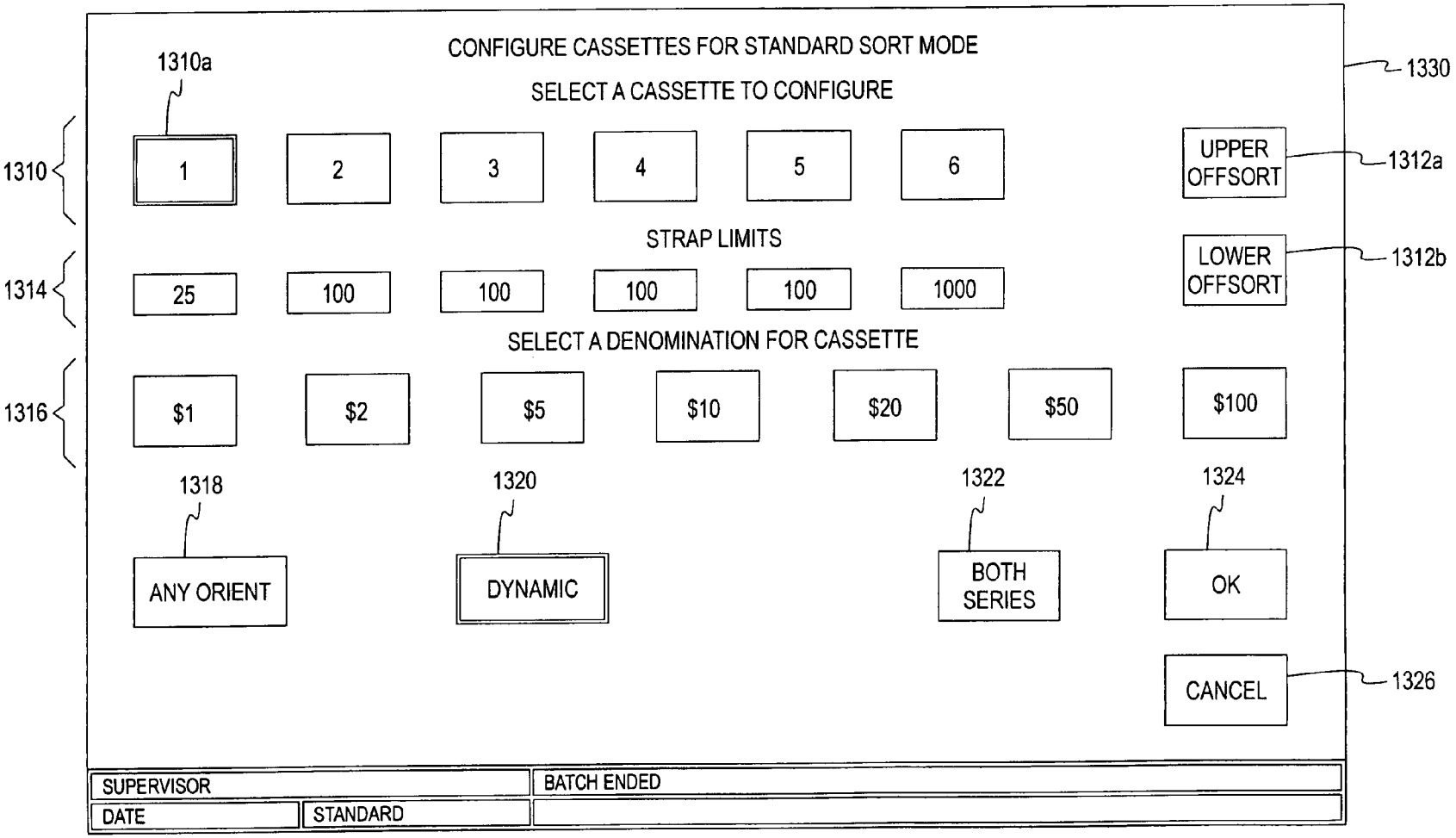

Referring to FIGS. 13*a* and 13*b*, these figures illustrate additional embodiments of user interfaces. In some embodiments the user interface 1330 comprises a touch screen. Of course, other variations could be utilized such as the physical keys or the combination of a display and physical keys. As illustrated in FIGS. 13*a* and 13*b*, the user interface 1330 comprises pocket selection elements 1310 and 1312*a* and 1312*b*, strap limit selection elements 1314, denomination selection elements 1316, an orientation selection element 1318, a dynamic selection element 1320, a series selection element 1322, an accept or OK selection element 1324 and a cancel selection element 1326. According to some embodiments, pocket selection elements 1310 labeled 1-6 may correspond to six main output receptacles such as pockets 106*c*-106*h* illustrated in FIGS. 1*a*-1*e*. According to some embodiments, pocket selection elements 1312*a* and 1312*b* labeled Upper Offsort and Lower Offsort may correspond with smaller output receptacles such as pockets 106*a*-106*b* illustrated in FIGS. 1*a*-1*e*.

To vary the characteristics or assignment criteria applicable to a particular output receptacle, an operator may select an appropriate pocket selection element 1310 or 1312. In FIGS. 13*a* and 13*b* Pocket #1 has been selected as indicated by the additional box surrounding pocket selection element 1310*a*. Of course, other methods may be used to indicate that a particular selection element has been selected such as the use of reverse-video or a change in color. In embodiments wherein the user interface 1330 is a touch screen, selection of a particular selection element can be achieved by the operator touching the touch screen in the vicinity of the displayed selection element icon.

Once a particular pocket has been selected, characteristics of the selected pocket may be varied. For example, a particular denomination may be assigned to a particular pocket by selecting one of the denomination selection elements 1316. Such a procedure would make the selected pocket a fixed pocket. As illustrated by the additional box about the $100 denomination selection element 1316, Pocket #1 in FIG. 13*a* has been assigned to the $100 denomination, thus making Pocket #1 a fixed pocket. Additional denominations may be assigned to pockets by selecting additional denomination selection elements. For example, in FIG. 13*a*, if the operator were to next touch the $50 key 1316, then both the $100 and the $50 denomination selection keys 1316 would be selected and Pocket #1 would be assigned to receive both $50 and $100 bills. The user interface may be adapted such that repeated touches to a denomination selection element 1316 toggles the denomination selection element on and off.

In FIG. 13*b*, Pocket #1 has been designated to be a dynamic pocket as indicated by the additional boxes about selection elements 1310*a* and 1320. Similar to the denomination selection elements 1316, dynamic selection element 1320 may be designed to toggle on and off with repeated touches.

Orientation criteria may be assigned to particular pockets via orientation selection element 1318. According to some embodiments, repeated touches of orientation selection element 1318 may cause the orientation selection to scroll through a number of orientation options such as Face-Up, Face-Down, Forward Orientation, Reverse Orientation, Face-Up & Forward Orientation, Face-Up & Reverse Orientation, Face-Down & Forward Orientation, Face-Down & Reverse Orientation, and/or Any Orientation. In FIG. 13*a*, Pocket #1 has been designated to receive $100 bills of any orientation. In FIG. 13*b*, Pocket #1 has been designed to receive bills of whatever particular denomination becomes dynamically assigned to the pocket without regard to orientation.

Similar to orientation selection element 1318, series selection element 1322 permits a user to assign a series sorting criteria to a pocket. According to some embodiments such as those adapted to process US currency bills, the user interface 1330 can be adapted such that repeated touches of series selection element 1322 causes the selected series to scroll through the options of Old Series, New Series, and Both Series. As indicated in FIGS. 13*a* and 13*b*, Both Series has been designated for Pocket #1.

Once the pockets have been configured as desired, the OK selection element 1324 may be selected such as by being touched or depressed. If the operator wishes to revert to the pocket configuration existing before he or she began modifying the configuration (for example, the configuration which existed before the user accessed the pocket configuration set up screen illustrated in FIGS. 13*a* and 13*b*), the user may select the Cancel selection element 1326.

Strap limit selection elements 1314 indicate the current strap limits assigned to corresponding pockets 1-6. In some embodiments, a strap limit may be adjusted by selecting a desired strap limit selection element 1314. For example, repeated touches may result in the scrolling through of preset strap limits, e.g., 1, 10, 25, 50, 100, 300, none. Alternatively, in some embodiments touching a strap limit selection element will bring up a separate "strap limit" touch screen which permits the adjustment of strap limits (e.g., by providing pre-set strap limit selection elements and/or increase/decrease (e.g., "+1" and "−1") selection elements.) According to some embodiments, such a "strap limit" touch screen may permit the adjustment of the limits for all pockets 1-6 regardless of which strap limit selection element 1314 was touched to cause the screen to change to the "strap limit" screen.

Particular denominations can also be assigned to offsort pockets such as pockets 106*a*-106*b* of FIGS. 1*a*-1*c*. For example, touching pocket selection element 1312*a* and the $50 denomination selection element 1316 would assign the $50 denomination to the corresponding output receptacle such as pocket 106*a* of FIGS. 1*a*-1*c*. Assignment of particular denominations (or bills satisfying designated sorting criteria) to one or more of the offsort pockets may be particularly advantageous wherein few bills of that denomination (or satisfying the designated criteria) are expected in a batch of bills to be processed. For example, if it anticipated that a large batch of bills is likely to contain few $50 and $2 bills, then the $50 and $2 denominations can be assigned to one or more of the offsort pockets. Having done so, available dynamic pockets will not be taken up by the occurrence of such low volume bills. Take, for example, a large bundle of bills containing only one $50 bill. Assume the first sixty bills are $20 bills followed by the single $50 bill. Also assume that pockets 1-6 are all dynamic pockets. Without assigning the $50 denomination to an offsort pocket, then upon encountering the $50 bill, it would be dynamically assigned to Pocket #2 (Pocket #1 having been assigned to $20 bills). Pocket #2 would then become unavailable for dynamic assignment for more frequently occurring bills. Assigning such low volume denominations (or other sorting criteria) to an offsort pocket would result in the dynamic pockets being available for assignment to higher volume notes which in turn would decrease the likelihood that the machine would have to halt because no dynamic pockets remain available for assignment when needed.

In addition to a denomination criteria, orientation and series criteria, and combinations thereof may be assigned to offsort pockets via selection elements 1312*a* and 1312*b*. According to some embodiments, no calls, suspects, and other error criteria bills such as bills meeting certain fitness determinations (e.g., unfit bills), chains and doubles may be assigned to the offsort pockets as well. Likewise, in a fully fixed mode of operation (i.e., all six main pockets have been assigned to less than all possible denominations or sorting parameter criteria), bills of non-assigned denominations or sorting parameter criteria may be routed to offsort pockets. For example, if Pockets 1-3 were fixed to be $1 pockets and Pockets 3-6 were fixed to be $20 pockets, then bills of the remaining denominations (i.e., $2, $5, $50, and $100) would be routed to an offsort pocket.

As an example of the assignment of a combination of sorting parameters to offsort pockets, via the pocket selection elements 1312*a* and 1312*b*, the $50 denomination selection element 1316, and the orientation selection element 1318, the operator may designate that face-up $50 bills go into a first or upper offsort pocket while face-down $50 bills go into a second or lower offsort pocket.

As another example, via selection elements 1312*a* and 1318, the user may assign all face-down bills to be routed to a first offsort pocket. Such a configuration may be particularly useful in a document evaluation device which does not have a bill turn-over mechanism. Accordingly, when processing a batch of bills, during an initial run, all acceptable face-up bills may be sorted into the various pockets 1-6 according to any of a variety of sorting criteria (e.g., by denomination). During the initial run, the first offsort pocket may be assigned to receive all acceptable face-down bills. A second offsort pocket may be programmed to accept any unacceptable bills (e.g., suspects, unfit bills). Then after the initial run, the operator may remove the acceptable but face-down bills from the first offsort pocket, re-orient them, place them back into the input receptacle, and re-start the device. The acceptable bills will then be oriented face-up and can be routed into the appropriate ones of Pockets 1-6. Of course, any of the other sorting criteria described in this application or combinations thereof may be used in place of face orientation in the above example. Likewise, while this example was described in connection with offsort pockets, main pockets could be programmed in a similar way as desired by an operator.

Figure 14:
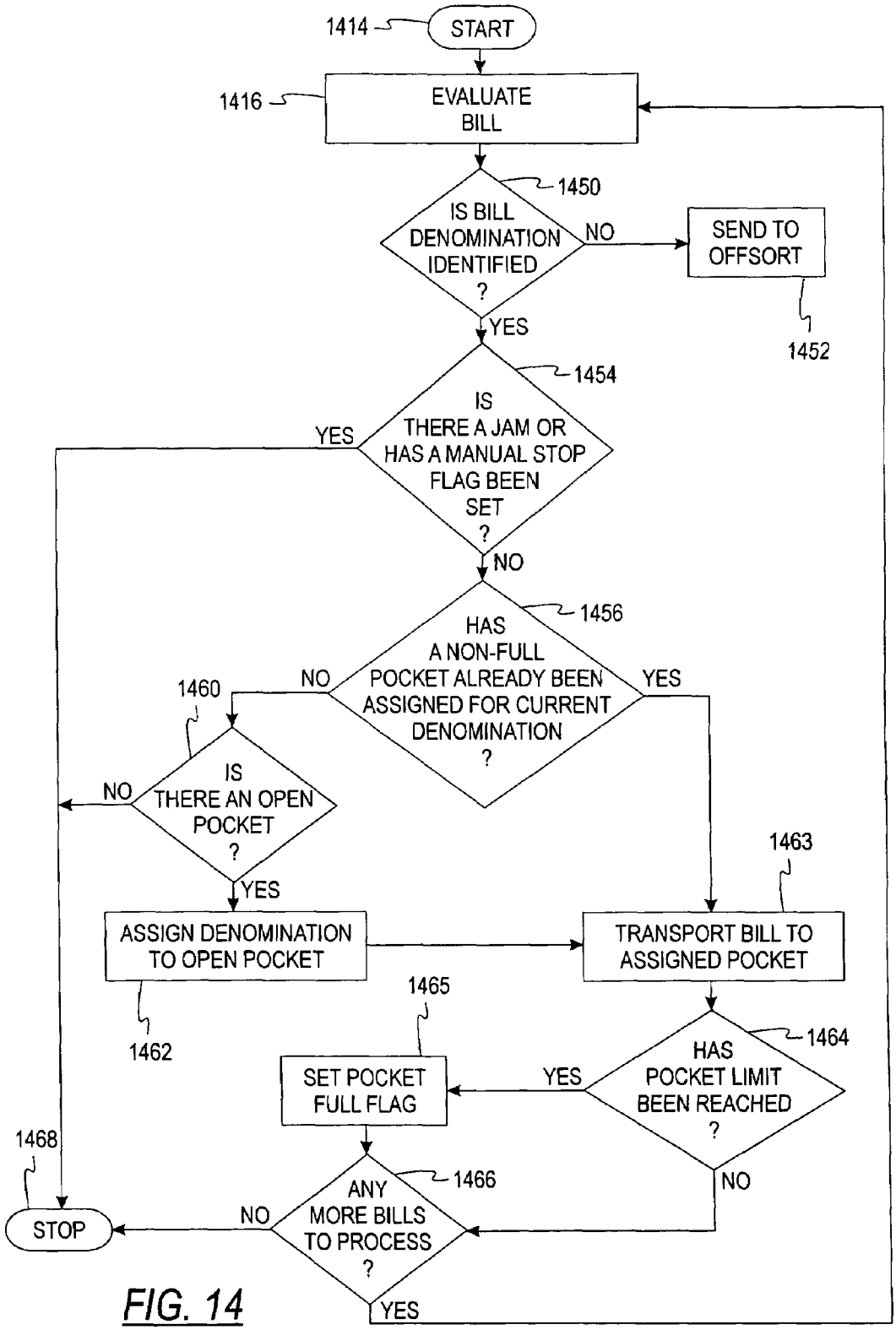
FIG. 14 is a flowchart illustrating steps performed when evaluating the denomination of currency bills pursuant to a Dynamic Sorting Assignment according to one embodiment.

Turning now to FIG. 14, a flowchart is provided illustrating steps performed when evaluating the denomination of currency bills pursuant to a Dynamic Sorting Assignment according to one embodiment of the present invention. This flowchart illustrates the steps performed during normal operation of a currency evaluation device wherein dynamic pockets have been assigned. The process starts at step 1414. Bills in an input receptacle of the currency evaluation device are fed one-by-one from the input receptacle and past a discrimination region containing one or more sensors.

At step 1416 the evaluating device evaluates a currency bill received from the input receptacle. At step 1416 a currency bill is evaluated according to at least one predetermined criterion, such as denomination, face orientation, forward/reverse orientation, and/or currency-type. An example of a predetermined criterion is the denomination of a U.S. currency bill.

A determination whether the denomination of a currency bill (or some other criterion, e.g., has the currency type/country, face orientation, and denomination) has been identified is made at step 1450. If the currency bill is not identified (e.g., in this present embodiment meaning denominated) then it is sent to an offsort pocket (step 1452), where the evaluating device has at least one offsort pocket, for example, output receptacle 106*a* which is shown in FIGS. 1*a* and 1*b*. If a bill has other problems, such as being a suspect bill, it may likewise be routed to an offsort pocket. However, if the currency bill is identified the process continues. In step 1454 an option is given to stop the process if a jam occurs or if an operator desires the process to stop. However, if a jam has not occurred and if the process is not manually stopped, then a determination is made at step 1456 whether the denomination of the current bill is the first of its kind, that is, whether a pocket has already been assigned to the denomination of the current bill. If a non-full pocket has already been assigned to the denomination of the current bill, the currency bill is transported to the assigned pocket (step 1463).

If at step 1456 a determination is made that the current denomination has not been assigned to a non-full pocket, then the next determination is whether an open pocket is available (step 1460). If an open pocket is not available, then the evaluation process ends (step 1468) and the evaluating device stops. However, if an open pocket is available, then the denomination of the currency bill is assigned to the open pocket (step 1462). If there is more than one open pocket then the evaluating device may choose arbitrarily or in a predetermined manner which open pocket to assign to the identified denomination. For example, if the evaluating device has six pockets numbered 1 through 6, then the evaluating device may be preprogrammed to select pocket 1 first, pocket 2 second, pocket 3 third, and so on. The priority of selecting open pockets may be preprogrammed, or be a customizable option that allows the operator to select the priority of pocket assignment.

Next, the currency bill is transported to the assigned pocket (step 1463) and a determination is made whether a stack limit (or in its absence a pocket limit) has now been reached (step 1464). If not, the process proceeds to step 1466 where the evaluating device checks to see if there are any more bills to process. If a limit has been reached at step 1464, then the evaluating device sets a flag that the pocket is full (step 1465) and proceeds to check to see if there are any more bills to process (step 1466). If the currency stack has been depleted the evaluation process ends (step 1468). However, if the currency stack has not been depleted, the evaluation process loops to step 1416 where it begins to evaluate the next currency bill from the input receptacle.

Although the evaluating procedure has been described in a particular order, it will be apparent to those of skill in the art that the order of the steps may be varied to suit different applications. Likewise not all steps are necessary in all embodiments. For example, the process of checking for jams or the presence of a manual stop flag may be carried out independently of the process detailed in FIG. 14. Likewise, in some embodiments the currency evaluation device may be programmed to stop upon the detection of a bill meeting a particular parameter such as a no call or suspect bill rather than offsorting the bill at step 1452. Means for reconciling no call and suspects bills and/or restarting the currency evaluation device are discussed in more detail in U.S. Pat. No. 5,790,697 incorporated herein by reference in its entirety.

Figure 15A:
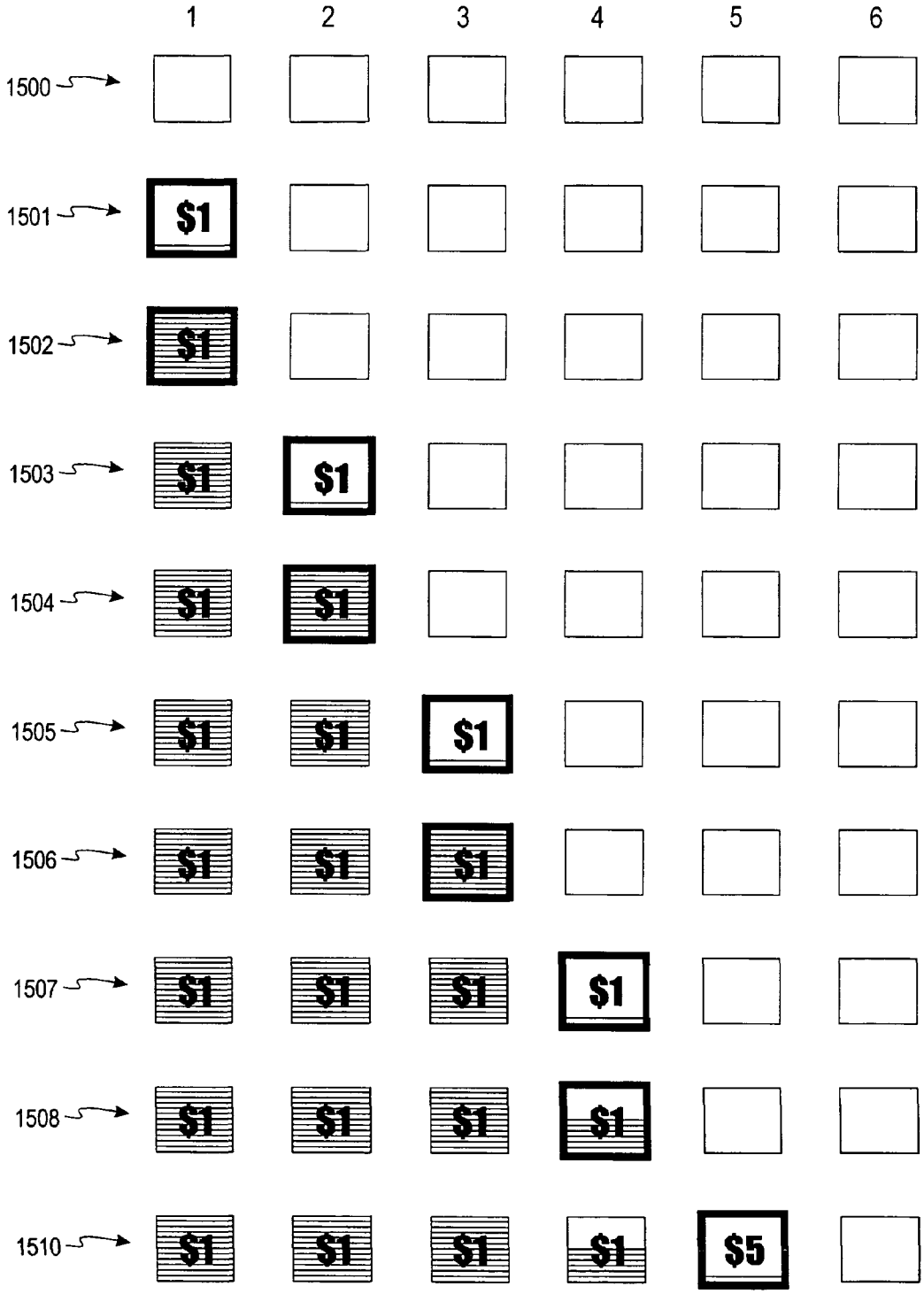
FIG. 15*a* is a functional diagram illustrating an example of evaluating currency bills pursuant to the Dynamic Sorting Assignment of FIG. 14.
Figure 15B:
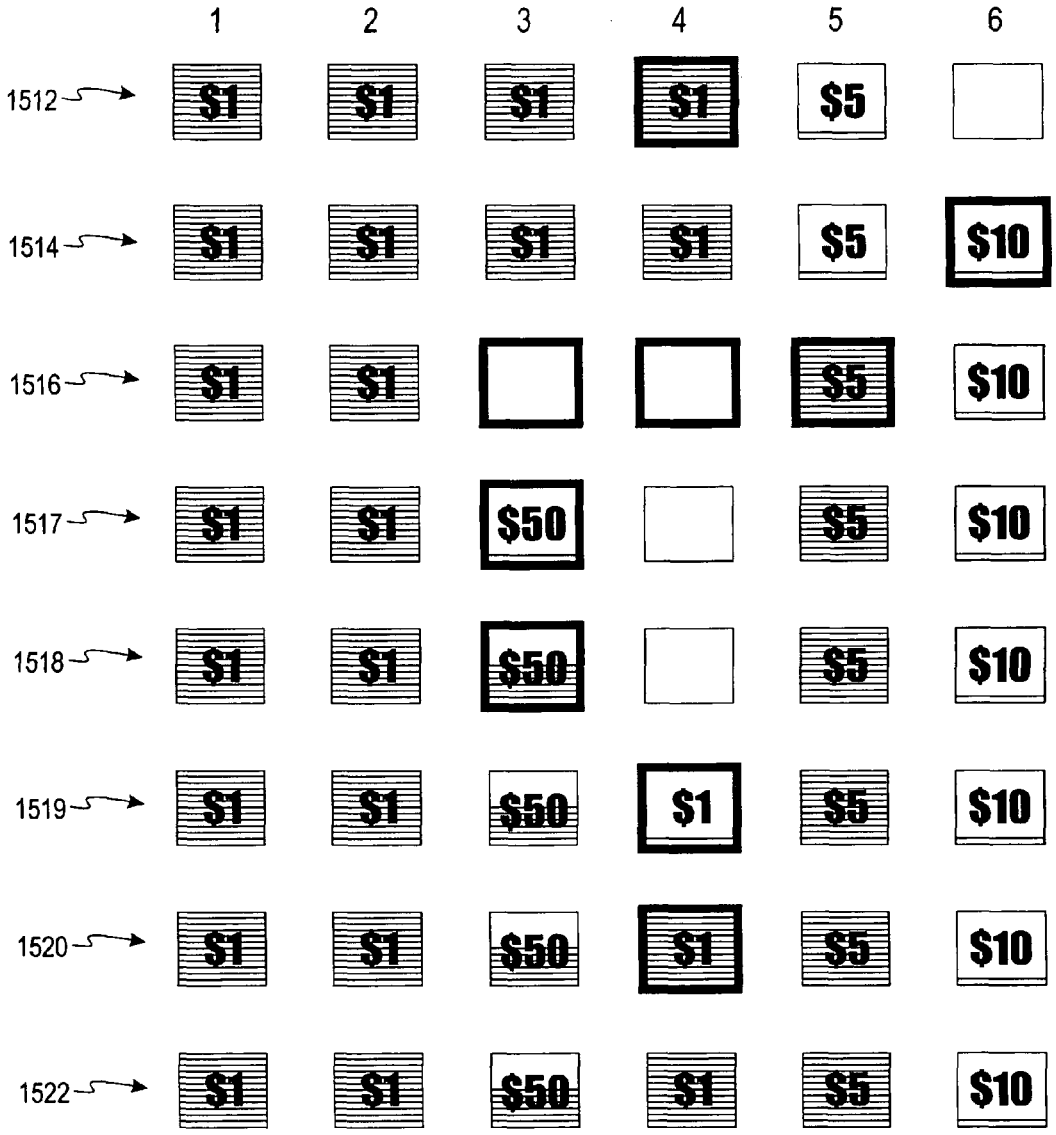
FIG. 15*b* is a continuation of FIG. 15*a*.

An example of a Dynamic Assignment method is illustrated in FIGS. 15*a*-15*b* for an evaluating device that has six output pockets, numbered 1 through 6. Each column represents a particular pocket, and each row represents a different stage in the evaluation process. A dark outline represents a change from the previous step, and the amount of shading inside a box represents the approximate number of currency bills in a particular pocket. Furthermore, the denomination assigned to a pocket is labeled on the particular pocket. Also, it is assumed that a strap limit of 100 has been assigned to each pocket and that the operator has selected the "Full Dynamic Assignment," meaning that each output pocket is designated as a dynamic pocket. After a stack of mixed denomination U.S. currency bills has been placed in the input receptacle, as described above, the evaluation process begins.

At step 1500 no currency bills have been evaluated yet. Therefore, all six pockets are represented as empty boxes. At step 1501, the evaluating device identifies the first bill as being a $1 bill. The evaluating device then assigns the $1 denomination to the first available pocket, which in this case is pocket 1, and transports the first bill to pocket 1. At step 1502, the evaluating device identifies the next 99 bills, bills 2-100, as also being $1 bills, and, therefore, the bills are transported to pocket 1. At this point pocket 1 is full because the limit of 100 has been reached, and it cannot accept any other bills until the pocket has been cleared such as by having an operator remove the currency bills from the pocket or other means for removing the bills from the output pocket such as being plunged into a cassette as described in connection with FIGS. 1-3 above and in co-pending U.S. patent application Ser. No. 09/502,666 filed Feb. 11, 2000 entitled "Currency Handling system Having Multiple Output Receptacles," now issued as U.S. Pat. No. 6,398,000 (each of which is incorporated herein by reference in its entirety) or such as the moving means described below in conjunction with the use of one or more strapping units (see e.g., FIGS. 17-33). Accordingly, the full status of pocket 1 is changed to yes. A processor may monitor the status of each output receptacle. According to some embodiments, when a pocket becomes full, the device may notify the operator that the pocket is full such as via a visual indication (e.g., the illumination of a light or LED or a message on a display interface such as a display screen) and/or an audible indication (e.g., a beep, audible message, etc.) When a non-empty pocket is emptied, the associated full flag is cleared as is any dynamic denomination assignment. Likewise, the processor may reset the open status flag to the "open" status.

At step 1503 the evaluating device identifies the next bill, bill 101, as being a $1 bill. Because pocket 1 has reached its limit and the currency stack has not been removed, the only available dynamic pockets for bill 101 are pockets 2-6. Assuming that pocket 2 has priority over pockets 3-6, the evaluating device then assigns the $1 denomination to pocket 2 and transports bill 101 to pocket 2. At step 1504 the evaluating device identifies the next 99 bills, bills 102-200, as also being $1 bills, and, therefore, the bills are transported to pocket 2. At this point pocket 2 is full because the limit of 100 has been reached, and it cannot accept any other bills until the pocket has been cleared (e.g., by having an operator or other means remove the currency bills from the pocket).

At step 1505 the evaluating device identifies the next bill, bill 201, as being a $1 bill. Because pockets 1 and 2 have reached their limit and because the currency stacks have not been removed from pockets 1 and 2, the only available dynamic pockets for bill 201 are pockets 3-6. Assuming that pocket 3 has priority over pockets 4-6, the evaluating device then assigns the $1 denomination to pocket 3 and transports bill 201 to pocket 3. At step 1506 the evaluating device identifies the next 99 bills, bills 202-300, as also being $1 bills, and, therefore, the bills are transported to pocket 3. At this point pocket 3 is full because the limit of 100 has been reached, and it cannot accept any other bills until the pocket has been cleared.

At step 1507 the evaluating device identifies the next bill, bill 301, as being a $1 bill. Because pockets 1-3 have reached their limit and because the currency stacks have not been removed from pockets 1-3, the only available dynamic pockets for bill 201 are pockets 4-6. Assuming that pocket 4 has priority over pockets 5-6, the evaluating device then assigns the $1 denomination to pocket 4 and transports bill 301 to pocket 4. At step 1508 the evaluating device identifies the next 49 bills, bills 302-350, as also being $1 bills and transports bills 302-350 to pocket 4. However, unlike pockets 1-3, pocket 4 has not reached its strap limit of 100, and therefore it can still accept up to 50 more currency bills that have the $1 denomination. At this point, pockets 1-3 have not been cleared and therefore they cannot accept any more currency bills, pocket 4 has been "temporarily" fixed or assigned to accept only $1 currency bills and it can accept only 50 more bills, and pockets 5 and 6 are open pockets that are available to accept any denomination.

At step 1510 the evaluating device identifies the next currency bill, bill 351, as being a $5 bill. Assuming that pocket 5 has priority over pocket 6, bill 351 is placed in pocket 5. Thus, pocket 5 has been "temporarily" fixed or assigned to accept only $5 bills until the pocket has been cleared. Also, because the limit is 100 pocket 5 can accept 99 more $5 bills. At this point the only remaining open pocket is pocket 6.

At step 1512 the evaluating device identifies the next 50 bills, bills 352-401, as being $1 bills. Although pocket 6 is an open pocket and it can obviously accept these bills, pocket 4 can still accept 50 $1 bills before its limit is reached. Therefore, bills 352-401 are placed in pocket 4. Thus, pocket 4 has now reached its limit by having a total of 100 $1 bills: bills 301-350 and bills 352-401.

At step 1514 the evaluating device identifies the next currency bill, bill 402, as being a $10 bill. The only open pocket is pocket 6 and, because no non-full pockets have a $10 bill, bill 402 is placed in pocket 6. At this point all the pockets have been "temporarily" fixed or assigned to a denomination, with pockets 1-4 being full because they reached their limit.

At step 1516 the evaluating device identifies the next 99 currency bills, bills 403-502, as being $5 bills. Pocket 5, having only 1 $5 bill, accepts bills 403-502. At this point pocket 5 has reached its limit. However, the currency bills from pockets 3 and 4 have been removed, clearing these pockets to become once again open pockets, as they were in steps 1500-1504. Therefore, pockets 3 and 4 are available to accept any denomination that may be identified in the currency stack from the input receptacle. If pockets 1 and 2 would have been cleared, then they also would have been available to receive additional currency bills.

At step 1517 the evaluating device identifies the next currency bill, bill 503, as being a $50 bill. Pocket 1, 2 and 5 are full and therefore not available to accept currency bills. Pocket 6 has been "temporarily" fixed or assigned to accept $10 bills. Pockets 3 and 4 are the only pockets available to accept the $50 bill. Therefore, bill 503 is assigned to pocket 3, under the continuing assumption that pocket 3 has priority over pocket 4. At step 1518 the evaluating device identifies the next 49 currency bills, bills 504-552, as being $50 bills. They are transported to pocket 3 which after step 1517 can still accept an additional 99 $50 bills before it reaches its limit. At this point 50 additional $50 bills may be placed in pocket 3, 100 bills of any one denomination may be placed in pocket 4, and 99 additional $10 bills may be placed in pocket 6.

At step 1519 the evaluating device identifies the next currency bill, bill 553, as being a $1 bill. From the above discussion it is clear that the only available pocket is pocket 4. Therefore, bill 553 is assigned to pocket 4. At step 1520 the evaluating device identifies the next 99 currency bills, bills 554-652, as being $1 bills. Because pocket 4 can still accept up to 99 more $1 bills before it reaches its limit, bills 553-652 are placed in pocket 4. At this point pocket 4 has reached its strap limit and, therefore, cannot accept any additional currency bills until it is cleared.

At step 1522 the evaluating device identifies the next currency bill, bill 653, as being a $20 bill. At this point none of the pockets are available to accept bill 653: pockets 1,2, 4, and 5 are full, pocket 3 is "temporarily" assigned to accept bills of the $50 denomination, and pocket 6 is "temporarily" assigned to accept bills of the $10 denomination. The evaluating device would temporarily stop at this point until at least one pocket is cleared. The evaluating device can be designed to restart automatically or upon the selection of a manual start button after at least one pocket has been cleared. However, as long as the operator continues to clear full pockets the evaluating device can continue to evaluate currency bills until the currency is depleted, unless the operator manually stops the machine or unless a jam occurs.

According to some embodiments, additional pockets such as the upper offsort pockets 106*a* and 106*b* of FIG. 1 can be used to accept bills when there are no open pockets available to accept a denominated bill such as in step 1522 discussed above. Using one or more offsort pockets could provide additional time for an operator to clear at least one pocket. A user interface of the device could warn the operator (e.g., audibly and/or visually as discussed above) that bills have been routed to one or more of the offsort pockets and when appropriate that one or more lower pockets are full and ready to be emptied. By using the offsort pockets in such a manner the need to stop the machine and the loss of time and efficiency resulting from the machine stopping and having to be restarted may be reduced.

Figure 16:
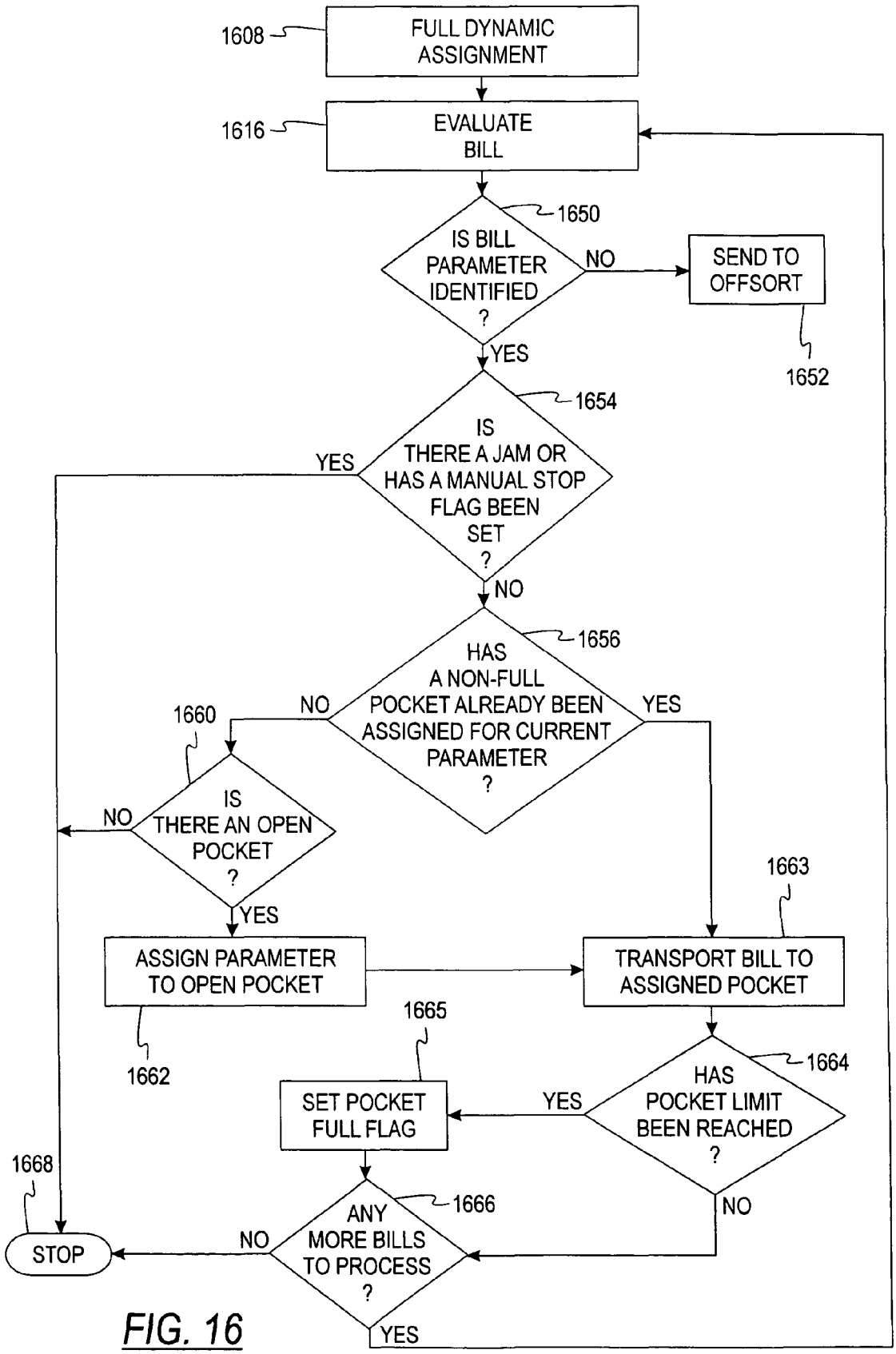
FIG. 16 is a flowchart illustrating steps performed when evaluating a parameter of currency bills pursuant to a Dynamic Sorting Assignment according to one embodiment.

Referring to FIG. 16, a detailed description of a "Full Dynamic Assignment" according to other embodiments is shown using any parameter of a currency bill, such as, for example, country of origin, face orientation, forward/reverse orientation, fitness, size, color, or shape. Examples of discriminating by denomination, face orientation, and/or face orientation are described in more detail in U.S. Pat. No. 5,815,592 incorporated herein by reference in its entirety. The method of the present embodiment of the invention is similar to the method described above in reference to FIG. 14, except that any parameter of currency bills may be used as an evaluating criteria. Additionally, although the description refers to "a parameter," any combination of parameters can be used in the evaluating process, including a bill denomination.

For example, bills may be pre-assigned (fixed) or dynamically assigned to pockets based on the combination of currency type/country of origin (e.g. Japanese yens, European euros, British pounds) and denomination. For example, each pocket (fixed or dynamic) can be limited to accept only bills having the same denomination and country of origin (e.g., Pocket 1 receives U.S. $20 bills, Pocket 2 receives 1000 ¥ notes, etc.). As another example, assignments may be based on the combination of denomination and face orientation and country type. For example, in a Full Dynamic Mode, if the first bill is a face down US $1, it may be routed to Pocket 1 and the combination of US face-down $1 bills is assigned to Pocket 1. If the next non-face-down-US-$1 is a face-up US $1 bill, the combination of face-up, US, and $1 may be dynamically assigned to Pocket 2 and bills meeting this combination will be routed to Pocket 2. The next new country/face orientation/denomination parameter combination would be assigned to the next open dynamic pocket (e.g., face-up US $20 bills). Take the following example stack of bills, all US bills: Bill #1=face-down $1, Bill #2=face-up $1 bill, Bill #3=face-down $1 bill, Bill #4=face-up $20 bill, and Bill #5=face-down $20. If dynamic sorting parameters are selected to be the combination of US country, face orientation, and denomination (or if the device is capable of recognizing only US bills and the sorting parameters are selected to be the combination of face orientation and denomination), then Bill #1 and #3 would be transported to Pocket 1 and Pocket 1 would be assigned the combination of face-down US $1 bills. Similarly, Bill #2 would be transported to Pocket 2 and Pocket 2 would be dynamically assigned to the combination of face-up US $1 bills. Bill #4 would be transported to Pocket 3 and Pocket 3 would be dynamically assigned to the combination of face-up US $20 bills. And Bill #5 would be transported to Pocket 4 and Pocket 4 would be dynamically assigned to the combination of face-down US $20 bills.

Sorting criteria can be defined in a set-up mode. For example, an operator may employ a user interface to indicate which sorting parameters should be detected and employed to sort currency bills into different output receptacles. As described above in conjunction with providing an operator flexibility of designating into which pockets bills of different denominations should be transported, the user interface in some embodiments provides similar flexibility with respect to a variety of sorting parameters (e.g., denomination, country of origin/issuing entity, face orientation, forward/reverse orientation, fitness, size, color, and combinations thereof). For example, the user interface may permit an operator to designate country of origin/issuing entity (e.g., US dollars, Canadian dollars, Japanese Yens, Euros, Disney Dollars, ABC Casino) as a dynamic sorting parameters. In a full dynamic mode, currency bills (or other types of documents such as substitute currency notes or currency notes) are separated into different output pockets by country of origin/issuing entity. Take for example a stack of 100 documents comprising twenty $5 US bills, twenty $50 US bills, twenty $50 Canadian bills, twenty $100 Canadian bills, and twenty 5000¥ Japanese Yens. In an example of a full dynamic mode embodiment in which sorting is based solely on country of origin, the forty US bills would be delivered to a first pocket, the forty Canadian bills would be delivered to a second pocket, and the twenty Japanese bills would be delivered to a third pocket.

As discussed above, multiple sorting parameters may be selected. Taking the example above of the 100 documents, in an embodiment wherein the operator designated sorting parameters to be country of origin and denomination, then the twenty $5 US bills would be delivered to one pocket, the twenty $50 US bills would be delivered to a second pocket, the twenty $50 Canadian bills would be delivered to a third pocket, the twenty $100 Canadian bills would be delivered to a fourth pocket, and the twenty 5000¥ Japanese Yens would be delivered to a fifth pocket. In a full dynamic mode, exactly to which pockets the individual combinations of country of origin and denomination would be assigned would depend on the order in which the bills were placed in the input receptacle and discriminated. For example, if the first 10 bills were 5000¥ Japanese Yens and the next two bills were $50 Canadian bills, and the next bill was a $50 US bill, then in one embodiment the 5000¥ Japanese Yen combination of parameters would be assigned to Pocket #1, the $50 Canadian bill combination of parameters would be assigned to Pocket #2, and the $50 US bill combination of parameters would be assigned to Pocket #3.

Likewise as described above in connection with the simple example of a sorting parameter of US denominations, the user interface in some embodiments is designed to permit the designation of one or more sorting parameters in a fixed assignment and a fixed-dynamic assignment. One example of such a fixed-dynamic assignment would be wherein the operator designates Pocket #1 as a fixed pocket to which the combination of US country and $20 is assigned, and Pockets #2-#6 are designated to be dynamic pockets wherein pocket assignments are dynamically made based on the discrimination of each bill's country of origin and denomination.

Returning to FIG. 16, the "Full Dynamic Assignment" begins by having an operator select the assignment at step 1608. The selection automatically selects all the output pockets to become dynamic pockets. In general, a pocket that is designated as an offsort pocket, which is used for collecting unidentified currency bills, may not be designated as a dynamic pocket. However, in some embodiments even a pocket normally designated as an offsort pocket may be redesignated as a dynamic pocket if the operator would so desire (in which case, the pocket would no longer be an offsort pocket). For example, referring to FIGS. 1*a* and 1*b*, output receptacles 106*a* and 106*b* may be designated as offsort pockets, while output receptacles 106*c*-106*h* may be designated as dynamic pockets. A dynamic pocket is a pocket that does not have a specific parameter or parameter combination pre-assigned to it. Rather, the evaluating device automatically assigns a parameter or parameter combination to a particular dynamic pocket on-the-fly, as will be described in more detail below. After a dynamic pocket has been assigned a parameter (parameter combination), the dynamic pocket becomes "temporarily" a fixed pocket, accepting only currency bills of the same parameter (parameter combination) as the automatically assigned parameter (parameter combination) until the pocket has been cleared so that it becomes once again an open pocket. When the dynamic pocket becomes an open pocket the evaluating device will automatically assign another parameter (parameter combination) to the dynamic pocket, as needed, which could be the same or different than the previous parameter (parameter combination) that was assigned to the dynamic pocket.

In step 1616 the evaluating device evaluates a currency bill. A determination whether the currency bill is identified is made at step 1650, that is, the whether the parameter(s) which serves as the basis of sorting can be determined. If the currency bill is not identified then it is sent to an offsort pocket (step 1652), where the evaluating device has at least one offsort pocket, for example, output receptacle 106*a* which is shown in FIGS. 1*a* and 1*b*. However, if the currency bill is identified, the process continues. According to some embodiments, in step 1654 the currency evaluation device determines whether the process should be stopped because a jam has occurred or an operator has selected a manual stop selection element. However, if a jam has not occurred and if the process is not manually stopped, then a determination is made at step 1656 whether the parameter of the current bill is the first of its kind, that is, whether a pocket has already been assigned to the parameter of the current bill.

If at step 1656 a determination is made that the current parameter has not been assigned to a non-full pocket, then the next determination is whether an open pocket is available (step 1660). If an open pocket is not available, then the evaluation process ends (step 1668) and the evaluating device stops. However, if an open pocket is available, then the parameter of the currency bill is assigned to the open pocket (step 1662). If there is more than one open pocket then the evaluating device may choose arbitrarily or in a predetermined manner which open pocket to assign to the identified parameter. For example, if the evaluating device has six pockets numbered 1 through 6, then the evaluating device may be preprogrammed to select pocket 1 first, pocket 2 second, pocket 3 third, and so on. The priority of selecting open pockets may be preprogrammed, or be a customizable option that allows the operator to select the priority of pocket assignment.

Next, the currency bill is transported to the assigned pocket (step 1663) and a determination is made whether the limit has now been reached (step 1664). If the limit has been reached then the evaluating device sets a flag that the pocket is full (step 1665) and then checks to see if there are any more bills to process (step 1666). If the limit has not been reached then the evaluating device checks to see if there are any more bills to process (step 1666). If the currency stack has been depleted the evaluation process ends (step 1668). However, if the currency stack has not been depleted, the evaluation process loops to step 1616 where it begins to evaluate the next currency bill from the input receptacle.

If at step 1656 a determination is made that the parameter of the current bill has been assigned to a non-full pocket, then the current bill is transported to the assigned pocket (step 1663). After transporting the current bill to the assigned pocket (step 1663), the procedure is the same as above starting with step 1664 and either stopping at step 1668 or looping back to step 1616.

Although the procedures above have been described in a particular order, it will be apparent to those of skill in the art that the order of the steps may be varied to suit different applications.

Although many of the above embodiments have been described in connection with a currency evaluation device having six or eight output receptacles, the number of output receptacles can be varied. For example, the above described dynamic assignment embodiments may be employed in conjunction with a currency evaluation device having fourteen output receptacles. Likewise the devices illustrated in FIGS. 1*a*-1*e* may be adapted to accommodate the modular addition of additional pockets such as modular units having one, two, or more output receptacles each. Such a modular scheme permits the addition of output receptacles in increments of one, two, or more receptacles so that the currency evaluation device may be expanded to accommodate the needs of a particular business or operator. See, e.g., the embodiments illustrated in FIGS. 1*f*-1*g*.

While the above techniques including the dynamic assignment, fixed assignment, and dynamic-fixed assignment embodiments have been discussed in terms of processing currency bills, other embodiments employ documents, "currency documents", "substitute currency media" such as casino script or Disney Dollars, "substitute currency notes", "currency notes" and/or "non-currency documents". Likewise barcoded documents such as barcoded currency documents and barcoded substitute currency media are also contemplated.

Strapping

Now various embodiments of strapping devices and methods are described in more detail in conjunction with FIGS. 17-39. The dynamic sorting methods may be used in conjunction with the various devices described above such as those illustrated in and described in conjunction with FIGS. 1*a*-1*g*, 4*a*-4*c*, 5*a*-5*c*, 6, and 7 and the dynamic sorting methods described above in connection with FIGS. 8-16.

Figure 17:
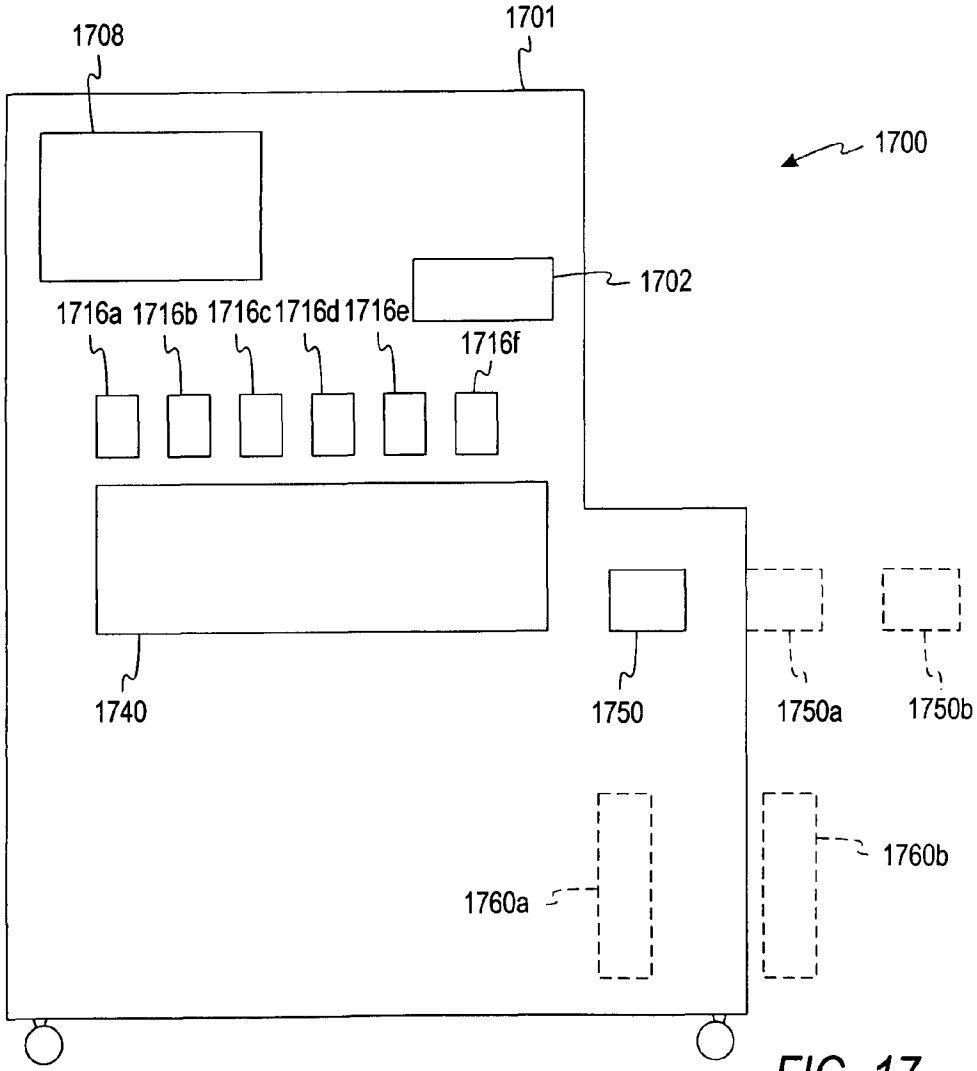
FIG. 17 is a front view illustration of a multi-pocket document processing and strapping system with an integrated strapping unit according to one embodiment.

Referring to FIG. 17, in another embodiment of the invention, a multi-pocket document processing and strapping system 1700 is illustrated. According to some embodiments the processing and strapping system 1700 is identical or similar to the multi-pocket document processing devices 100, 140, 150 shown in FIGS. 1*a*-1*g* with the addition of a strapping unit 1750. The processing and strapping system 1700 contains a strapping unit 1750 which is adapted to strap stacks of currency bills.

Figure 18:
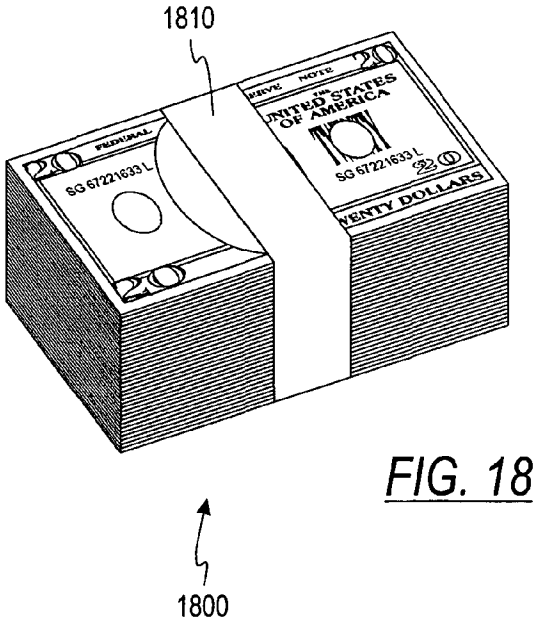
FIG. 18 is an illustration of a strapped currency stack.

Strapping generally comprises binding a stack of currency bills or other documents together into a package referred to as a strap. A strap of currency 1800 is illustrated in FIG. 18. In the embodiment illustrated in FIG. 18, the currency is strapped with a strapping band 1810. The strapping band 1810 may be made from a variety of materials such as paper, plastic, cloth or paper-like, plastic-like or cloth-like materials. Additionally, depending on the embodiment, a strapping band may be denominational or non-denominational. A denominational band is one which has some indicia associated with a particular denomination such as a numerical or word denomination indicia (e.g., "$1", "$5", "$10", "$20" or "one", "five", "ten", "twenty") or some other indicia such as a symbol or color (e.g., blue may be associated with $1 bills and red may be associated with $5 bills). Additionally or alternatively, total value indicia may be written on the band, e.g., a strap of one hundred $1 bills may say "$100" while a strap of one hundred $20 bills may say "$2000". As described below, other information may used be printed on the straps at the time of binding such as the date, time, a sequence number, a teller number, etc.

As illustrated in FIG. 17, the system 1700 comprises an input receptacle 1702, an evaluation region or unit 1708, and plurality of output receptacles 1716*a*-1716*f*, and a means 1740 for moving currency bills from one or more of the output receptacles 1716*a*-1716*f* to the strapping unit 1750. A transport mechanism (not illustrated in FIG. 17) is adapted to transport the bills from the input receptacle 1702, past an evaluation region 1708, to the output receptacles 1716*a*-1716*f*. According to some embodiments, the input region 1702 may correspond to the input receptacle 102 of FIGS. 1*a*-1*g*, the evaluation region 1708 may correspond to evaluation region 108 of FIGS. 1*a*-1*g*, and the output receptacles 1716*a*-1716*f* may correspond to output receptacles 106*c*-106*h* or escrow regions 116*a*-116*f* of FIGS. 1*a*-1*e* or the output receptacles or escrow regions illustrated in FIGS. 1*f*-1*g*.

According to the particular needs of a particular embodiment, the evaluation unit 1708 can be adapted to analyze, denominate, authenticate, count, sort, identify, and/or otherwise process the currency bills received from the input receptacle 1702. After each currency bill has been evaluated it is sent to an appropriate one of the output receptacles 1716*a*-1716*f*.

As described above in connection with FIGS. 1-16, generally bills or other, documents are transported into the various output receptacles 1716*a*-1716*f*. When one of the output receptacles 1716*a*-1716*f* reaches a strap limit, a processor or controller directs the moving means 1740 to move all the bills in an individual one of the output receptacles to the strapping unit 1750 and then the strapping unit binds the bills together into a strap of currency or documents. In some embodiments the means 1740 for moving currency bills is designed to move bills individually from an output receptacle to the strapping unit 1750 wherein the bills are restacked prior to strapping. Alternatively, in some embodiments the moving means 1740 is designed to move a complete stack of bills from an output receptacle to the strapping unit 1750. The moving means 1740 may be coupled to some or all of the output receptacles so as to permit the movement of bills from some or all of the output receptacles 1716*a*-1716*f* to the strapping unit 1750. Any of a variety of different moving means 1740 can be used to move bills to be strapped from an output receptacle 1716*a*-1716*f* to the strapping unit 1750. As discussed above, bills may be moved one at a time or as stacks of bills.

The document processing and strapping system 1700 may also comprise one or more receptacles for receiving strapped currency. For example, an internal receptacle 1760*a* may receive strapped currency bundles from the strapping unit 1750. Alternatively, or additionally, an external strapped currency receptacle 1760*b* may be provided for receiving currency from a strapping unit. Likewise, in some embodiments, the strapped currency receptacles 1760*a* or 1760*b* are replaced with a plurality of strapped currency receptacles. According to some embodiments, each of the plurality of strapped currency receptacles may be adapted to receive strapped currency according to the denomination of the strapped currency, e.g., a $1 strapped currency receptacle may be provided to receive straps of only $1 bills, a $5 strapped currency receptacle may be provided to receive straps of only $5 bills, etc.

Figure 19:
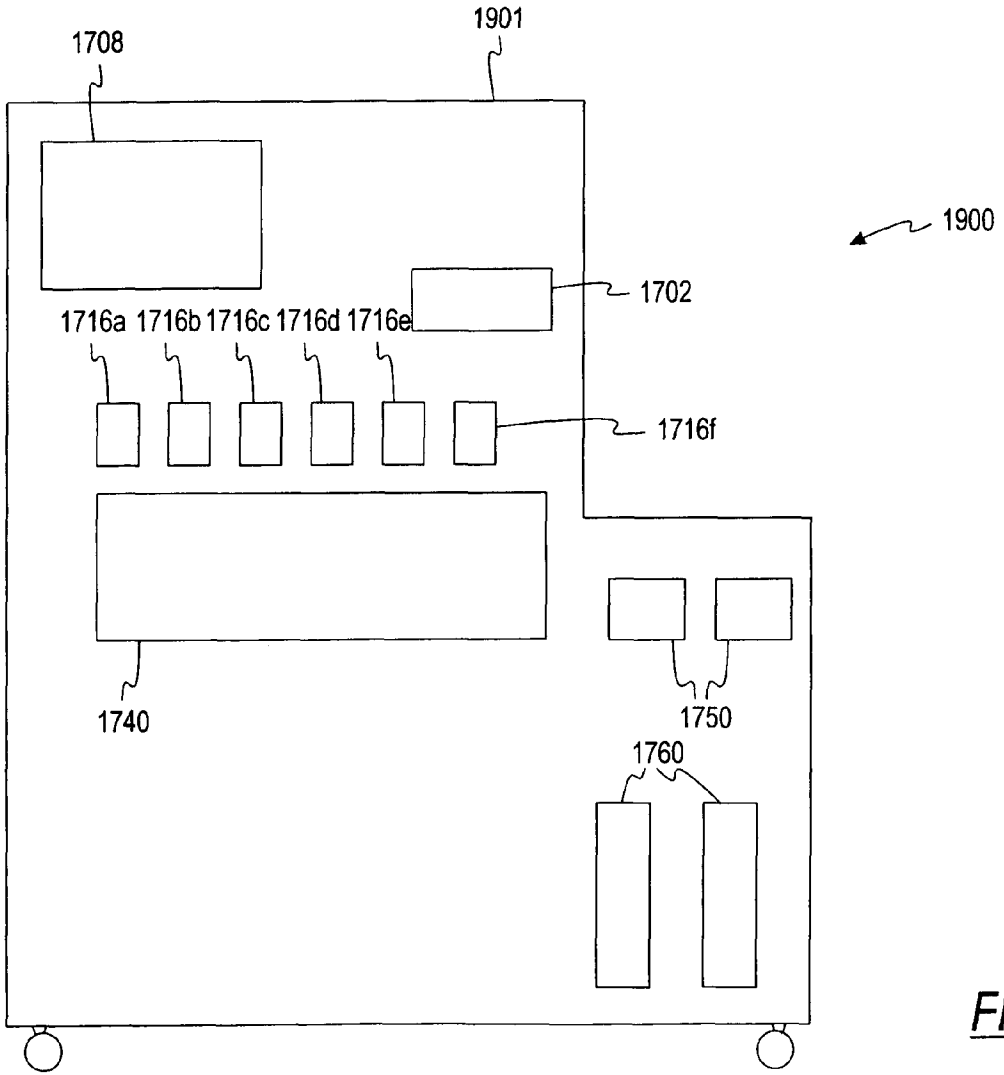
FIG. 19 is a front view illustration of a multi-pocket document processing and strapping system with two integrated strapping units according to one embodiment.

In some embodiments, a system for processing and strapping documents or currency is provided comprising more than one strapping unit 1750. For example, FIG. 19 illustrates a processing and strapping system 1900 comprising a document processing device 1901 and two strapping units 1750. According to some embodiments, a system for processing and strapping documents or currency comprises more than two strapping units 1750 such as, for example, where each output receptacle 1716*a*-1716*f* has a dedicated strapping unit 1750 associated therewith. As before, one or more or all of the strapping units may reside within the document processing device 1901, be mounted to the body of the device 1901, or be external to the device 1901.

Figure 20:
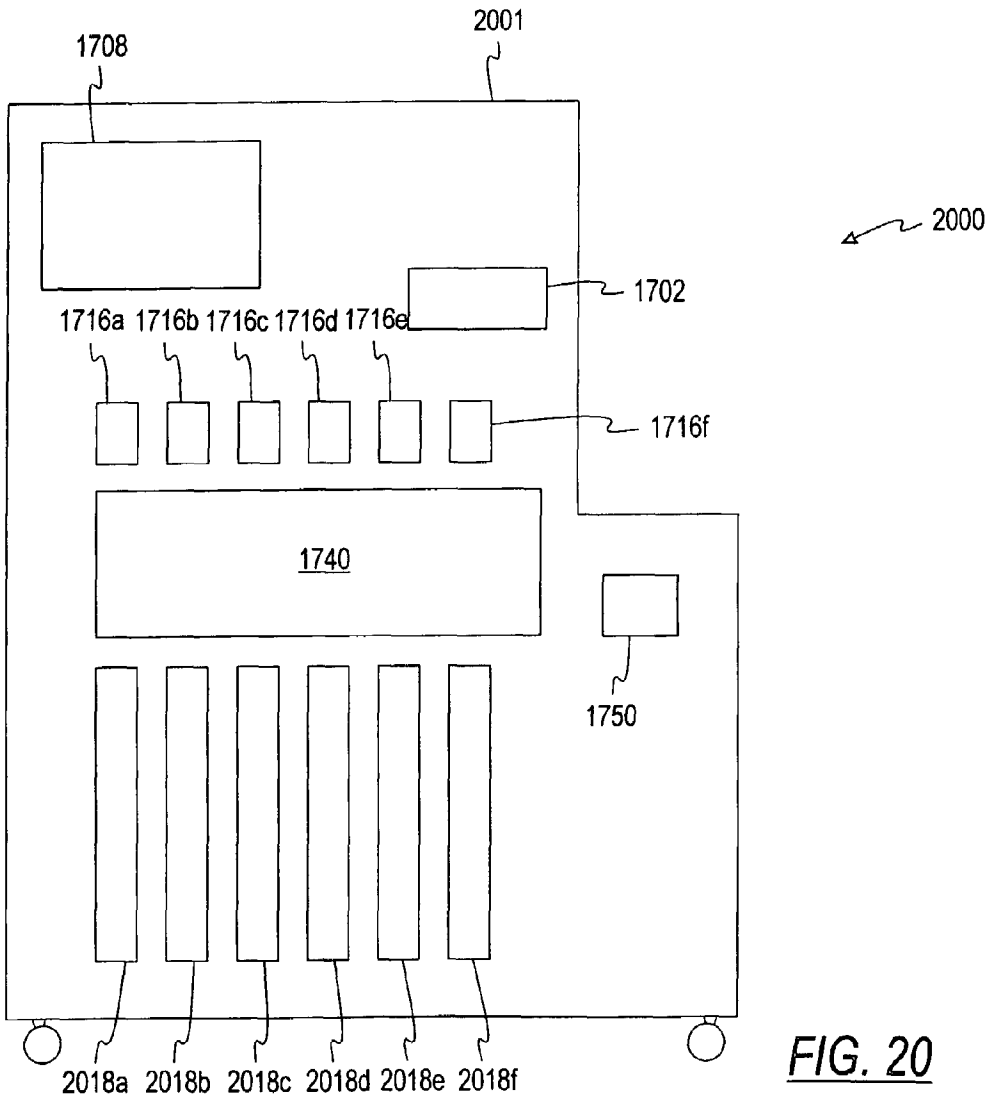
FIG. 20 illustrates a document processing and strapping system comprising a plurality of storage cassettes according to one embodiment.

Referring to FIG. 20, in another embodiment of the present invention, a document processing and strapping system comprises a plurality of storage cassettes, such as the storage cassettes 2018*a*-2018*f*. According to some embodiments, the storage cassettes are adapted to store strapped currency. According to other embodiments some of the storage cassettes may be adapted to store strapped currency while others are adapted to store un-strapped currency. Furthermore, according to some embodiments, an individual cassette may be adapted so that it can accept and store either or both strapped and un-strapped currency. The processing and strapping system 2000 of FIG. 20 is similar to the multi-pocket document processing device 100 except that it contains a strapping unit 1750 and currency moving means 1740. The moving means 1740 may be positioned between the plurality of escrow compartments 1716*a*-1716*f* (or 116*a*-116*f* of FIG. 1*a*) and the storage cassettes 2018*a*-2018*f*. The moving means 1740 may be adapted to transport currency bills from the plurality of escrow compartments 1716*a*-1716*f* to the strapping unit 1750, and also to transport strapped stacks of currency bills from the strapping unit 1750 to the storage cassettes 2018*a*-2018*f*.

According to some embodiments, the strapping unit 1750 may, optionally, eliminate the need to provide storing capabilities, such as the storage cassettes 2018*a*-2018*f* shown in FIG. 20 (118*a*-118*f* of FIGS. 1*a* and 1*b*). For example, as shown in FIG. 17, in some embodiments a storage bin 1760*a* or 1760*b* may be adapted to receive strapped stacks of currency bills from the strapping unit 1750. Alternatively, in other embodiments the storage bin 1760 may not be required where the strapping unit 1750 may be adapted to dispense the strapped stacks of currency bills directly to an operator. Alternatively, means may be provided for moving strapped currency back into one or more of the output receptacles 1716*a*-1716*f* or into cassettes such as the storage cassettes 2018*a*-2018*f* shown in FIG. 20 (118*a*-118*f* shown in FIGS. 1*a* and 1*b*).

As illustrated in FIGS. 17-33, strapping unit(s) 1750 may be contained within the body of the document processing device 1701. Alternatively, the strapping unit(s) 1750 may be external to the device 1701. For example, as shown in FIG. 17, a strapping unit 1750*a* may be physically coupled to the body of the device 1701. Alternatively, the strapping unit(s) may be separate and unattached to the processing device 1701, such as strapping unit 1750*b* illustrated in FIG. 17. The moving means 1740 may be adapted as necessary to move bills from the output receptacles to the strapping unit(s) depending on the location of the strapping unit(s).

Figure 21:
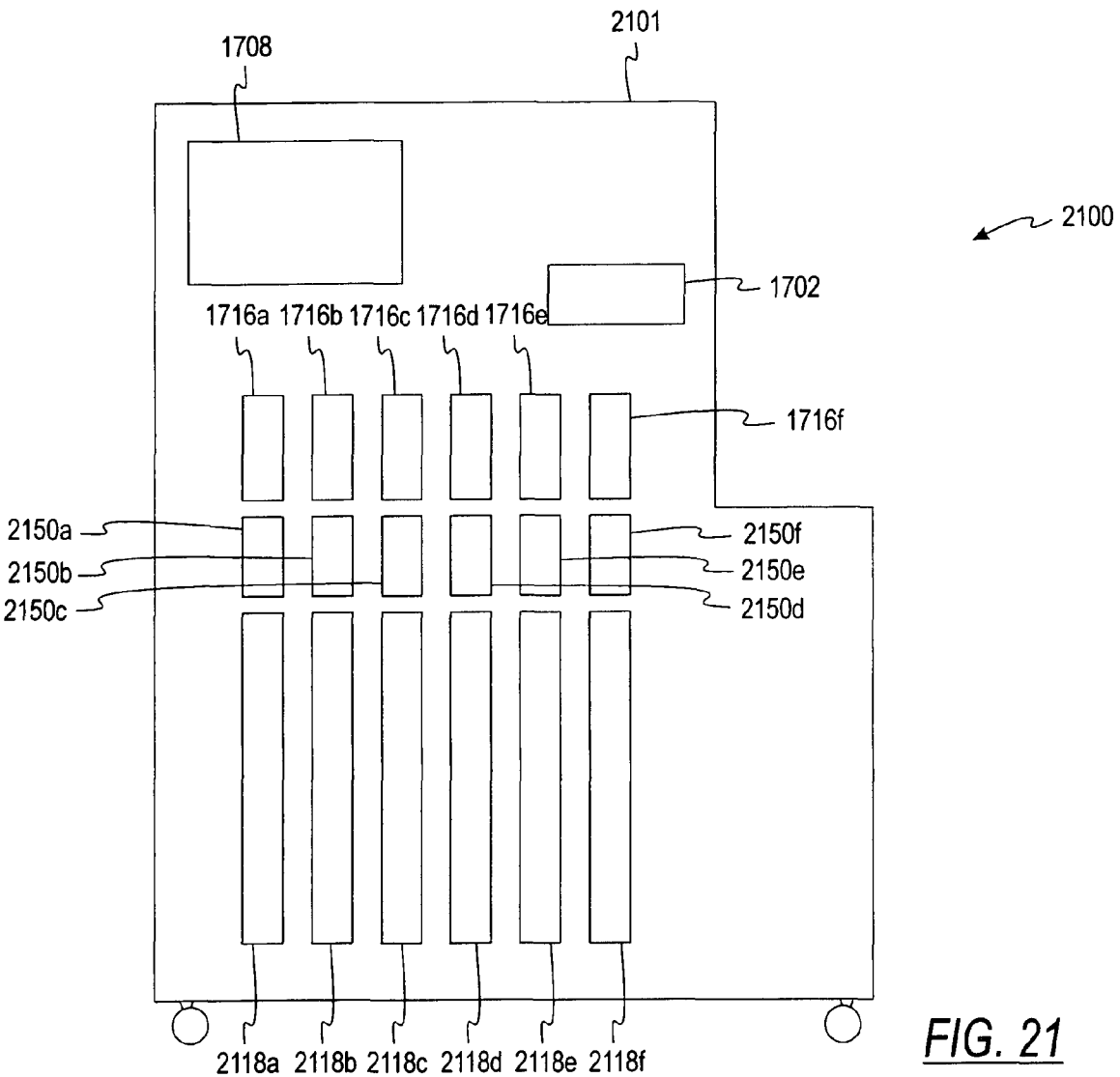
FIG. 21 illustrates a currency processing and strapping system comprising a plurality of strapping units according to one embodiment.

FIG. 21 illustrates a currency processing and strapping system 2100 comprising a plurality of strapping units 2150*a*-2150*f*. In the embodiment of FIG. 21, each output receptacle 1716*a*-1716*f* has a corresponding strapping unit 2150*a*-2150*f* and storage container or cassette 2118*a*-2118*f* associated therewith. According to some embodiments, output receptacles 1716*a*-1716*f* are similar to escrow regions 116*a*-116*f* of FIG. 1*a*. In operation, when a strap limit is reached for a given output receptacle 1716*a*-1716*f*, the stack of bills contained therein are transferred to the corresponding strapping unit 2150*a*-2150*f*. After the bills have been strapped by the strapping unit 2150*a*-2150*f*, the strapped currency is then transferred to a corresponding storage container or cassette 2118*a*-2118*f*. According to some embodiments, bills are transferred from an output receptacles 1716*a*-1716*f* to a corresponding strapping unit 2150*a*-2150*f* in a manner similar to that described above for transferring bills from an escrow region 116*a*-116*f* to a storage cassette 118*a*-118*f* in connection with the device illustrate in FIG. 1*a* and as described in more detail in U.S. Pat. No. 6,398,000 incorporated by reference in its entirety above. That is a plunger mechanism may descend above a stack of bills in an output receptacle 2150*a*-2150*f* and force a gate in the bottom thereof to open. Each strapping unit may be designed to comprise a bill receiving mechanism similar to that described in connection with the storage cassettes 118*a*-118*f* described above and in U.S. Pat. No. 6,398,000 (e.g., an upwardly biased and downwardly compressible platform) to receive the bills in the strapping unit, thereby facilitating the neat and orderly transfer of the bills stacked in an output receptacle into a strapping unit. Such a neat and orderly transfer would reduce the need to have to straighten out the stack of bills received in a strapping unit prior to strapping the stack of bills.

As described above for example in connection with various dynamic or fix assignment modes of operation (see FIGS. 8-16 and accompanying description), a processor (e.g., in connection with a memory) may be adapted to keep track of how many bills are contained within a given output receptacle at a given time along with the characteristics of such bills, e.g., their denomination, country of origin, face orientation, etc. The processor may be adapted to set a "full" or stack limit flag in memory when an output receptacle reaches an associated strap limit. In response to a full flag being set, the bills in the full pocket can be removed from the full pocket by the moving means 1740 and transported to the strapping unit. If the unstrapped currency removed from a particular output receptacle is not to be replaced into the output receptacle after strapping, then the full status flag can be turned off for the output receptacle. Likewise, if the output receptacle is a dynamic pocket, its open status can be reset to "open" so that a new sorting parameter (e.g., denomination) or combination of sorting parameters can be dynamically assigned to the pocket as needed. If the output receptacle is a fixed pocket, the pocket becomes available to accept additional bills having the pre-assigned criteria.

Figure 22A:
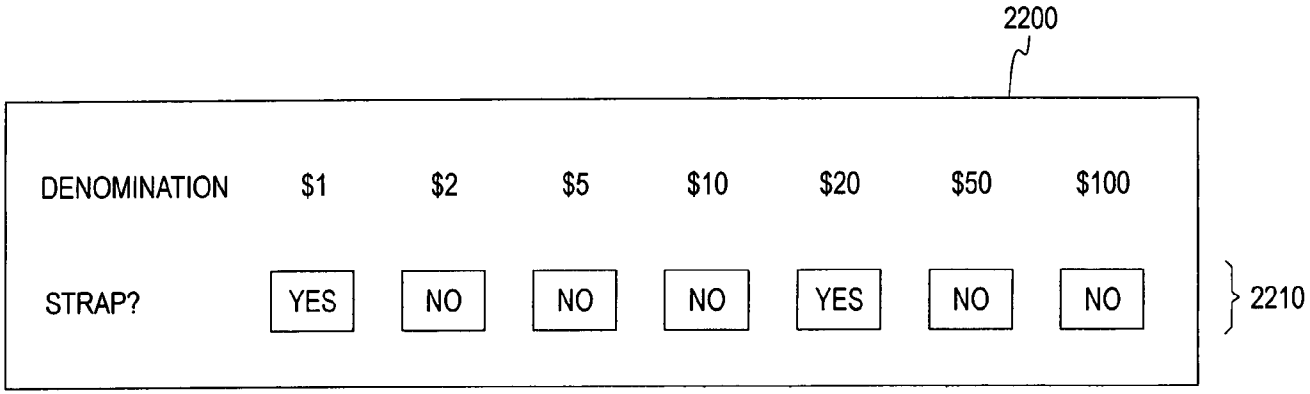
FIG. 22*a* illustrates an example of a user interface which permits strapping to be enabled or disabled on a denomination by denomination basis according to one embodiment.
Figure 22B:
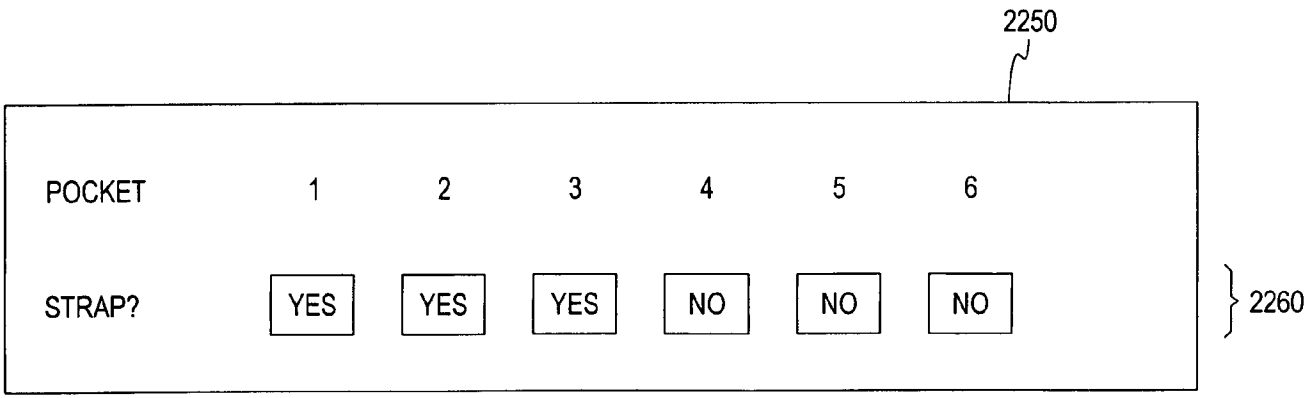
FIG. 22*b* illustrates an example of a user interface which permits strapping to be enabled or disabled on a pocket by pocket basis according to one embodiment.

Also as described above and below, the systems 1700, 1900-2100 and/or 2300-3100 be provided with a user interface which permits an operator to indicate whether particular output receptacles or denominations are to be strapped by the strapping unit. The interface may be similar to those described above (e.g., in connection with FIGS. 8 and 13). Where the decision to strap is based on denomination, denomination strapping selection elements may be provided. FIG. 22*a* is an example of a user interface 2200 which permits strapping to be enabled or disabled on a denomination by denomination basis via denomination strapping selection elements 2210. FIG. 22*b* is an example of a user interface 2250 which permits strapping to be enabled or disabled on a pocket by pocket basis via pocket strapping selection elements 2260. As described above with respect to other user interfaces, according to some embodiments, the interface may comprise functional touch panel keys and/or physical selection elements such as buttons or keys. In the example, illustrated in FIG. 22*b*, Pockets #1-#3 (which may correspond, for example, to output receptacles 116*a*-116*c* of FIG. 1*a* or 1716*a*-1716*c* such as in FIG. 20 or FIG. 21) are set so that bills contained therein are strapped by a strapping unit. Conversely, Pockets #4-#6 (which may correspond, for example, to output receptacles 116*d*-116*f* of FIG. 1*a* or 1716*d*-1716*f* such as in FIG. 20 or FIG. 21) are set so that bills contained therein are not strapped by a strapping unit. According to such embodiments, upon reaching a strap limit in a pocket whose bills are not to be strapped, the pocket may be cleared, for example, by transferring the bills into a storage cassette such as storage cassettes 118*d*-118*e* of FIG. 1*a*. Alternatively, such pockets may be cleared manually by the operator.

Stack limits may be assigned to individual pockets or denominations (or sorting parameters or combinations of sorting parameters) as described above, e.g., in connection with FIG. 11. According to some embodiments a single stack limit may apply to all denominations or all pockets, or according to other embodiments different stack limits may be set for different denominations or pockets. Likewise, according to some embodiments, strap limits may be preset by pocket or denomination such that they may not be varied by an operator of a processing device or system.

Figure 23:
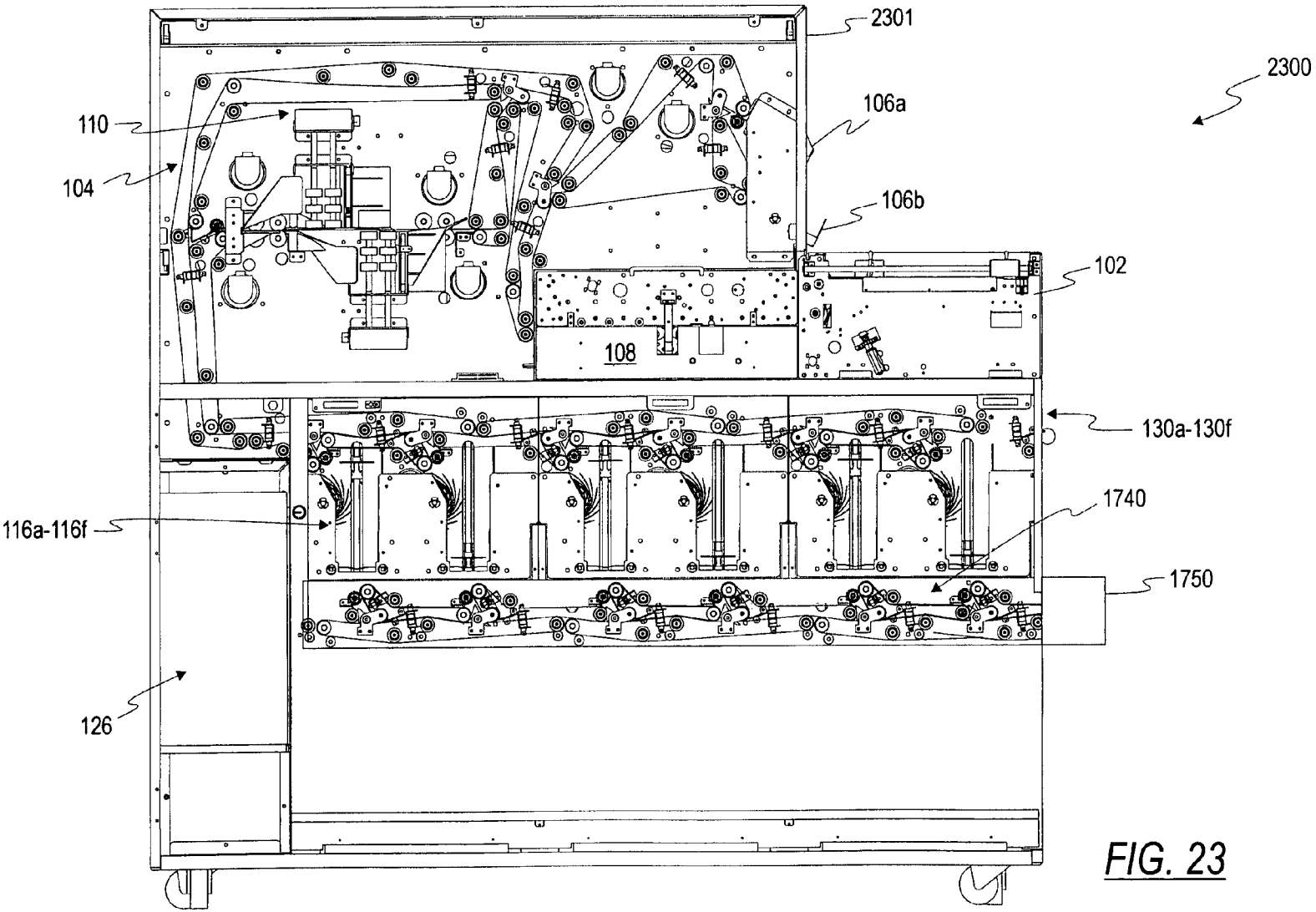
FIG. 23 is a front view of a multi-pocket document processing and strapping system comprising a moving means for moving bills individually from output receptacles to a strapping unit according to one embodiment.

Turning to FIG. 23, a multi-pocket document processing and strapping system 2300 comprising a moving means 1740 for moving bills individually from output receptacles 116*a*-116*f* to a strapping unit 1750 is illustrated. According to some embodiments, the moving means comprises a series of belts and rollers and may also include a stripping mechanism similar to that employed in conjunction with the input receptacle to strip off and feed bills one at a time into the currency moving means 1740. Otherwise, the system 2300 is similar to those described above (see e.g., FIGS. 1*c*, 1*d* and 17-21) and comprises a document processing device 2301 and a strapping unit 1750.

Figure 24:
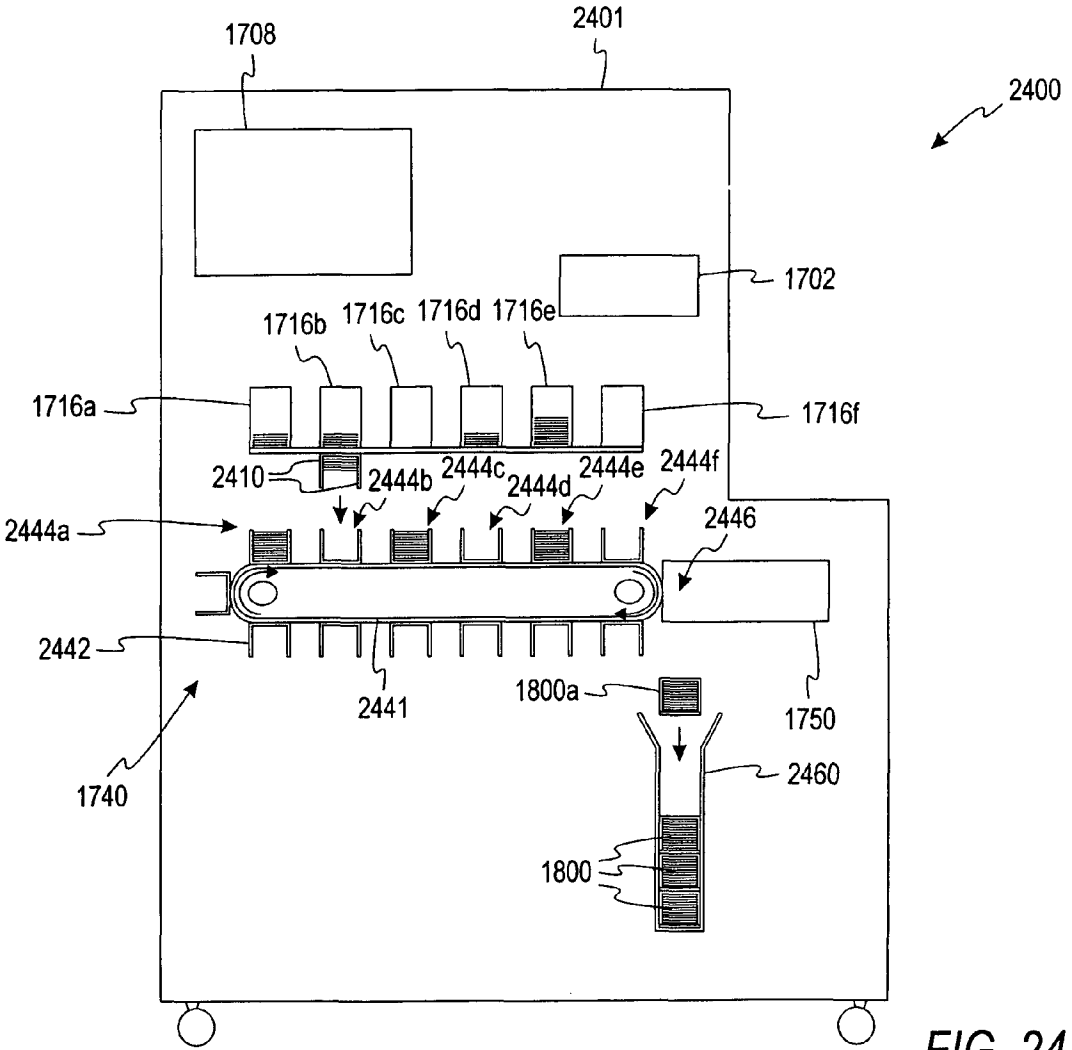
FIG. 24 is a front view illustration of a multi-pocket document processing and strapping system with an integrated strapping unit and a conveyor belt stack moving mechanism according to one embodiment.

Referring to FIG. 24, another embodiment of a multi-pocket document processing and strapping system 2400 is shown. The system 2400 is similar to those described above. The moving means or transport mechanism 1740 comprises a conveyor belt 2441 and at least one transport structure 2442 attached thereto. In the illustrated embodiment, stacking gates 2410 are positioned below each one of the plurality of output receptacles 1716*a*-1716*f* and above the transport mechanism 1740. In some embodiments, the stacking gate 2410 is adapted to work similarly to the gate 210 which is described earlier in reference to FIGS. 2*b*-2*c*. After a stack limit or full flag is set, the stacking gate 2410 of the corresponding output receptacle opens and the currency bills contained therein are transferred into a transport structure 2442. According to some embodiments, bills fall into a transport structure 2442 when the gate 2410 opens. According to other embodiments, bills may be transferred into an appropriate positioned transport structure 2442 in a manner similar to that in which bills are transferred into one of the storage cassettes as described above in connection with the device shown in FIG. 1*a* and in U.S. patent application Ser. No. 09/502,666 (U.S. Pat. No. 6,398,000), referred to above. For example, a transport structure 2442 may have an upwardly biased platform which is downwardly compressible by the interaction of bills positioned thereon and a paddle moving downwardly. The transport structure may also contain retainer clips or tabs to retain the bills within the transport structure upon the upward movement and return of the paddle into an output receptacle. In this manner a stack of currency bills residing in an output receptacle 1716 and comprising a complete but unbound stack of currency (e.g., 100 bills) may be transferred to a transport structure 2442 and then be transported to a strapping unit 1750 which may then strap the stack of currency.

According to some embodiments only a single transport structure 2442 is provided. According to other embodiments a plurality of transport structures 2442 are provided. The shape and size of the transport structure 2442 may be adapted to accommodate a stack of currency bills or other documents, and, furthermore, it may be adapted to keep the currency bills within the stack aligned with each other. For example, in FIG. 24 each transport structure 2442 is shown having a u-shaped profile which has a width that is roughly the size of one dimension of a currency bill such as the narrow dimension of a currency bill. According to some embodiments the transport structure 2442 may be adapted to repeatedly carry a single currency bill at a time, as opposed to a currency stack, until a currency stack is completed in the strapping unit 1750.

According to some embodiments comprising a plurality of transport structures 2442, the spacing between adjacent transport structures 2442 may be set to be approximately equal to the distance between adjacent output receptacles 1716*a*-1716*f*. In other words, each transport structure 2442 is spaced apart from another transport structure 2442 on the conveyor belt 2441 such that there is a corresponding transport structure 2442 for each one of the plurality of output receptacles 1716*a*-1716*f* whenever currency bills, individually or as currency stacks, are being loaded into one of the transport structures 2442. When a stack limit or full flag is set for an output receptacle, a controller or other processor may cause the conveyor belt 2441 to move so as to position one of the transport structures 2442 in a loading position 2444*a*-2444*f* below the appropriate output receptacle. Accordingly, a plurality of loading positions 2444*a*-2444*f* may correspond to the plurality of output receptacles 1716*a*-1716*f*. For example, as illustrated in FIG. 24 there is one transport structure 2442 in each one of the plurality of loading positions 2444*a*-2444*f*.

In operation, when the currency bills in one of the output receptacles 1716*a*-1716*f* have reached a predetermined stack limit, and before the stacking gate 2410 begins to open, a processor or controller may cause the conveyor belt 2441 to advance and stop when an empty transport structure 2442 is in an appropriate one of the loading positions 2444*a*-2444*f*. For example, as shown in FIG. 24, one of the plurality of transport structures 2442, which is empty, is stopped in the loading position 2444*b* ready to receive a currency stack from the output receptacle 1716*b*. After one of the transport structures 2442 is positioned in one of the loading positions 2444*a*-2444*f*, the appropriate stacking gate 2410 opens and the currency bills or stack from the output receptacle associated with the limit or full flag may be placed in the corresponding transport structure 2442. Then according to some embodiments, the stacking gate 2410 may then be closed and the output receptacle 1716*b* made ready to accept additional currency bills. For example, the stack limit or full flag associated with the now empty output receptacle may be cleared. Likewise, if applicable, a dynamically assigned denomination may also be cleared so that the output receptacle is indicated to be an open dynamic pocket.

After the bills from an output receptacle 1716 are transferred to a transport structure 2442, the processor may cause the conveyor belt 2441 to advance the transport structure 2442, which now contains a bill stack, to a strapping unit position 2446 in the strapping unit 1750. After the strapping unit 1750 receives the currency stack, it then proceeds to strap the currency stack.

According to some embodiments, after a currency stack is strapped the controller sets the conveyor belt 2441 in motion to allow the next transport structure 2442 that contains a currency stack to move to the strapping position 2446. According to some embodiments, the processing and strapping system 2400 may be adapted to place the strapped currency stacks 1800*a* into a storage bin 2460. When the conveyor belt 2441 starts moving the transport structure 2442 containing a strapped currency stack 1800*a* starts to turn upside down dropping the strapped currency stack 1800*a* into the storage bin 2460. In some embodiments, the storage bin 2460 contains only one receptacle. In other embodiments, the storage bin 2460 contains a plurality of receptacles where the processing and strapping system 2400 is adapted to automatically sort the strapped bill stacks 1800 according to denomination. A system 2400 is adapted to permit an operator to subsequently remove the strapped currency stacks from the storage bin 2460. Alternatively, as described above the storage container or containers may reside outside the body of the processing device 2401. Likewise the strapping unit may be external to the body of the processing device 2401 such as being attached to the outside of the body of the processing device 2401 as shown in FIG. 17 (1750*a*) or may be unattached and separate from the processing system 2400. Likewise, a processing and strapping system such as illustrated in FIG. 24 may comprise more than one strapping unit, e.g., two strapping units which are adapted to accept bills from any output receptacle or a plurality of strapping units with each being dedicated to accept and strap currency only from one or more of the output receptacles and/or bills having only one or more designated denominations. For example, the number of strapping units provided may be equal to the number of different denominations which are desired to be strapped, with each strapping unit only accepting and strapping bills of a pre-assigned denomination. Such embodiments would permit the strapping units to contain and utilize dedicated strapping materials or bands, e.g., a $1 strapping unit could contain and strap currency with bands which have a "$1" indicia pre-printed thereon while a $20 strapping unit contains and straps currency with bands which have a "$20" indicia pre-printed thereon.

Figure 25:
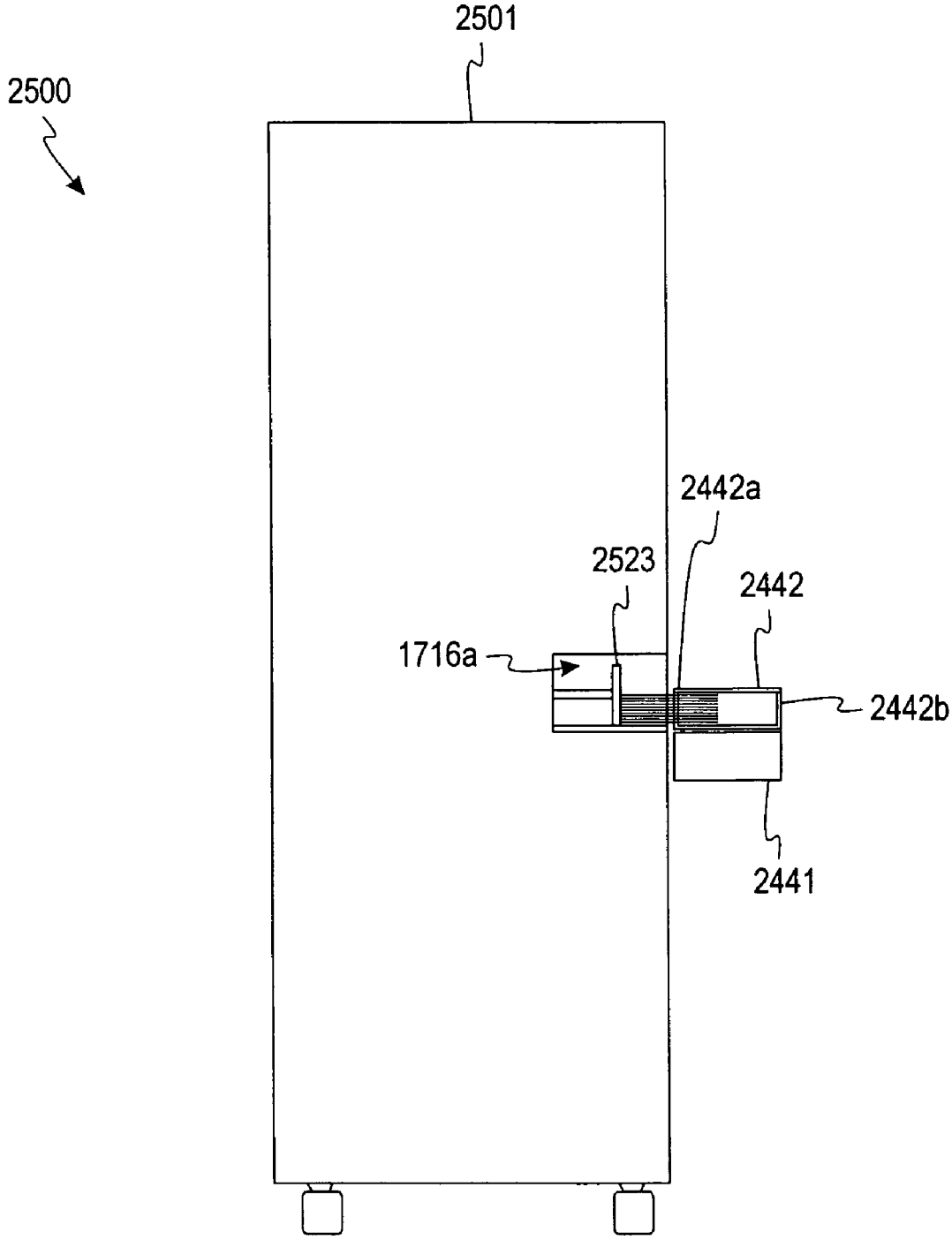
FIG. 25 is a side view illustration of a multi-pocket document processing and strapping system having a mechanism for loading bills unto a transport structure according to one embodiment.

Turning to FIG. 25, FIG. 25 illustrates a side view of a multi-pocket document processing and strapping system 2500 according to another embodiment. The system 2500 and the moving means 1740 is similar to that illustrated to that of FIG. 24, however, the conveyor belt 2441 and transport structures 2442 are positioned adjacent to and in front of the output receptacles 1716*a*-1716*f* Bills in an output receptacle may be transferred to a transport structure via a bill pushing mechanism 2523, as shown in FIG. 25, which may push a stack of bills contained in an output receptacle out into a transport structures 2442. Each transport structure 2442 may be adapted to accept the bills as they are pushed out from one of the plurality of output receptacles 1716*a*-1716*f* onto the conveyor belt 2441. For example, the transport structures 2442 may be designed so they do not have a wall on the side (2442*a*) from which the bills are received in order to allow the currency bills to be pushed into the transport structures 2442. For example, FIG. 25 shows a currency stack being pushed by the bill pushing mechanism 2523 out of the output receptacle 1716*a* into the transport structure 2442. As described earlier, each transport structure 2442 may have a shape that allows it to hold a stack of currency bills such that the currency bills will remain aligned with each other. Likewise the structure 2442 may be designed to have a wall on the side (2442*b*) opposite from which bills are received to permit the pushing mechanism to push the bills against the wall on the opposite side 2442*b*, thereby facilitating the creation of a neat and orderly stack of bills in the transport structure 2442.

Figure 26A:
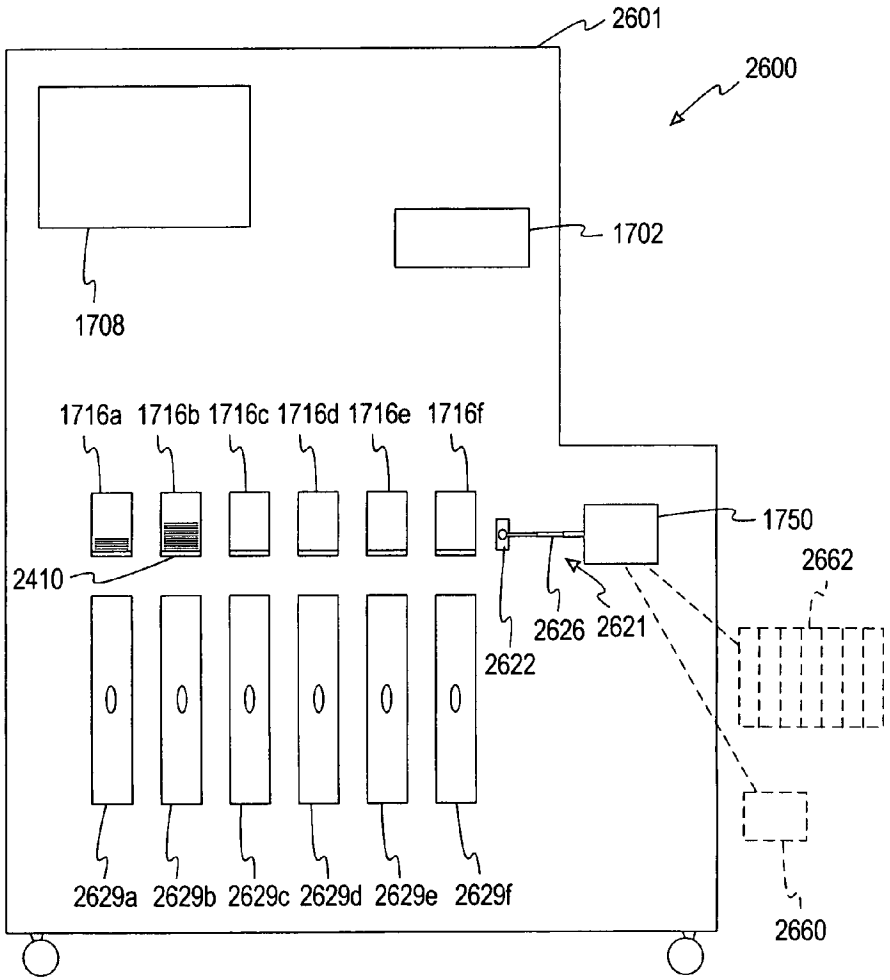
FIG. 26*a* is a front view illustration of a multi-pocket document processing and strapping system comprising a strapping unit and a clamp mechanism, which is shown in a retracted position according to one embodiment.
Figure 26B:
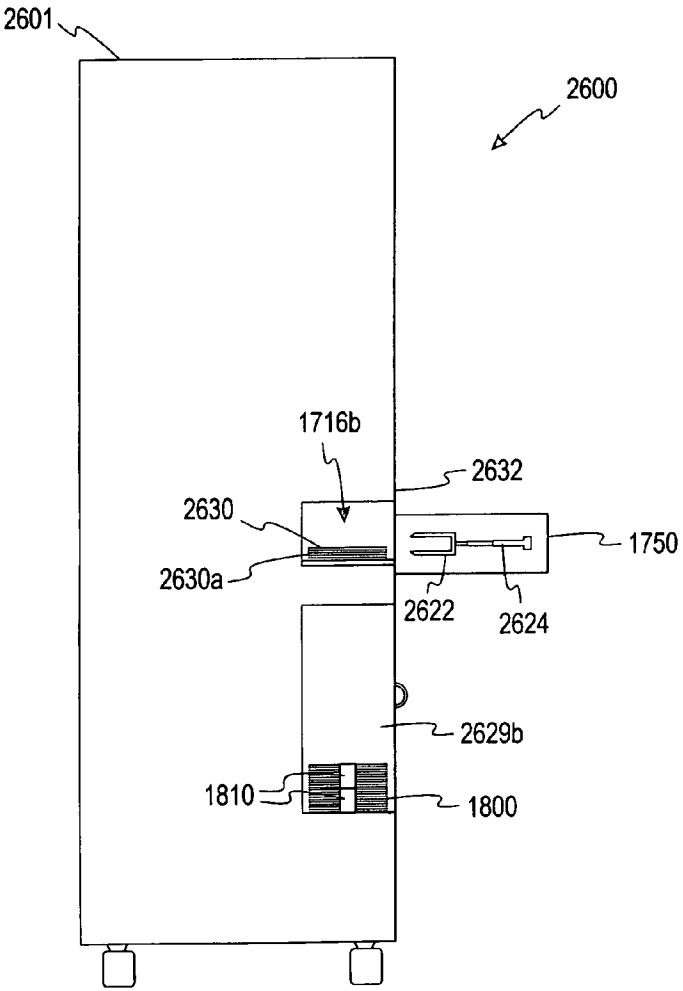
FIG. 26*b* is a side view illustration of FIG. 26*a;*

Another embodiment of a document processing and strapping system is shown in FIGS. 26*a*-26*d*. The system 2600 is similar to those described above, however, the moving means or transport mechanism 1740 comprises a clamp 2622. FIG. 26*a* is a front view and FIG. 26*b* is a side view of a multi-pocket document processing and strapping system 2600 wherein the moving means 1740 comprises a clamp 2622. Generally, the clamp 2622 is used to grab a stack of bills from an output receptacle and transport the stack to one or more strapping units so that the stack may be strapped.

Figure 26C:
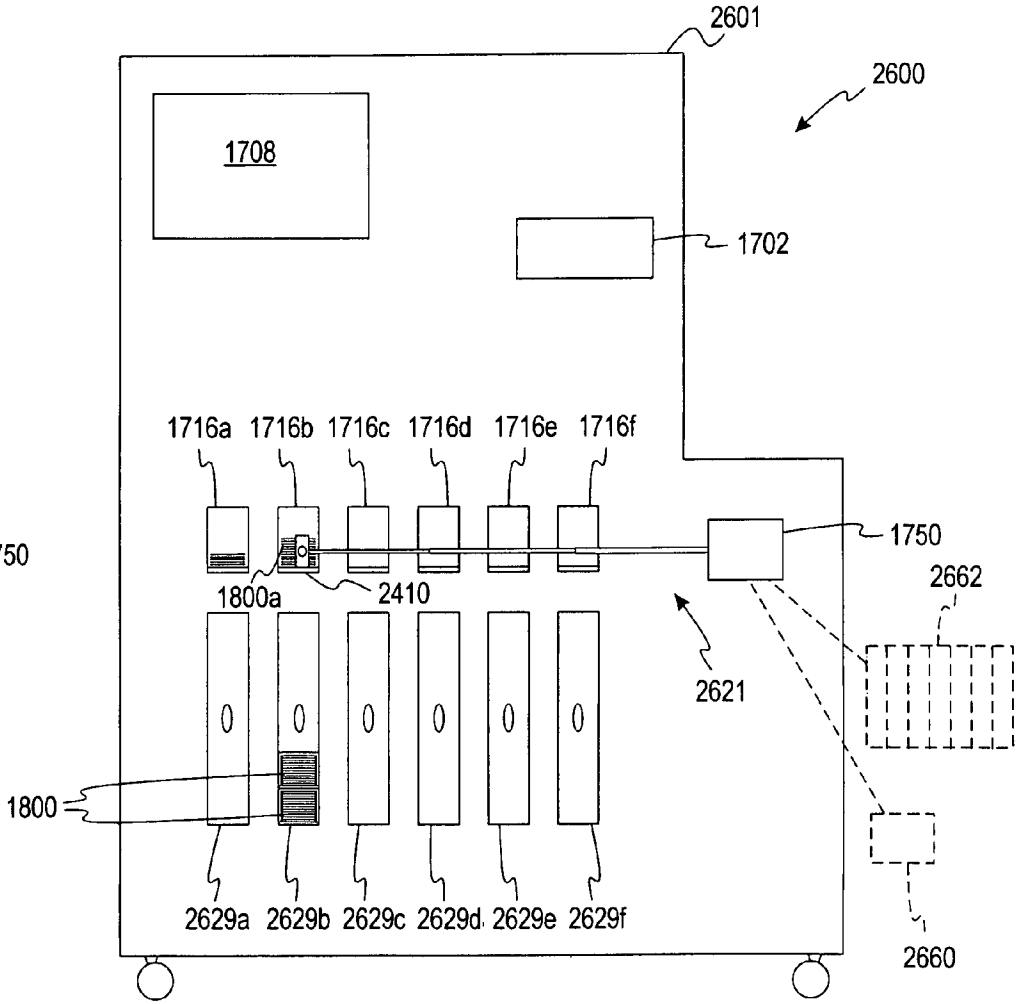
FIG. 26*c* shows the device illustrated in FIG. 26*a* with the clamp mechanism shown in an extended position according to one embodiment.

According to some embodiments, such as the one illustrated in FIGS. 26*a*-26*d*, a first extendable arm 2626 is used to position the clamp 2622 in front of an output receptacle from which bills are to be removed. Furthermore, according to some embodiments, the clamp may be attached to a clamp holder or second extendible arm 2624 which may move the clamp 2622 into and out of a particular output receptacle and/or, in some embodiments, into and out of a strapping unit. As illustrated in FIGS. 26*a*-26*d*, a clamp mechanism 2621 may comprise a clamp 2622 attached to a second extendable arm 2624 which is in turn attached to a first extendable arm 2626. The first extendable or adjustable arm 2626 which is attached at a first end to the clamp holder 2624. A second end of the first extendable or adjustable arm 2626 may be attached, for example, to the strapping unit 1750 (as shown in FIGS. 26*a* and 26*c*) or to the body of the processing device 2601.

Figure 26D:
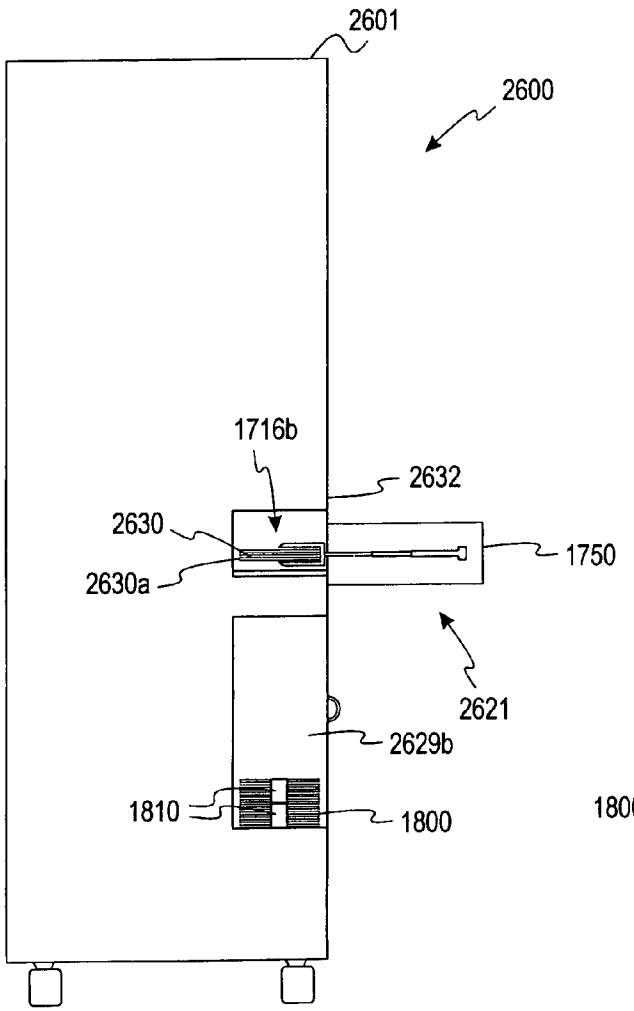
FIG. 26*d* is a side view of the device illustrated in FIG. 26*c* with the clamp mechanism shown in an extended position.

In FIG. 26*a*, the clamp mechanism 2621 is shown with the first extendable arm 2626 in a somewhat retracted position while FIG. 26*b* the second extendable arm 2624 is also shown in a somewhat retracted position. In FIG. 26*c* first extendable arm 2626 in shown in an extended position so that clamp 2622 is positioned in front of output receptacle 1716*b*. Likewise, FIG. 26*d* shows second extendable arm 2624 in an extended position such that clamp 2622 is positioned inside output receptacle 1716*b* so that the clamp 2622 may grasp the bills contained with output receptacle 1716*b*. Additionally, the processing and strapping system 2600 is illustrated comprising a plurality of storage bins or cassettes 2629*a*-2629*f*. Each bin or cassette 2629 may be adapted to receive at least one currency stack 1800.

In operation, when a predetermined stack limit is reached in one of the output receptacles 1716*a*-1716*f* a strapping signal may be sent to the clamp mechanism 2621. Using the first arm 2626 the clamp mechanism 2621 extends the clamp 2622 to a position adjacent to the appropriate output receptacle. The clamp 2622 is adapted to grab a stack of currency bills residing in the appropriate output receptacle. Then, the clamp holder 2624 extends so that the clamp 2622 enters the output receptacle. The clamp 2622 may then grab the currency stack from one of the plurality of output receptacles 1716*a*-1716*f*. According to some embodiments the clamp mechanism 2621 is adapted to permit the clamp to grasp bills from any of the plurality of output receptacles 1716*a*-1716*f*. In alternative embodiments, the clamp 2622 may be adapted to grab and transport currency bills from an output receptacle to a strapping unit in a one bill at a time fashion.

After the stack of currency bills is grabbed, the clamp holder 2624 retracts the clamp 2622 which is now holding the stack of unstrapped bills from the output receptacle. The clamp holder 2624 retracts the clamp 2622 until an inside edge 2630*a* of the bills 2630, which is located opposite the clamp 2622, clears a pocket surface 2632. The pocket surface 2632 is, generally speaking, a boundary separating the inside from the outside of each of the output receptacles 1716*a*-1716*f*. Then, the arm 2626 retracts and brings the clamp 2622 to a position in the strapping unit 1750. The strapping unit may then strap the currency. In some embodiment, the strapping unit straps the currency (e.g., places a strapping band 1810 about the stack of currency) while it is being held by the clamp 2622. In other embodiments, the bills are first transferred to and held by the strapping unit prior to strapping. As described in more detail below, the band 1810 may be a blank or color-coded band, and/or the corresponding denomination may be written on it.

According to some embodiments, after the strapping procedure is finished the clamp mechanism 2621 is used to place the strapped stack of bills 1800 back into one of the output receptacles such as the output receptacle from which the bills were taken. After the strapped stack of bills 1800 is released, the clamp holder 2624 retracts so that the clamp 2622, which is now empty, is positioned outside of the output receptacle into which the strapped currency was placed. The clamp 2622 may then either be brought back to the strapping unit 1750 or to another one of the plurality of output receptacles 1716*a*-1716*f*. The clamp mechanism 2621 is now ready for transporting a next stack of currency bills to the strapping unit 1750.

In some embodiments, after placing the strapped stack of bills 1800 in the output receptacle a stacking gate 2410, which is shown in a closed position, is opened and the strapped stack of bills 1800 is transferred into a corresponding storage cassette of the plurality of storage cassettes 2629*a*-2629*f*. In some embodiments, the strapped currency may be transferred into a storage container or cassette by allowing the strapped currency to fall into a storage container or cassette positioned below the gate 2410. In some embodiments, the strapped currency may be transferred into a storage cassette in manner similar to that described above in connection with FIGS. 1-3 (e.g., via the use of a plunger mechanism 302).

According to some embodiments, the processing and strapping system 1700 may additionally or alternatively include a common receptacle 2660 inside or outside the body of the processing device 2601. Likewise, according to some embodiments, a plurality of strapped bill receptacles may be provided inside or outside the body of the processing device 2601 such as denomination specific receptacles 2662. The processing and strapping system 2600 may be adapted to deposit the strapped stacks of currency 1800 into the common receptacle 2660 or into the denomination specific receptacles 2662 rather than sending the strapped stacks of currency 1800 back to the plurality of output receptacles 1716*a*-1716*f*. For example, the strapped stacks of currency 1800 can be deposited by dropping them into the common receptacle 2660 or into the denomination specific receptacles 2662. In some embodiments, the strapped stacks of currency 1800 are deposited directly into the storage cassettes 2629*a*-2629*f* rather than having the strapped stacks of currency 1800 returned to the output receptacles 1716*a*-1716*f* before they are placed into the storage cassettes 2629*a*-2629*f*.

As described above, a user interface may be provided to permit an operator to indicate which denominations of bills or bills in which output receptacles 1716*a*-1716*f* are to be strapped. For example, the operation may desire that bills in output receptacles 1716*a*-1716*c* be strapped while those in 1716*d*-1716*f* are not. Accordingly in operation, the bills in 1716*a*-1716*c* are retrieved by the clamp mechanism 2621 and strapped by the strapping unit 1750 as described above. In some embodiments, the strapped bills originating from output receptacles 1716*a*-1716*c* may ultimately be deposited into respective storage bins or cassettes 2629*a*-2629*c*. Conversely, bills in output receptacles 1716*d*-1716*f* are not strapped by the strapping unit 1750 but may instead be plunged at appropriate times into respective cassettes 2629*d*-2629*f* as described above in connection with FIGS. 1-3 and in U.S. patent application Ser. No. 09/502,666, now issued as U.S. Pat. No. 6,398,000, incorporated by reference above.

Of course, other means may be provided for moving a clamp from a position adjacent one of the output receptacles to a strapping unit. For example, instead of an extendable arm, a clamp may be mounted on a structure which is in turn moveably mounted on a rail, rail system, or track system such that the clamp may be moved between the output receptacles and a strapping unit (e.g., left to right). For example, a clamp may be mounted to one or more of the rails depicted in FIGS. 27*a*-27*b*.

Figure 27B:
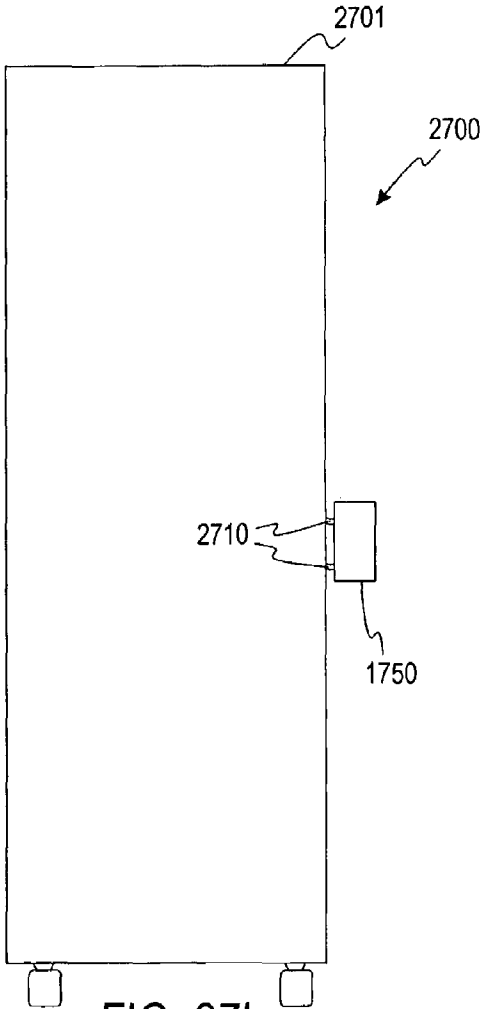
FIG. 27*b* is a side view of the system of FIG. 27*a;*
Figure 27A:
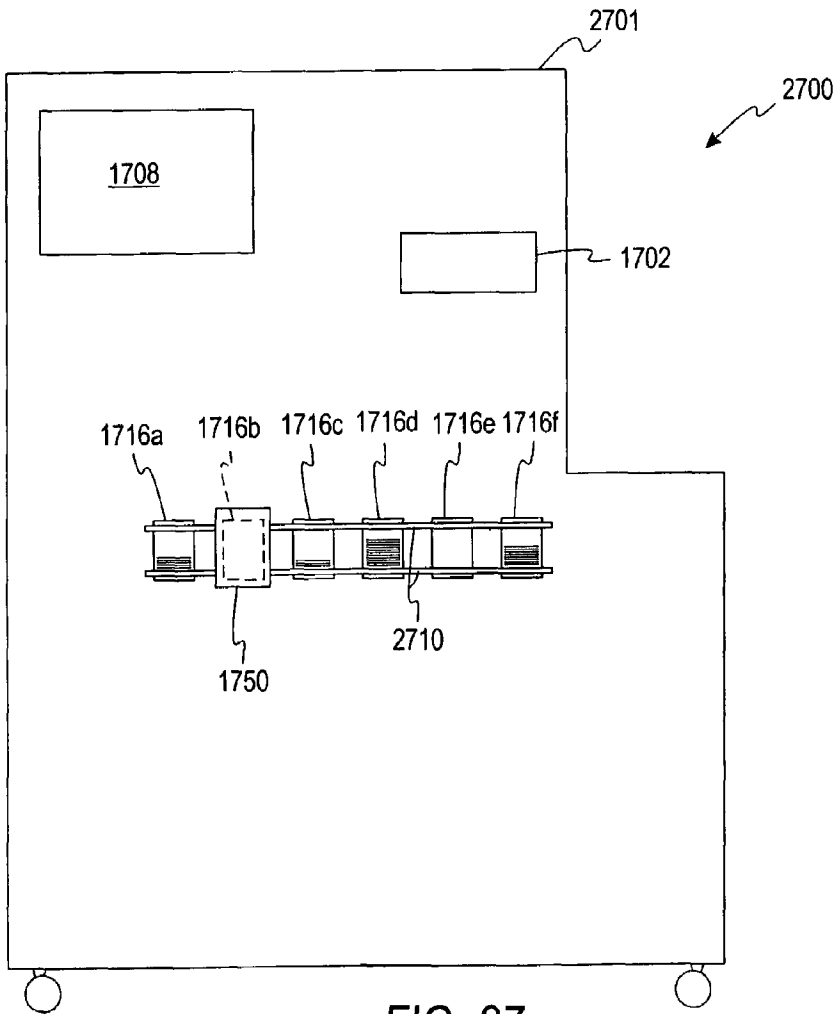
FIG. 27*a* is a front view illustration of a multi-pocket document processing and strapping system comprising a movable strapping unit according to one embodiment.

FIGS. 27*a*-27*b* illustrates a document processing and strapping system 2700 similar to those described above but which comprises one or more moveably mounted strapping units 1750. In general, the present invention is not limited to systems in which bills to be strapped are moved to one or more stationary strapping units but also includes systems in which strapping units may be brought to bills which need to be strapped (or systems in which both bills to be strapped and strapping unit(s) move). For example, instead of employing various mechanisms to transport bills to be strapped to one or more strapping units, one or more strapping units 1750 may be moveably mounted to move to positions adjacent to the output receptacles 1716*a*-1716*f*. For example, a strapping unit 1750 may be moveable mounted on one or more rails 2710 along which a strapping unit may slide (e.g., left to right as illustrated in FIG. 27*a*). In operation, when a stacking limit is reached for a particular output receptacle 1716*a*-1716*f* and a corresponding stacking limit flag is set in memory, the device may send a strapping signal to the strapping unit 1750 and cause it to move to a position adjacent to the appropriate output receptacle 1716*a*-1716*f*. Then, the bills from the appropriate receptacle can be transferred to and strapped by the strapping unit 1750 using one of the methods described above, such as using a pushing mechanism 2523, which was described in reference to FIG. 25 or using a clamp 2622 or clamp mechanism 2621, which was described in reference to FIGS. 26*a*-26*d*. Likewise, according to some embodiments, a moveable strapping unit may be positioned inside a document processing device 2701 below an appropriate output receptacle and bills may be transferred to the strapping unit by opening gates at the bottom of the output receptacle (e.g., in conjunction with gravity and/or a plunging mechanism as described above). In some embodiments more than one strapping unit 1750 may be moveably mounted to or positioned within the processing device 2701, that is, the document processing and strapping systems may comprise a plurality of moveable strapping units. Such systems may be also comprise one or move internal or external strapped bill storage containers or cassettes as described in the various embodiments above.

Figure 28:
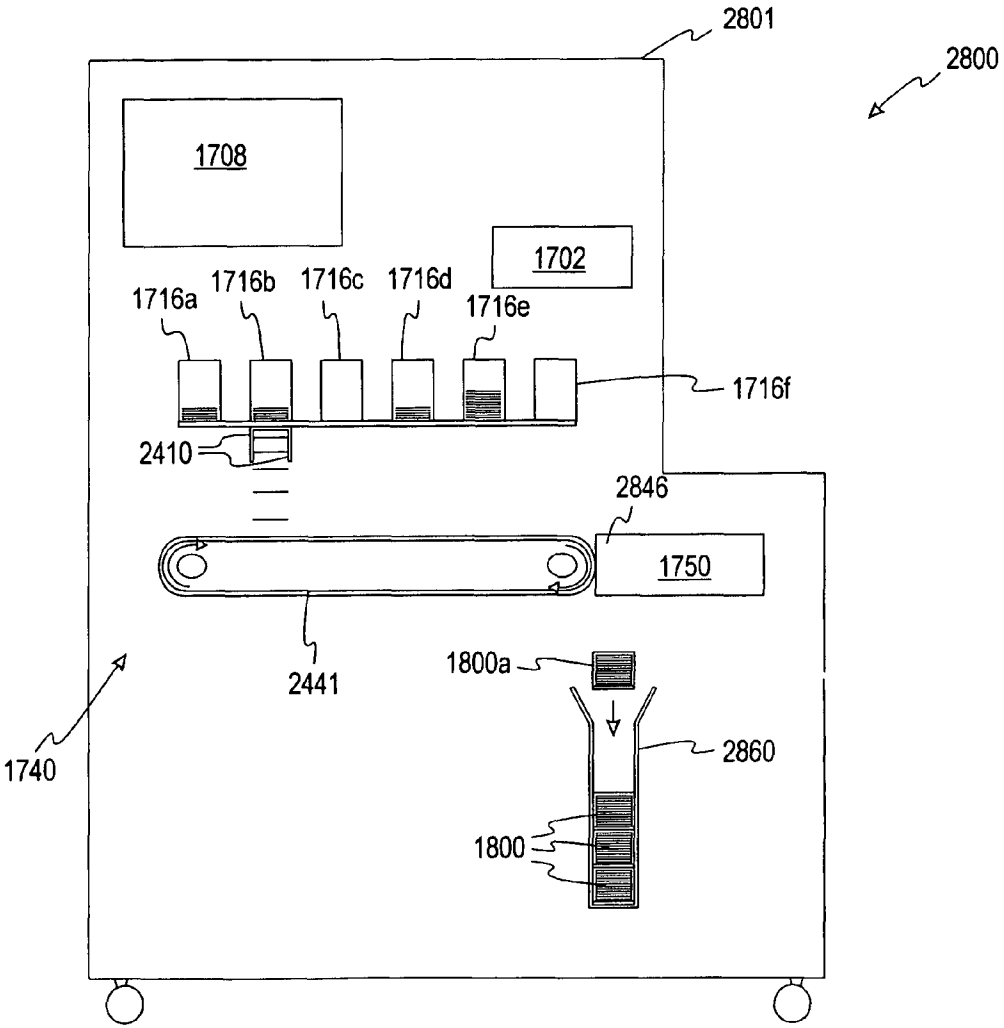
FIG. 28 is a front view illustration of a multi-pocket document processing and strapping system with an integrated strapping unit and a conveyor belt for transporting currency bills one at a time to the strapping unit according to one embodiment.

Referring now to FIG. 28, a document processing and strapping system 2800 similar to those described above but wherein the moving means 1740 comprising a conveyor belt 2441 not having transport structures 2442 attached thereto. The conveyor belt 2441 may be adapted to transport currency bills one at a time to a strapping unit 1750. The moving mechanism 1740 may work as described above in reference to FIG. 24 except that it lacks the transport structures 2442.

Figure 29:
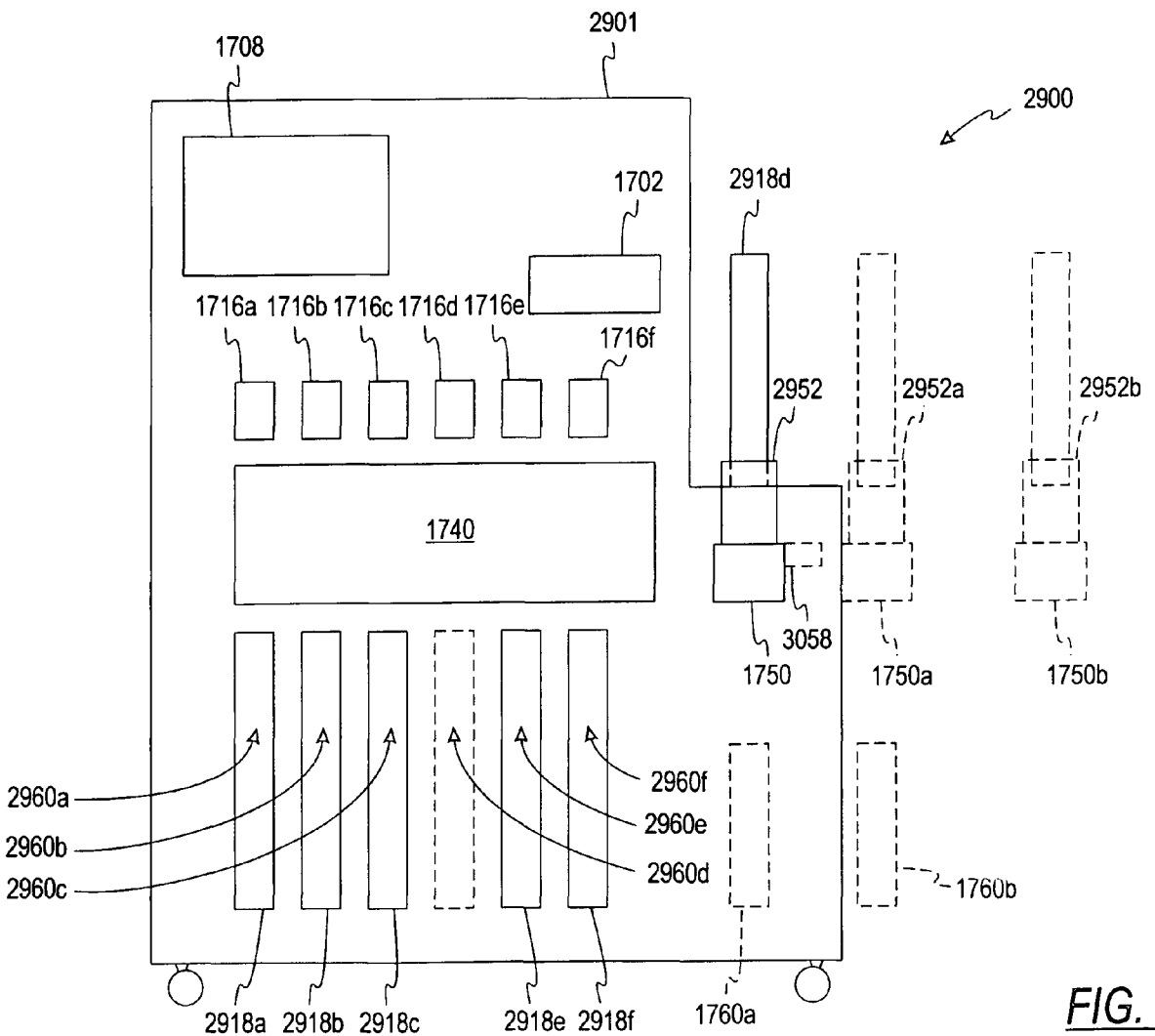
FIG. 29 illustrates a document processing and strapping system comprising a plurality of storage cassettes and a strapping unit having a cassette interface according to one embodiment.

FIG. 29 illustrates a currency bill processing and strapping system 2900 similar to those described above comprising a strapping unit 1750 and a processing device 2901 comprising an input receptacle 1702, an evaluation unit 1708, and a plurality of cassettes 2918*a*-2918*f*. A transport mechanism (not illustrated in FIG. 29) is adapted to transport the bills from the input receptacle 1702, past an evaluation region 1708, to the plurality of cassettes 2918*a*-2918*f*. According to some embodiments, the input region 1702 may correspond to the input receptacle 102 of FIGS. 1*a*-1*g*, the evaluation unit

1708 may correspond to the evaluation region 108 of FIGS. 1*a*-1*g*, and the cassettes 2918*a*-1018*f* may correspond to storage cassettes 118*a*-118*f*. The system may optionally include a transport mechanism 1740 as described above.

A processor controls the transport mechanism which feeds currency bills from the input receptacle 1702 to the evaluating unit 1708. The evaluating unit 1708, which may comprise one or more denominating sensors and/or one or more other sensors, evaluates each currency bill sent by the transport mechanism. According to one embodiment, the data pertaining to each currency bill from the denominating sensor is sent to the processor, which uses the data to denominate the bills. The currency transport mechanism is also utilized by the processor to sort the bills by denominations into the appropriate denomination specific cassettes, e.g., a $1 currency bill cassette may be provided to receive only $1 bills, a $5 currency bill cassette may be provided to receive only $5 bills, etc. In one embodiment, when a cassette has reached a demarcated limit for the amount of currency it is to hold, the processor will stop the transport mechanism from sending additional currency bills to the respective cassette. Alternatively, in another embodiment, the processor could stop the entire transport mechanism from delivering currency bills to any of the plurality of cassettes 2918*a*-2918*f* when a threshold has been met for at least one of the cassettes, e.g., the processor may instruct the entire transport mechanism to stop when one of the cassettes 2918*a*-2918*f* becomes full.

As can be seen from FIG. 29, in some embodiments the strapping unit 1750 may be utilized in conjunction with an interface mechanism 2952. The interface mechanism 2952 may be integrated as part of the strapping unit 1750 or may be a separate component. The interface mechanism 2952 is adapted to receive a cassette therein and permit the bills within the cassette to be fed into the strapping unit. A cassette may be transferred to the strapping unit 1750 by manual or mechanical means.

For example, in operation, a cassette is placed into an interface mechanism 2952 adapted to receive at least one of the plurality of cassettes 2918*a*-2918*f*. The interface mechanism 2952 may be adapted to draw bills from the cassette and feed them into the strapping unit 1750. As described above, the strapping unit is adapted to strap bills in stacks containing a predetermined number of bills, e.g., the strapping unit may strap one hundred bills at a time. In some embodiments, the pre-determined number of bills constituting a strap may be set by an operator. The strapping unit 1750, comprising a counting mechanism, feeds bills into a strapping position until the pre-determined number of bills has been fed to the strapping position. When a sufficient number of bills have been fed to the strapping position, the strapping unit straps the bills as a stack.

In some embodiments, the interface is adapted to receive any and all of cassettes 2918*a*-2918*f* and the strapping unit 1750 is thereby capable of strapping bills received from any of a plurality of cassettes 2918*a*-2918*f*. In this manner, the one strapping unit is capable of efficiently strapping bills delivered into any of the cassettes 2918*a*-2918*f*.

For example, an operator could feed in a single stack of nine hundred (900) $1 bills, twelve hundred (1200) $10 bills and seven hundred and fifty (750) $100 bills into the input receptacle 1702. According to one embodiment, the transport mechanism would then feed the mixed bills past the evaluating unit 1708, wherein the currency bills are denominated and sorted into the appropriate cassettes 2918*a*-2918*f*. A cassette used in such a system could have a maximum limit of one thousand (1000) currency bills. When one thousand (1000) of the $10 bills have been sorted into a respective $10 cassette, the processor will stop the transport mechanism from delivering any more $10 bills to that respective cassette. Additionally, the operator could be alerted that the $10 cassette is full by any number of means, such as an audible alarm, a light, or some other type of display unit.

According to some embodiments, the system 2900 is adapted such that the operator can then manually remove the full cassette from its respective loading position 2960, or, if the operator so desires, may remove any non-fill cassette if the sorting device is not sorting currency bills at the time. In the example illustrated in FIG. 29, the cassette 2918*d*, has been placed in the interface mechanism 2952 of the strapping unit 1750. When the strapping unit is run, the strapper will count the number of bills fed through the unit and stop feeding when a pre-determined strap limit is met, e.g., a limit of 100 currency bills in the present example. When the pre-determined limit has been met, the strapping unit will then strap the stack of bills and move them to storage receptacle 1760*a* or 1760*b*. In the case of the $10 cassette containing 1000 $10 bills, all the bills could be fed through and strapped into ten stacks or straps of 100 currency bills. Finally, the operator may place the empty cassette 2918*d* back to its loading position in the sorting device 2901.

Additional cassettes 2918*a*-2918*f* may be subsequently inserted into the interface mechanism 2952 so that bills contained therein may be strapped. In the case of the non-full $1 cassette, all the bills could be fed through and strapped into nine stacks or straps of 100 currency bills. In the case of the non-full $100 cassette, all the bills could be fed through, but only seven complete stacks or straps of 100 currency bills will be completed. In one embodiment, the remaining fifty $100 bills could be left as loose currency in the cassette to be removed by the operator. In another embodiment, the strapping unit could strap the non-complete stack and apply an appropriate band indicating that the bundle did not contain a complete strap. Alternatively, when no bills remain to be fed to the strapping position but the strapping position contains less than a full strap of bills, the strapping unit may not strap the incomplete stack. Rather, an error signal could be generated and the operator could be prompted to remove the bills from the strapping position. Alternatively, incomplete stacks of bills could be automatically removed from the strapper position such as by being ejected to a holding bin.

According to some embodiments, when a full cassette is removed from a loading position 2960, an empty cassette may be placed therein. Such embodiments permit the processing device 2901 to resume operation, if halted, without having to wait for the contents of the removed cassette to be strapped by the strapping unit 1750. Then independently of the operation of the processing device 2901, the removed cassette may be coupled to the strapping unit (e.g., via interface 2952) and the bills contained therein may be removed and strapped. That is, in some embodiments, strapping units may be run independently of the operation of the document or currency processing devices such as device 2901.

As illustrated in FIG. 29, the strapping unit 1750 may be contained within the body of the currency bill processing device 2901. Alternatively, the strapping unit 1750 may be external to the device 2901. For example, as shown in FIG. 29, a strapping unit 1750*a* may be physically coupled to the body of the device 2901. Alternatively, the strapping unit may be separate and unattached from the processing device 2901, such as strapping unit 1750*b* illustrated in FIG. 29.

Figure 30:
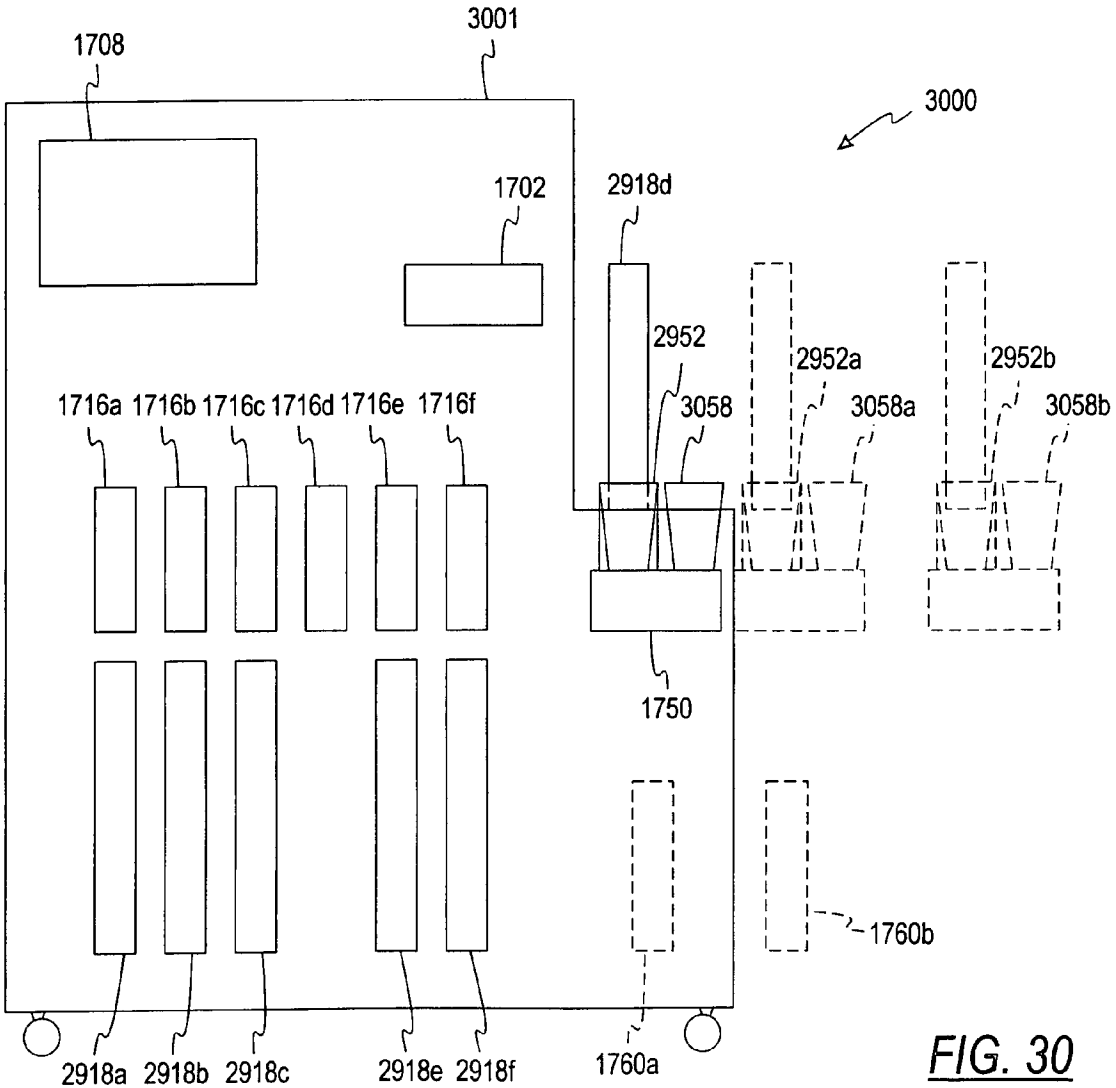
FIG. 30 illustrates a document processing and strapping system comprising a plurality of storage cassettes and a strapping unit having a cassette interface and an input hopper according to one embodiment.

FIG. 30 illustrates a currency bill processing and strapping system 3100 similar to those described above. Such embodiments may or may not comprise a transport mechanism 1740. As illustrated in FIG. 30, some embodiments supplement or replace the strapping unit 1750 with an integrated or attached input hopper 3058 that accepts loose currency bills, e.g., loose currency bills inserted into the input hopper 3058 by the operator. Such embodiments would permit, for example, bills to be manually removed from a cassette 2918 or escrow region 1716 and manually placed into the input hopper 3058. Some embodiments allow only one feeding mechanism to operate at a time, i.e., the input hopper 3058 can feed bills to the strapper or the interface mechanism can draw bills from a cassette and feed them to the strapper. Other embodiments allow for the concurrent feeding of bills from both the input hopper 3058 and interface mechanism 2952.

As described above, in some embodiments, a system for processing and strapping currency bills is comprised of two or more strapping units. Other embodiments that employ multiple strappers utilize strapping units that are dedicated to a certain denomination of currency bill. In yet other embodiments, a system for processing and strapping currency comprises a dedicated strapping unit for each of a plurality of cassettes 2918*a*-2918*f*. Additionally, the multiple strapping units may be arranged in a multitude of ways, wherein a plurality of strappers within a document processing device 3001 may use a plurality of strapping unit arrangements, i.e., units may reside within the document processing device 3001, or be physically coupled to the body of the processing device 3001, or be separate and unattached from the processing device 3001.

Additionally, some embodiments circumvent and/or supplement the utilization of cassettes 2918*a*-2918*f* and/or escrow regions 1716 by directly transporting the processed currency bills to a strapping unit 1750. See e.g., FIG. 31. According to some embodiments, all or some of the processed currency bills are directly transported to either a sole or one of a plurality of currency strappers. In some multiple strapping unit embodiments, the strapping units are dedicated to a particular denomination and bills of the corresponding denominations are delivered directly to the respective dedicated strapping units, e.g., $1 bills are transported to a dedicated $1 bill strapper, $5 bills are transported to a dedicated $5 bill strapper, etc. In some embodiments, single or multiple strappers are employed which have currency bills directly transported to them, while the remaining bills are sent to a sole output receptacle (e.g., receptacle 1716 or a cassette) or the appropriate one of a plurality of output receptacles (e.g., receptacles 1716*a-f* or cassettes 2918*a-f*). Some embodiments of the current system employing the direct transportation of processed currency bills to a strapping unit 1750 also have default or operator settable thresholds for each strapping unit. When the threshold of currency bills is met within the strapping unit, the bills are then strapped. The strapped bills may then be, for example, routed by way of a transport mechanism to a cassette/receptacle or the respective cassette/receptacle of a plurality of cassettes 2918*a-f* or receptacles 1716*a-f*.

The document processing and strapping device 3001 may also comprise one or more storage receptacles for receiving strapped currency bills. For example, an internal receptacle 1760*a* may receive strapped currency stacks from the strapping unit 1750. Alternatively, or additionally, an external strapped currency receptacle 1760*b* may be provided for receiving currency from a strapping unit. Likewise, in some embodiments, the strapped currency receptacle 1760*a* or 1760*b* is replaced with a plurality of strapped currency receptacles. According to some embodiments, each of the plurality of strapped currency receptacles may be adapted to receive strapped currency according to the denomination of the strapped currency.

Figure 31:
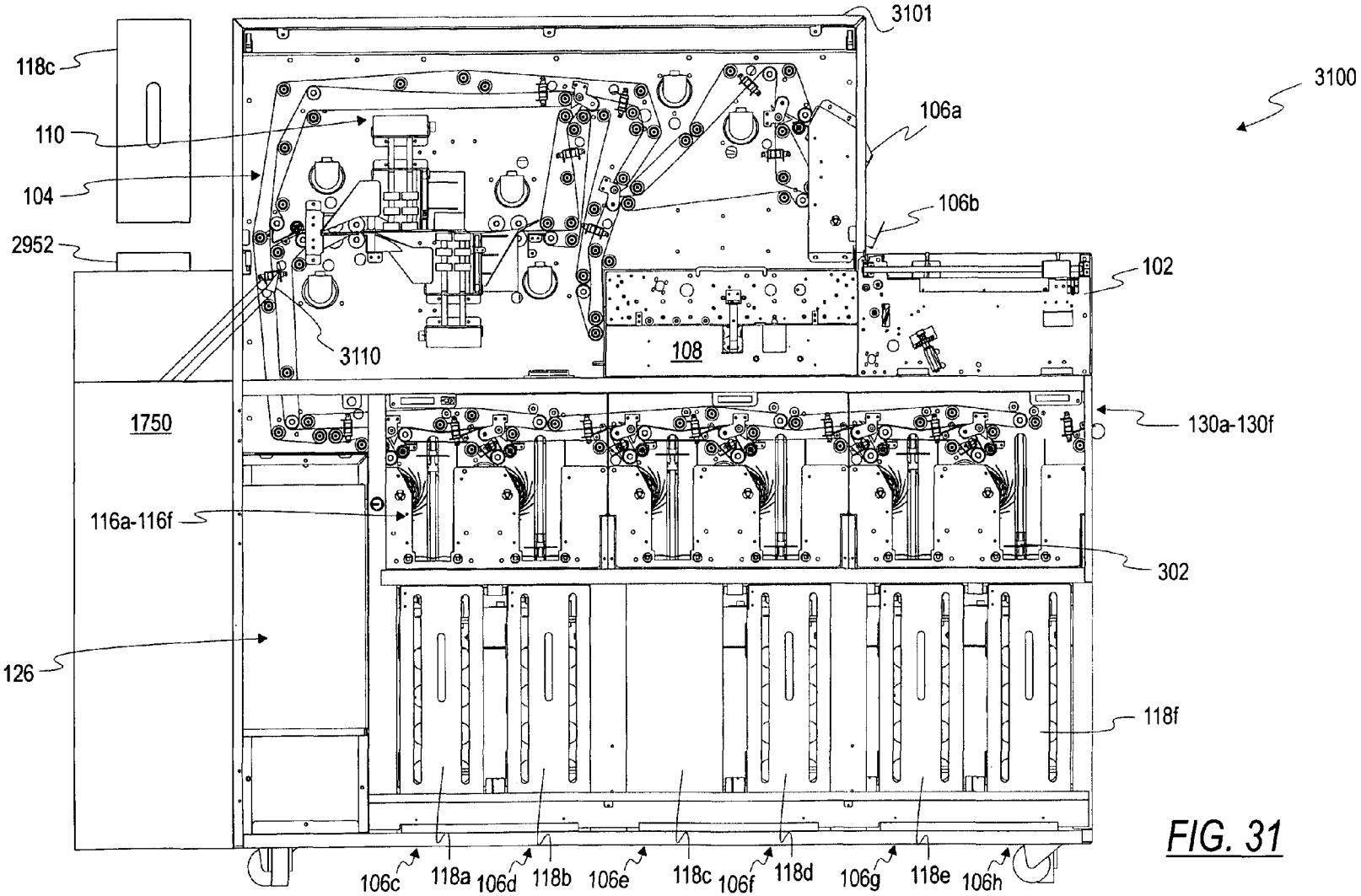
FIG. 31 illustrates a document processing and strapping system comprising a plurality of output receptacles and a strapping unit adapted to permit bills to be delivered directly to the strapping unit or output receptacles according to one embodiment.

One example of an embodiment wherein bills may be directly transported to a strapping unit 1750 is illustrated in FIG. 31. A diverter 3110 may be used to direct bills to a strapping unit 1750 instead of one of the lower output receptacles 106*c*-106*h*. As illustrated, the strapping unit 1750 is equipped with a cassette interface. A cassette, such as cassette 118*c* as illustrated, may be coupled to the strapping unit 1750. In operation, bills of a particular denomination, such as $20 bills, may be sent directly to the strapping unit 1750 for strapping. Other denominations may be processed as described above with, for example, $1 bills being directed to escrow compartment 116*a* and eventually into cassette 118*a*, $5 bills being directed to escrow compartment 116*b* and eventually into cassette 118*b*, $10 bills being directed to escrow compartment 116*c* and eventually into cassette 118*c*, etc. As stacks of $20 bills are collected in the strapping unit 1750 they may be strapped, e.g., into straps containing 100 bills each. Then, for example, when one of the cassettes 118*a-f* becomes full, the machine 3101 may be halted and the full cassette may be coupled to the strapping unit 1750 and the bills contained therein may be strapped. Such an embodiments permits the same strapping unit 1750 to be used to strap $20 bills during an initial pass of bills through the device 3101 and subsequently to be used to strap other denominations contained in one or more of the cassettes 118*a-f*.

The number of output receptacles may be varied as described above. For example, in some embodiments, the processing device 3101 may have two, four, or more output receptacles or cassettes 118.

Figure 32:
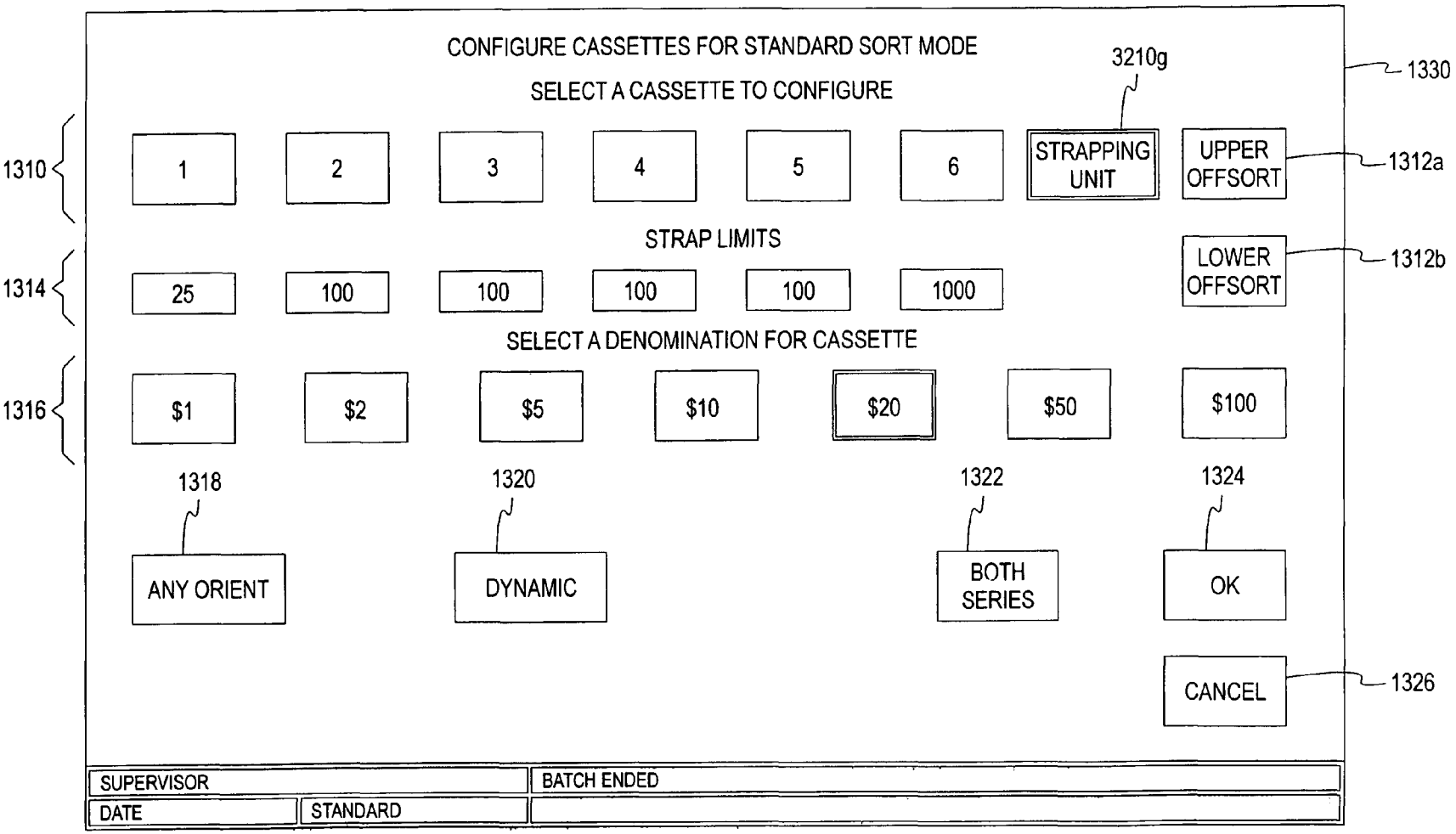
FIG. 32 illustrates an additional embodiment of an user interface permitting designation of a strapping unit as a destination in addition to a number of output receptacles according to one embodiment.

Now an example of a manner in which the currency processing and strapping system 3100 shown in FIG. 31 is described. According to some embodiments, in operation, the operator first configures to machine in the manner she desires, for example, specifying a particular mode of operation and/or designating whether bills of any denomination is to be strapped and/or into which output receptacles and/or cassettes bills of particular denominations are to be delivered. FIG. 32 illustrates a user interface, such as a touch screen, similar to that described above in connection with FIG. 13*a* which may be used to configure the machine. As illustrated in FIG. 32, $20 bills (row 1316) have been set to be routed to and strapped by strapping unit 1750 (3210*g*—row 1310). Then as described above such as in connection with FIG. 13, bills of other denominations may be assigned to various output receptacles, e.g., $1 bills being assigned to pocket 1, $5 bills being assigned to pocket 2, $10 bills being assigned to pocket 3. Also as described above, Dynamic pockets/Dynamic Sorting Assignment mode may be employed as well as the other modes previously described.

After completing any configuration changes, e.g., in a set up mode, bills in the input hopper 102 are transported through the processing machine 3101 as previously described. Bills which are determined to be $20 bills are routed to the strapping unit 1750 and are strapped on the fly, e.g., every time 100 bills are received by the strapping unit. Thus the $20 bills are strapped in real time. Bills which are determined to be $1 bills are routed to escrow compartment 116*a* and eventually into cassette 118*a*, $5 bills are routed to escrow compartment 116*b* and eventually into cassette 118*b*, $10 bills are routed to escrow compartment 116*c* and eventually into cassette 118*c*, etc. When the strapping unit 1750 is not strapping $20 bills it may be used to strap bills of other denominations, for example, bills from cassettes via cassette interface 2952 or in some embodiments, alternatively or additionally, loose bills via an input hopper such as described in connection with hopper 3058 of FIG. 30.

The embodiments wherein bills may be routed directly to a strapping unit while other bills are routed to other designations such as being sorted by denomination into respective pockets or cassettes provide a number of advantages. For example, in some applications 40%, 50%, 60% or more of all currency processed is of one denomination. If this denomination is routed to a strapping unit, most bills will be strapped on the fly, the first time through the machine. Accordingly, direct feeding of bills to the strapping unit, such as those having the most common bill denomination, helps to enhance throughput. Such embodiments which additionally permit bills to be feed into the strapping unit from another source, e.g., cassette interface 2952 and/or loose bill hopper 3058, provide the additional advantage of also allowing an operator to easily strap bills of other denominations. The strapping of other denominations can be accomplished without having to purchase additional stand-alone strapping units or a strapping unit for each output receptacle. Accordingly, such embodiments are very cost effective.

Where the bills being processed have a large percentage of one denomination, e.g., 40% or more, the system 3100 may be able to be run continuously for a ½ hour, an hour, or longer before one of the cassettes receiving a non-predominate denomination becomes full. At such time, the processing machine 3101 may be halted and the bills in the full cassette may be strapped down by the strapping unit.

In some embodiments, the strapping unit may accumulate bills received directly from the processing machine 3101 in a position which does not interfere with the acceptance of bills from another source, e.g., cassette interface 2952 or hopper 3058. For example, using FIG. 33 as an example, the bills received directly from the processing machine 3101 may be accumulated in a receiving area 3322 and moved into a strapping position 3320 within the strapping unit 3350 only when a complete strap has been obtained, e.g., one hundred bills. Then if one of the cassettes 118 becomes full and the processing machine 3101 stops when there are only ten $20 bills residing in the strapping unit, bills from the full cassette may nonetheless be strapped down using the strapping unit without having to clear the strapping unit. When an empty cassette is placed back into the processing machine 3101 or the processing machine is otherwise restarted, the strapping unit may continue to accept $20 bills directly from the processing machine 3101 and strap the $20 when a complete strap is reached, e.g., when ninety additional $20 bills are delivered to the strapping unit 1750.

Figure 33:
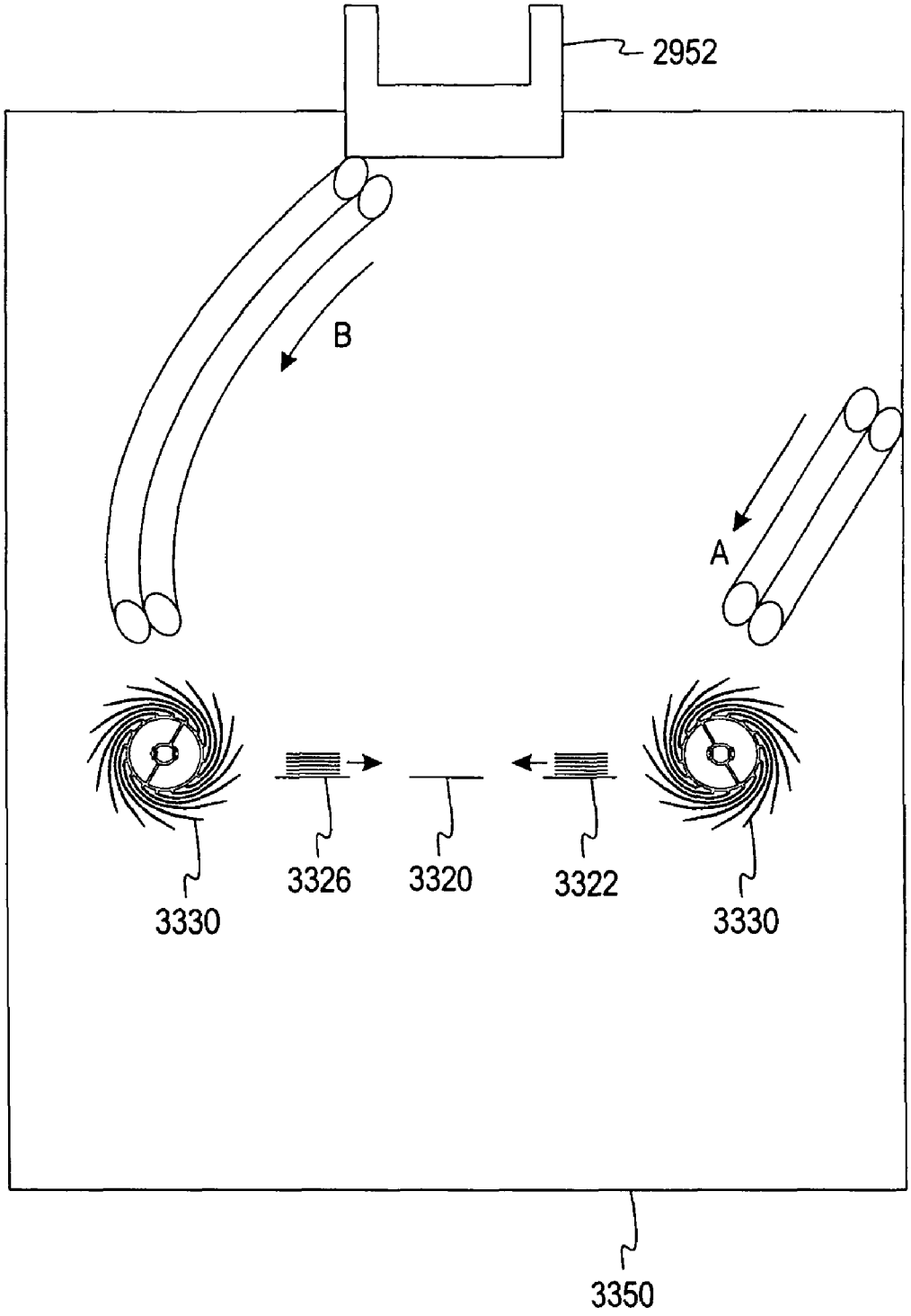
FIG. 33 illustrates strapping unit which can receive bills from a document processing device and from a cassette interface according to one embodiment.

In the example illustrated in FIG. 33, bills received directly from the processing machine 3101 are transported in direction A and accumulated in a receiving area 3322. When a complete strap of bills has been accumulated in receiving area 3322, e.g., one hundred bills, the bills may be moved into the strapping position 3320 and banded. Bills from a cassette may be transported from the cassette interface 2952 in direction B and accumulated in receiving area 3326. When a complete strap of bills has been accumulated in receiving area 3326, e.g., one hundred bills, the bills may be moved into the strapping position 3320 and banded. Stacking wheels 3330 are also illustrated. Although not illustrated, bills from an input hopper 3058 may be handled in a similar manner. For example, in some embodiments a transport mechanism from an input hopper 3058 may merge with the transport mechanism associated with cassette interface 2952 shown generally in the area of arrow B.

In other embodiments, two, three, or more additional strappers 1750 are added to the end of the currency processor 3101. For example, a second strapping unit may be positioned to the left of the strapping unit 1750 depicted in FIG. 31 and the system 3100 may be adapted to deliver bills directly to either of the strapping units, e.g., one strapping unit receiving and strapping $20 bills and the other receiving and strapping $10 bills. Both can be fitted with cassette interfaces 2952 and/or loose bill hoppers 3058. In operation, such a system may be run for several hours with $20 bills and $10 bills being strapped in real time and with bills of other denominations being collected in respective cassettes. The operation of the processing machine 3101 may then been suspended and the set up of the machine may then be changed so that the second strapper no longer receives $10 bills or any bills directly from the processing machine 3101. The machine may then be restarted with $20 bills continuing to be routed to and strapped by the first strapper and $10 bills being routed to one of the output receptacles or cassettes. Then the second strapper could be used to strap down bills which have been accumulated in the cassettes or output receptacles. Such an embodiment may be particularly useful when dynamic pocket assignment has been engaged. For example, where dynamic pocket assignment is engaged, an operator could disable bills from being transported to one of the cassettes, e.g., by operating a cassette release button or switch, and the machine may dynamically reassign the denomination which had been assigned to the released cassette to another pocket or cassette. As an example, if we assume that cassette **118*a* had been receiving $1 bills and that cassette is almost full, the operator could release cassette 118*a* and the machine would automatically dynamically assign $1 bills to another cassette such as cassette 118*e* (assuming that cassette was empty). The operator may then remove cassette 118*a* and couple it to the second strapping unit 1750. The second strapping unit could then strap the $1 bills in cassette 118*a*. When the cassette 118*a* becomes empty, it may be replaced in processing machine 3101 in its original location. The processing machine 3101 is adapted to detect the presence of the empty cassette 118*a*** and recognize that it is available for dynamic assignment of a denomination (or alternatively, depending on the configuration, recognize that it is available again to receive bills having the denomination previously assigned to that cassette, here $1 bills).

The above described procedure also works when the system detects that a cassette has become full. For example, as described above, in some embodiments, when a cassette becomes full, bills having the denomination assigned to that cassette may be redirected to a different dedicated pocket or to one which is dynamically assigned and the machine continues to operate. The machine may continue operating and the operator can be notified of the presence of a full cassette and the operator can remove the cassette and couple it to the second strapping unit which in turn straps the bills contained in the cassette. When the cassette is emptied, the operator may re-insert it into the processing machine 3101. Such procedures reduce the downtime of the machine and enhance efficiency.

Accordingly, in some embodiments, the processing system 1700-3100 can process currency continuously without having to stop when one output receptacle reaches a stack limit and without having to stop while currency is being strapped. The use of the dynamic sorting methods described above in conjunction with the above described strapping systems can facilitate the ability to continuously process currency or documents without having to stop when a particular output receptacle reaches a strap limit. Likewise, the use of systems, such as those described above, in which strapped currency is not returned to an output receptacle 1716 after strapping may also facilitate the ability to continuously process currency or documents without having to stop (or reducing the likelihood that the processing will have to be stopped) because in such embodiments an output receptacle from which bills are removed may become immediately available for the receipt of additional bills and/or dynamic assignment as soon as the bills are removed therefrom.

According to some embodiments, the strapping units 1750/2150/3350 described above (and below) may be provided with means for determining the denomination (or document-type) of bills processed by the strapping unit. By way of example, the strapping unit may employ scanning technology such as described above or in connection with commonly assigned U.S. Pat. Nos. 5,692,067 and 5,815,592, each incorporated herein by reference in its entirety. A variety of other denominating technique may also be employed. For example, U.S. Pat. No. 6,311,819 B1 (incorporated herein by reference in its entirety) mentions a variety of currency characteristics which can be measured using magnetic, optical, electrical conductivity, capacitive, and mechanical sensing and refers to a number of patents (also incorporated herein by reference) further describing such characteristic information sensing and/or denominating techniques.

Some examples of the use of such a denominating strapper will now be described. Such a strapper may have an input hopper having a capacity of, for example, 2,000 notes and may have an adjustable strap limit (e.g., 50 or 100) or limits (e.g., adjustable per denomination strap limits) as described above. Such a strapper could also, or alternatively, be fitted with a cassette interface 2952 or have a one document at a time inlet. Such strappers may be stand-alone or be coupled to a document processor and in some embodiments may be adapted to receive bills directly for a document processing device as described above.

According to one example, a cassette is filled with 200 units of $5 notes, 800 units of $1 notes, 500 units of $10 notes, followed by 500 units of $50 notes. Using a strapper unit having denominating capability and a cassette interface 2952, the strapper to which such cassette is coupled begins drawing out the bills and denominating the bills. The strapper would then begin to strap down the first denomination (in this case $5 notes) and would continue to strap as long as it could create a full strap (in this case, assuming straps of one hundred notes, two straps of $5 notes would be banded). As soon as a new denomination appeared, the strapping mechanism would determine if any bills of the prior denomination remained to be strapped (i.e., less than a full strap). If so, according to some embodiments, bills of the prior denomination being of a number less than a full strap (partial strap) could be removed or ejected from the strapping position such as into an off-sort bin. The strapper could then begin to strap down bills of the second denomination (here, $1 notes), and so on.

As described above, such embodiments may additionally employ one or more denominationally specific banding materials and/or generic and/or generic but modifiable banding material. In operation, the operator places a stack of like bills to strapped in an input receptacle of the strapping unit. The strapping unit then determines the denomination of the bills to be strapped and then straps the bills by selecting an appropriate one of the denominational specific banding materials or rolls or applies the appropriate indicia onto a generic banding material to make it denominationally specific. For example, the size of the documents to be strapped may be used by the strapping unit to make a determination as to which type (denomination) of banding material to use.

Strapping units employed with the above discussed embodiments (or below discussed embodiments such as with stand-alone strapping units) may either be denominational (or document-type) specific or denominational (or document-type) generic. The banding material may be in the form of, for example, roll(s) and/or cut sheet. For example, a denominational specific strapping unit may comprise a single type of denominational specific strapping material or band. For example, a strapping unit may contain only strapping materials bearing the indicia "$1" thereon and thus the strapping unit may be designed to accept and strap only $1 bills.

According to other embodiments, a strapping unit may not be denominational (or document-type) specific. For example, a strapping unit may use a plain band (such as white strapping paper, for example) which may be used to strap any denomination of currency stacks or document-types. Alternatively, a strapping unit may comprise means for tailoring a generic strapping material to become denominational or document-type specific. Alternatively, a strapping unit may comprise a plurality of denominational or document-type specific strapping materials which may be selected from in response to an indication of the identity of the type of documents (or denomination) to be strapped.

For example, according to some embodiments, the strapping unit 1750 (or 2150 or 3350) is adapted to accept a denomination signal that tells the strapping unit which denomination is associated with the currency stack that requires strapping. Then an appropriate banding material may be selected from a plurality of available banding materials to strap the stack of currency or a generic strapping material may be appropriately modified.

Accordingly, in some embodiments, a strapping unit 1750 (or 2150 or 3350) may be adapted to accept a denomination signal (e.g., from a processor of the document processing device 1701) that tells the strapping unit which denomination is associated with the currency stack that requires strapping and then the strapping unit uses the denomination signal to tailor generic strapping material to conform to the denomination which is indicated via the denomination signal. Accordingly, a generic banding material may be tailored so that it becomes denominational or document-type specific. For example, a strapping unit 1750 (or 2150 or 3350) may include a printer such as an inkjet printer, or similar device, that is adapted to spray an appropriate color-coding and/or print appropriate indicia (e.g., alphanumerical characters or symbols) unto blank strapping material before or after strapping a bill stack in response to a denomination or document-type identifying signal. For example, an inkjet printer associated with the strapping unit can be adapted to spray a plain strapping band with yellow ink in response to an indication that the documents to be strapped are $10 currency bills and violet ink in response to an indication that the documents to be strapped are the $20 currency bills. An advantage of the use of generic but modifiable strapping material is that the amount of strapping material that must be kept in inventory may be reduced because separate amounts of denomination specific material need not be kept on hand.

Likewise, according to some embodiments, the strapping unit 1750 (or 2150 or 3350) includes a plurality of strapping material rolls which are color-coded according to a particular denominational or document-type coding scheme (e.g., yellow for $10 and red for $5) and/or which are otherwise denominationally specific (e.g., by having denominational specific alphanumerical characters or symbols printed thereon). Then in response to a denomination or other document-type signal, an appropriate strapping material may be selected and used to strap a stack of documents. For example, if a strapping unit receives a denomination signal indicating that the documents to be strapped are $10 currency bills, then a roll of yellow strapping material (or strapping material having "$10" printed thereon) may be selected and used to strap the documents. Likewise, if the strapping unit receives a denomination signal indicating that the documents to be strapped are $20 currency bills, then a roll of violet strapping material (or strapping material having "$20" printed thereon) may be selected and used to strap the documents.

The denomination signal may be generated based on the operation or selection of buttons or others controls on the strapping unit (such as where the strapping unit is a stand-alone device) or elsewhere on the strapping system (e.g., on the document processing device 1701 shown in FIG. 17). The buttons or other controls may, for example, comprise a number of denomination specific buttons or selections, e.g., a $1 button, a $5 button, etc. For example, according to some embodiments, an operator would push a $20 button to indicate that the bills to be strapped are $20 bills and the operator would push a $5 button to indicate that the bills to be strapped are $5 bills. Alternatively, the denomination signal may be generated based on the automatic determination of the denomination of bills such as by the document processing system (e.g., units 108, 1708) which is then provided to the strapping unit or by the strapping unit itself where the strapping unit itself contains means for determining the denomination of bills (e.g., unit 108 or the means described or referred to elsewhere in this application). Where the denomination signal is based on the means to determine the denomination of bills within the strapping unit itself, the strapping unit may be either a stand-alone unit or part of a larger system. As described above, in response to a denomination signal (such as where an operator presses a $20 key), appropriate banding material be selected or tailored (e.g., appropriate alphanumeric or color may be printed on a generic banding material).

Furthermore, the above strapping units can be adapted to permit the operator change the strapping material being used. Such a configuration is particularly useful when a denomination specific or document-type specific strapping material is being employed by a strapping unit. For example, through a strapping set-up option an operator could indicate that only $1 bills are to be strapped. Then denomination specific strapping material in a strapping unit (such as 1750 or 2150 or 3350, e.g., 1750 of FIG. 17) of a document processing and strapping system could then be changed to have the appropriate indicia (e.g., strapping material with "$1" printed thereon). Then the operator could process the desired stack or stacks of bills with the bills having a denomination of $1 being strapped. If the operator then wanted to change the operation of the device so that $20 bills were strapped, the operator could change the strapping operation via a strapping set-up option so that $1 bills are no longer strapped while $20 bills are now strapped. Likewise, the operator could replace the "$1" strapping material in the strapping unit with "$20 strapping material.

Likewise according to some embodiments, additional information may be added to strapping material (whether denominationally specific or not). For example, means may be provided for adding information to strapping material such as a printer. Devices employing one or more strapping units having such means for adding information to strapping material could be adapted to add such information as the time and/or date when the bundle was strapped, the sequence or batch number, the teller or device operator name and/or number, etc. Furthermore, the device may have an interface adapted to receive information to be added to the strapping material. For example, the device could be adapted to receive an identification of the operator and/or batch or sequence number and this information could then be printed or otherwise added to the strapping material.

Furthermore, what information should be added to the strapping material may be user selectable and the device may include means such as a user interface adapted to receive instructions from an operator as to what information should be added to strapping material. For example, an operator could instruct the device to print the denomination, date, time, and operator information on straps of bills. Another operator or when processing a different batch of bills, an operator could instruct the device to print the denomination, date, and batch number.

According to some embodiments, an interface is utilized to apply other information to the denominationally specific banding materials and/or generic but modifiable banding materials. Such information may comprise, but is not limited to, the date, time, operator ID, operator name, appropriate bank name and/or number, unique client information, denomination of the currency, etc. To assist with date and time information, the strapping unit may comprise an internal clock or may be coupled to an external clock. Other embodiments utilize the interface to apply imprints to the banding materials, which may comprise but are not limited to, two or more of any of the aforementioned types of information. For example, an imprint could comprise the operator's name, date and the denomination of the bills strapped. The imprints could be electronically stored in a memory of the strapping unit or larger system. Thus, the operator has the ability to quickly pull up unique imprints without reproducing the various information every time the machine is used. Also, some embodiments employ a password controlled interface that is utilized to pull up operator specific banding information. In this manner, operator specific imprints may be produced without permitting the operator to attribute straps to another operator, time, date, etc. As described above and below, strapping units having such interfaces and/or capabilities may be stand-alone devices or part of a larger system such as described in this application.

Additionally the strapping units described above could be embodied in stand-alone strapping systems, that is, apart from a document processing device such as device 1701. For example, according to one embodiment, a strapping unit is provided which is adapted to accept a stack of bills, all of the same denomination. The strapping unit may contain one or more denominational specific strapping materials. Alternatively or additionally, the strapping unit may contain non-denominationally (or document-type) specific material and strap bills with a non-denominational strapping band or a band which has been modified to become denominationally specific (e.g., via the strapping unit applying color ink or other indicia thereon such as via a printer contained in or associated with the strapping unit).

According to some embodiments employing only a single denominationally specific banding material (e.g., rolls pre-printed with a denominational indicia thereon), an operator places a stack of bills of the appropriate denomination to be strapped into an input receptacle of the strapping unit and the strapping unit then straps the bills. When a different denomination (or document-type) is to be strapped by the strapping unit, the operator changes the strapping material to the appropriate new type of document specific material.

According to some embodiments employing one or more denominationally specific banding materials and/or generic but modifiable banding material, the operator places a stack of like bills to strapped in an input receptacle of the strapping unit. The strapping unit further comprises an interface for the operator to indicate the denomination (or document-type) of bills (or documents) to be strapped. The operator uses the interface to indicate the denomination of the bills to be strapped and the strapping unit then straps the bills by selecting an appropriate one of the denominational specific banding materials or rolls or applies the appropriate indicia onto a generic banding material to make it denominationally specific.

According to some embodiments, a strapping unit is provided with means for determining the denomination (or document-type) of a stack of bills placed into the input receptacle of the strapping unit. Such embodiments may additionally employ one or more denominationally specific banding materials and/or generic but modifiable banding material. In operation, the operator places a stack of like bills to strapped in an input receptacle of the strapping unit. The strapping unit then determines the denomination of the bills to be strapped and then straps the bills by selecting an appropriate one of the denominational specific banding materials or rolls or applies the appropriate indicia onto a generic banding material to make it denominationally specific. For example, the size of the documents to be strapped may be used by the strapping unit to make a determination as to which type (denomination) of banding material to use. Alternatively, the strapping unit may employ scanning technology such as described above or in connection with commonly assigned U.S. Pat. Nos. 5,692,067 and 5,815,592, each incorporated herein by reference in its entirety.

Figure 34:
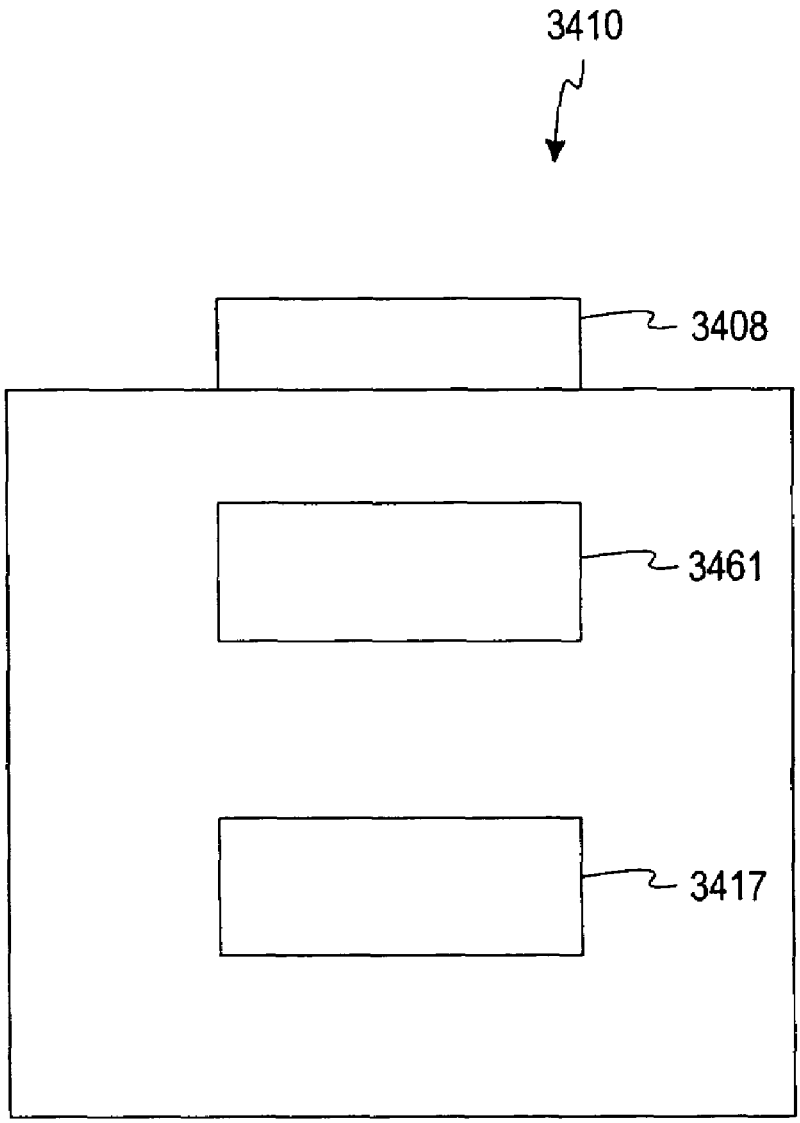
FIG. 34 illustrates one embodiment of a stand-alone strapping device.

FIG. 34 illustrates one exemplary embodiment of a standalone strapping unit. As shown in FIG. 34, a strapping device 3410 may comprise an input receptacle 3408, and an output receptacle or strapping position 3417, a denomination detector, and a transport mechanism (e.g., such as a device similar to that described in U.S. Pat. No. 5,815,592). Bills placed into the input receptacle may be transported, one by one, past a denomination detector and be restacked in a single output receptacle or strapping position. The strapping unit determines the denomination of each bill and provided they are all the same transports the bills into the strapping position or output receptacle until a strap limit is reached (e.g., 100 bills of the same denomination have been transported into the strapping position or output receptacle). At that point the transporting is suspended and the bills in the strapping position or output receptacle are strapped by the strapping unit with an appropriate band. According to some embodiments, the strapping unit may comprise a strapping position and an output receptacle with the strapping position being upstream of the output receptacle. Bills may be strapped while they reside at the strapping position and the strapped bill stack may then be moved to the output receptacle. According to other embodiments, the output receptacle also serves as the strapping position.

The operation of the strapping unit may be resumed after the strapped bills are removed from the strapping position or output receptacle by the operator. Alternatively, the strapping unit may have means for removing the bills from the strapping position or output receptacle (e.g., a lever designed to push the strapped bills out of the output receptacle and, for example, into an appropriately located storage container or out of the strapping position and into an output receptacle). The strapping unit may then automatically resume processing bills and transporting denominated bills to the strapping position or output receptacle until a strap limit is again reached. In the case of a no call or wrong denomination bill being encountered, then unit may halt and provide an indication of the problem to the operator (e.g., via a display 3461 and/or audible signal). According to some embodiments, the strapping unit may be halted with the problem bill being the last bill in the output receptacle as described in U.S. Pat. No. 5,815,592.

Likewise, the embodiments described in FIGS. 4*a*-4*c* and 5*a*-5*c* and those described in commonly owned U.S. Pat. No. 6,311,819 (incorporated herein by reference in its entirety) may be adapted to operate in a similar manner with one or more of the output receptacles being adapted to strap bills therein. In some embodiments of multi-pocket devices, problem bills such as no calls, suspects, or wrong denomination bills may be off-sorted to a different output receptacle. In the event of a problem bill, the device may be adapted to halt or not to halt or to provide the operator the flexibility to decide whether the device should halt as described in more detail in U.S. Pat. No. 6,311,819.

Figure 35:
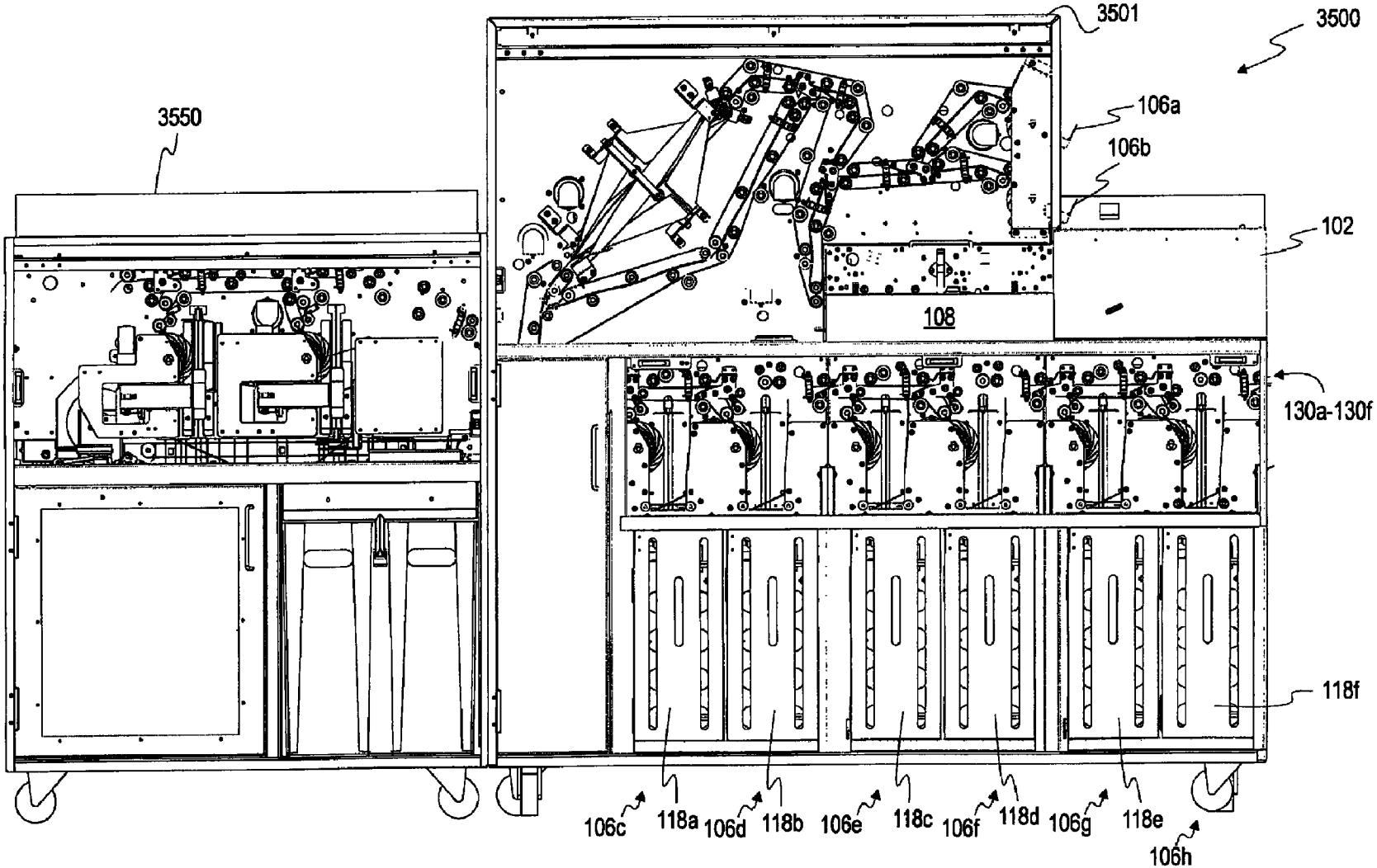
FIG. 35 is a front view of a multi-pocket document processing and strapping system according to one embodiment.

FIG. 35 is a front view of a multi-pocket document processing and strapping system 3500 similar that described above in connection with FIG. 31. The processing and strapping system 3500 comprises a processing device 3501 and a strapping unit 3550. In the embodiment illustrated, the processing device comprises a number of lower output receptacles 106*c*-106*h*. As described above in connection with FIGS. 31 and 32, the operator may program the system 3500 to direct bills of a particular denomination to one of the output receptacles 106*a*-106*h* of the processing device 3501 or to the strapping unit 3550 and/or denominations may be dynamically assigned to one or more of the output receptacles 106*a*-106*h* or to the strapping unit 3550 and/or the individual strapping positions within the strapping unit.

Figure 36A:
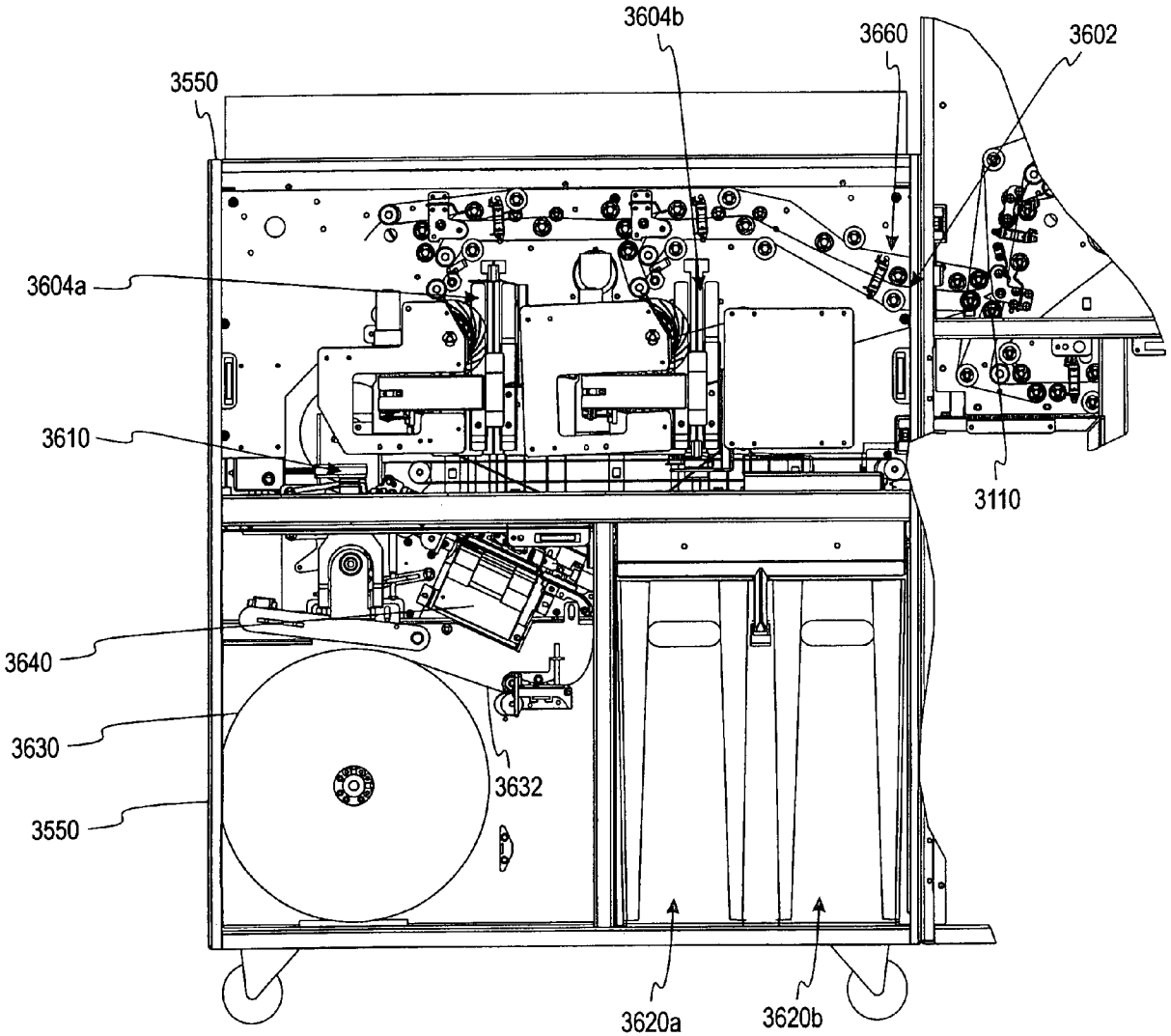
FIG. 36*a* is a front view of a strapping unit according to one embodiment.

FIG. 36*a* is a front view of strapping unit 3550. Bills entering the strapping unit 3550 from the processing device 3501 of FIG. 35 at area 3602 are transported to one of two stacking positions or receptacles 3604*a,b*. In some embodiments, bills are sent to a particular one of the stacking receptacles 3604*a,b* until a strap limit is reached. When a strap limit is reached, incoming bills then begin to be delivered to the other stacking receptacle. In the meantime, the complete stack of bills (a stack having the number of bills defined by the strap limit) are then transferred to a strapping position 3610 where the stack of strapped. Once a stack has been strapped, it is then transferred into a strap currency storage bin 3620*a,b*.

Also illustrated in FIG. 36*a* is a spool 3630 of strapping or banding material 3632. As discussed above, this strapping material may be generic or denominational specific. The strapping unit 3550 also comprises a printer 3640 which is located in close proximity to the strapping position 3610. According to some embodiments the printer comprises a black and white printhead and a color printhead. In other embodiment, only a black and white or only a color printhead is provided.

Figure 36B:
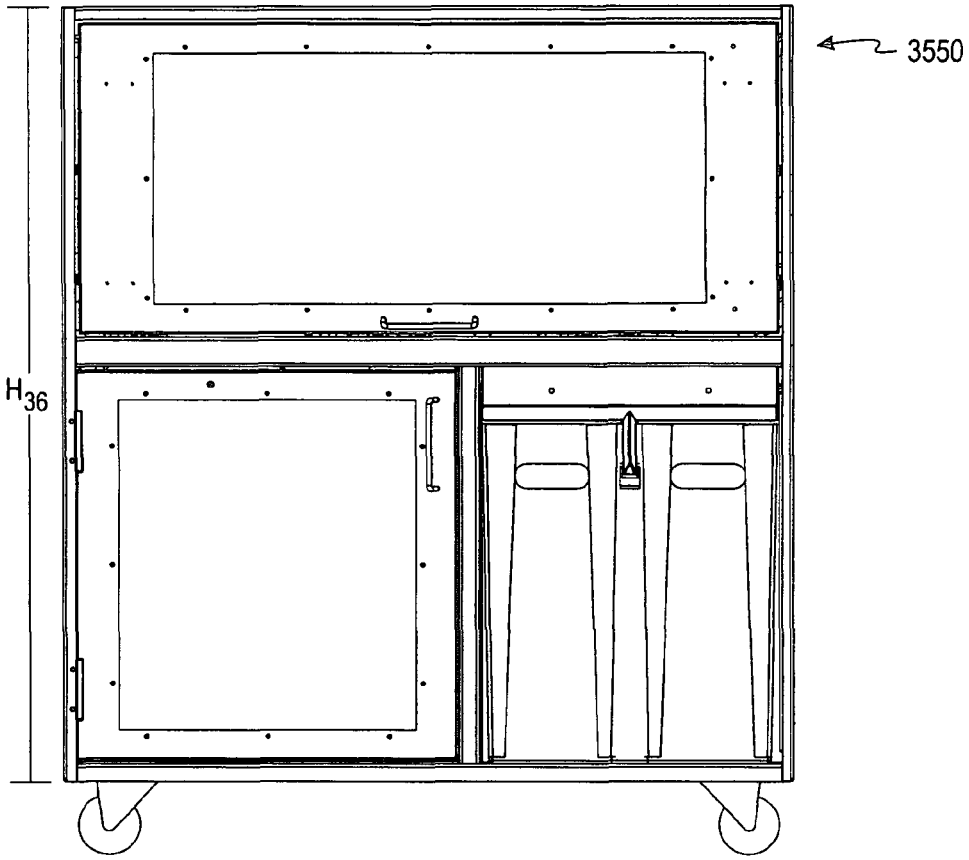
FIG. 36*b* is a front view of a strapping unit shown with closed doors and FIG. 36*c* is a top view of the strapping unit according to one embodiment.
Figure 36C:
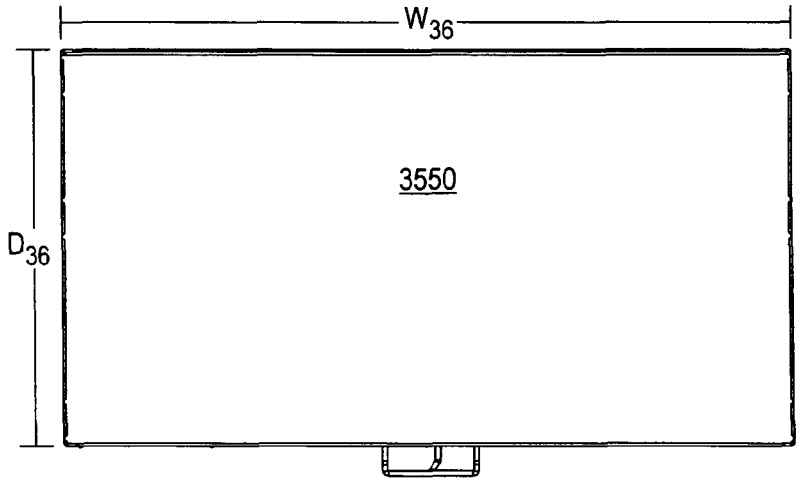

FIG. 36*b* is a front view of the strapping unit 3550 shown with closed doors and FIG. 36*c* is a top view of the strapping unit 3550. As can be seen in FIGS. 36*b* and 36*c*, according to some embodiments, the strapping unit 3550 has a height, $H_{36}$, of 42 inches (107 cm) or less, a depth, $D_{36}$, of 20 inches (50 cm) or less, and a width, $W_{36}$, of 36 inches (91 cm) or less.

The operation of the strapping unit 3550 and the processing device 3501 will now be described using the example wherein $20 bills have been designated to be strapped with reference to FIGS. 35 and 36. A stack of bills to be processed is placed in input receptacle 102 of the processing device 3501. Bills are then fed, one by one, through a discriminating region 108 where information from passing bills is detected to, for example, denominate passing bills. Based on the information detected from a bill, that bill is directed to one of the output receptacles 106*a*-*h* or to the strapping unit 3550. In the present example, if the bills is determined to be a $20, it is routed to the strapping unit 3550. According to one embodiment, when the first $20 bill is detected is a routed into stacking position 3606*a*. Using a strap limit of 100 bills as an example, the next 99 $20 bills are also routed to stacking position 3606*a*. However, the 101$^{st}$ $20 bills is directed to stacking position 3606*b*. The stack of 100 $20 bills are then transferred from the stacking position 3606*a* to the strapping position 3610 where the stack of 100 $20 bills is strapped with some of the strapping or banding material 3632. The strapped stack of $20 bills is then deposited into one of the strapped currency storage bins 3620*a,b*.

In the meantime, any incoming $20 bills are directed to the second stacking position 3604*b*. More specifically; the 101$^{st}$ through the 200$^{th}$ $20 bill sent to the strapping unit 3550 are stacked in stacking position 3604*b*. Once the 200$^{th}$ $20 bill has been delivered to the second stacking position 3604*b*, the now complete stack of 100 $20 bills for stacking position 3604*b* is then transferred to the strapping position 3610 where it is strapped and then to one of the strapped currency storage bins 3620*a,b*. In the meantime, any incoming $20 bills are directed to the first stacking position 3604*a*, i.e., the 201$^{st}$-300$^{th}$ $20 bills. This processed is continued with each set of hundred bills being delivered to alternating ones of the stacking positions 3604*a,b*. Such a procedure increases the throughput of the strapping unit 3550 and system 3500 as the operation the strapping unit need not be suspended while one stack of bills is being strapped.

According to some embodiments, strapped stacks of bills are deposited into a first one of the strapped currency storage bins 3620*a,b* (e.g., 3620*a*) until the bin becomes full and then strapped stacks of bills are deposited into a second one of the strapped currency storage bins 3620*a,b* (e.g., 3620*b*). According to some embodiments, when one of the strapped currency storage bins 3620*a,b* becomes full, the system 3500 alerts the operator such as via a light, displayed message on a user interface, and/or a audible signal. The operator can then empty or replace the full storage bin while the strapping unit continues to deposit strapped currency into the other storage bin. Once the first bin has been emptied or replaced with an empty bin, the strapping unit may begin depositing strapped currency into it again when the second bin becomes full. The process may be continued in this alternating manner. According to such embodiments, the strapping unit 3550 and system 3500 may continuously operate as long as the operator empties storage bins as they become full. Such a procedure increases the throughput of the strapping unit 3550 and system 3500.

Bill location sensors are positioned throughout the transport path of the processing unit 3501 and the strapping unit 3550 to monitor and keep track of the location of each bill along the transport paths of the system 3500. According to some embodiments, when the last bill in a strap (e.g., the 100$^{th}$ bill) is detected by the discriminating unit 108, an appropriate signal is sent to the printer 3640 and the printer prints any desired information onto the strapping material (e.g., the denomination; a color; the total value of the strap; the date; the time; the name, number, and/or alphanumeric designation of the operator; and/or the name, number and/or alphanumeric designation of the bank such as the bank's ABA routing number. For example, for a stack of 100 $20 bills, the printer may print a violet strip or image on the banding material along with text reading "$2000, ABC Bank, B12345, Smith248, 6/4/03, 1:32 p.m." The violet color may correspond to $20 bills, "$2000" indicated the total value of the strap, the bank name is "ABC Bank"; "B12345" indicates the bank's number; "Smith248" designates the operator of the system when the strap was banded; "6/4/03" indicates that date the strap was banded—Jun. 4, 2003; and "1:32 p.m." indicates the time the strap was banded.

In some embodiments, when the last bill in a strap (e.g., the 100$^{th}$ bill) reaches the strapping unit 3550 and is detected by a position sensor located, for example, in area 3660, an appropriate signal is sent to the printer 3640 and the printer prints any desired information onto the strapping material as discussed above. Alternatively, in some embodiments, when the last bill in a strap (e.g., the 100$^{th}$ bill) reaches one of the strapping positions 3604*a,b* and is detected by a position sensor located, for example, in area 3762*a,b* (see FIG. 37), an appropriate signal is sent to the printer 3640 and the printer prints any desired information onto the strapping material as discussed above. Thus, according to some embodiments, information about a stack of bills to be strapped is printed on strapping material (and/or the strapping material is appropriately modified, e.g., color is added) substantially simultaneously upon the determination that a complete stack exists to be strapped and/or substantially simultaneously with the determination that a stack of bills will be sent to the strapping position (such as when a signal is provided indicating that an incomplete stack of bills is to be strapped such as when the operator desires to purge the strapping unit). According to some embodiments, information about a stack of bills to be strapped is printed on strapping material (and/or the strapping material is appropriately modified, e.g., color is added) within about a second of a determination that a complete stack exists to be strapped and/or within about a second of a determination that a stack of bills will be sent to the strapping position (such as when a signal is provided indicating that an incomplete stack of bills is to be strapped such as when the operator desires to purge the strapping unit). Thus according to some embodiments, the printer prints the stack specific information/color onto strapping material to be used to strap the stack in the same cycle—identify complete stack, print desired information/color on strapping material, and strap stack. When the next complete stack is identified in the next cycle, the printer prints any desired information/color during that next cycle.

Advantages of such embodiments include fewer purge cycles in the event of a jam and thus less wasted strapping material and less wasted time purging pre-printed strapping material. Additionally, multiple stacks, each stack having the same denomination of bills within a given stack but having different denominations from stack to stack, can be strapped with the same strapping unit. Additionally, by printing just prior to strapping a stack, there is minimal time delay of the information printed on the strapping material and time a stack is actually strapped.

Figure 37:
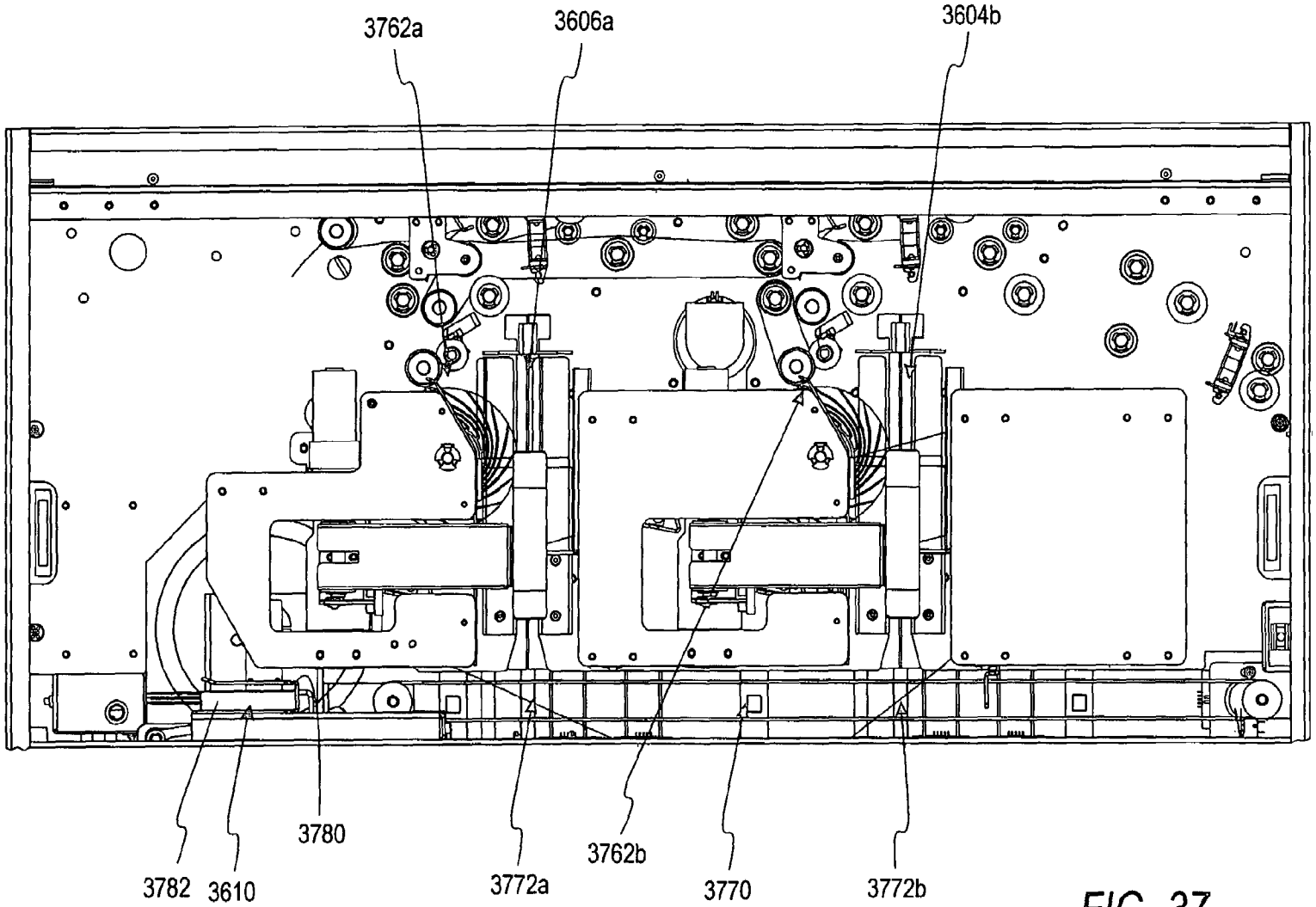
FIG. 37 is an enlarged view of a portion of a strapping unit according to one embodiment.

Referring to FIG. 37, after the appropriate number of bills have be deposited in a stacking position 3606*a,b*, e.g., 100 bills, the stack of bills in the stacking position is lowered into the area of a raceway 3770 such as location 3772*a* or 3772*b*. A carriage 3780 then travels from right to left as seen in FIG. 37 and grabs the stack of bills 3782 to be strapped and moves them to the strapping position 3610. The bills are then strapped. After the bills have been strapped, the carriage 3780 moves back to the right carrying the strap of bills with it. A stripping flange positioned above the appropriate one of the strapped currency storage bins 3620*a,b* extends into the raceway 3770 and strips the strap of bills from the carriage as the carriage continues to move to the right. The strap of bills then falls into the appropriate one of the storage bins 3620*a.b*.

Figure 38A:
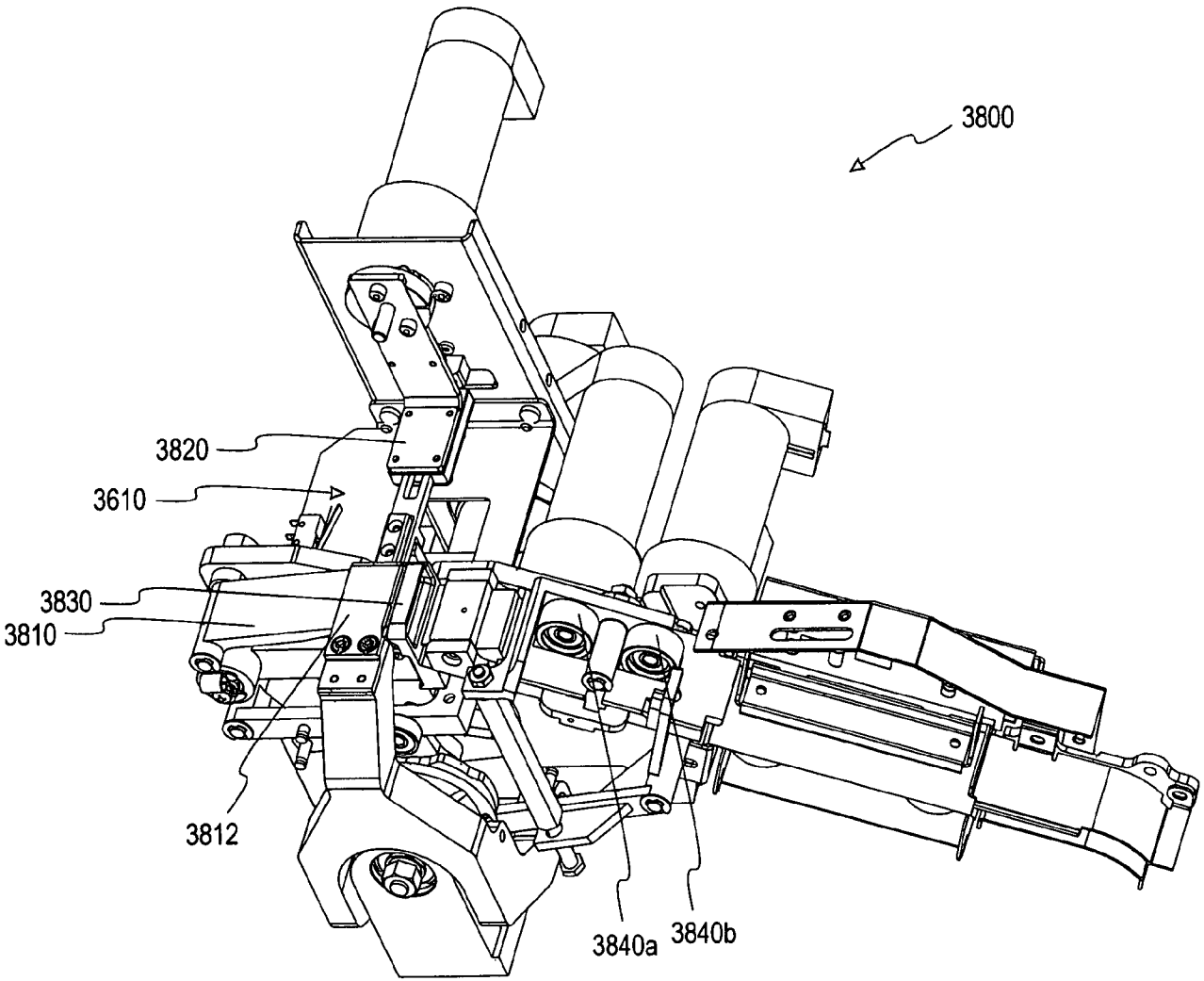
FIG. 38*a* is a perspective view and FIG. 38*b* is a front view of components of a strapping mechanism according to one embodiment.
Figure 38B:
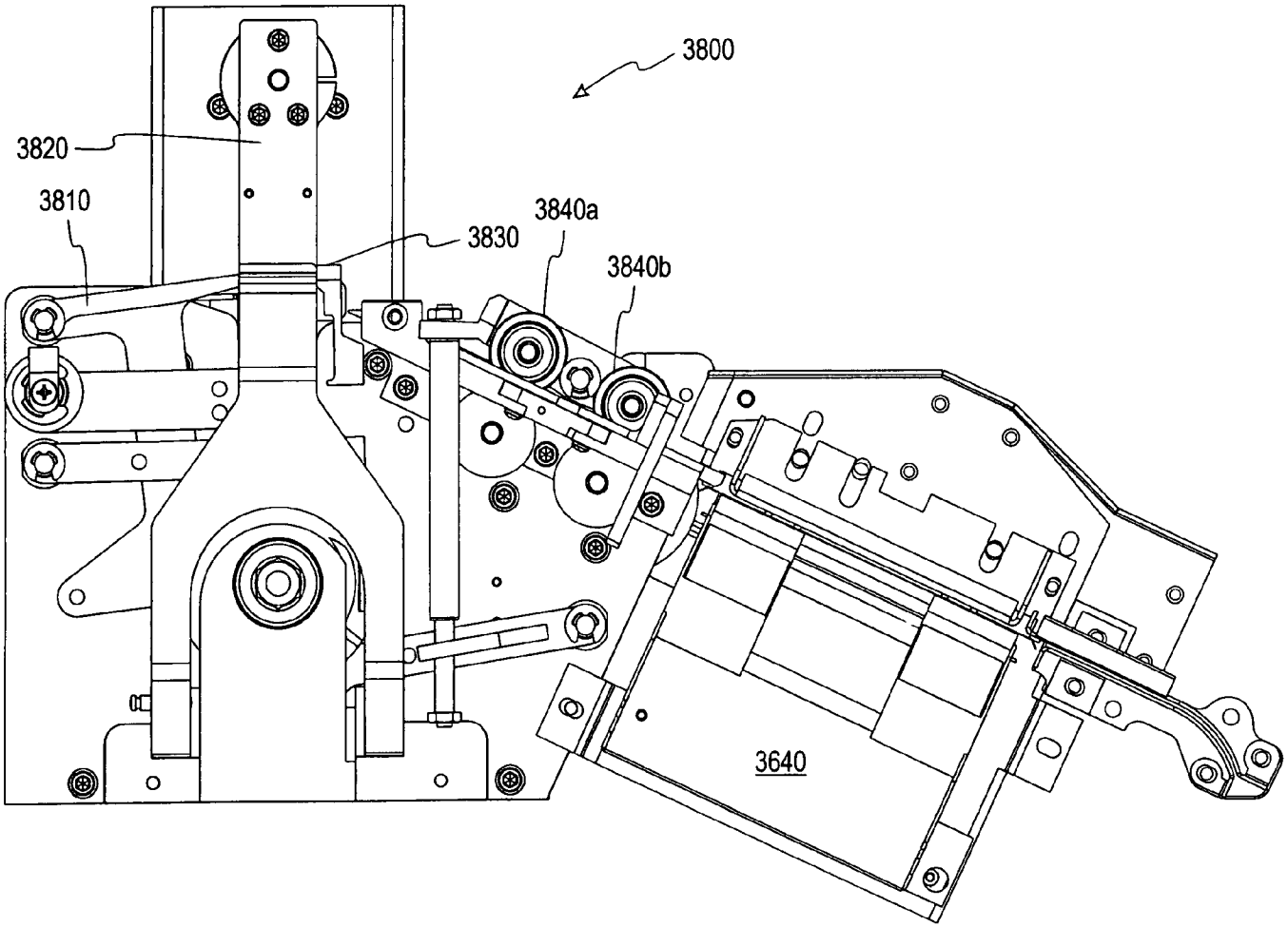
Figure 39A:
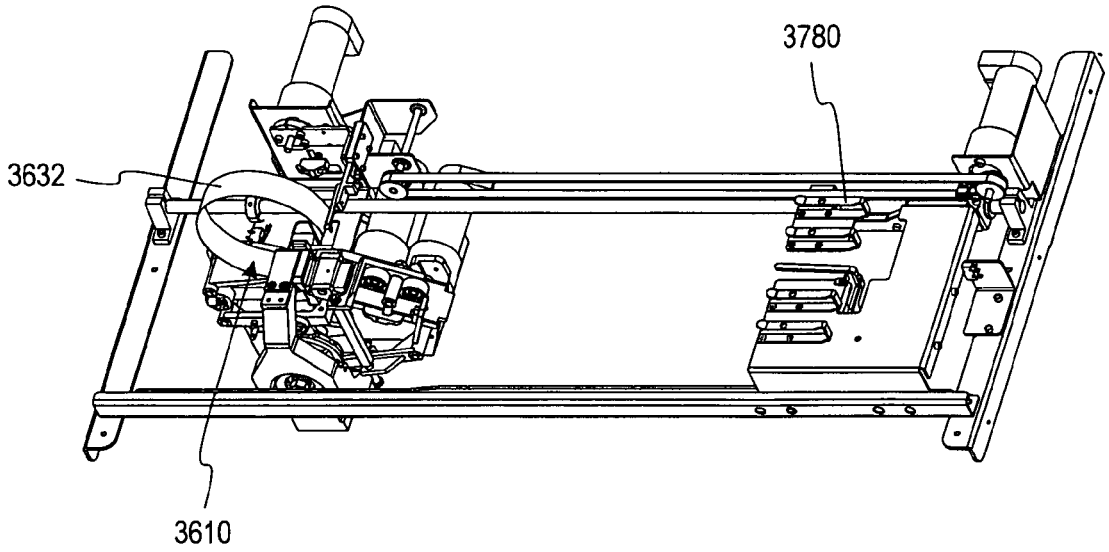
FIG. 39*a* is a perspective view and FIG. 39*b* is a front view illustrating raceway, carriage, and strapping assemblies according to one embodiment.
Figure 39B:
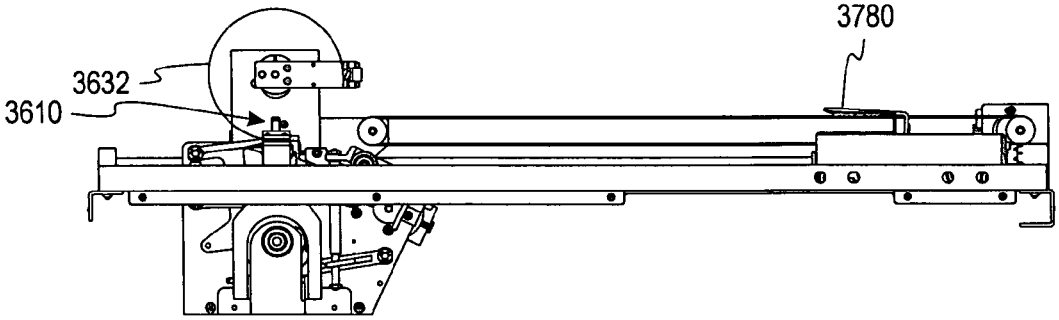

FIG. 38*a* is a perspective view and FIG. 38*b* is a front view of components of a strapping mechanism 3800. FIG. 39*a* is a perspective view and FIG. 39*b* is a front view illustrating raceway, carriage, and strapping assemblies. The strapping mechanism comprises a loop gripper 3810 adapted to hold the end of strapping material 3632 fed into the strapping position

3610 and an anvil 3812. While the loop gripper 3810 holds the end of the strapping material 3632, a portion of the wrap arm 3820 extends and grabs the strapping material. Additional strapping material is then fed into the strapping area by one of strapping material feed rollers 3840*a,b* while the wrap arm 3820 rotates clockwise until about ¾ of a complete loop is formed as illustrated in FIGS. 39*a* and 39*b*. Then the carriage 3780 carrying a stack of bills to be strapped moves into the strapping position 3610. Additional strapping material is then fed into the strapping area by the feed rollers 3840*a,b* and the wrap arm 3820 rotates clockwise so that the strapping material 3632 extends completely around the stack of bills to be strapped. Excess strapping material 3632 is removed from the strapping area by reverse feeding it back toward the printer 3640 by one of the feed roller 3840*a,b* until the stack of bills is tightly banded by the strapping material. An end gripper 3830 comprising a cutter and a heater then extends upward and cuts the strapping material while heat sealing the ends of the thermoplastic coated strapping material together.

As can be seen in FIG. 38*b*, according to some embodiments, the printer 3640 is located very close to the strapping position 3610. Such positioning facilities printing on the strapping material at a time when the information about a complete stack of bills has been determined. For example, if a first stack of $20 bills was sent to the strapping unit 3550 and then the operator changed the configuration of the processing and strapping system such that the processing unit is adapted to send and the strapping unit is adapted to receive and strap $10 bills, the strapping unit straps the stack of $20 bills with appropriate modified strapping material (e.g., having a violet color and/or "$20" printed thereon) and then straps the stack of $10 bills with appropriately modified strapping material (e.g., having a yellow color and/or "$10" printed thereon) without wasting any strapping material and without requiring the operator to manually change the strapping material or discard excess strapping material printed with the wrong denominational information, e.g., "$20". Likewise, if at the time the configuration is changed from $20 bills to $10 bills, an incomplete stack of $20 bills exists in the strapping unit, the incomplete stack of bills may be immediately sent to the strapping position without having to wait for a complete stack to be obtained and the printer may be adapted to print an appropriate message on the strapping material (e.g. "incomplete strap" or the total value such as "$840" where the stack contains only 42 notes instead of the complete strap total value of "$2000").

According to some prior machines, the printer is located further from the strapping position and strapping units modify strapping material before the existence of an actual stack of bills to be strapped has been confirmed. Rather, some prior machines modify strapping material based on anticipated information about the documents to be strapped such as the anticipated denomination of the bills. Such arrangements can result in strapping material having to be purged and discarded from the strapping unit when, for example, the denomination of bills to be strapped is changed. Furthermore, the pre-printing of information can result in other inaccuracies such as the time the documents were actually strapped and/or the operator who was running the system at the time the documents were actually strapped.

According to some embodiments, the rail and carriage system illustrated above in connection with FIGS. 35-37 is extended into the processing device 3501 so that the carriage may transfer a stack of bills from any of the escrow compartments 116*a*-116*f* to the strapping position 3610, thereby permitting bills delivered to any of the escrow compartments 116*a*-116*f* to be strapped. Furthermore, as described above, the carriage may also return the strapped bills to any of the output receptacle 106*c*-106*h* such as the output receptacle from which the bills were originally taken. For example, the cassettes 118*a*-118*f* may be replaced with storage bins and strapped currency could be dropped from the carriage into an appropriate one of the storage bins. Alternatively, the carriage may be adapted to deposited and the cassettes may be adapted to receive strapped stacks of currency.

Likewise, the carriage and rail system described in connection with FIGS. 35-37 may be employed as the means 1740 for moving currency bills from one or more of the output receptacles 1716*a*-1716*f* to the strapping unit 1750/strapping position as described above such as in connection with FIGS. 17, 19-20, and 29.

According to some embodiments, the stacking positions 3604*a* and 3604*b* are adapted to accept stacks of 1000 bills and the carriage 3780 is adapted to transport a stack of a thousand bills to the strapping position 3610. In such embodiments, the wrap arm is longer but otherwise the strapping mechanism operates in a similar manner as described above to strap the stack of 1000 bills.

According to some embodiments, the document processing and strapping systems described above are adapted to strap bundles of strapped currencies. For example, some embodiments are adapted to place a strap around a stack of ten straps of notes, each strap containing one hundred notes. Such an arrangement of a strap about ten straps of notes, each strap having one hundred notes is referred to as a standard bundle of notes—one bundle having one thousand notes.

One embodiment for strapping a standard bundle of notes comprises a strapping unit similar to that described above in connection with FIGS. 35-39, however, the storage bins 3620*a,b* are replaced with one or more strapped bill stacking positions adapted to accept multiple straps of bills, such as ten straps. In some embodiments, the multiple straps are stacked one on top of the other in a column. In some embodiments, the multiple straps are arranged in two side-by-side columns such as two columns of five straps each. Then in a manner similar to that discussed above in connection with stacking positions 3606*a,b* and the rail and carriage system of FIGS. 35-39, when an appropriate number of straps have been accumulated in a strapped bill stacking position, the bottom of the stacking position is lowered into a bundle rail area and a bundle carriage adapted to grab the stack of multiple straps transfers the multiple stacks into a bundle strapping position similar to the strapping position 3610 described above. In the bundle strapping position a strapping mechanism similar to that described above in connection with FIGS. 35-39 but having a longer wrap arm bundles the multiple straps together with a segment of strapping material. The strapping material may be modified to have bundle specific information in a manner similar to that described above (e.g., a printer printing color or alphanumeric information on the strapping material such as denomination, operator, bank, time, date, etc. information). The carriage may then transfer the bundle to an appropriate bundle storage bin.

The strapping units described above including those discussed in connection with FIGS. 17-39 may transport, denominate, and strap bills at speeds as described in U.S. Pat. No. 5,815,592 and U.S. Pat. No. 6,311,819 such as in excess of 800, 1000, 1200, and 1500 bills per minute.

Alternative Strapping Device

Figure 40:
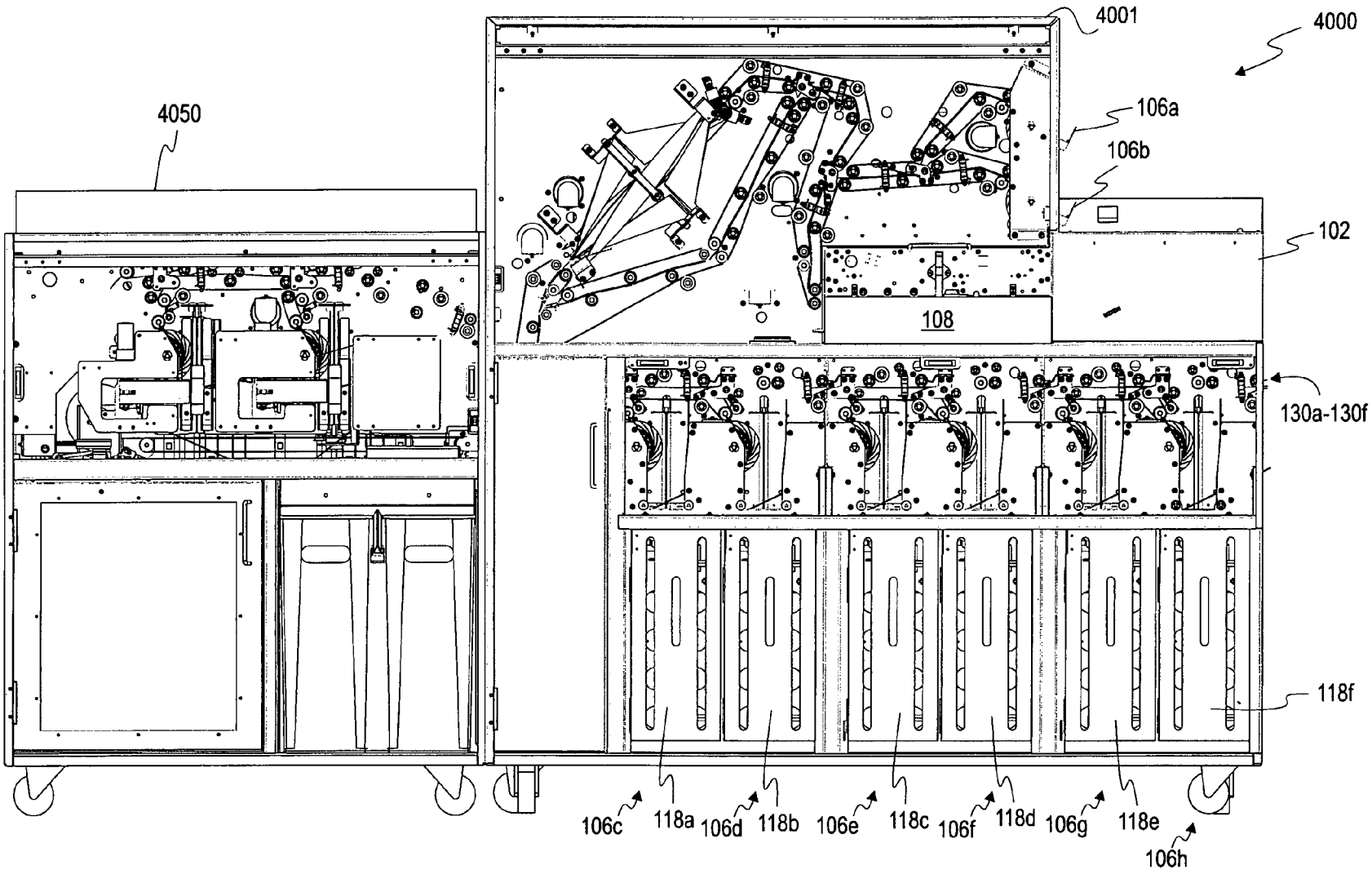
FIG. 40 is a front view of a multi-pocket document processing and strapping system according to one embodiment.

Turning now to FIG. 40, a front view of a multi-pocket document processing and strapping system 4000 similar that described above in connection with FIGS. 31 and 35, according to a further embodiment of the present invention. The processing and strapping system 4000 comprises a processing device 4001 and a strapping unit 4050. In the embodiment illustrated; the processing device comprises a number of lower output receptacles 106*c*-106*h*. As described above in connection with FIGS. 31 and 32, the operator may program the system 4000 to direct bills of a particular denomination to one of the output receptacles 106*a*-106*h* of the processing device 4001 or to the strapping unit 4050 and/or denominations may be dynamically assigned to one or more of the output receptacles 106*a*-106*h* or to the strapping unit.

Figure 41A:
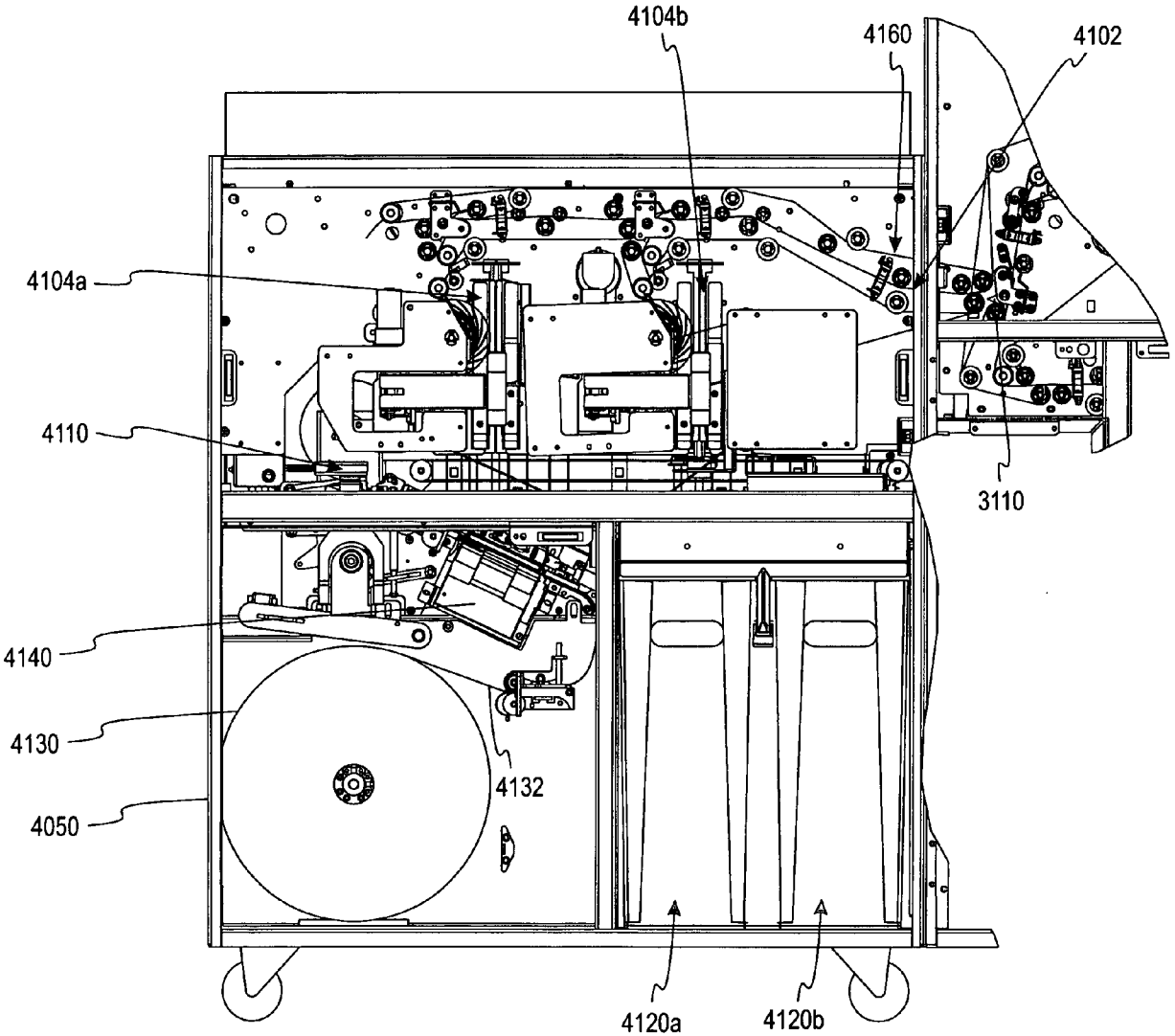
FIG. 41*a* is a front view of a strapping unit according to one embodiment.

FIG. 41*a* is a front view of strapping unit 4050. Bills entering the strapping unit 4050 from the processing device 4001 of FIG. 40 at area 4102 are transported to one of two stacking positions or receptacles 4104*a,b*. In some embodiments, bills are sent to a particular one of the stacking receptacles 4104*a,b* until a strap limit is reached. When a strap limit is reached, incoming bills then begin to be delivered to the other stacking receptacle. In the meantime, the complete stack of bills (a stack having the number of bills defined by the strap limit) are then transferred to a strapping position 4110 where the stack is strapped. Once a stack has been strapped, it is then transferred into a strapped currency storage bin 4120*a, b*.

Also illustrated in FIG. 41*a* is a spool 4130 of strapping or banding material 4132. As discussed above, this strapping material may be generic or denominational specific. The strapping unit 4050 also comprises a printer 4140 which is located in close proximity to the strapping position 4110. According to some embodiments the printer comprises a black and white printhead and a color printhead. In other embodiments, only a black and white or only a color printhead is provided.

Figure 41B:
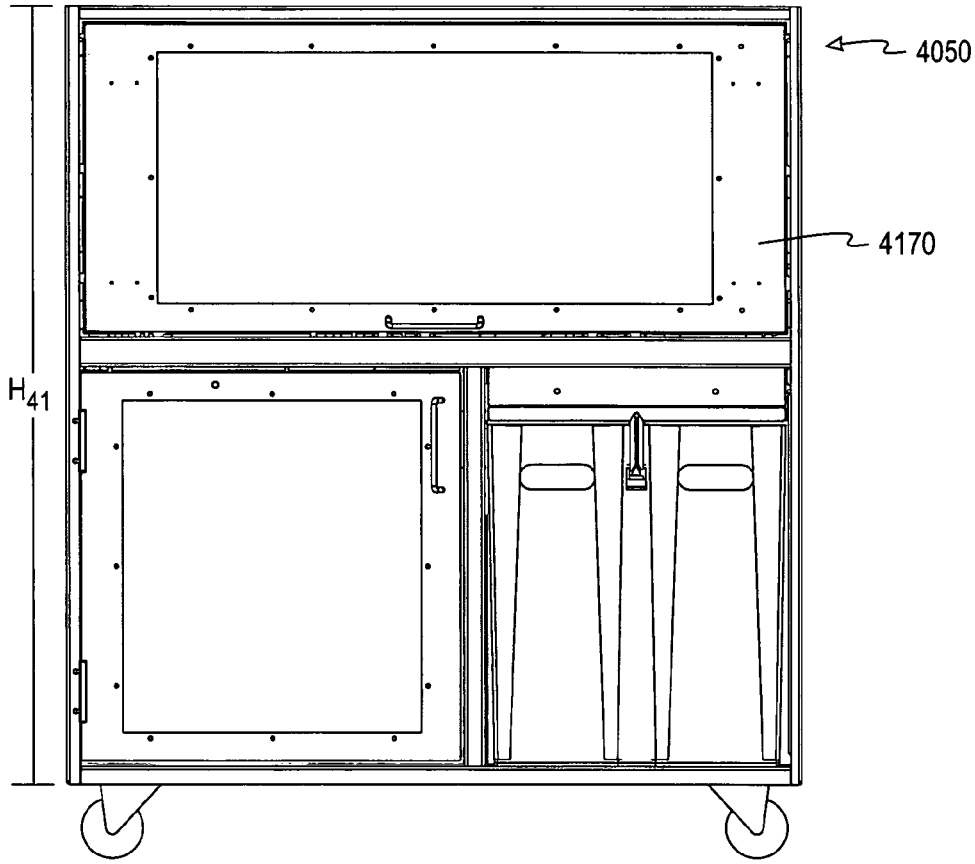
FIG. 41*b* is a front view of a strapping unit shown with closed doors
Figure 41C:
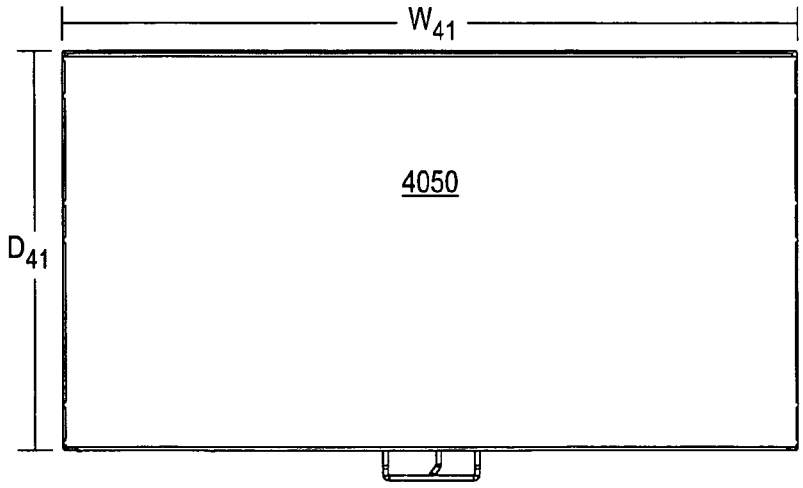
FIG. 41*c* is a top view of the strapping unit according to one embodiment.

FIG. 41*b* is a front view of the strapping unit 4050 shown with closed doors and FIG. 41*c* is a top view of the strapping unit 4050. As can be seen in FIGS. 41*b* and 41*c*, according to some embodiments, the strapping unit 4050 has a height, $H_{41}$, of 42 inches (107 cm) or less, a depth, $D_{41}$, of 20 inches (50 cm) or less, and a width, $W_{41}$, of 36 inches (91 cm) or less.

The operation of the strapping unit 4050 and the processing device 4001 will now be described using the example wherein $20 bills have been designated to be strapped with reference to FIGS. 40 and 41. A stack of bills to be processed is placed in input receptacle 102 of the processing device 4001. Bills are then fed, one by one, through a discriminating region 108 where information from passing bills is detected to, for example, denominate passing bills. Based on the information detected from a bill, that bill is directed to one of the output receptacles 106*a-h* or to the strapping unit 4050. In the present example, if the bills is determined to be a $20, it is routed to the strapping unit 4050. According to one embodiment, when the first $20 bill is detected it is routed into stacking position 4104*a*. Using a strap limit of 100 bills as an example, the next 99 $20 bills are also routed to stacking position 4104*a*. However, the $101^{st}$ $20 bills is directed to stacking position 4104*b*. The stack of 100 $20 bills are then transferred from the stacking position 4104*a* to the strapping position 4110 where the stack of 100 $20 bills is strapped with some of the strapping or banding material 4132. The strapped stack of $20 bills is then deposited into one of the strapped currency storage bins 4120*a,b*.

In the meantime, any incoming $20 bills are directed to the second stacking position 4104*b*. More specifically, the $101^{st}$ through the $200^{th}$ $20 bill sent to the strapping unit 4050 are stacked in stacking position 4104*b*. Once the $200^{th}$ $20 bill has been delivered to the second stacking position 4104*b*, the now complete stack of 100 $20 bills for stacking position 4104*b* is then transferred to the strapping position 4110 where it is strapped and then to one of the strapped currency storage bins 4120*a,b*. In the meantime, any incoming $20 bills are directed to the first stacking position 4104*a*, i.e., the $201^{st}$-$300^{th}$ $20 bills. This processed is continued with each set of hundred bills being delivered to alternating ones of the stacking positions 4104*a,b*. Such a procedure increases the throughput of the strapping unit 4050 and system 4000 as the operation the strapping unit need not be suspended while one stack of bills is being strapped.

According to some embodiments, strapped stacks of bills are deposited into a first one of the strapped currency storage bins 4120*a,b* (e.g., 4120*a*) until the bin becomes full and then strapped stacks of bills are deposited into a second one of the strapped currency storage bins 4120*a,b* (e.g., 4120*b*). According to some embodiments, when one of the strapped currency storage bins 4120*a,b* becomes full, the system 4000 alerts the operator such as via a light, displayed message on a user interface, and/or an audible signal. The operator can then empty or replace the full storage bin while the strapping unit continues to deposit strapped currency into the other storage bin. Once the first bin has been emptied or replaced with an empty bin, the strapping unit may begin depositing strapped currency into it again when the second bin becomes full. The process may be continued in this alternating manner. According to such embodiments, the strapping unit 4050 and system 4000 may continuously operate as long as the operator empties storage bins as they become full. Such a procedure increases the throughput of the strapping unit 4050 and system 4000.

Bill location sensors are positioned throughout the transport path of the processing unit 4001 and the strapping unit 4050 to monitor and keep track of the location of each bill along the transport paths of the system 4000. According to some embodiments, when the last bill in a strap (e.g., the $100^{th}$ bill) is detected by the discriminating unit 108, an appropriate signal is sent to the printer 4140 and the printer prints any desired information onto the strapping material (e.g., the denomination; a color; the total value of the strap; the date; the time; the name, number, and/or alphanumeric designation of the operator; and/or the name, number and/or alphanumeric designation of the bank such as the bank's ABA routing number. For example, for a stack of 100 $20 bills, the printer may print a violet strip or image on the banding material along with text reading "$2000, ABC Bank, B12345, Smith248, 6/4/03, 1:32 p.m." The violet color may correspond to $20 bills, "$2000" indicated the total value of the strap, the bank name is "ABC Bank"; "B12345" indicates the bank's number; "Smith248" designates the operator of the system when the strap was banded; "6/4/13" indicates that date the strap was banded—Jun. 4, 2013; and "1:32 p.m." indicates the time the strap was banded.

In some embodiments, when the last bill in a strap (e.g., the $100^{th}$ bill) reaches the strapping unit 4050 and is detected by a position sensor located, for example, in area 4160, an appropriate signal is sent to the printer 4140 and the printer prints any desired information onto the strapping material as discussed above. Alternatively, in some embodiments, when the last bill in a strap (e.g., the $100^{th}$ bill) reaches one of the strapping positions 4104*a,b* and is detected by a position sensor located, for example, in area 4262*a,b* (see FIG. 42), an appropriate signal is sent to the printer 4140 and the printer prints any desired information onto the strapping material as discussed above. Thus, according to some embodiments, information about a stack of bills to be strapped is printed on strapping material (and/or the strapping material is appropriately modified, e.g., color is added) substantially simultaneously upon the determination that a complete stack exists to be strapped and/or substantially simultaneously with the determination that a stack of bills will be sent to the strapping position (such as when a signal is provided indicating that an incomplete stack of bills is to be strapped such as when the operator desires to purge the strapping unit). According to some embodiments, information about a stack of bills to be strapped is printed on strapping material (and/or the strapping material is appropriately modified, e.g., color is added) within about a second of a determination that a complete stack exists to be strapped and/or within about a second of a determination that a stack of bills will be sent to the strapping position (such as when a signal is provided indicating that an incomplete stack of bills is to be strapped such as when the operator desires to purge the strapping unit). Thus according to some embodiments, the printer prints the stack specific information/color onto strapping material to be used to strap the stack in the same cycle—identify complete stack, print desired information/color on strapping material, and strap stack. When the next complete stack is identified in the next cycle, the printer prints any desired information/color during that next cycle.

Advantages of such embodiments include fewer purge cycles in the event of a jam and thus less wasted strapping material and less wasted time purging pre-printed strapping material. Additionally, multiple stacks, each stack having the same denomination of bills within a given stack but having different denominations from stack to stack, can be strapped with the same strapping unit. Additionally, by printing just prior to strapping a stack, there is minimal time delay of the information printed on the strapping material and time a stack is actually strapped.

Figure 42:
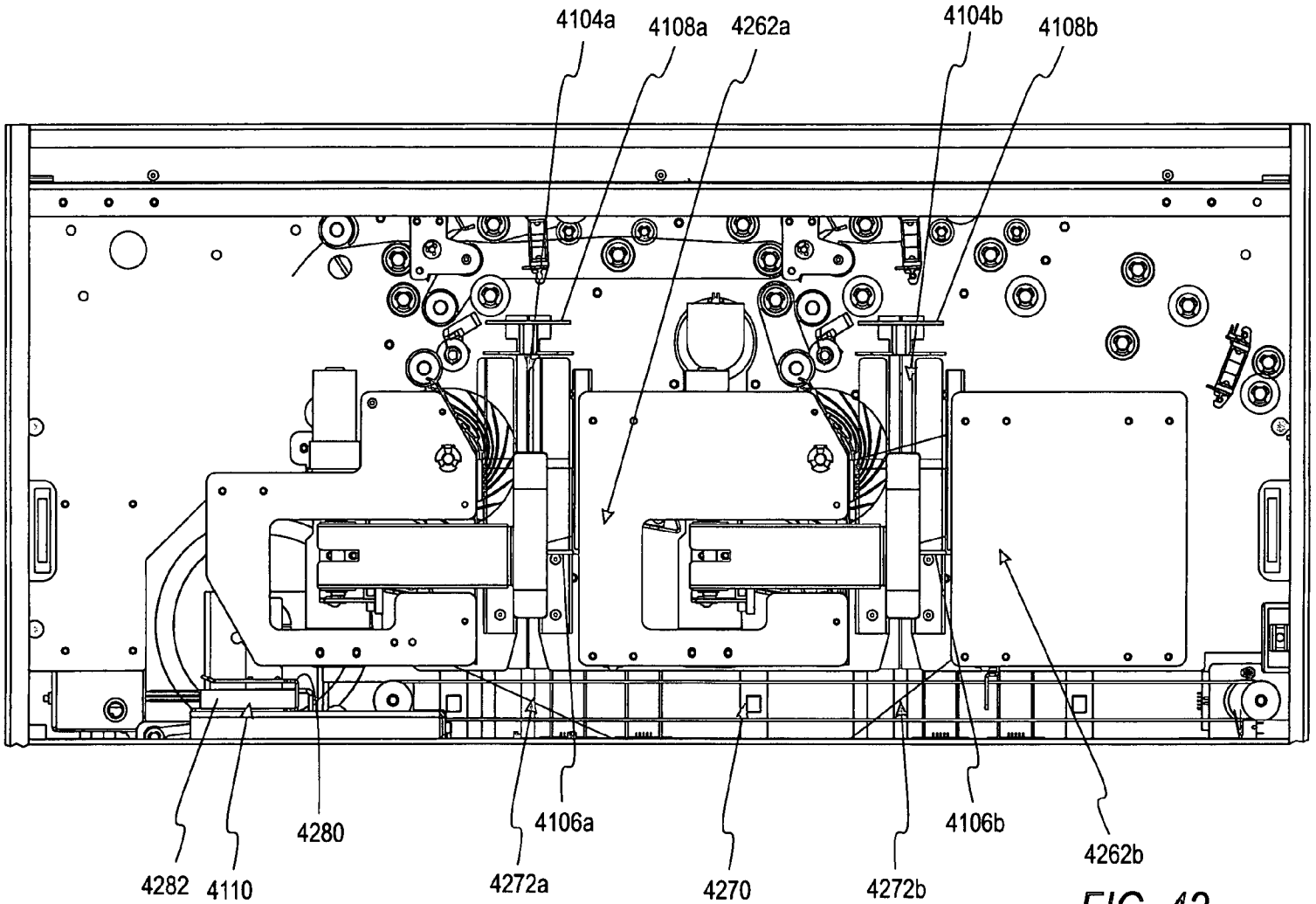
FIG. 42 is an enlarged view of a portion of a strapping unit according to one embodiment of the present invention.

Referring to FIG. 42, after the appropriate number of bills have be deposited in a stacking position 4104*a,b*, e.g., 100 bills, the stack of bills in the stacking position is lowered into the area of a raceway 4270 such as location 4272*a* or 4272*b*. A carriage 4280 then travels from right to left as seen in FIG. 42 and grabs the stack of bills 4282 to be strapped and moves them to the strapping position 4110. The bills are then strapped. After the bills have been strapped, the carriage 4280 moves back to the right carrying the strap of bills with it. A stripping flange positioned above the appropriate one of the strapped currency storage bins 4120*a,b* extends into the raceway 4270 and strips the strap of bills from the carriage as the carriage continues to move to the right. The strap of bills then falls into the appropriate one of the storage bins 4120*a,b*.

As shown in FIG. 42, each of the stacking positions 4104*a,b* include a first stacking floor 4106*a,b* and a second stacking floor 4108*a,b*. During normal operation, bills entering the stacking positions 4104*a,b* are placed on the first stacking floor 4106*a,b*. Thus, for example, a bill entering the stacking position 4104*a* is deposited on the first stacking floor 4106*a*. During normal operation the appropriate number of bills is deposited on the first stacking floor 4106*a,b* until the stack of bills is lowered into the raceway 4270 and moved to the strapping position 4110 as described above.

If a bill is misfed, such as when a bill jam occurs, the bill location sensors of the multi-pocket document processing and strapping system 4000 determine the location of the misfeed. In prior systems, when a bill misfeed occurred, all bills not yet strapped would have to be cleared from the system, including those bills that had already been evaluated. Therefore, when a misfeed occurs in the system, it is possible that hundreds to thousands of previously evaluated, but unstrapped bills would have to be transported through the system a second time, increasing the amount of time needed to evaluate the bills.

If a misfeed occurs at a position other than the stacking positions 4104*a,b* of the strapping unit 4050, the stack of bills in the stacking unit 4104*a,b* resting on the first stacking floor 4106*a,b* are lowered into the raceway 4270 such as location 4272*a* or 4272*b*. When the stack of bills resting on the first stacking floor 4106*a,b* is lowered into the raceway 4270, the second stacking floor 4108*a,b* is positioned in generally the same location as the first stacking floor 4106*a,b* is when the first stacking floor is receiving bills. All or a portion of the remaining bills located outside of the stacking positions 4104*a,b* or the output receptacles 106*a*-106*h* of the processing device 4001 within the multi-pocket document processing and strapping system 4000 are flushed to the stacking positions 4104*a,b* and placed on the second stacking floors 4108*a,b*. It is contemplated that some bills will be located within the transport path beyond a diverter used to divert bills to the strapping unit 4050, these bills will also not be flushed to the stacking positions 4104*a,b*, but rather may be flushed to one of the output receptacles 106*a*-106*h*. The remaining bills flushed to the second stacking floors 4108*a,b* are typically those bills within a transport path of the multi-pocket document processing and strapping system 4000 that have not yet passed through the discriminating region 108. By moving the second stacking floor 4108*a,b* to generally the same location as the first stacking floor 4106*a,b* when a misfeed occurs, the position sensors located at positions 4262*a,b* are able to determine if any bills rest on either of the second stacking floors 4108*a,b*. According to some embodiments, when the bills have been flushed to the second stacking floors 4108*a,b*, the system 4000 alerts the user, such as via a light, displayed message on the user interface, and/or an audible signal. A user may then remove the bills from the second stacking floors 4108*a,b* for reprocessing. Once the bills on the second stacking floor 4108*a,b* are removed, the first stacking floors 4106, *a,b* are moved back into the stacking positions 4104*a,b*, and bill processing may resume.

The multi-pocket document processing and strapping system 4000 retains the count of the number of bills previously placed on the first stacking floor 4106*a,b* by monitoring the output of the discrimination region 108 and the bill location sensors so that a proper number of additional bills may be added to the first stacking floor 4106*a,b* until the correct number of bills for a stack is reached and the stack is strapped as previously described. By avoiding the need to reprocess the bills on the first stacking floors 4106*a,b* the time needed to reconcile a batch following a misfeed is reduced.

Moving the first stacking floor 4106*a,b* to secure the bills located thereon into the raceway 4270 and placing additional bills onto the second stacking floor 4108*a,b* reduces the amount of time required to process the batch or batches of currency being processed when the jam, or other misfeed, occurs, as the bills placed on the first stacking floor 4106*a,b* do not need to be re-processed. Further, moving the first stacking floors 4106*a,b* into the raceway 4270 reduces the users access to the bills on the first stacking floors 4106*a,b*. Further, a bottom portion of the second stacking floors 4108*a,b* rests on top of the bills on the first stacking floors 4106*a,b*, further limiting the access to those bills. Not having to reprocess the bills on the first stacking floors 4106*a,b* reduces the number of bills that must be re-processed, simplifying the actions a user must perform when a jam occurs.

It is additionally contemplated that a door position sensor (not shown) is employed to determine a position of a door 4170 on the front of the stacking unit 4050 (FIG. 41*b*) to allow the system 4000 to evaluate whether the door 4170 has been opened to clear a bill jam or to remove bills from the second stacking floor 4108*a,b* of the stacking unit 4050, and whether the door 4170 has been closed. When the system 4000 determines that the door 4170 has been opened, the sensors located at positions 4262*a,b* determine that no bills remain on either of the second stacking floors 4108*a,b*, and that the door 4170 has been subsequently closed, the first stacking floors 4106*a,b* are returned to a position to receive bills, and the system 4000 resumes operation.

While the above strapping techniques and embodiments have been discussed in terms of strapping currency bills, other embodiments strap documents, "currency documents", "substitute currency media" such as casino script or Disney Dollars, "substitute currency notes", "currency notes" and/or "non-currency documents". Likewise the strapping of barcoded documents such as barcoded currency documents and barcoded substitute currency media are also contemplated.

In addition to embodiments described above or in the accompanying claims, several more embodiments of the present inventions will now be described.

Alternative Embodiment A

A document processing and strapping system comprising:

one or more output receptacles adapted to receive documents to be strapped, at least one of the one or more output receptacles having a first bill stacking surface and a second bill stacking surface; and one or more strapping units adapted to strap stacks of documents.

Alternative Embodiment B

B. A currency processing and strapping device comprising:

an input receptacle adapted to receive a stack of currency bills to be processed;

a plurality of output receptacles adapted to receive bills which have been evaluated by the device, at least one of the plurality of output receptacles having a first bill stacking surface and a second bill stacking surface;

one or more denomination detectors;

a transport mechanism adapted to transport bills, one at a time, from the input receptacle, past the one or more denomination detectors, and to the plurality of output receptacles; and a processor adapted to control the routing of the bills into the output receptacles and to keep track of how many bills having been delivered to any given output receptacle, wherein the processor is programmed to sort the bills into the output receptacles based on their detected denominations, and wherein the processor is programmed to route bills so that each output receptacle receives bills all having the same denomination, and wherein the processor is programmed to determine when the number of bills delivered to given output receptacle has reached a stack limit and thereupon to set a pocket full flag, the processor being programmed to not route any more bills into an output receptacle for which a pocket full flag has been set; and one or more strapping units for strapping stacks of bills, at least one of the strapping units being adapted to receive stacks of bills from more than one of the plurality of output receptacles.

Alternative Embodiment C

C. The device according to alternative embodiment B, further comprising a stack moving mechanism for moving a stack from one of the plurality of output receptacles to one of the strapping units after a stack limit has been reached for the one of the plurality of output receptacles.

Alternative Embodiment D

D. The device of embodiment A, wherein the stack moving mechanism comprises a conveyor belt.

Alternative Embodiment E

E. The device of embodiment D, wherein the stack moving mechanism further comprises:

a plurality of stack carrying structures attached to the conveyor belt and adapted to transport stacks of currency bills from the output receptacles to the strapping unit;

wherein the conveyor belt moves the carrying structures from loading positions to a strapping position, the conveyor belt being positioned proximate the output receptacles and the strapping unit.

Alternative Embodiment F

F. A currency processing and strapping device for strapping a stack of currency bills, each bill having a respective denomination, the device comprising:

an input receptacle adapted to receive bills to be strapped;

an evaluating unit comprising one or more detectors adapted to retrieve information from a passing bill which is used to denominate the passing bill;

a plurality of output receptacles adapted to receive the bills processed by the evaluating unit, each one of the plurality of output receptacles having a stack limit which determines how many bills will form a complete stack of bills, at least one of the plurality of output receptacles having a first stacking surface and a second stacking surface;

a transport mechanism defining a transport path between the input receptacle, past the evaluating unit, and the plurality of output receptacles, the transport mechanism being adapted to transport each bill individually along the transport path, the transport mechanism being adapted to sort the bills into the plurality of output receptacles based on the denomination of the bills as determined from the information obtained from the one or more detectors so that an individual one of the output receptacles contains bills having the same denomination;

one or more strapping units for strapping stacks of bills, each strapping unit being adapted to receive stacks of bills from at least one of the plurality of output receptacles, the stacks of bills being strapped after being placed in a strapping position; and a stack moving mechanism adapted to move a stack of bills selected for strapping from at least one of the plurality of output receptacles to the one or more strapping units;

wherein the first stacking surface of the at least one of the plurality of output receptacles is adapted to receive the bills processed by the evaluating unit during normal operations, and the second stacking surface is adapted to receive the bills within the transport mechanism when a bill misfeed is detected.

Alternative Embodiment G

G. A strapping unit for strapping stacks of bills comprising:

a plurality of output receptacles adapted to receive a plurality of bills, each one of the plurality of output receptacles having a stack limit which determines how many bills will form a complete stack of bills, at least one of the plurality of output receptacles having a first stacking surface and a second stacking surface;

a strapping position adapted to receive stacks of bills from at least one of the plurality of output receptacles, the stacks of bills being strapped after being placed in the strapping position;

a stack moving mechanism adapted to move a stack of bills selected for strapping from any of the plurality of output receptacles to the strapping position, wherein the first stacking surface of the at least one of the plurality of output receptacles is adapted to receive the bills processed by the evaluating unit during normal operations, and the second stacking surface is adapted to receive the bills within the transport mechanism when a bill misfeed is detected.

Alternative Embodiment H

H. An output receptacle for a currency handling device, the output receptacle adapted to receive a plurality of bills; the output receptacle comprising:

a first stacking surface adapted to receive a plurality of bills during normal operation of the currency handling device; and a second stacking surface adapted to receive a plurality of bills when a misfeed of the currency handling device has been detected, wherein, the second stacking surface being located above the first stacking surface during normal operation, the first stacking surface being adapted to move to from an initial position to a lower position when a misfeed is detected, the second stacking surface being adapted to move generally near the initial location of the first stacking surface when a misfeed is detected.

Alternative Embodiment I

I. A method of strapping currency bills with a strapping unit comprising the acts of:

receiving a plurality of bills within a plurality of output receptacles of a strapping unit from another device, each of the plurality of output receptacles having a first bill stacking surface and a second bill stacking surface;

monitoring whether a complete stack of bills has been received in any of the output receptacles;

moving a complete stack of bills from one of the plurality of output receptacles to a strapping position;

strapping a complete stack of bills that is placed in the strapping position;

monitoring whether a bill misfeed occurs during the act of receiving;

moving the first stacking surface from a first position to a second position and moving the second stacking surface from a third position to a position generally near to the first position of the first stacking surface when the act of monitoring indicates a bill misfeed has occurred;

retaining the stack of bills on the first stacking surface; and flushing bills not located within an output receptacle of the strapping unit that are being received from the other device to the second stacking surface.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

The invention claimed is:

1. A currency processing and strapping device for strapping a stack of currency bills, each bill having a respective denomination, the device comprising:

an input receptacle configured to receive bills to be strapped;

one or more detectors configured to retrieve information from a passing bill which is used to denominate the passing bill;

at least one strapping unit for strapping stacks of bills, the at least one strapping unit having a plurality of output receptacles configured to receive bills, each one of the plurality of output receptacles having a stack limit which determines how many bills will form a complete stack of bills, at least one of the plurality of output receptacles having a first stacking surface and a second stacking surface, the at least one strapping unit having a strapping position, the at least one strapping unit configured to strap a stacks of bills placed in the strapping position, the at least one strapping unit having a stack moving mechanism configured to move a stack of bills selected for strapping from any of the plurality of output receptacles to the strapping position; and a transport mechanism defining a transport path between the input receptacle, past the one or more detectors, and the at least one strapping unit, the transport mechanism being configured to transport each bill individually along the transport path, the transport mechanism being configured to sort the bills into the plurality of output receptacles based on the information retrieved from the one or more detectors so that an individual one of the output receptacles contains bills having the same denomination;

wherein the first stacking surface of the at least one of the plurality of output receptacles is configured to receive bills during normal operation of the device, and the second stacking surface is configured to receive bills residing within the transport mechanism when a bill misfeed is detected; and wherein the device is configured to deliver bills to the first stacking surface of the at least one of the plurality of output receptacles during normal operation of the device, and the device is configured to deliver bills residing within the transport mechanism, when a bill misfeed is detected, to the second stacking surface.

2. The device of claim 1, wherein currency processing and strapping device further comprises a plurality of misfeed detection sensors.

3. The device of claim 1, wherein the first stacking surface is located below the second stacking surface.

4. The device of claim 1, wherein the first stacking surface is lowered from a first position to a second position when a bill misfeed is detected by the device, and the second stacking surface is lowered from a third position to a position generally near to the first position of the first stacking surface when a bill misfeed is detected by the device.

5. The device of claim 4, wherein the first stacking surface second position is within the stack moving mechanism.

6. A method for processing and strapping currency bills using a currency processing and strapping device, each bill having a respective denomination, the method comprising the acts of:

receiving a plurality of bills in an input receptacle;

transporting individually the bills from the input receptacle to a plurality of output receptacles, each of the plurality of output receptacles having a first bill stacking surface and a second bill stacking surface;

determining information regarding each of the bills;

the act of transporting comprising sorting the bills into the plurality of output receptacles based on the information determined about each bill;

receiving bills sorted into an output receptacle on the first stacking surface associated with the output receptacle;

monitoring whether a complete stack of bills has been received in any of the output receptacles;

moving a complete stack of bills from one of the plurality of output receptacles to a strapping position;

strapping a complete stack of bills that is placed in the strapping position;

detecting that a bill misfeed has occurred during the act of transporting;

moving the first stacking surface of an output receptacle from a first position to a second position and moving the second stacking surface of the output receptacle from a third position to a position generally near to the first position of the first stacking surface when a bill misfeed has been detected;

retaining a stack of bills on the first stacking surface when a bill misfeed has been detected;

flushing bills not located within an output receptacle to the second stacking surface which has been moved to a position generally near the first position after a bill misfeed has been detected.

7. The method of claim 6 further comprising the acts of:

determining that bills on the second stacking surface have been removed; and resuming the act of transporting after determining the bills on the second stacking surface have been removed.

8. The method of claim 7, further comprising:

receiving in the input receptacle bills removed from the second stacking surface;

wherein the act of transporting comprises transporting bills removed from the second stacking surface and received in the input receptacle.

9. A method of processing currency bills using a currency processing and strapping device, each bill having a respective denomination, the currency processing and strapping device having an input receptacle, at least one strapping unit having a plurality of output receptacles, each of the plurality of output receptacles having a first bill stacking surface and a second bill stacking surface, the device further having a transport mechanism configured to transport each bill individually along a transport path from the input receptacle to one of the plurality of output receptacles of the at least one strapping unit, the method comprising the acts of:

transporting currency bills within the currency processing and strapping device from the input receptacle to one of the plurality of output receptacles of the at least one strapping unit;

receiving a stack of currency bills during normal operation of the device on a first bill stacking surface of an output receptacle;

detecting that a bill misfeed has occurred during the act of transporting currency bills;

moving the first stacking surface from a first position to a second position and moving a second stacking surface of the output receptacle from a third position to a position generally near to the first position of the first stacking surface when a bill misfeed has been detected;

retaining a stack of bills on the first stacking surface when a bill misfeed has been detected;

flushing bills not located within an output receptacle to the second stacking surface when a bill misfeed has been detected.

10. The method of claim 9, further comprising the acts of:

detecting that all bills on the second stacking surface have been removed;

returning the first stacking surface to the first position after detecting that all bills have been removed from the second stacking surface, the act of returning occurring without altering the stack of bills on the first stacking surface; and resuming operation of the processing and strapping device after returning the first stacking surface to the first position without reprocessing the stack of bills on the first stacking surface.

11. The method of claim 10, further comprising the act of:

processing the currency bills removed from the second stacking surface in the processing and strapping device after the act of resuming operation of the processing and strapping device.

12. The method of claim 11, further comprising adding at least one of the currency bills removed from the second stacking surface to a stack of bills on at least one of the first stacking surfaces.

13. The method of claim 10, further comprising the acts of:

detecting the status of an access panel configured to allow access to at least one of the plurality of output receptacles; and verifying that the access panel is in a closed position before the act of resuming operation of the processing and strapping device.

14. A currency processing device comprising:

an input receptacle positioned to receive bills to be processed;

a plurality of output receptacles;

a transport mechanism defining a transport path between the input receptacle and the plurality of output receptacles, the transport mechanism being configured to transport bills, one at a time, along the transport path;

one or more detectors positioned to retrieve information from bills moving along the transport path, at least one of the detectors being configured to detect if a bill misfeed occurs;

wherein the device is configured to sort bills into the plurality of output receptacles based on information retrieved by the one or more detectors;

wherein at least one of the plurality of output receptacles comprises a first stacking surface and a second stacking surface, the at least one output receptacle being configured to receive bills on the first stacking surface during normal operation of the device and being configured to receive bills on the second stacking surface after a bill misfeed occurs whereby the device is configured to deliver at least a portion of the bills located within the transport mechanism when a bill misfeed occurs to the second stacking surface while retaining bills stacked on the first stacking surface prior to the detection of a bill misfeed.

15. The device of claim 14 wherein the second stacking surface is positioned above the first stacking surface and wherein during normal operation the first stacking surface resides at a bill receiving position; and wherein after a bill misfeed, the device is configured to lower the first stacking surface below the bill receiving position together with any bills stacked thereon and to lower the second stacking surface to generally near the bill receiving position.

16. The device of claim 14 further comprising a strapping unit and wherein the at least one output receptacle comprising the first and second stacking surfaces is located in the strapping unit.

17. The device of claim 14 wherein after a bill misfeed, the device is configured to lower the first stacking surface below a bill receiving position together with any bills stacked thereon to a location at which operator access to bills stacked on the first stacking surface is reduced.

18. The device of claim 17 wherein after a bill misfeed the device is configured to position the first and second stacking surfaces such that a bottom portion of the second stacking surface rests on top of bills stacked on the first stacking surface thereby further limiting operator access to bills stacked on the first stacking surface.

19. The device of claim 18 further comprising a door having an open and a closed position, wherein when in the closed position, the door blocks operator access to bills received in the at least one of the plurality of output receptacles comprising the first and second stacking surfaces; and a door position sensor configured to detect whether the door is in the closed position;

wherein the device is configured to permit an operator to open the door after bills have been received on the second stacking surface and to thereby remove bills from the second stacking surface;

the device being further configured to detect when the door has subsequently been closed and no bills remain on the second stacking surface and thereafter to raise the first and second stacking surfaces and to cause the device to resume operation; wherein after operation has been resumed, bills subsequently directed to the at least one output receptacle are received on the first stacking surface.

20. The device of claim 14 wherein the device is configured to retain the count of the number of bills placed on the first stacking surface prior to a bill misfeed;

the device being configured to halt operation after at least a portion of the bills located within the transport mechanism when a bill misfeed occurs have been delivered to the second stacking surface;

the device being configured to permit an operator remove bills from the second stacking surface after operation of the device has halted;

the device being configured to detect when the bills on the second stacking surface have been removed;

the device being configured to resume normal operation after the bills on the second stacking surface have been removed and to subsequently deliver an additional number of bills to the first stacking surface until a predetermined total number of bills have been delivered to the first stacking surface, the total number of bills taking into account the number of bills placed on the first stacking surface prior to a bill misfeed and the additional number of bills delivered to the first stacking surface after a bill misfeed.

21. A currency processing device for strapping a stack of currency bills, each bill having a respective denomination, the device comprising:

an input receptacle configured to receive bills to be processed;

a plurality of output receptacles positioned to receive processed bills, each one of the plurality of output receptacles having a stack limit which determines how many bills will form a complete stack of bills, at least one of the plurality of output receptacles having a first stacking surface and a second stacking surface;

a transport mechanism being configured to transport bills, one at a time, from the input receptacle to the plurality of output receptacles along a transport path;

one or more detectors configured to retrieve information from bills being transported along the transport path, the information being used to denominate the bills;

wherein the transport mechanism is configured to sort the bills into the plurality of output receptacles based on the denomination of the bills as determined from the information obtained from the one or more detectors so that individual ones of the output receptacles contain bills having the same denomination;

at least one detector configured to detect if a bill misfeed occurs;

wherein the device is configured to deliver bills to the first stacking surface of the at least one of the plurality of output receptacles during normal operation; and wherein the device is configured to deliver at least some of the bills residing within the transport mechanism when a bill misfeed occurs to the second stacking surface of the at least one of the plurality of output receptacles.

22. A strapping unit for strapping stacks of bills comprising:

a transport mechanism configured to transport bills, one at a time, along a transport path to a plurality of output receptacles;

the plurality of output receptacles being configured to receive a plurality of bills, each one of the plurality of output receptacles having a stack limit which determines how many bills will form a complete stack of bills, at least one of the plurality of output receptacles having a first stacking surface and a second stacking surface;

a strapping position configured to receive stacks of bills from at least one of the plurality of output receptacles, a stack of bills being strapped after being placed in the strapping position;

a stack moving mechanism configured to move a stack of bills selected for strapping from at least one of the plurality of output receptacles to the strapping position;

wherein the strapping unit is configured to deliver bills to the first stacking surface of the at least one of the plurality of output receptacles during normal operation, and wherein the strapping unit is configured to deliver bills from the transport mechanism to the second stacking surface of the at least one of the plurality of output receptacles when a bill misfeed is detected.

23. An output receptacle of a currency handling device configured to receive a plurality of bills, the output receptacle comprising:

a first stacking surface configured to receive a plurality of bills during normal operation of the currency handling device; and a second stacking surface configured to receive a plurality of bills when a misfeed in the currency handling device has been detected;

wherein the device is configured to detect if a bill misfeed occurs;

wherein the second stacking surface is located above the first stacking surface during normal operation, wherein the device is configured to move the first stacking surface from an initial position to a lower position when a misfeed is detected, and wherein the device is configured to move the second stacking surface generally near the initial location of the first stacking surface when a misfeed is detected.

24. A method of operating a strapping unit comprising the acts of:

receiving bills in the strapping unit from another device;

transporting the bills, one at a time, to a plurality of output receptacles in the strapping unit, at least one of the plurality of output receptacles having a first bill stacking surface and a second bill stacking surface;

receiving bills in the at least one of the plurality of output receptacles having a first and second bill stacking surface, the act of receiving bills in the at least one output receptacle comprising receiving bills on the first bill stacking surface during normal operation;

monitoring whether a complete stack of bills has been received in any of the output receptacles;

moving a complete stack of bills from one of the plurality of output receptacles to a strapping position;

strapping a complete stack of bills that is placed in the strapping position;

detecting a bill misfeed; and in response to the detecting of a bill misfeed:

moving the first stacking surface from a first position to a second position and moving the second stacking surface from a third position to a position generally near the first position;

retaining a stack of bills on the first stacking surface; and flushing bills not located within an output receptacle of the strapping unit to the second stacking surface.

25. A method of processing currency bills using a currency processing device, each bill having a respective denomination, the currency processing device having an input receptacle and at least one output receptacle, the output receptacle having a first bill stacking surface and a second bill stacking surface, the device further having a transport mechanism configured to transport bills, one at a time, along a transport path from the input receptacle to the output receptacle, the method comprising the acts of:

transporting currency bills from the input receptacle to the at least one output receptacle;

receiving currency bills during normal operation of the device on the first bill stacking surface of the output receptacle;

detecting that a bill misfeed has occurred during the act of transporting currency bills;

moving the first stacking surface from a first position to a second position and moving the second stacking surface of the output receptacle from a third position to a position generally near to the first position in response to detecting that a bill misfeed has occurred;

retaining a stack of bills on the first stacking surface after detecting a bill misfeed has occurred; and flushing bills located within the transport mechanism to the second stacking surface after detecting a bill misfeed has occurred.

26. The method of claim 25, further comprising the acts of:

halting operation of the device after the act of flushing;

after the act of halting, determining that all bills on the second stacking surface have been removed from the second stacking surface;

returning the first stacking surface to the first position after determining all bills have been removed from the second stacking surface, the act of returning occurring without altering the stack of bills on the first stacking surface; and resuming operation of the device after returning the first stacking surface to the first position without reprocessing the stack of bills on the first stacking surface.

27. The method of claim 26, further comprising receiving at least one of the currency bills removed from the second stacking surface in the input receptacle and transporting the at least one of the currency bills to the first stacking surface.

28. The device of claim 14 wherein after a bill misfeed the device is configured to position the first and second stacking surfaces such that a bottom portion of the second stacking surface rests on top of bills stacked on the first stacking surface thereby further limiting operator access to bills stacked on the first stacking surface.

29. The device of claim 21 further comprising a strapping unit and wherein the at least one output receptacle having the first and second stacking surfaces is located in the strapping unit.

30. A currency processing device comprising:

an input receptacle positioned to receive bills to be processed;

a plurality of output receptacles each having a first stacking surface and a second stacking surface;

a transport mechanism defining a transport path between the input receptacle and the plurality of output receptacles, the transport mechanism being configured to transport bills, one at a time, along the transport path;

one or more detectors positioned to retrieve information from bills moving along the transport path, at least one of the detectors being configured to detect if a bill misfeed occurs;

wherein the device is configured to sort bills into the plurality of output receptacles based on information retrieved by the one or more detectors;

wherein the device is configured to deliver bills to a first stacking surface during normal operation of the device; and wherein the device is configured to deliver bills to a second stacking surface after a bill misfeed occurs while retaining bills on the first stacking surface that were delivered to the first stacking surface during normal operation.

31. The device of claim 30 wherein the second stacking surfaces are positioned above the first stacking surfaces and wherein during normal operation each first stacking surface resides at a bill receiving position; and wherein, after a bill misfeed, the device is configured to lower a first stacking surface together with any bills stacked thereon and to lower a second stacking surface to generally near a bill receiving position.

32. The device of claim 31 wherein after a bill misfeed, the device is configured to lower the first stacking surface together with any bills stacked thereon to a location at which operator access to bills stacked on the first stacking surface is reduced.

33. The device of claim 32 wherein after a bill misfeed the device is configured to position the first and second stacking surfaces such that a bottom portion of a second stacking surface rests on top of bills stacked on a first stacking surface thereby further limiting operator access to bills stacked on the first stacking surface.

34. The device of claim 31 wherein after a bill misfeed the device is configured to position the first and second stacking surfaces such that a bottom portion of a second stacking surface rests on top of bills stacked on a first stacking surface thereby further limiting operator access to bills stacked on the first stacking surface.

35. The device of claim 31 further comprising a strapping unit and wherein the plurality of output receptacles having the first and second stacking surfaces are located in the strapping unit.

36. The device of claim 30 further comprising a strapping unit and wherein the plurality of output receptacles having the first and second stacking surfaces are located in the strapping unit.

37. A currency processing device for strapping a stack of currency bills, each bill having a respective denomination, the device comprising:

an input receptacle configured to receive bills to be processed;

a plurality of output receptacles positioned to receive processed bills, each of the plurality of output receptacles having a first stacking surface and a second stacking surface;

a transport mechanism being configured to transport bills, one at a time, from the input receptacle to the plurality of output receptacles along a transport path;

one or more detectors configured to retrieve information from bills being transported along the transport path, the information being used to denominate the bills;

wherein the transport mechanism is configured to sort the bills into the plurality of output receptacles based on the denomination of the bills as determined from the information obtained from the one or more detectors so that individual ones of the output receptacles contain bills having the same denomination;

at least one detector configured to detect if a bill misfeed occurs;

wherein the device is configured to deliver bills to at least one of the first stacking surfaces during normal operation; and wherein the device is configured to deliver at least some of the bills residing within the transport mechanism when a bill misfeed occurs to at least one of the second stacking surfaces.

38. The device of claim 37 wherein the second stacking surfaces are positioned above the first stacking surfaces and wherein during normal operation each first stacking surface resides at a bill receiving position; and wherein, after a bill misfeed, the device is configured to lower a first stacking surface together with any bills stacked thereon and to lower a second stacking surface to generally near a bill receiving position.

39. The device of claim 38 wherein after a bill misfeed the device is configured to position the first and second stacking surfaces such that a bottom portion of a second stacking surface rests on top of bills stacked on a first stacking surface thereby limiting operator access to bills stacked on the first stacking surface.

40. The device of claim 39 further comprising a strapping unit and wherein the plurality of output receptacles having the first and second stacking surfaces are located in the strapping unit.

41. The device of claim 37 further comprising a strapping unit and wherein the plurality of output receptacles having the first and second stacking surfaces are located in the strapping unit.

42. A strapping unit for strapping stacks of bills comprising:

a transport mechanism configured to transport bills, one at a time, along a transport path to a plurality of output receptacles;

the plurality of output receptacles being configured to receive a plurality of bills, each one of the plurality of output receptacles having a stack limit which determines how many bills will form a complete stack of bills, each of the plurality of output receptacles having a first stacking surface and a second stacking surface;

a strapping position, a stack of bills being strapped after being placed in the strapping position;

a stack moving mechanism configured to move a stack of bills selected for strapping from at least one of the plurality of output receptacles to the strapping position;

wherein the strapping unit is configured to deliver bills to at least one of the first stacking surfaces during normal operation, and wherein the strapping unit is configured to deliver bills from the transport mechanism to at least one of the second stacking surfaces when a bill misfeed is detected by a misfeed detector.

43. The strapping unit of claim 42 wherein the second stacking surfaces are positioned above the first stacking surfaces and wherein during normal operation each first stacking surface resides at a bill receiving position; and wherein, after a bill misfeed, the device is configured to lower a first stacking surface together with any bills stacked thereon and to lower a second stacking surface to generally near a bill receiving position.

44. The strapping unit of claim 43 wherein after a bill misfeed the device is configured to position the first and second stacking surfaces such that a bottom portion of a second stacking surface rests on top of bills stacked on a first stacking surface thereby limiting operator access to bills stacked on the first stacking surface.

45. A method of operating a strapping unit comprising the acts of:

receiving bills in the strapping unit from another device;

transporting the bills, one at a time, to a plurality of output receptacles in the strapping unit, each of the plurality of output receptacles having a first bill stacking surface and a second bill stacking surface;

receiving bills on a first bill stacking surface of at least one of the plurality of output receptacles during normal operation;

monitoring whether a complete stack of bills has been received in any of the output receptacles;

moving a complete stack of bills from one of the plurality of output receptacles to a strapping position;

strapping a complete stack of bills that is placed in the strapping position; and responding to the occurrence of a bill misfeed by:

moving at least one of the first stacking surfaces from a first position to a second position while retaining a stack of bills on the at least one of the first stacking surfaces;

moving at least one of the second stacking surfaces from a third position to a position generally near a first position; and flushing bills not located within an output receptacle of the strapping unit to at least one of the second stacking surfaces.

46. A method of processing currency bills using a currency processing device, each bill having a respective denomination, the currency processing device having an input receptacle and a plurality of output receptacles, each output receptacle having a first bill stacking surface and a second bill stacking surface, the device further having a transport mechanism configured to transport bills, one at a time, along a transport path from the input receptacle to the output receptacles, the method comprising the acts of:

transporting currency bills from the input receptacle to at least one of the output receptacles;

receiving currency bills during normal operation of the device on at least one of the first bill stacking surfaces;

detecting that a bill misfeed has occurred during the act of transporting currency bills;

moving at least one of the first stacking surfaces from a first position to a second position while retaining a stack of bills on the at least one of the first stacking surfaces after detecting a bill misfeed has occurred;

moving at least one of the second stacking surfaces from a third position to a position generally near to a first position after detecting that a bill misfeed has occurred; and flushing bills located within the transport mechanism to at least one of the second stacking surfaces after detecting a bill misfeed has occurred.

* * * * *

UNITED STATES PATENT AND TRADEMARK OFFICE

CERTIFICATE OF CORRECTION

PATENT NO. : 7,779,982 B2
APPLICATION NO. : 11/517236
DATED : August 24, 2010
INVENTOR(S) : Fitzgerald et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 171 days.

Signed and Sealed this
Fifteenth Day of February, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,779,982 B2
APPLICATION NO. : 11/517236
DATED : August 24, 2010
INVENTOR(S) : Fitzgerald et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 348 days.

Signed and Sealed this
Thirteenth Day of November, 2012

David J. Kappos

David J. Kappos
*Director of the United States Patent and Trademark Office*